US007514395B2

(12) United States Patent
Bayersdoerfer et al.

(10) Patent No.: US 7,514,395 B2
(45) Date of Patent: Apr. 7, 2009

(54) DISHWASHER DETERGENTS COMPRISING SPECIFIC POLYMERS

(75) Inventors: Rolf Bayersdoerfer, Hamburg (DE); Arnd Kessler, Monheim-Baumberg (DE); Silke Menke, Haan (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 101 days.

(21) Appl. No.: 11/375,616

(22) Filed: Mar. 14, 2006

(65) Prior Publication Data

US 2007/0054833 A1 Mar. 8, 2007

Related U.S. Application Data

(63) Continuation of application No. PCT/EP2004/009887, filed on Sep. 4, 2004.

(30) Foreign Application Priority Data

Sep. 15, 2003 (DE) ..... 103 42 632

(51) Int. Cl.

| | |
|---|---|
| ***C11D 1/66*** | (2006.01) |
| ***C11D 3/34*** | (2006.01) |
| ***C11D 3/36*** | (2006.01) |
| ***C11D 3/37*** | (2006.01) |

(52) U.S. Cl. ..... 510/220; 510/222; 510/228; 510/230; 510/467; 510/475; 510/495; 510/499; 510/504

(58) Field of Classification Search ..... 510/220, 510/222, 228, 230, 467, 475, 495, 499, 504
See application file for complete search history.

(56) References Cited

U.S. PATENT DOCUMENTS

| | | | | |
|---|---|---|---|---|
| 4,749,758 | A | 6/1988 | Dursch | |
| 6,025,314 | A | 2/2000 | Nitsch | |
| 6,200,937 | B1 | 3/2001 | Perassinoto | |
| 6,326,343 | B1 * | 12/2001 | Ghatlia et al. | 510/222 |
| 6,962,898 | B2 | 11/2005 | Kessler | |
| 7,012,048 | B2 | 3/2006 | Drovetskaya et al. | |
| 2003/0158064 | A1 | 8/2003 | Kessler | |
| 2004/0005990 | A1 | 1/2004 | Aubay | |

FOREIGN PATENT DOCUMENTS

| | | | |
|---|---|---|---|
| DE | 100 32 612 | | 2/2002 |
| EP | 0 077 588 | | 4/1983 |
| EP | 0 165 452 | | 12/1985 |
| EP | 0 197 434 | | 10/1986 |
| EP | 0 405 818 | | 1/1991 |
| EP | 405818 | * | 1/1991 |
| EP | 0 664 334 | | 7/1995 |
| EP | 664334 | * | 7/1995 |
| EP | 0 851 024 | | 7/1997 |
| EP | 0 824 147 | | 2/1998 |
| EP | 0 835 925 | | 4/1998 |
| EP | 0 877 076 | | 11/1998 |
| EP | 877076 | * | 11/1998 |
| WO | WO 97/09408 | | 3/1997 |
| WO | WO 99/05248 | | 2/1999 |
| WO | WO 01/12769 | | 2/2001 |
| WO | WO 01/85890 | | 11/2001 |
| WO | WO 02/04583 | | 1/2002 |
| WO | WO 02/20709 | | 3/2002 |
| WO | WO 03/060054 | | 7/2003 |
| WO | WO 03/099980 | | 12/2003 |

OTHER PUBLICATIONS

U.S. Appl. No. 11/373,808, filed Mar. 10, 2006, Bayersdoerfer.

* cited by examiner

*Primary Examiner*—Brian P Mruk
(74) *Attorney, Agent, or Firm*—John E. Drach

(57) ABSTRACT

The present invention relates to detergents and rinse agents for machine dishwashing and to supply forms which combine detergent and rinse agent containing certain polymers in a single product comprising at least one polymer modified with phosphorus-containing groups, characterized in that the pH value of a 1% by weight solution of the anionic polymer in distilled water at 20° C. is less than pH 6.

16 Claims, No Drawings

DISHWASHER DETERGENTS COMPRISING SPECIFIC POLYMERS

CROSS REFERENCE TO RELATED APPLICATIONS

This application is a continuation under 35 U.S.C. § 365(c) and 35 U.S.C. § 120 of International Application PCT/EP2004/009887, filed Sep. 4, 2004. This application also claims priority under 35 U.S.C. § 119 of German Application DE 103 42 632.9, filed Sep. 15, 2003. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention relates to detergents and rinse aids for machine dishwashing. The invention relates, in particular, to detergents and rinse aids for machine dishwashing and to supply forms which provide detergents and rinse aids in one product and comprise certain polymers. These compositions are summarized below under the generic term "detergents for machine dishwashing" or "machine dishwasher detergents."

At present, the demands made on machine-washed dishware are frequently higher than on manually washed dishware. For instance, even dishware which has been completely cleaned of food residue will not be evaluated as impeccable when, after machine dishwashing, it still has whitish marks which are based on water hardness or other mineral salts and stem from dried-on water drops owing to lack of wetting agent.

In order to obtain sparkling and mark-free dishware, rinse aids are, therefore, used with success at present. The addition of rinse aid at the end of the washing program ensures that the water runs off substantially fully from the ware, so that the different surfaces are residue-free and flawlessly shiny at the end of the wash program.

Machine cleaning of dishware in domestic machine dishwashers typically includes a prewash cycle, a main wash cycle and a rinse cycle, which are intermitted by intermediate rinse cycles. In most machines, the prewash cycle for heavily soiled dishware can be actuated, but is only selected by the consumer in exceptional cases, so that a main wash cycle, an intermediate rinse cycle with clean water and a rinse cycle are carried out in most machines. The temperature of the main wash cycle varies, depending on the machine type and program level selection, between 40 and 65° C. In the rinse cycle, rinse aids, which typically comprise nonionic surfactants as the main constituent, are added from a dosing tank in the machine. Such rinse aids are present in liquid form and have been widely described in the prior art. Their task consists principally in preventing lime spots and films on the cleaned dishware. In addition to water and low-foaming nonionic surfactants, these rinse aids often also comprise hydrotropes, pH modifiers such as citric acid or scale-inhibiting polymers.

(2) Description of Related Art, Including Information Disclosed Under 37 C.F.R. §§ 1.97 and 1.98.

EP-B1 0 197 434 (Henkel) discloses liquid rinse aids which comprise mixed ethers as nonionic surfactants. In the machine dishwasher, a multitude of different materials (glass, metal, silver, plastic, porcelain) is cleaned. This variety of materials has to be wetted as well as possible in the rinse cycle. Rinse aid formulations which comprise exclusively mixed ethers as the surfactant component fulfill these requirements only to a slight extent, if at all, so that the rinse or drying effect is not satisfactory, especially in the case of plastic surfaces.

The reservoir tank in the machine dishwasher has to be replenished with rinse aid at regular intervals, one filling being sufficient for from 10 to 50 rinse cycles depending on the machine type. When refilling of the tank is forgotten, glasses, in particular, become visually unappealing as a result of lime spots and films. Therefore, in the prior art there exist some proposed solutions to the problem of integrating a rinse aid into the detergent for machine dishwashing. These proposed solutions are tied to the supply form of the compact tablet.

For instance, European patent application EP-A-0 851 024 (Unilever) describes two-layer detergent tablets whose first layer comprises peroxy bleaches, builders and enzyme, while the second layer comprises acidifier and a continuous medium with a melting point between 55 and 70° C., and also scale inhibitors. The high-melting continuous medium is intended to retard the release of the acid(s) and scale inhibitor (s) and bring about a rinse aid effect. There is no mention in this document of pulverulent machine dishwasher detergents or surfactant-containing rinse aid systems.

It was an object of the present invention to provide novel rinse aids which, with regard to the performance properties, provide at least the same results as rinse aids common on the market and which additionally bring further performance advantages. The novel rinse aids should be usable both as conventional rinse aids and in the form of combination products, and should develop their advantageous properties irrespective of their formulation form. Not least, the use of the novel rinse aids should also be possible in conventional detergents for machine dishwashing, i.e. the compositions should also bring performance advantages as an additive component.

BRIEF SUMMARY OF THE INVENTION

It has now been found that the use of polymers which have been modified with P-containing groups brings about advantageous effects in detergents for machine dishwashing. It is particularly advantageous when the polymers are used in the rinse cycle.

In a first embodiment, the present invention, therefore, provides a machine dishwasher detergent comprising at least one polymer which has been modified with phosphorus-containing groups, characterized in that the polymer, in 1% by weight solution in distilled water at 20° C., has a pH below 6.

DETAILED DESCRIPTION OF THE INVENTION

According to the invention, the compositions comprise at least one polymer which has P-containing groups and, in 1% by weight solution in distilled water at 20° C., has a pH below 6. These polymers may stem from different groups. Preference is given to polymers which have, as monomer units, P-containing monomers in addition to unsaturated carboxylic acids. Preference is given to polymers which additionally also comprise further ionic or nonionogenic monomers.

Preferred inventive machine dishwasher detergents comprise a polymer composed of i) unsaturated carboxylic acids ii) phosphate-containing monomers iii) optionally further ionic or nonionogenic monomers.

In the context of the present invention, preferred monomers are unsaturated carboxylic acids of formula I $$R^1(R^2)C{=}C(R^3)COOH \quad (I)$$

in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are each —COOH or —$COOR^4$ where $R^4$ is a saturated or unsaturated, straight-chain or branched hydrocarbon radical having from 1 to 12 carbon atoms.

Among the unsaturated carboxylic acids which can be described by formula I, preference is given, in particular, to acrylic acid ($R^1{=}R^2{=}R^3{=}H$), methacrylic acid ($R^1{=}R^2{=}H$; $R^3{=}CH_3$) and/or maleic acid ($R^1{=}COOH$; $R^2{=}R^3{=}H$).

The phosphate-containing monomers can be described by formula II $$R^5(R^6)C{=}C(R^7)—X—PO_4H \quad (II)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are each —COOH or —$COOR^4$ where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—CH$(CH_2CH_3)$—.

Among these monomers, preference is given to those of formulas IIa, IIb and/or IIc $$H_2C{=}CH—X—PO_4H \quad (IIa)$$

$$H_2C{=}C(CH_3)—X—PO_4H \quad (IIb)$$

$$HO_4P—X—(R^6)C{=}C(R^7)—X—PO_4H \quad (IIc)$$

in which $R^6$ and $R^7$ are each independently selected from —H, —$CH_3$, —$CH_2CH_3$, —$CH_2CH_2CH_3$, —$CH(CH_3)_2$, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Further preferred monomers with their $R^5$, $R^6$ and $R^7$ radicals and also the spacer groups X are compiled in the table which follows:

| No. | $R^5$ | $R^6$ | $R^7$ | X |
|---|---|---|---|---|
| 1 | —H | —H | —H | — |
| 2 | —$CH_3$ | —H | —H | — |
| 3 | —$CH_2$—$CH_3$ | —H | —H | — |
| 4 | —$CH_2$—$CH_2$—$CH_3$ | —H | —H | — |
| 5 | —$CH(CH_3)$—$CH_3$ | —H | —H | — |
| 6 | —$CH_2$—OH | —H | —H | — |
| 7 | —$CH_2$—$CH_2$—OH | —H | —H | — |
| 8 | —CH(OH)—$CH_3$ | —H | —H | — |
| 9 | —$CH_2$—$CH_2$—$CH_2$—OH | —H | —H | — |
| 10 | —$CH_2$—CH(OH)—$CH_3$ | —H | —H | — |
| 11 | —CH(OH)—$CH_2$—$CH_3$ | —H | —H | — |
| 12 | —H | —H | —$CH_3$ | — |
| 13 | —$CH_3$ | —H | —$CH_3$ | — |
| 14 | —$CH_2$—$CH_3$ | —H | —$CH_3$ | — |
| 15 | —$CH_2$—$CH_2$—$CH_3$ | —H | —$CH_3$ | — |
| 16 | —$CH(CH_3)$—$CH_3$ | —H | —$CH_3$ | — |
| 17 | —$CH_2$—OH | —H | —$CH_3$ | — |
| 18 | —$CH_2$—$CH_2$—OH | —H | —$CH_3$ | — |
| 19 | —CH(OH)—$CH_3$ | —H | —$CH_3$ | — |
| 20 | —$CH_2$—$CH_2$—$CH_2$—OH | —H | —$CH_3$ | — |
| 21 | —$CH_2$—CH(OH)—$CH_3$ | —H | —$CH_3$ | — |
| 22 | —CH(OH)—$CH_2$—$CH_3$ | —H | —$CH_3$ | — |
| 23 | —H | —H | —$CH_2$—$CH_3$ | — |
| 24 | —$CH_3$ | —H | —$CH_2$—$CH_3$ | — |
| 25 | —$CH_2$—$CH_3$ | —H | —$CH_2$—$CH_3$ | — |
| 26 | —$CH_2$—$CH_2$—$CH_3$ | —H | —$CH_2$—$CH_3$ | — |
| 27 | —$CH(CH_3)$—$CH_3$ | —H | —$CH_2$—$CH_3$ | — |
| 28 | —$CH_2$—OH | —H | —$CH_2$—$CH_3$ | — |
| 29 | —$CH_2$—$CH_2$—OH | —H | —$CH_2$—$CH_3$ | — |
| 30 | —CH(OH)—$CH_3$ | —H | —$CH_2$—$CH_3$ | — |
| 31 | —$CH_2$—$CH_2$—$CH_2$—OH | —H | —$CH_2$—$CH_3$ | — |
| 32 | —$CH_2$—CH(OH)—$CH_3$ | —H | —$CH_2$—$CH_3$ | — |
| 33 | —CH(OH)—$CH_2$—$CH_3$ | —H | —$CH_2$—$CH_3$ | — |
| 34 | —H | —H | —$CH_2$—$CH_2$—$CH_3$ | — |
| 35 | —$CH_3$ | —H | —$CH_2$—$CH_2$—$CH_3$ | — |
| 36 | —$CH_2$—$CH_3$ | —H | —$CH_2$—$CH_2$—$CH_3$ | — |
| 37 | —$CH_2$—$CH_2$—$CH_3$ | —H | —$CH_2$—$CH_2$—$CH_3$ | — |
| 38 | —$CH(CH_3)$—$CH_3$ | —H | —$CH_2$—$CH_2$—$CH_3$ | — |
| 39 | —$CH_2$—OH | —H | —$CH_2$—$CH_2$—$CH_3$ | — |

-continued

| No. | $R^5$ | $R^6$ | $R^7$ | X |
|---|---|---|---|---|
| 40 | —$CH_2$—$CH_2$—OH | —H | —$CH_2$—$CH_2$—$CH_3$ | — |
| 41 | —CH(OH)—$CH_3$ | —H | —$CH_2$—$CH_2$—$CH_3$ | — |
| 42 | —$CH_2$—$CH_2$—$CH_2$—OH | —H | —$CH_2$—$CH_2$—$CH_3$ | — |
| 43 | —$CH_2$—CH(OH)—$CH_3$ | —H | —$CH_2$—$CH_2$—$CH_3$ | — |
| 44 | —CH(OH)—$CH_2$—$CH_3$ | —H | —$CH_2$—$CH_2$—$CH_3$ | — |
| 45 | —H | —H | —CH($CH_3$)—$CH_3$ | — |
| 46 | —$CH_3$ | —H | —CH($CH_3$)—$CH_3$ | — |
| 47 | —$CH_2$—$CH_3$ | —H | —CH($CH_3$)—$CH_3$ | — |
| 48 | —$CH_2$—$CH_2$—$CH_3$ | —H | —CH($CH_3$)—$CH_3$ | — |
| 49 | —CH($CH_3$)—$CH_3$ | —H | —CH($CH_3$)—$CH_3$ | — |
| 50 | —$CH_2$—OH | —H | —CH($CH_3$)—$CH_3$ | — |
| 51 | —$CH_2$—$CH_2$—OH | —H | —CH($CH_3$)—$CH_3$ | — |
| 52 | —CH(OH)—$CH_3$ | —H | —CH($CH_3$)—$CH_3$ | — |
| 53 | —$CH_2$—$CH_2$—$CH_2$—OH | —H | —CH($CH_3$)—$CH_3$ | — |
| 54 | —$CH_2$—CH(OH)—$CH_3$ | —H | —CH($CH_3$)—$CH_3$ | — |
| 55 | —CH(OH)—$CH_2$—$CH_3$ | —H | —CH($CH_3$)—$CH_3$ | — |
| 56 | —H | —$CH_3$ | —H | — |
| 57 | —$CH_3$ | —$CH_3$ | —H | — |
| 58 | —$CH_2$—$CH_3$ | —$CH_3$ | —H | — |
| 59 | —$CH_2$—$CH_2$—$CH_3$ | —$CH_3$ | —H | — |
| 60 | —CH($CH_3$)—$CH_3$ | —$CH_3$ | —H | — |
| 61 | —$CH_2$—OH | —$CH_3$ | —H | — |
| 62 | —$CH_2$—$CH_2$—OH | —$CH_3$ | —H | — |
| 63 | —CH(OH)—$CH_3$ | —$CH_3$ | —H | — |
| 64 | —$CH_2$—$CH_2$—$CH_2$—OH | —$CH_3$ | —H | — |
| 65 | —$CH_2$—CH(OH)—$CH_3$ | —$CH_3$ | —H | — |
| 66 | —CH(OH)—$CH_2$—$CH_3$ | —$CH_3$ | —H | — |
| 67 | —H | —$CH_3$ | —$CH_3$ | — |
| 68 | —$CH_3$ | —$CH_3$ | —$CH_3$ | — |
| 69 | —$CH_2$—$CH_3$ | —$CH_3$ | —$CH_3$ | — |
| 70 | —$CH_2$—$CH_2$—$CH_3$ | —$CH_3$ | —$CH_3$ | — |
| 71 | —CH($CH_3$)—$CH_3$ | —$CH_3$ | —$CH_3$ | — |
| 72 | —$CH_2$—OH | —$CH_3$ | —$CH_3$ | — |
| 73 | —$CH_2$—$CH_2$—OH | —$CH_3$ | —$CH_3$ | — |
| 74 | —CH(OH)—$CH_3$ | —$CH_3$ | —$CH_3$ | — |
| 75 | —$CH_2$—$CH_2$—$CH_2$—OH | —$CH_3$ | —$CH_3$ | — |
| 76 | —$CH_2$—CH(OH)—$CH_3$ | —$CH_3$ | —$CH_3$ | — |
| 77 | —CH(OH)—$CH_2$—$CH_3$ | —$CH_3$ | —$CH_3$ | — |
| 78 | —H | —$CH_3$ | —$CH_2$—$CH_3$ | — |
| 79 | —$CH_3$ | —$CH_3$ | —$CH_2$—$CH_3$ | — |
| 80 | —$CH_2$—$CH_3$ | —$CH_3$ | —$CH_2$—$CH_3$ | — |
| 81 | —$CH_2$—$CH_2$—$CH_3$ | —$CH_3$ | —$CH_2$—$CH_3$ | — |
| 82 | —CH($CH_3$)—$CH_3$ | —$CH_3$ | —$CH_2$—$CH_3$ | — |
| 83 | —$CH_2$—OH | —$CH_3$ | —$CH_2$—$CH_3$ | — |
| 84 | —$CH_2$—$CH_2$—OH | —$CH_3$ | —$CH_2$—$CH_3$ | — |
| 85 | —CH(OH)—$CH_3$ | —$CH_3$ | —$CH_2$—$CH_3$ | — |
| 86 | —$CH_2$—$CH_2$—$CH_2$—OH | —$CH_3$ | —$CH_2$—$CH_3$ | — |
| 87 | —$CH_2$—CH(OH)—$CH_3$ | —$CH_3$ | —$CH_2$—$CH_3$ | — |
| 88 | —CH(OH)—$CH_2$—$CH_3$ | —$CH_3$ | —$CH_2$—$CH_3$ | — |
| 89 | —H | —$CH_3$ | —$CH_2$—$CH_2$—$CH_3$ | — |
| 90 | —$CH_3$ | —$CH_3$ | —$CH_2$—$CH_2$—$CH_3$ | — |
| 91 | —$CH_2$—$CH_3$ | —$CH_3$ | —$CH_2$—$CH_2$—$CH_3$ | — |
| 92 | —$CH_2$—$CH_2$—$CH_3$ | —$CH_3$ | —$CH_2$—$CH_2$—$CH_3$ | — |
| 93 | —CH($CH_3$)—$CH_3$ | —$CH_3$ | —$CH_2$—$CH_2$—$CH_3$ | — |
| 94 | —$CH_2$—OH | —$CH_3$ | —$CH_2$—$CH_2$—$CH_3$ | — |
| 95 | —$CH_2$—$CH_2$—OH | —$CH_3$ | —$CH_2$—$CH_2$—$CH_3$ | — |
| 96 | —CH(OH)—$CH_3$ | —$CH_3$ | —$CH_2$—$CH_2$—$CH_3$ | — |
| 97 | —$CH_2$—$CH_2$—$CH_2$—OH | —$CH_3$ | —$CH_2$—$CH_2$—$CH_3$ | — |
| 98 | —$CH_2$—CH(OH)—$CH_3$ | —$CH_3$ | —$CH_2$—$CH_2$—$CH_3$ | — |
| 99 | —CH(OH)—$CH_2$—$CH_3$ | —$CH_3$ | —$CH_2$—$CH_2$—$CH_3$ | — |
| 100 | —H | —$CH_3$ | —CH($CH_3$)—$CH_3$ | — |
| 101 | —$CH_3$ | —$CH_3$ | —CH($CH_3$)—$CH_3$ | — |
| 102 | —$CH_2$—$CH_3$ | —$CH_3$ | —CH($CH_3$)—$CH_3$ | — |
| 103 | —$CH_2$—$CH_2$—$CH_3$ | —$CH_3$ | —CH($CH_3$)—$CH_3$ | — |
| 104 | —CH($CH_3$)—$CH_3$ | —$CH_3$ | —CH($CH_3$)—$CH_3$ | — |
| 105 | —$CH_2$—OH | —$CH_3$ | —CH($CH_3$)—$CH_3$ | — |
| 106 | —$CH_2$—$CH_2$—OH | —$CH_3$ | —CH($CH_3$)—$CH_3$ | — |
| 107 | —CH(OH)—$CH_3$ | —$CH_3$ | —CH($CH_3$)—$CH_3$ | — |
| 108 | —$CH_2$—$CH_2$—$CH_2$—OH | —$CH_3$ | —CH($CH_3$)—$CH_3$ | — |
| 109 | —$CH_2$—CH(OH)—$CH_3$ | —$CH_3$ | —CH($CH_3$)—$CH_3$ | — |
| 110 | —CH(OH)—$CH_2$—$CH_3$ | —$CH_3$ | —CH($CH_3$)—$CH_3$ | — |
| 111 | —H | —$CH_2$—$CH_3$ | —H | — |
| 112 | —$CH_3$ | —$CH_2$—$CH_3$ | —H | — |
| 113 | —$CH_2$—$CH_3$ | —$CH_2$—$CH_3$ | —H | — |
| 114 | —$CH_2$—$CH_2$—$CH_3$ | —$CH_2$—$CH_3$ | —H | — |
| 115 | —CH($CH_3$)—$CH_3$ | —$CH_2$—$CH_3$ | —H | — |
| 116 | —$CH_2$—OH | —$CH_2$—$CH_3$ | —H | — |

-continued

| No. | $R^5$ | $R^6$ | $R^7$ | X |
|---|---|---|---|---|
| 117 | —$CH_2$—$CH_2$—OH | —$CH_2$—$CH_3$ | —H | — |
| 118 | —CH(OH)—$CH_3$ | —$CH_2$—$CH_3$ | —H | — |
| 119 | —$CH_2$—$CH_2$—$CH_2$—OH | —$CH_2$—$CH_3$ | —H | — |
| 120 | —$CH_2$—CH(OH)—$CH_3$ | —$CH_2$—$CH_3$ | —H | — |
| 121 | —CH(OH)—$CH_2$—$CH_3$ | —$CH_2$—$CH_3$ | —H | — |
| 122 | —H | —$CH_2$—$CH_3$ | —$CH_3$ | — |
| 123 | —$CH_3$ | —$CH_2$—$CH_3$ | —$CH_3$ | — |
| 124 | —$CH_2$—$CH_3$ | —$CH_2$—$CH_3$ | —$CH_3$ | — |
| 125 | —$CH_2$—$CH_2$—$CH_3$ | —$CH_2$—$CH_3$ | —$CH_3$ | — |
| 126 | —CH($CH_3$)—$CH_3$ | —$CH_2$—$CH_3$ | —$CH_3$ | — |
| 127 | —$CH_2$—OH | —$CH_2$—$CH_3$ | —$CH_3$ | — |
| 128 | —$CH_2$—$CH_2$—OH | —$CH_2$—$CH_3$ | —$CH_3$ | — |
| 129 | —CH(OH)—$CH_3$ | —$CH_2$—$CH_3$ | —$CH_3$ | — |
| 130 | —$CH_2$—$CH_2$—$CH_2$—OH | —$CH_2$—$CH_3$ | —$CH_3$ | — |
| 131 | —$CH_2$—CH(OH)—$CH_3$ | —$CH_2$—$CH_3$ | —$CH_3$ | — |
| 132 | —CH(OH)—$CH_2$—$CH_3$ | —$CH_2$—$CH_3$ | —$CH_3$ | — |
| 133 | —H | —$CH_2$—$CH_3$ | —$CH_2$—$CH_3$ | — |
| 134 | —$CH_3$ | —$CH_2$—$CH_3$ | —$CH_2$—$CH_3$ | — |
| 135 | —$CH_2$—$CH_3$ | —$CH_2$—$CH_3$ | —$CH_2$—$CH_3$ | — |
| 136 | —$CH_2$—$CH_2$—$CH_3$ | —$CH_2$—$CH_3$ | —$CH_2$—$CH_3$ | — |
| 137 | —CH($CH_3$)—$CH_3$ | —$CH_2$—$CH_3$ | —$CH_2$—$CH_3$ | — |
| 138 | —$CH_2$—OH | —$CH_2$—$CH_3$ | —$CH_2$—$CH_3$ | — |
| 139 | —$CH_2$—$CH_2$—OH | —$CH_2$—$CH_3$ | —$CH_2$—$CH_3$ | — |
| 140 | —CH(OH)—$CH_3$ | —$CH_2$—$CH_3$ | —$CH_2$—$CH_3$ | — |
| 141 | —$CH_2$—$CH_2$—$CH_2$—OH | —$CH_2$—$CH_3$ | —$CH_2$—$CH_3$ | — |
| 142 | —$CH_2$—CH(OH)—$CH_3$ | —$CH_2$—$CH_3$ | —$CH_2$—$CH_3$ | — |
| 143 | —CH(OH)—$CH_2$—$CH_3$ | —$CH_2$—$CH_3$ | —$CH_2$—$CH_3$ | — |
| 144 | —H | —$CH_2$—$CH_3$ | —$CH_2$—$CH_2$—$CH_3$ | — |
| 145 | —$CH_3$ | —$CH_2$—$CH_3$ | —$CH_2$—$CH_2$—$CH_3$ | — |
| 146 | —$CH_2$—$CH_3$ | —$CH_2$—$CH_3$ | —$CH_2$—$CH_2$—$CH_3$ | — |
| 147 | —$CH_2$—$CH_2$—$CH_3$ | —$CH_2$—$CH_3$ | —$CH_2$—$CH_2$—$CH_3$ | — |
| 148 | —CH($CH_3$)—$CH_3$ | —$CH_2$—$CH_3$ | —$CH_2$—$CH_2$—$CH_3$ | — |
| 149 | —$CH_2$—OH | —$CH_2$—$CH_3$ | —$CH_2$—$CH_2$—$CH_3$ | — |
| 150 | —$CH_2$—$CH_2$—OH | —$CH_2$—$CH_3$ | —$CH_2$—$CH_2$—$CH_3$ | — |
| 151 | —CH(OH)—$CH_3$ | —$CH_2$—$CH_3$ | —$CH_2$—$CH_2$—$CH_3$ | — |
| 152 | —$CH_2$—$CH_2$—$CH_2$—OH | —$CH_2$—$CH_3$ | —$CH_2$—$CH_2$—$CH_3$ | — |
| 153 | —$CH_2$—CH(OH)—$CH_3$ | —$CH_2$—$CH_3$ | —$CH_2$—$CH_2$—$CH_3$ | — |
| 154 | —CH(OH)—$CH_2$—$CH_3$ | —$CH_2$—$CH_3$ | —$CH_2$—$CH_2$—$CH_3$ | — |
| 155 | —H | —$CH_2$—$CH_3$ | —CH($CH_3$)—$CH_3$ | — |
| 156 | —$CH_3$ | —$CH_2$—$CH_3$ | —CH($CH_3$)—$CH_3$ | — |
| 157 | —$CH_2$—$CH_3$ | —$CH_2$—$CH_3$ | —CH($CH_3$)—$CH_3$ | — |
| 158 | —$CH_2$—$CH_2$—$CH_3$ | —$CH_2$—$CH_3$ | —CH($CH_3$)—$CH_3$ | — |
| 159 | —CH($CH_3$)—$CH_3$ | —$CH_2$—$CH_3$ | —CH($CH_3$)—$CH_3$ | — |
| 160 | —$CH_2$—OH | —$CH_2$—$CH_3$ | —CH($CH_3$)—$CH_3$ | — |
| 161 | —$CH_2$—$CH_2$—OH | —$CH_2$—$CH_3$ | —CH($CH_3$)—$CH_3$ | — |
| 162 | —CH(OH)—$CH_3$ | —$CH_2$—$CH_3$ | —CH($CH_3$)—$CH_3$ | — |
| 163 | —$CH_2$—$CH_2$—$CH_2$—OH | —$CH_2$—$CH_3$ | —CH($CH_3$)—$CH_3$ | — |
| 164 | —$CH_2$—CH(OH)—$CH_3$ | —$CH_2$—$CH_3$ | —CH($CH_3$)—$CH_3$ | — |
| 165 | —CH(OH)—$CH_2$—$CH_3$ | —$CH_2$—$CH_3$ | —CH($CH_3$)—$CH_3$ | — |
| 166 | —H | —$CH_2$—$CH_2$—$CH_3$ | —H | — |
| 167 | —$CH_3$ | —$CH_2$—$CH_2$—$CH_3$ | —H | — |
| 168 | —$CH_2$—$CH_3$ | —$CH_2$—$CH_2$—$CH_3$ | —H | — |
| 169 | —$CH_2$—$CH_2$—$CH_3$ | —$CH_2$—$CH_2$—$CH_3$ | —H | — |
| 170 | —CH($CH_3$)—$CH_3$ | —$CH_2$—$CH_2$—$CH_3$ | —H | — |
| 171 | —$CH_2$—OH | —$CH_2$—$CH_2$—$CH_3$ | —H | — |
| 172 | —$CH_2$—$CH_2$—OH | —$CH_2$—$CH_2$—$CH_3$ | —H | — |
| 173 | —CH(OH)—$CH_3$ | —$CH_2$—$CH_2$—$CH_3$ | —H | — |
| 174 | —$CH_2$—$CH_2$—$CH_2$—OH | —$CH_2$—$CH_2$—$CH_3$ | —H | — |
| 175 | —$CH_2$—CH(OH)—$CH_3$ | —$CH_2$—$CH_2$—$CH_3$ | —H | — |
| 176 | —CH(OH)—$CH_2$—$CH_3$ | —$CH_2$—$CH_2$—$CH_3$ | —H | — |
| 177 | —H | —$CH_2$—$CH_2$—$CH_3$ | —$CH_3$ | — |
| 178 | —$CH_3$ | —$CH_2$—$CH_2$—$CH_3$ | —$CH_3$ | — |
| 179 | —$CH_2$—$CH_3$ | —$CH_2$—$CH_2$—$CH_3$ | —$CH_3$ | — |
| 180 | —$CH_2$—$CH_2$—$CH_3$ | —$CH_2$—$CH_2$—$CH_3$ | —$CH_3$ | — |
| 181 | —CH($CH_3$)—$CH_3$ | —$CH_2$—$CH_2$—$CH_3$ | —$CH_3$ | — |
| 182 | —$CH_2$—OH | —$CH_2$—$CH_2$—$CH_3$ | —$CH_3$ | — |
| 183 | —$CH_2$—$CH_2$—OH | —$CH_2$—$CH_2$—$CH_3$ | —$CH_3$ | — |
| 184 | —CH(OH)—$CH_3$ | —$CH_2$—$CH_2$—$CH_3$ | —$CH_3$ | — |
| 185 | —$CH_2$—$CH_2$—$CH_2$—OH | —$CH_2$—$CH_2$—$CH_3$ | —$CH_3$ | — |
| 186 | —$CH_2$—CH(OH)—$CH_3$ | —$CH_2$—$CH_2$—$CH_3$ | —$CH_3$ | — |
| 187 | —CH(OH)—$CH_2$—$CH_3$ | —$CH_2$—$CH_2$—$CH_3$ | —$CH_3$ | — |
| 188 | —H | —$CH_2$—$CH_2$—$CH_3$ | —$CH_2$—$CH_3$ | — |
| 189 | —$CH_3$ | —$CH_2$—$CH_2$—$CH_3$ | —$CH_2$—$CH_3$ | — |
| 190 | —$CH_2$—$CH_3$ | —$CH_2$—$CH_2$—$CH_3$ | —$CH_2$—$CH_3$ | — |
| 191 | —$CH_2$—$CH_2$—$CH_3$ | —$CH_2$—$CH_2$—$CH_3$ | —$CH_2$—$CH_3$ | — |
| 192 | —CH($CH_3$)—$CH_3$ | —$CH_2$—$CH_2$—$CH_3$ | —$CH_2$—$CH_3$ | — |
| 193 | —$CH_2$—OH | —$CH_2$—$CH_2$—$CH_3$ | —$CH_2$—$CH_3$ | — |

-continued

| No. | $R^5$ | $R^6$ | $R^7$ | X |
|---|---|---|---|---|
| 194 | —$CH_2$—$CH_2$—OH | —$CH_2$—$CH_2$—$CH_3$ | —$CH_2$—$CH_3$ | — |
| 195 | —CH(OH)—$CH_3$ | —$CH_2$—$CH_2$—$CH_3$ | —$CH_2$—$CH_3$ | — |
| 196 | —$CH_2$—$CH_2$—$CH_2$—OH | —$CH_2$—$CH_2$—$CH_3$ | —$CH_2$—$CH_3$ | — |
| 197 | —$CH_2$—CH(OH)—$CH_3$ | —$CH_2$—$CH_2$—$CH_3$ | —$CH_2$—$CH_3$ | — |
| 198 | —CH(OH)—$CH_2$—$CH_3$ | —$CH_2$—$CH_2$—$CH_3$ | —$CH_2$—$CH_3$ | — |
| 199 | —H | —$CH_2$—$CH_2$—$CH_3$ | —$CH_2$—$CH_2$—$CH_3$ | — |
| 200 | —$CH_3$ | —$CH_2$—$CH_2$—$CH_3$ | —$CH_2$—$CH_2$—$CH_3$ | — |
| 201 | —$CH_2$—$CH_3$ | —$CH_2$—$CH_2$—$CH_3$ | —$CH_2$—$CH_2$—$CH_3$ | — |
| 202 | —$CH_2$—$CH_2$—$CH_3$ | —$CH_2$—$CH_2$—$CH_3$ | —$CH_2$—$CH_2$—$CH_3$ | — |
| 203 | —$CH(CH_3)$—$CH_3$ | —$CH_2$—$CH_2$—$CH_3$ | —$CH_2$—$CH_2$—$CH_3$ | — |
| 204 | —$CH_2$—OH | —$CH_2$—$CH_2$—$CH_3$ | —$CH_2$—$CH_2$—$CH_3$ | — |
| 205 | —$CH_2$—$CH_2$—OH | —$CH_2$—$CH_2$—$CH_3$ | —$CH_2$—$CH_2$—$CH_3$ | — |
| 206 | —CH(OH)—$CH_3$ | —$CH_2$—$CH_2$—$CH_3$ | —$CH_2$—$CH_2$—$CH_3$ | — |
| 207 | —$CH_2$—$CH_2$—$CH_2$—OH | —$CH_2$—$CH_2$—$CH_3$ | —$CH_2$—$CH_2$—$CH_3$ | — |
| 208 | —$CH_2$—CH(OH)—$CH_3$ | —$CH_2$—$CH_2$—$CH_3$ | —$CH_2$—$CH_2$—$CH_3$ | — |
| 209 | —CH(OH)—$CH_2$—$CH_3$ | —$CH_2$—$CH_2$—$CH_3$ | —$CH_2$—$CH_2$—$CH_3$ | — |
| 210 | —H | —$CH_2$—$CH_2$—$CH_3$ | —$CH(CH_3)$—$CH_3$ | — |
| 211 | —$CH_3$ | —$CH_2$—$CH_2$—$CH_3$ | —$CH(CH_3)$—$CH_3$ | — |
| 212 | —$CH_2$—$CH_3$ | —$CH_2$—$CH_2$—$CH_3$ | —$CH(CH_3)$—$CH_3$ | — |
| 213 | —$CH_2$—$CH_2$—$CH_3$ | —$CH_2$—$CH_2$—$CH_3$ | —$CH(CH_3)$—$CH_3$ | — |
| 214 | —$CH(CH_3)$—$CH_3$ | —$CH_2$—$CH_2$—$CH_3$ | —$CH(CH_3)$—$CH_3$ | — |
| 215 | —$CH_2$—OH | —$CH_2$—$CH_2$—$CH_3$ | —$CH(CH_3)$—$CH_3$ | — |
| 216 | —$CH_2$—$CH_2$—OH | —$CH_2$—$CH_2$—$CH_3$ | —$CH(CH_3)$—$CH_3$ | — |
| 217 | —CH(OH)—$CH_3$ | —$CH_2$—$CH_2$—$CH_3$ | —$CH(CH_3)$—$CH_3$ | — |
| 218 | —$CH_2$—$CH_2$—$CH_2$—OH | —$CH_2$—$CH_2$—$CH_3$ | —$CH(CH_3)$—$CH_3$ | — |
| 219 | —$CH_2$—CH(OH)—$CH_3$ | —$CH_2$—$CH_2$—$CH_3$ | —$CH(CH_3)$—$CH_3$ | — |
| 220 | —CH(OH)—$CH_2$—$CH_3$ | —$CH_2$—$CH_2$—$CH_3$ | —$CH(CH_3)$—$CH_3$ | — |
| 221 | —H | —$CH(CH_3)$—$CH_3$ | —H | — |
| 222 | —$CH_3$ | —$CH(CH_3)$—$CH_3$ | —H | — |
| 223 | —$CH_2$—$CH_3$ | —$CH(CH_3)$—$CH_3$ | —H | — |
| 224 | —$CH_2$—$CH_2$—$CH_3$ | —$CH(CH_3)$—$CH_3$ | —H | — |
| 225 | —$CH(CH_3)$—$CH_3$ | —$CH(CH_3)$—$CH_3$ | —H | — |
| 226 | —$CH_2$—OH | —$CH(CH_3)$—$CH_3$ | —H | — |
| 227 | —$CH_2$—$CH_2$—OH | —$CH(CH_3)$—$CH_3$ | —H | — |
| 228 | —CH(OH)—$CH_3$ | —$CH(CH_3)$—$CH_3$ | —H | — |
| 229 | —$CH_2$—$CH_2$—$CH_2$—OH | —$CH(CH_3)$—$CH_3$ | —H | — |
| 230 | —$CH_2$—CH(OH)—$CH_3$ | —$CH(CH_3)$—$CH_3$ | —H | — |
| 231 | —CH(OH)—$CH_2$—$CH_3$ | —$CH(CH_3)$—$CH_3$ | —H | — |
| 232 | —H | —$CH(CH_3)$—$CH_3$ | —$CH_3$ | — |
| 233 | —$CH_3$ | —$CH(CH_3)$—$CH_3$ | —$CH_3$ | — |
| 234 | —$CH_2$—$CH_3$ | —$CH(CH_3)$—$CH_3$ | —$CH_3$ | — |
| 235 | —$CH_2$—$CH_2$—$CH_3$ | —$CH(CH_3)$—$CH_3$ | —$CH_3$ | — |
| 236 | —$CH(CH_3)$—$CH_3$ | —$CH(CH_3)$—$CH_3$ | —$CH_3$ | — |
| 237 | —$CH_2$—OH | —$CH(CH_3)$—$CH_3$ | —$CH_3$ | — |
| 238 | —$CH_2$—$CH_2$—OH | —$CH(CH_3)$—$CH_3$ | —$CH_3$ | — |
| 239 | —CH(OH)—$CH_3$ | —$CH(CH_3)$—$CH_3$ | —$CH_3$ | — |
| 240 | —$CH_2$—$CH_2$—$CH_2$—OH | —$CH(CH_3)$—$CH_3$ | —$CH_3$ | — |
| 241 | —$CH_2$—CH(OH)—$CH_3$ | —$CH(CH_3)$—$CH_3$ | —$CH_3$ | — |
| 242 | —CH(OH)—$CH_2$—$CH_3$ | —$CH(CH_3)$—$CH_3$ | —$CH_3$ | — |
| 243 | —H | —$CH(CH_3)$—$CH_3$ | —$CH_2$—$CH_3$ | — |
| 244 | —$CH_3$ | —$CH(CH_3)$—$CH_3$ | —$CH_2$—$CH_3$ | — |
| 245 | —$CH_2$—$CH_3$ | —$CH(CH_3)$—$CH_3$ | —$CH_2$—$CH_3$ | — |
| 246 | —$CH_2$—$CH_2$—$CH_3$ | —$CH(CH_3)$—$CH_3$ | —$CH_2$—$CH_3$ | — |
| 247 | —$CH(CH_3)$—$CH_3$ | —$CH(CH_3)$—$CH_3$ | —$CH_2$—$CH_3$ | — |
| 248 | —$CH_2$—OH | —$CH(CH_3)$—$CH_3$ | —$CH_2$—$CH_3$ | — |
| 249 | —$CH_2$—$CH_2$—OH | —$CH(CH_3)$—$CH_3$ | —$CH_2$—$CH_3$ | — |
| 250 | —CH(OH)—$CH_3$ | —$CH(CH_3)$—$CH_3$ | —$CH_2$—$CH_3$ | — |
| 251 | —$CH_2$—$CH_2$—$CH_2$—OH | —$CH(CH_3)$—$CH_3$ | —$CH_2$—$CH_3$ | — |
| 252 | —$CH_2$—CH(OH)—$CH_3$ | —$CH(CH_3)$—$CH_3$ | —$CH_2$—$CH_3$ | — |
| 253 | —CH(OH)—$CH_2$—$CH_3$ | —$CH(CH_3)$—$CH_3$ | —$CH_2$—$CH_3$ | — |
| 254 | —H | —$CH(CH_3)$—$CH_3$ | —$CH_2$—$CH_2$—$CH_3$ | — |
| 255 | —$CH_3$ | —$CH(CH_3)$—$CH_3$ | —$CH_2$—$CH_2$—$CH_3$ | — |
| 256 | —$CH_2$—$CH_3$ | —$CH(CH_3)$—$CH_3$ | —$CH_2$—$CH_2$—$CH_3$ | — |
| 257 | —$CH_2$—$CH_2$—$CH_3$ | —$CH(CH_3)$—$CH_3$ | —$CH_2$—$CH_2$—$CH_3$ | — |
| 258 | —$CH(CH_3)$—$CH_3$ | —$CH(CH_3)$—$CH_3$ | —$CH_2$—$CH_2$—$CH_3$ | — |
| 259 | —$CH_2$—OH | —$CH(CH_3)$—$CH_3$ | —$CH_2$—$CH_2$—$CH_3$ | — |
| 260 | —$CH_2$—$CH_2$—OH | —$CH(CH_3)$—$CH_3$ | —$CH_2$—$CH_2$—$CH_3$ | — |
| 261 | —CH(OH)—$CH_3$ | —$CH(CH_3)$—$CH_3$ | —$CH_2$—$CH_2$—$CH_3$ | — |
| 262 | —$CH_2$—$CH_2$—$CH_2$—OH | —$CH(CH_3)$—$CH_3$ | —$CH_2$—$CH_2$—$CH_3$ | — |
| 263 | —$CH_2$—CH(OH)—$CH_3$ | —$CH(CH_3)$—$CH_3$ | —$CH_2$—$CH_2$—$CH_3$ | — |
| 264 | —CH(OH)—$CH_2$—$CH_3$ | —$CH(CH_3)$—$CH_3$ | —$CH_2$—$CH_2$—$CH_3$ | — |
| 265 | —H | —$CH(CH_3)$—$CH_3$ | —$CH(CH_3)$—$CH_3$ | — |
| 266 | —$CH_3$ | —$CH(CH_3)$—$CH_3$ | —$CH(CH_3)$—$CH_3$ | — |
| 267 | —$CH_2$—$CH_3$ | —$CH(CH_3)$—$CH_3$ | —$CH(CH_3)$—$CH_3$ | — |
| 268 | —$CH_2$—$CH_2$—$CH_3$ | —$CH(CH_3)$—$CH_3$ | —$CH(CH_3)$—$CH_3$ | — |
| 269 | —$CH(CH_3)$—$CH_3$ | —$CH(CH_3)$—$CH_3$ | —$CH(CH_3)$—$CH_3$ | — |
| 270 | —$CH_2$—OH | —$CH(CH_3)$—$CH_3$ | —$CH(CH_3)$—$CH_3$ | — |

-continued

| No. | $R^5$ | $R^6$ | $R^7$ | X |
|---|---|---|---|---|
| 271 | —$CH_2$—$CH_2$—OH | —CH($CH_3$)—$CH_3$ | —CH($CH_3$)—$CH_3$ | — |
| 272 | —CH(OH)—$CH_3$ | —CH($CH_3$)—$CH_3$ | —CH($CH_3$)—$CH_3$ | — |
| 273 | —$CH_2$—$CH_2$—$CH_2$—OH | —CH($CH_3$)—$CH_3$ | —CH($CH_3$)—$CH_3$ | — |
| 274 | —$CH_2$—CH(OH)—$CH_3$ | —CH($CH_3$)—$CH_3$ | —CH($CH_3$)—$CH_3$ | — |
| 275 | —CH(OH)—$CH_2$—$CH_3$ | —CH($CH_3$)—$CH_3$ | —CH($CH_3$)—$CH_3$ | — |
| 276 | —H | —H | —H | —$CH_2$— |
| 277 | —$CH_3$ | —H | —H | —$CH_2$— |
| 278 | —$CH_2$—$CH_3$ | —H | —H | —$CH_2$— |
| 279 | —$CH_2$—$CH_2$—$CH_3$ | —H | —H | —$CH_2$— |
| 280 | —CH($CH_3$)—$CH_3$ | —H | —H | —$CH_2$— |
| 281 | —$CH_2$—OH | —H | —H | —$CH_2$— |
| 282 | —$CH_2$—$CH_2$—OH | —H | —H | —$CH_2$— |
| 283 | —CH(OH)—$CH_3$ | —H | —H | —$CH_2$— |
| 284 | —$CH_2$—$CH_2$—$CH_2$—OH | —H | —H | —$CH_2$— |
| 285 | —$CH_2$—CH(OH)—$CH_3$ | —H | —H | —$CH_2$— |
| 286 | —CH(OH)—$CH_2$—$CH_3$ | —H | —H | —$CH_2$— |
| 287 | —H | —H | —$CH_3$ | —$CH_2$— |
| 288 | —$CH_3$ | —H | —$CH_3$ | —$CH_2$— |
| 289 | —$CH_2$—$CH_3$ | —H | —$CH_3$ | —$CH_2$— |
| 290 | —$CH_2$—$CH_2$—$CH_3$ | —H | —$CH_3$ | —$CH_2$— |
| 291 | —CH($CH_3$)—$CH_3$ | —H | —$CH_3$ | —$CH_2$— |
| 292 | —$CH_2$—OH | —H | —$CH_3$ | —$CH_2$— |
| 293 | —$CH_2$—$CH_2$—OH | —H | —$CH_3$ | —$CH_2$— |
| 294 | —CH(OH)—$CH_3$ | —H | —$CH_3$ | —$CH_2$— |
| 295 | —$CH_2$—$CH_2$—$CH_2$—OH | —H | —$CH_3$ | —$CH_2$— |
| 296 | —$CH_2$—CH(OH)—$CH_3$ | —H | —$CH_3$ | —$CH_2$— |
| 297 | —CH(OH)—$CH_2$—$CH_3$ | —H | —$CH_3$ | —$CH_2$— |
| 298 | —H | —H | —$CH_2$—$CH_3$ | —$CH_2$— |
| 299 | —$CH_3$ | —H | —$CH_2$—$CH_3$ | —$CH_2$— |
| 300 | —$CH_2$—$CH_3$ | —H | —$CH_2$—$CH_3$ | —$CH_2$— |
| 301 | —$CH_2$—$CH_2$—$CH_3$ | —H | —$CH_2$—$CH_3$ | —$CH_2$— |
| 302 | —CH($CH_3$)—$CH_3$ | —H | —$CH_2$—$CH_3$ | —$CH_2$— |
| 303 | —$CH_2$—OH | —H | —$CH_2$—$CH_3$ | —$CH_2$— |
| 304 | —$CH_2$—$CH_2$—OH | —H | —$CH_2$—$CH_3$ | —$CH_2$— |
| 305 | —CH(OH)—$CH_3$ | —H | —$CH_2$—$CH_3$ | —$CH_2$— |
| 306 | —$CH_2$—$CH_2$—$CH_2$—OH | —H | —$CH_2$—$CH_3$ | —$CH_2$— |
| 307 | —$CH_2$—CH(OH)—$CH_3$ | —H | —$CH_2$—$CH_3$ | —$CH_2$— |
| 308 | —CH(OH)—$CH_2$—$CH_3$ | —H | —$CH_2$—$CH_3$ | —$CH_2$— |
| 309 | —H | —H | —$CH_2$—$CH_2$—$CH_3$ | —$CH_2$— |
| 310 | —$CH_3$ | —H | —$CH_2$—$CH_2$—$CH_3$ | —$CH_2$— |
| 311 | —$CH_2$—$CH_3$ | —H | —$CH_2$—$CH_2$—$CH_3$ | —$CH_2$— |
| 312 | —$CH_2$—$CH_2$—$CH_3$ | —H | —$CH_2$—$CH_2$—$CH_3$ | —$CH_2$— |
| 313 | —CH($CH_3$)—$CH_3$ | —H | —$CH_2$—$CH_2$—$CH_3$ | —$CH_2$— |
| 314 | —$CH_2$—OH | —H | —$CH_2$—$CH_2$—$CH_3$ | —$CH_2$— |
| 315 | —$CH_2$—$CH_2$—OH | —H | —$CH_2$—$CH_2$—$CH_3$ | —$CH_2$— |
| 316 | —CH(OH)—$CH_3$ | —H | —$CH_2$—$CH_2$—$CH_3$ | —$CH_2$— |
| 317 | —$CH_2$—$CH_2$—$CH_2$—OH | —H | —$CH_2$—$CH_2$—$CH_3$ | —$CH_2$— |
| 318 | —$CH_2$—CH(OH)—$CH_3$ | —H | —$CH_2$—$CH_2$—$CH_3$ | —$CH_2$— |
| 319 | —CH(OH)—$CH_2$—$CH_3$ | —H | —$CH_2$—$CH_2$—$CH_3$ | —$CH_2$— |
| 320 | —H | —H | —CH($CH_3$)—$CH_3$ | —$CH_2$— |
| 321 | —$CH_3$ | —H | —CH($CH_3$)—$CH_3$ | —$CH_2$— |
| 322 | —$CH_2$—$CH_3$ | —H | —CH($CH_3$)—$CH_3$ | —$CH_2$— |
| 323 | —$CH_2$—$CH_2$—$CH_3$ | —H | —CH($CH_3$)—$CH_3$ | —$CH_2$— |
| 324 | —CH($CH_3$)—$CH_3$ | —H | —CH($CH_3$)—$CH_3$ | —$CH_2$— |
| 325 | —$CH_2$—OH | —H | —CH($CH_3$)—$CH_3$ | —$CH_2$— |
| 326 | —$CH_2$—$CH_2$—OH | —H | —CH($CH_3$)—$CH_3$ | —$CH_2$— |
| 327 | —CH(OH)—$CH_3$ | —H | —CH($CH_3$)—$CH_3$ | —$CH_2$— |
| 328 | —$CH_2$—$CH_2$—$CH_2$—OH | —H | —CH($CH_3$)—$CH_3$ | —$CH_2$— |
| 329 | —$CH_2$—CH(OH)—$CH_3$ | —H | —CH($CH_3$)—$CH_3$ | —$CH_2$— |
| 330 | —CH(OH)—$CH_2$—$CH_3$ | —H | —CH($CH_3$)—$CH_3$ | —$CH_2$— |
| 331 | —H | —$CH_3$ | —H | —$CH_2$— |
| 332 | —$CH_3$ | —$CH_3$ | —H | —$CH_2$— |
| 333 | —$CH_2$—$CH_3$ | —$CH_3$ | —H | —$CH_2$— |
| 334 | —$CH_2$—$CH_2$—$CH_3$ | —$CH_3$ | —H | —$CH_2$— |
| 335 | —CH($CH_3$)—$CH_3$ | —$CH_3$ | —H | —$CH_2$— |
| 336 | —$CH_2$—OH | —$CH_3$ | —H | —$CH_2$— |
| 337 | —$CH_2$—$CH_2$—OH | —$CH_3$ | —H | —$CH_2$— |
| 338 | —CH(OH)—$CH_3$ | —$CH_3$ | —H | —$CH_2$— |
| 339 | —$CH_2$—$CH_2$—$CH_2$—OH | —$CH_3$ | —H | —$CH_2$— |
| 340 | —$CH_2$—CH(OH)—$CH_3$ | —$CH_3$ | —H | —$CH_2$— |
| 341 | —CH(OH)—$CH_2$—$CH_3$ | —$CH_3$ | —H | —$CH_2$— |
| 342 | —H | —$CH_3$ | —$CH_3$ | —$CH_2$— |
| 343 | —$CH_3$ | —$CH_3$ | —$CH_3$ | —$CH_2$— |
| 344 | —$CH_2$—$CH_3$ | —$CH_3$ | —$CH_3$ | —$CH_2$— |
| 345 | —$CH_2$—$CH_2$—$CH_3$ | —$CH_3$ | —$CH_3$ | —$CH_2$— |
| 346 | —CH($CH_3$)—$CH_3$ | —$CH_3$ | —$CH_3$ | —$CH_2$— |
| 347 | —$CH_2$—OH | —$CH_3$ | —$CH_3$ | —$CH_2$— |

-continued

| No. | $R^5$ | $R^6$ | $R^7$ | X |
|---|---|---|---|---|
| 348 | —$CH_2$—$CH_2$—OH | —$CH_3$ | —$CH_3$ | —$CH_2$— |
| 349 | —CH(OH)—$CH_3$ | —$CH_3$ | —$CH_3$ | —$CH_2$— |
| 350 | —$CH_2$—$CH_2$—$CH_2$—OH | —$CH_3$ | —$CH_3$ | —$CH_2$— |
| 351 | —$CH_2$—CH(OH)—$CH_3$ | —$CH_3$ | —$CH_3$ | —$CH_2$— |
| 352 | —CH(OH)—$CH_2$—$CH_3$ | —$CH_3$ | —$CH_3$ | —$CH_2$— |
| 353 | —H | —$CH_3$ | —$CH_2$—$CH_3$ | —$CH_2$— |
| 354 | —$CH_3$ | —$CH_3$ | —$CH_2$—$CH_3$ | —$CH_2$— |
| 355 | —$CH_2$—$CH_3$ | —$CH_3$ | —$CH_2$—$CH_3$ | —$CH_2$— |
| 356 | —$CH_2$—$CH_2$—$CH_3$ | —$CH_3$ | —$CH_2$—$CH_3$ | —$CH_2$— |
| 357 | —$CH(CH_3)$—$CH_3$ | —$CH_3$ | —$CH_2$—$CH_3$ | —$CH_2$— |
| 358 | —$CH_2$—OH | —$CH_3$ | —$CH_2$—$CH_3$ | —$CH_2$— |
| 359 | —$CH_2$—$CH_2$—OH | —$CH_3$ | —$CH_2$—$CH_3$ | —$CH_2$— |
| 360 | —CH(OH)—$CH_3$ | —$CH_3$ | —$CH_2$—$CH_3$ | —$CH_2$— |
| 361 | —$CH_2$—$CH_2$—$CH_2$—OH | —$CH_3$ | —$CH_2$—$CH_3$ | —$CH_2$— |
| 362 | —$CH_2$—CH(OH)—$CH_3$ | —$CH_3$ | —$CH_2$—$CH_3$ | —$CH_2$— |
| 363 | —CH(OH)—$CH_2$—$CH_3$ | —$CH_3$ | —$CH_2$—$CH_3$ | —$CH_2$— |
| 364 | —H | —$CH_3$ | —$CH_2$—$CH_2$—$CH_3$ | —$CH_2$— |
| 365 | —$CH_3$ | —$CH_3$ | —$CH_2$—$CH_2$—$CH_3$ | —$CH_2$— |
| 366 | —$CH_2$—$CH_3$ | —$CH_3$ | —$CH_2$—$CH_2$—$CH_3$ | —$CH_2$— |
| 367 | —$CH_2$—$CH_2$—$CH_3$ | —$CH_3$ | —$CH_2$—$CH_2$—$CH_3$ | —$CH_2$— |
| 368 | —$CH(CH_3)$—$CH_3$ | —$CH_3$ | —$CH_2$—$CH_2$—$CH_3$ | —$CH_2$— |
| 369 | —$CH_2$—OH | —$CH_3$ | —$CH_2$—$CH_2$—$CH_3$ | —$CH_2$— |
| 370 | —$CH_2$—$CH_2$—OH | —$CH_3$ | —$CH_2$—$CH_2$—$CH_3$ | —$CH_2$— |
| 371 | —CH(OH)—$CH_3$ | —$CH_3$ | —$CH_2$—$CH_2$—$CH_3$ | —$CH_2$— |
| 372 | —$CH_2$—$CH_2$—$CH_2$—OH | —$CH_3$ | —$CH_2$—$CH_2$—$CH_3$ | —$CH_2$— |
| 373 | —$CH_2$—CH(OH)—$CH_3$ | —$CH_3$ | —$CH_2$—$CH_2$—$CH_3$ | —$CH_2$— |
| 374 | —CH(OH)—$CH_2$—$CH_3$ | —$CH_3$ | —$CH_2$—$CH_2$—$CH_3$ | —$CH_2$— |
| 375 | —H | —$CH_3$ | —$CH(CH_3)$—$CH_3$ | —$CH_2$— |
| 376 | —$CH_3$ | —$CH_3$ | —$CH(CH_3)$—$CH_3$ | —$CH_2$— |
| 377 | —$CH_2$—$CH_3$ | —$CH_3$ | —$CH(CH_3)$—$CH_3$ | —$CH_2$— |
| 378 | —$CH_2$—$CH_2$—$CH_3$ | —$CH_3$ | —$CH(CH_3)$—$CH_3$ | —$CH_2$— |
| 379 | —$CH(CH_3)$—$CH_3$ | —$CH_3$ | —$CH(CH_3)$—$CH_3$ | —$CH_2$— |
| 380 | —$CH_2$—OH | —$CH_3$ | —$CH(CH_3)$—$CH_3$ | —$CH_2$— |
| 381 | —$CH_2$—$CH_2$—OH | —$CH_3$ | —$CH(CH_3)$—$CH_3$ | —$CH_2$— |
| 382 | —CH(OH)—$CH_3$ | —$CH_3$ | —$CH(CH_3)$—$CH_3$ | —$CH_2$— |
| 383 | —$CH_2$—$CH_2$—$CH_2$—OH | —$CH_3$ | —$CH(CH_3)$—$CH_3$ | —$CH_2$— |
| 384 | —$CH_2$—CH(OH)—$CH_3$ | —$CH_3$ | —$CH(CH_3)$—$CH_3$ | —$CH_2$— |
| 385 | —CH(OH)—$CH_2$—$CH_3$ | —$CH_3$ | —$CH(CH_3)$—$CH_3$ | —$CH_2$— |
| 386 | —H | —$CH_2$—$CH_3$ | —H | —$CH_2$— |
| 387 | —$CH_3$ | —$CH_2$—$CH_3$ | —H | —$CH_2$— |
| 388 | —$CH_2$—$CH_3$ | —$CH_2$—$CH_3$ | —H | —$CH_2$— |
| 389 | —$CH_2$—$CH_2$—$CH_3$ | —$CH_2$—$CH_3$ | —H | —$CH_2$— |
| 390 | —$CH(CH_3)$—$CH_3$ | —$CH_2$—$CH_3$ | —H | —$CH_2$— |
| 391 | —$CH_2$—OH | —$CH_2$—$CH_3$ | —H | —$CH_2$— |
| 392 | —$CH_2$—$CH_2$—OH | —$CH_2$—$CH_3$ | —H | —$CH_2$— |
| 393 | —CH(OH)—$CH_3$ | —$CH_2$—$CH_3$ | —H | —$CH_2$— |
| 394 | —$CH_2$—$CH_2$—$CH_2$—OH | —$CH_2$—$CH_3$ | —H | —$CH_2$— |
| 395 | —$CH_2$—CH(OH)—$CH_3$ | —$CH_2$—$CH_3$ | —H | —$CH_2$— |
| 396 | —CH(OH)—$CH_2$—$CH_3$ | —$CH_2$—$CH_3$ | —H | —$CH_2$— |
| 397 | —H | —$CH_2$—$CH_3$ | —$CH_3$ | —$CH_2$— |
| 398 | —$CH_3$ | —$CH_2$—$CH_3$ | —$CH_3$ | —$CH_2$— |
| 399 | —$CH_2$—$CH_3$ | —$CH_2$—$CH_3$ | —$CH_3$ | —$CH_2$— |
| 400 | —$CH_2$—$CH_2$—$CH_3$ | —$CH_2$—$CH_3$ | —$CH_3$ | —$CH_2$— |
| 401 | —$CH(CH_3)$—$CH_3$ | —$CH_2$—$CH_3$ | —$CH_3$ | —$CH_2$— |
| 402 | —$CH_2$—OH | —$CH_2$—$CH_3$ | —$CH_3$ | —$CH_2$— |
| 403 | —$CH_2$—$CH_2$—OH | —$CH_2$—$CH_3$ | —$CH_3$ | —$CH_2$— |
| 404 | —CH(OH)—$CH_3$ | —$CH_2$—$CH_3$ | —$CH_3$ | —$CH_2$— |
| 405 | —$CH_2$—$CH_2$—$CH_2$—OH | —$CH_2$—$CH_3$ | —$CH_3$ | —$CH_2$— |
| 406 | —$CH_2$—CH(OH)—$CH_3$ | —$CH_2$—$CH_3$ | —$CH_3$ | —$CH_2$— |
| 407 | —CH(OH)—$CH_2$—$CH_3$ | —$CH_2$—$CH_3$ | —$CH_3$ | —$CH_2$— |
| 408 | —H | —$CH_2$—$CH_3$ | —$CH_2$—$CH_3$ | —$CH_2$— |
| 409 | —$CH_3$ | —$CH_2$—$CH_3$ | —$CH_2$—$CH_3$ | —$CH_2$— |
| 410 | —$CH_2$—$CH_3$ | —$CH_2$—$CH_3$ | —$CH_2$—$CH_3$ | —$CH_2$— |
| 411 | —$CH_2$—$CH_2$—$CH_3$ | —$CH_2$—$CH_3$ | —$CH_2$—$CH_3$ | —$CH_2$— |
| 412 | —$CH(CH_3)$—$CH_3$ | —$CH_2$—$CH_3$ | —$CH_2$—$CH_3$ | —$CH_2$— |
| 413 | —$CH_2$—OH | —$CH_2$—$CH_3$ | —$CH_2$—$CH_3$ | —$CH_2$— |
| 414 | —$CH_2$—$CH_2$—OH | —$CH_2$—$CH_3$ | —$CH_2$—$CH_3$ | —$CH_2$— |
| 415 | —CH(OH)—$CH_3$ | —$CH_2$—$CH_3$ | —$CH_2$—$CH_3$ | —$CH_2$— |
| 416 | —$CH_2$—$CH_2$—$CH_2$—OH | —$CH_2$—$CH_3$ | —$CH_2$—$CH_3$ | —$CH_2$— |
| 417 | —$CH_2$—CH(OH)—$CH_3$ | —$CH_2$—$CH_3$ | —$CH_2$—$CH_3$ | —$CH_2$— |
| 418 | —CH(OH)—$CH_2$—$CH_3$ | —$CH_2$—$CH_3$ | —$CH_2$—$CH_3$ | —$CH_2$— |
| 419 | —H | —$CH_2$—$CH_3$ | —$CH_2$—$CH_2$—$CH_3$ | —$CH_2$— |
| 420 | —$CH_3$ | —$CH_2$—$CH_3$ | —$CH_2$—$CH_2$—$CH_3$ | —$CH_2$— |
| 421 | —$CH_2$—$CH_3$ | —$CH_2$—$CH_3$ | —$CH_2$—$CH_2$—$CH_3$ | —$CH_2$— |
| 422 | —$CH_2$—$CH_2$—$CH_3$ | —$CH_2$—$CH_3$ | —$CH_2$—$CH_2$—$CH_3$ | —$CH_2$— |
| 423 | —$CH(CH_3)$—$CH_3$ | —$CH_2$—$CH_3$ | —$CH_2$—$CH_2$—$CH_3$ | —$CH_2$— |
| 424 | —$CH_2$—OH | —$CH_2$—$CH_3$ | —$CH_2$—$CH_2$—$CH_3$ | —$CH_2$— |

-continued

| No. | $R^5$ | $R^6$ | $R^7$ | X |
|---|---|---|---|---|
| 425 | —$CH_2$—$CH_2$—OH | —$CH_2$—$CH_3$ | —$CH_2$—$CH_2$—$CH_3$ | —$CH_2$— |
| 426 | —CH(OH)—$CH_3$ | —$CH_2$—$CH_3$ | —$CH_2$—$CH_2$—$CH_3$ | —$CH_2$— |
| 427 | —$CH_2$—$CH_2$—$CH_2$—OH | —$CH_2$—$CH_3$ | —$CH_2$—$CH_2$—$CH_3$ | —$CH_2$— |
| 428 | —$CH_2$—CH(OH)—$CH_3$ | —$CH_2$—$CH_3$ | —$CH_2$—$CH_2$—$CH_3$ | —$CH_2$— |
| 429 | —CH(OH)—$CH_2$—$CH_3$ | —$CH_2$—$CH_3$ | —$CH_2$—$CH_2$—$CH_3$ | —$CH_2$— |
| 430 | —H | —$CH_2$—$CH_3$ | —CH($CH_3$)—$CH_3$ | —$CH_2$— |
| 431 | —$CH_3$ | —$CH_2$—$CH_3$ | —CH($CH_3$)—$CH_3$ | —$CH_2$— |
| 432 | —$CH_2$—$CH_3$ | —$CH_2$—$CH_3$ | —CH($CH_3$)—$CH_3$ | —$CH_2$— |
| 433 | —$CH_2$—$CH_2$—$CH_3$ | —$CH_2$—$CH_3$ | —CH($CH_3$)—$CH_3$ | —$CH_2$— |
| 434 | —CH($CH_3$)—$CH_3$ | —$CH_2$—$CH_3$ | —CH($CH_3$)—$CH_3$ | —$CH_2$— |
| 435 | —$CH_2$—OH | —$CH_2$—$CH_3$ | —CH($CH_3$)—$CH_3$ | —$CH_2$— |
| 436 | —$CH_2$—$CH_2$—OH | —$CH_2$—$CH_3$ | —CH($CH_3$)—$CH_3$ | —$CH_2$— |
| 437 | —CH(OH)—$CH_3$ | —$CH_2$—$CH_3$ | —CH($CH_3$)—$CH_3$ | —$CH_2$— |
| 438 | —$CH_2$—$CH_2$—$CH_2$—OH | —$CH_2$—$CH_3$ | —CH($CH_3$)—$CH_3$ | —$CH_2$— |
| 439 | —$CH_2$—CH(OH)—$CH_3$ | —$CH_2$—$CH_3$ | —CH($CH_3$)—$CH_3$ | —$CH_2$— |
| 440 | —CH(OH)—$CH_2$—$CH_3$ | —$CH_2$—$CH_3$ | —CH($CH_3$)—$CH_3$ | —$CH_2$— |
| 441 | —H | —$CH_2$—$CH_2$—$CH_3$ | —H | —$CH_2$— |
| 442 | —$CH_3$ | —$CH_2$—$CH_2$—$CH_3$ | —H | —$CH_2$— |
| 443 | —$CH_2$—$CH_3$ | —$CH_2$—$CH_2$—$CH_3$ | —H | —$CH_2$— |
| 444 | —$CH_2$—$CH_2$—$CH_3$ | —$CH_2$—$CH_2$—$CH_3$ | —H | —$CH_2$— |
| 445 | —CH($CH_3$)—$CH_3$ | —$CH_2$—$CH_2$—$CH_3$ | —H | —$CH_2$— |
| 446 | —$CH_2$—OH | —$CH_2$—$CH_2$—$CH_3$ | —H | —$CH_2$— |
| 447 | —$CH_2$—$CH_2$—OH | —$CH_2$—$CH_2$—$CH_3$ | —H | —$CH_2$— |
| 448 | —CH(OH)—$CH_3$ | —$CH_2$—$CH_2$—$CH_3$ | —H | —$CH_2$— |
| 449 | —$CH_2$—$CH_2$—$CH_2$—OH | —$CH_2$—$CH_2$—$CH_3$ | —H | —$CH_2$— |
| 450 | —$CH_2$—CH(OH)—$CH_3$ | —$CH_2$—$CH_2$—$CH_3$ | —H | —$CH_2$— |
| 451 | —CH(OH)—$CH_2$—$CH_3$ | —$CH_2$—$CH_2$—$CH_3$ | —H | —$CH_2$— |
| 452 | —H | —$CH_2$—$CH_2$—$CH_3$ | —$CH_3$ | —$CH_2$— |
| 453 | —$CH_3$ | —$CH_2$—$CH_2$—$CH_3$ | —$CH_3$ | —$CH_2$— |
| 454 | —$CH_2$—$CH_3$ | —$CH_2$—$CH_2$—$CH_3$ | —$CH_3$ | —$CH_2$— |
| 455 | —$CH_2$—$CH_2$—$CH_3$ | —$CH_2$—$CH_2$—$CH_3$ | —$CH_3$ | —$CH_2$— |
| 456 | —CH($CH_3$)—$CH_3$ | —$CH_2$—$CH_2$—$CH_3$ | —$CH_3$ | —$CH_2$— |
| 457 | —$CH_2$—OH | —$CH_2$—$CH_2$—$CH_3$ | —$CH_3$ | —$CH_2$— |
| 458 | —$CH_2$—$CH_2$—OH | —$CH_2$—$CH_2$—$CH_3$ | —$CH_3$ | —$CH_2$— |
| 459 | —CH(OH)—$CH_3$ | —$CH_2$—$CH_2$—$CH_3$ | —$CH_3$ | —$CH_2$— |
| 460 | —$CH_2$—$CH_2$—$CH_2$—OH | —$CH_2$—$CH_2$—$CH_3$ | —$CH_3$ | —$CH_2$— |
| 461 | —$CH_2$—CH(OH)—$CH_3$ | —$CH_2$—$CH_2$—$CH_3$ | —$CH_3$ | —$CH_2$— |
| 462 | —CH(OH)—$CH_2$—$CH_3$ | —$CH_2$—$CH_2$—$CH_3$ | —$CH_3$ | —$CH_2$— |
| 463 | —H | —$CH_2$—$CH_2$—$CH_3$ | —$CH_2$—$CH_3$ | —$CH_2$— |
| 464 | —$CH_3$ | —$CH_2$—$CH_2$—$CH_3$ | —$CH_2$—$CH_3$ | —$CH_2$— |
| 465 | —$CH_2$—$CH_3$ | —$CH_2$—$CH_2$—$CH_3$ | —$CH_2$—$CH_3$ | —$CH_2$— |
| 466 | —$CH_2$—$CH_2$—$CH_3$ | —$CH_2$—$CH_2$—$CH_3$ | —$CH_2$—$CH_3$ | —$CH_2$— |
| 467 | —CH($CH_3$)—$CH_3$ | —$CH_2$—$CH_2$—$CH_3$ | —$CH_2$—$CH_3$ | —$CH_2$— |
| 468 | —$CH_2$—OH | —$CH_2$—$CH_2$—$CH_3$ | —$CH_2$—$CH_3$ | —$CH_2$— |
| 469 | —$CH_2$—$CH_2$—OH | —$CH_2$—$CH_2$—$CH_3$ | —$CH_2$—$CH_3$ | —$CH_2$— |
| 470 | —CH(OH)—$CH_3$ | —$CH_2$—$CH_2$—$CH_3$ | —$CH_2$—$CH_3$ | —$CH_2$— |
| 471 | —$CH_2$—$CH_2$—$CH_2$—OH | —$CH_2$—$CH_2$—$CH_3$ | —$CH_2$—$CH_3$ | —$CH_2$— |
| 472 | —$CH_2$—CH(OH)—$CH_3$ | —$CH_2$—$CH_2$—$CH_3$ | —$CH_2$—$CH_3$ | —$CH_2$— |
| 473 | —CH(OH)—$CH_2$—$CH_3$ | —$CH_2$—$CH_2$—$CH_3$ | —$CH_2$—$CH_3$ | —$CH_2$— |
| 474 | —H | —$CH_2$—$CH_2$—$CH_3$ | —$CH_2$—$CH_2$—$CH_3$ | —$CH_2$— |
| 475 | —$CH_3$ | —$CH_2$—$CH_2$—$CH_3$ | —$CH_2$—$CH_2$—$CH_3$ | —$CH_2$— |
| 476 | —$CH_2$—$CH_3$ | —$CH_2$—$CH_2$—$CH_3$ | —$CH_2$—$CH_2$—$CH_3$ | —$CH_2$— |
| 477 | —$CH_2$—$CH_2$—$CH_3$ | —$CH_2$—$CH_2$—$CH_3$ | —$CH_2$—$CH_2$—$CH_3$ | —$CH_2$— |
| 478 | —CH($CH_3$)—$CH_3$ | —$CH_2$—$CH_2$—$CH_3$ | —$CH_2$—$CH_2$—$CH_3$ | —$CH_2$— |
| 479 | —$CH_2$—OH | —$CH_2$—$CH_2$—$CH_3$ | —$CH_2$—$CH_2$—$CH_3$ | —$CH_2$— |
| 480 | —$CH_2$—$CH_2$—OH | —$CH_2$—$CH_2$—$CH_3$ | —$CH_2$—$CH_2$—$CH_3$ | —$CH_2$— |
| 481 | —CH(OH)—$CH_3$ | —$CH_2$—$CH_2$—$CH_3$ | —$CH_2$—$CH_2$—$CH_3$ | —$CH_2$— |
| 482 | —$CH_2$—$CH_2$—$CH_2$—OH | —$CH_2$—$CH_2$—$CH_3$ | —$CH_2$—$CH_2$—$CH_3$ | —$CH_2$— |
| 483 | —$CH_2$—CH(OH)—$CH_3$ | —$CH_2$—$CH_2$—$CH_3$ | —$CH_2$—$CH_2$—$CH_3$ | —$CH_2$— |
| 484 | —CH(OH)—$CH_2$—$CH_3$ | —$CH_2$—$CH_2$—$CH_3$ | —$CH_2$—$CH_2$—$CH_3$ | —$CH_2$— |
| 485 | —H | —$CH_2$—$CH_2$—$CH_3$ | —CH($CH_3$)—$CH_3$ | —$CH_2$— |
| 486 | —$CH_3$ | —$CH_2$—$CH_2$—$CH_3$ | —CH($CH_3$)—$CH_3$ | —$CH_2$— |
| 487 | —$CH_2$—$CH_3$ | —$CH_2$—$CH_2$—$CH_3$ | —CH($CH_3$)—$CH_3$ | —$CH_2$— |
| 488 | —$CH_2$—$CH_2$—$CH_3$ | —$CH_2$—$CH_2$—$CH_3$ | —CH($CH_3$)—$CH_3$ | —$CH_2$— |
| 489 | —CH($CH_3$)—$CH_3$ | —$CH_2$—$CH_2$—$CH_3$ | —CH($CH_3$)—$CH_3$ | —$CH_2$— |
| 490 | —$CH_2$—OH | —$CH_2$—$CH_2$—$CH_3$ | —CH($CH_3$)—$CH_3$ | —$CH_2$— |
| 491 | —$CH_2$—$CH_2$—OH | —$CH_2$—$CH_2$—$CH_3$ | —CH($CH_3$)—$CH_3$ | —$CH_2$— |
| 492 | —CH(OH)—$CH_3$ | —$CH_2$—$CH_2$—$CH_3$ | —CH($CH_3$)—$CH_3$ | —$CH_2$— |
| 493 | —$CH_2$—$CH_2$—$CH_2$—OH | —$CH_2$—$CH_2$—$CH_3$ | —CH($CH_3$)—$CH_3$ | —$CH_2$— |
| 494 | —$CH_2$—CH(OH)—$CH_3$ | —$CH_2$—$CH_2$—$CH_3$ | —CH($CH_3$)—$CH_3$ | —$CH_2$— |
| 495 | —CH(OH)—$CH_2$—$CH_3$ | —$CH_2$—$CH_2$—$CH_3$ | —CH($CH_3$)—$CH_3$ | —$CH_2$— |
| 496 | —H | —CH($CH_3$)—$CH_3$ | —H | —$CH_2$— |
| 497 | —$CH_3$ | —CH($CH_3$)—$CH_3$ | —H | —$CH_2$— |
| 498 | —$CH_2$—$CH_3$ | —CH($CH_3$)—$CH_3$ | —H | —$CH_2$— |
| 499 | —$CH_2$—$CH_2$—$CH_3$ | —CH($CH_3$)—$CH_3$ | —H | —$CH_2$— |
| 500 | —CH($CH_3$)—$CH_3$ | —CH($CH_3$)—$CH_3$ | —H | —$CH_2$— |
| 501 | —$CH_2$—OH | —CH($CH_3$)—$CH_3$ | —H | —$CH_2$— |

-continued

| No. | $R^5$ | $R^6$ | $R^7$ | X |
|---|---|---|---|---|
| 502 | —$CH_2$—$CH_2$—OH | —CH($CH_3$)—$CH_3$ | —H | —$CH_2$— |
| 503 | —CH(OH)—$CH_3$ | —CH($CH_3$)—$CH_3$ | —H | —$CH_2$— |
| 504 | —$CH_2$—$CH_2$—$CH_2$—OH | —CH($CH_3$)—$CH_3$ | —H | —$CH_2$— |
| 505 | —$CH_2$—CH(OH)—$CH_3$ | —CH($CH_3$)—$CH_3$ | —H | —$CH_2$— |
| 506 | —CH(OH)—$CH_2$—$CH_3$ | —CH($CH_3$)—$CH_3$ | —H | —$CH_2$— |
| 507 | —H | —CH($CH_3$)—$CH_3$ | —$CH_3$ | —$CH_2$— |
| 508 | —$CH_3$ | —CH($CH_3$)—$CH_3$ | —$CH_3$ | —$CH_2$— |
| 509 | —$CH_2$—$CH_3$ | —CH($CH_3$)—$CH_3$ | —$CH_3$ | —$CH_2$— |
| 510 | —$CH_2$—$CH_2$—$CH_3$ | —CH($CH_3$)—$CH_3$ | —$CH_3$ | —$CH_2$— |
| 511 | —CH($CH_3$)—$CH_3$ | —CH($CH_3$)—$CH_3$ | —$CH_3$ | —$CH_2$— |
| 512 | —$CH_2$—OH | —CH($CH_3$)—$CH_3$ | —$CH_3$ | —$CH_2$— |
| 513 | —$CH_2$—$CH_2$—OH | —CH($CH_3$)—$CH_3$ | —$CH_3$ | —$CH_2$— |
| 514 | —CH(OH)—$CH_3$ | —CH($CH_3$)—$CH_3$ | —$CH_3$ | —$CH_2$— |
| 515 | —$CH_2$—$CH_2$—$CH_2$—OH | —CH($CH_3$)—$CH_3$ | —$CH_3$ | —$CH_2$— |
| 516 | —$CH_2$—CH(OH)—$CH_3$ | —CH($CH_3$)—$CH_3$ | —$CH_3$ | —$CH_2$— |
| 517 | —CH(OH)—$CH_2$—$CH_3$ | —CH($CH_3$)—$CH_3$ | —$CH_3$ | —$CH_2$— |
| 518 | —H | —CH($CH_3$)—$CH_3$ | —$CH_2$—$CH_3$ | —$CH_2$— |
| 519 | —$CH_3$ | —CH($CH_3$)—$CH_3$ | —$CH_2$—$CH_3$ | —$CH_2$— |
| 520 | —$CH_2$—$CH_3$ | —CH($CH_3$)—$CH_3$ | —$CH_2$—$CH_3$ | —$CH_2$— |
| 521 | —$CH_2$—$CH_2$—$CH_3$ | —CH($CH_3$)—$CH_3$ | —$CH_2$—$CH_3$ | —$CH_2$— |
| 522 | —CH($CH_3$)—$CH_3$ | —CH($CH_3$)—$CH_3$ | —$CH_2$—$CH_3$ | —$CH_2$— |
| 523 | —$CH_2$—OH | —CH($CH_3$)—$CH_3$ | —$CH_2$—$CH_3$ | —$CH_2$— |
| 524 | —$CH_2$—$CH_2$—OH | —CH($CH_3$)—$CH_3$ | —$CH_2$—$CH_3$ | —$CH_2$— |
| 525 | —CH(OH)—$CH_3$ | —CH($CH_3$)—$CH_3$ | —$CH_2$—$CH_3$ | —$CH_2$— |
| 526 | —$CH_2$—$CH_2$—$CH_2$—OH | —CH($CH_3$)—$CH_3$ | —$CH_2$—$CH_3$ | —$CH_2$— |
| 527 | —$CH_2$—CH(OH)—$CH_3$ | —CH($CH_3$)—$CH_3$ | —$CH_2$—$CH_3$ | —$CH_2$— |
| 528 | —CH(OH)—$CH_2$—$CH_3$ | —CH($CH_3$)—$CH_3$ | —$CH_2$—$CH_3$ | —$CH_2$— |
| 529 | —H | —CH($CH_3$)—$CH_3$ | —$CH_2$—$CH_2$—$CH_3$ | —$CH_2$— |
| 530 | —$CH_3$ | —CH($CH_3$)—$CH_3$ | —$CH_2$—$CH_2$—$CH_3$ | —$CH_2$— |
| 531 | —$CH_2$—$CH_3$ | —CH($CH_3$)—$CH_3$ | —$CH_2$—$CH_2$—$CH_3$ | —$CH_2$— |
| 532 | —$CH_2$—$CH_2$—$CH_3$ | —CH($CH_3$)—$CH_3$ | —$CH_2$—$CH_2$—$CH_3$ | —$CH_2$— |
| 533 | —CH($CH_3$)—$CH_3$ | —CH($CH_3$)—$CH_3$ | —$CH_2$—$CH_2$—$CH_3$ | —$CH_2$— |
| 534 | —$CH_2$—OH | —CH($CH_3$)—$CH_3$ | —$CH_2$—$CH_2$—$CH_3$ | —$CH_2$— |
| 535 | —$CH_2$—$CH_2$—OH | —CH($CH_3$)—$CH_3$ | —$CH_2$—$CH_2$—$CH_3$ | —$CH_2$— |
| 536 | —CH(OH)—$CH_3$ | —CH($CH_3$)—$CH_3$ | —$CH_2$—$CH_2$—$CH_3$ | —$CH_2$— |
| 537 | —$CH_2$—$CH_2$—$CH_2$—OH | —CH($CH_3$)—$CH_3$ | —$CH_2$—$CH_2$—$CH_3$ | —$CH_2$— |
| 538 | —$CH_2$—CH(OH)—$CH_3$ | —CH($CH_3$)—$CH_3$ | —$CH_2$—$CH_2$—$CH_3$ | —$CH_2$— |
| 539 | —CH(OH)—$CH_2$—$CH_3$ | —CH($CH_3$)—$CH_3$ | —$CH_2$—$CH_2$—$CH_3$ | —$CH_2$— |
| 540 | —H | —CH($CH_3$)—$CH_3$ | —CH($CH_3$)—$CH_3$ | —$CH_2$— |
| 541 | —$CH_3$ | —CH($CH_3$)—$CH_3$ | —CH($CH_3$)—$CH_3$ | —$CH_2$— |
| 542 | —$CH_2$—$CH_3$ | —CH($CH_3$)—$CH_3$ | —CH($CH_3$)—$CH_3$ | —$CH_2$— |
| 543 | —$CH_2$—$CH_2$—$CH_3$ | —CH($CH_3$)—$CH_3$ | —CH($CH_3$)—$CH_3$ | —$CH_2$— |
| 544 | —CH($CH_3$)—$CH_3$ | —CH($CH_3$)—$CH_3$ | —CH($CH_3$)—$CH_3$ | —$CH_2$— |
| 545 | —$CH_2$—OH | —CH($CH_3$)—$CH_3$ | —CH($CH_3$)—$CH_3$ | —$CH_2$— |
| 546 | —$CH_2$—$CH_2$—OH | —CH($CH_3$)—$CH_3$ | —CH($CH_3$)—$CH_3$ | —$CH_2$— |
| 547 | —CH(OH)—$CH_3$ | —CH($CH_3$)—$CH_3$ | —CH($CH_3$)—$CH_3$ | —$CH_2$— |
| 548 | —$CH_2$—$CH_2$—$CH_2$—OH | —CH($CH_3$)—$CH_3$ | —CH($CH_3$)—$CH_3$ | —$CH_2$— |
| 549 | —$CH_2$—CH(OH)—$CH_3$ | —CH($CH_3$)—$CH_3$ | —CH($CH_3$)—$CH_3$ | —$CH_2$— |
| 550 | —CH(OH)—$CH_2$—$CH_3$ | —CH($CH_3$)—$CH_3$ | —CH($CH_3$)—$CH_3$ | —$CH_2$— |
| 551 | —H | —H | —H | —$CH_2$—$CH_2$— |
| 552 | —$CH_3$ | —H | —H | —$CH_2$—$CH_2$— |
| 553 | —$CH_2$—$CH_3$ | —H | —H | —$CH_2$—$CH_2$— |
| 554 | —$CH_2$—$CH_2$—$CH_3$ | —H | —H | —$CH_2$—$CH_2$— |
| 555 | —CH($CH_3$)—$CH_3$ | —H | —H | —$CH_2$—$CH_2$— |
| 556 | —$CH_2$—OH | —H | —H | —$CH_2$—$CH_2$— |
| 557 | —$CH_2$—$CH_2$—OH | —H | —H | —$CH_2$—$CH_2$— |
| 558 | —CH(OH)—$CH_3$ | —H | —H | —$CH_2$—$CH_2$— |
| 559 | —$CH_2$—$CH_2$—$CH_2$—OH | —H | —H | —$CH_2$—$CH_2$— |
| 560 | —$CH_2$—CH(OH)—$CH_3$ | —H | —H | —$CH_2$—$CH_2$— |
| 561 | —CH(OH)—$CH_2$—$CH_3$ | —H | —H | —$CH_2$—$CH_2$— |
| 562 | —H | —H | —$CH_3$ | —$CH_2$—$CH_2$— |
| 563 | —$CH_3$ | —H | —$CH_3$ | —$CH_2$—$CH_2$— |
| 564 | —$CH_2$—$CH_3$ | —H | —$CH_3$ | —$CH_2$—$CH_2$— |
| 565 | —$CH_2$—$CH_2$—$CH_3$ | —H | —$CH_3$ | —$CH_2$—$CH_2$— |
| 566 | —CH($CH_3$)—$CH_3$ | —H | —$CH_3$ | —$CH_2$—$CH_2$— |
| 567 | —$CH_2$—OH | —H | —$CH_3$ | —$CH_2$—$CH_2$— |
| 568 | —$CH_2$—$CH_2$—OH | —H | —$CH_3$ | —$CH_2$—$CH_2$— |
| 569 | —CH(OH)—$CH_3$ | —H | —$CH_3$ | —$CH_2$—$CH_2$— |
| 570 | —$CH_2$—$CH_2$—$CH_2$—OH | —H | —$CH_3$ | —$CH_2$—$CH_2$— |
| 571 | —$CH_2$—CH(OH)—$CH_3$ | —H | —$CH_3$ | —$CH_2$—$CH_2$— |
| 572 | —CH(OH)—$CH_2$—$CH_3$ | —H | —$CH_3$ | —$CH_2$—$CH_2$— |
| 573 | —H | —H | —$CH_2$—$CH_3$ | —$CH_2$—$CH_2$— |
| 574 | —$CH_3$ | —H | —$CH_2$—$CH_3$ | —$CH_2$—$CH_2$— |
| 575 | —$CH_2$—$CH_3$ | —H | —$CH_2$—$CH_3$ | —$CH_2$—$CH_2$— |
| 576 | —$CH_2$—$CH_2$—$CH_3$ | —H | —$CH_2$—$CH_3$ | —$CH_2$—$CH_2$— |
| 577 | —CH($CH_3$)—$CH_3$ | —H | —$CH_2$—$CH_3$ | —$CH_2$—$CH_2$— |
| 578 | —$CH_2$—OH | —H | —$CH_2$—$CH_3$ | —$CH_2$—$CH_2$— |

-continued

| No. | $R^5$ | $R^6$ | $R^7$ | X |
|---|---|---|---|---|
| 579 | —$CH_2$—$CH_2$—OH | —H | —$CH_2$—$CH_3$ | —$CH_2$—$CH_2$— |
| 580 | —CH(OH)—$CH_3$ | —H | —$CH_2$—$CH_3$ | —$CH_2$—$CH_2$— |
| 581 | —$CH_2$—$CH_2$—$CH_2$—OH | —H | —$CH_2$—$CH_3$ | —$CH_2$—$CH_2$— |
| 582 | —$CH_2$—CH(OH)—$CH_3$ | —H | —$CH_2$—$CH_3$ | —$CH_2$—$CH_2$— |
| 583 | —CH(OH)—$CH_2$—$CH_3$ | —H | —$CH_2$—$CH_3$ | —$CH_2$—$CH_2$— |
| 584 | —H | —H | —$CH_2$—$CH_2$—$CH_3$ | —$CH_2$—$CH_2$— |
| 585 | —$CH_3$ | —H | —$CH_2$—$CH_2$—$CH_3$ | —$CH_2$—$CH_2$— |
| 586 | —$CH_2$—$CH_3$ | —H | —$CH_2$—$CH_2$—$CH_3$ | —$CH_2$—$CH_2$— |
| 587 | —$CH_2$—$CH_2$—$CH_3$ | —H | —$CH_2$—$CH_2$—$CH_3$ | —$CH_2$—$CH_2$— |
| 588 | —$CH(CH_3)$—$CH_3$ | —H | —$CH_2$—$CH_2$—$CH_3$ | —$CH_2$—$CH_2$— |
| 589 | —$CH_2$—OH | —H | —$CH_2$—$CH_2$—$CH_3$ | —$CH_2$—$CH_2$— |
| 590 | —$CH_2$—$CH_2$—OH | —H | —$CH_2$—$CH_2$—$CH_3$ | —$CH_2$—$CH_2$— |
| 591 | —CH(OH)—$CH_3$ | —H | —$CH_2$—$CH_2$—$CH_3$ | —$CH_2$—$CH_2$— |
| 592 | —$CH_2$—$CH_2$—$CH_2$—OH | —H | —$CH_2$—$CH_2$—$CH_3$ | —$CH_2$—$CH_2$— |
| 593 | —$CH_2$—CH(OH)—$CH_3$ | —H | —$CH_2$—$CH_2$—$CH_3$ | —$CH_2$—$CH_2$— |
| 594 | —CH(OH)—$CH_2$—$CH_3$ | —H | —$CH_2$—$CH_2$—$CH_3$ | —$CH_2$—$CH_2$— |
| 595 | —H | —H | —$CH(CH_3)$—$CH_3$ | —$CH_2$—$CH_2$— |
| 596 | —$CH_3$ | —H | —$CH(CH_3)$—$CH_3$ | —$CH_2$—$CH_2$— |
| 597 | —$CH_2$—$CH_3$ | —H | —$CH(CH_3)$—$CH_3$ | —$CH_2$—$CH_2$— |
| 598 | —$CH_2$—$CH_2$—$CH_3$ | —H | —$CH(CH_3)$—$CH_3$ | —$CH_2$—$CH_2$— |
| 599 | —$CH(CH_3)$—$CH_3$ | —H | —$CH(CH_3)$—$CH_3$ | —$CH_2$—$CH_2$— |
| 600 | —$CH_2$—OH | —H | —$CH(CH_3)$—$CH_3$ | —$CH_2$—$CH_2$— |
| 601 | —$CH_2$—$CH_2$—OH | —H | —$CH(CH_3)$—$CH_3$ | —$CH_2$—$CH_2$— |
| 602 | —CH(OH)—$CH_3$ | —H | —$CH(CH_3)$—$CH_3$ | —$CH_2$—$CH_2$— |
| 603 | —$CH_2$—$CH_2$—$CH_2$—OH | —H | —$CH(CH_3)$—$CH_3$ | —$CH_2$—$CH_2$— |
| 604 | —$CH_2$—CH(OH)—$CH_3$ | —H | —$CH(CH_3)$—$CH_3$ | —$CH_2$—$CH_2$— |
| 605 | —CH(OH)—$CH_2$—$CH_3$ | —H | —$CH(CH_3)$—$CH_3$ | —$CH_2$—$CH_2$— |
| 606 | —H | —$CH_3$ | —H | —$CH_2$—$CH_2$— |
| 607 | —$CH_3$ | —$CH_3$ | —H | —$CH_2$—$CH_2$— |
| 608 | —$CH_2$—$CH_3$ | —$CH_3$ | —H | —$CH_2$—$CH_2$— |
| 609 | —$CH_2$—$CH_2$—$CH_3$ | —$CH_3$ | —H | —$CH_2$—$CH_2$— |
| 610 | —$CH(CH_3)$—$CH_3$ | —$CH_3$ | —H | —$CH_2$—$CH_2$— |
| 611 | —$CH_2$—OH | —$CH_3$ | —H | —$CH_2$—$CH_2$— |
| 612 | —$CH_2$—$CH_2$—OH | —$CH_3$ | —H | —$CH_2$—$CH_2$— |
| 613 | —CH(OH)—$CH_3$ | —$CH_3$ | —H | —$CH_2$—$CH_2$— |
| 614 | —$CH_2$—$CH_2$—$CH_2$—OH | —$CH_3$ | —H | —$CH_2$—$CH_2$— |
| 615 | —$CH_2$—CH(OH)—$CH_3$ | —$CH_3$ | —H | —$CH_2$—$CH_2$— |
| 616 | —CH(OH)—$CH_2$—$CH_3$ | —$CH_3$ | —H | —$CH_2$—$CH_2$— |
| 617 | —H | —$CH_3$ | —$CH_3$ | —$CH_2$—$CH_2$— |
| 618 | —$CH_3$ | —$CH_3$ | —$CH_3$ | —$CH_2$—$CH_2$— |
| 619 | —$CH_2$—$CH_3$ | —$CH_3$ | —$CH_3$ | —$CH_2$—$CH_2$— |
| 620 | —$CH_2$—$CH_2$—$CH_3$ | —$CH_3$ | —$CH_3$ | —$CH_2$—$CH_2$— |
| 621 | —$CH(CH_3)$—$CH_3$ | —$CH_3$ | —$CH_3$ | —$CH_2$—$CH_2$— |
| 622 | —$CH_2$—OH | —$CH_3$ | —$CH_3$ | —$CH_2$—$CH_2$— |
| 623 | —$CH_2$—$CH_2$—OH | —$CH_3$ | —$CH_3$ | —$CH_2$—$CH_2$— |
| 624 | —CH(OH)—$CH_3$ | —$CH_3$ | —$CH_3$ | —$CH_2$—$CH_2$— |
| 625 | —$CH_2$—$CH_2$—$CH_2$—OH | —$CH_3$ | —$CH_3$ | —$CH_2$—$CH_2$— |
| 626 | —$CH_2$—CH(OH)—$CH_3$ | —$CH_3$ | —$CH_3$ | —$CH_2$—$CH_2$— |
| 627 | —CH(OH)—$CH_2$—$CH_3$ | —$CH_3$ | —$CH_3$ | —$CH_2$—$CH_2$— |
| 628 | —H | —$CH_3$ | —$CH_2$—$CH_3$ | —$CH_2$—$CH_2$— |
| 629 | —$CH_3$ | —$CH_3$ | —$CH_2$—$CH_3$ | —$CH_2$—$CH_2$— |
| 630 | —$CH_2$—$CH_3$ | —$CH_3$ | —$CH_2$—$CH_3$ | —$CH_2$—$CH_2$— |
| 631 | —$CH_2$—$CH_2$—$CH_3$ | —$CH_3$ | —$CH_2$—$CH_3$ | —$CH_2$—$CH_2$— |
| 632 | —$CH(CH_3)$—$CH_3$ | —$CH_3$ | —$CH_2$—$CH_3$ | —$CH_2$—$CH_2$— |
| 633 | —$CH_2$—OH | —$CH_3$ | —$CH_2$—$CH_3$ | —$CH_2$—$CH_2$— |
| 634 | —$CH_2$—$CH_2$—OH | —$CH_3$ | —$CH_2$—$CH_3$ | —$CH_2$—$CH_2$— |
| 635 | —CH(OH)—$CH_3$ | —$CH_3$ | —$CH_2$—$CH_3$ | —$CH_2$—$CH_2$— |
| 636 | —$CH_2$—$CH_2$—$CH_2$—OH | —$CH_3$ | —$CH_2$—$CH_3$ | —$CH_2$—$CH_2$— |
| 637 | —$CH_2$—CH(OH)—$CH_3$ | —$CH_3$ | —$CH_2$—$CH_3$ | —$CH_2$—$CH_2$— |
| 638 | —CH(OH)—$CH_2$—$CH_3$ | —$CH_3$ | —$CH_2$—$CH_3$ | —$CH_2$—$CH_2$— |
| 639 | —H | —$CH_3$ | —$CH_2$—$CH_2$—$CH_3$ | —$CH_2$—$CH_2$— |
| 640 | —$CH_3$ | —$CH_3$ | —$CH_2$—$CH_2$—$CH_3$ | —$CH_2$—$CH_2$— |
| 641 | —$CH_2$—$CH_3$ | —$CH_3$ | —$CH_2$—$CH_2$—$CH_3$ | —$CH_2$—$CH_2$— |
| 642 | —$CH_2$—$CH_2$—$CH_3$ | —$CH_3$ | —$CH_2$—$CH_2$—$CH_3$ | —$CH_2$—$CH_2$— |
| 643 | —$CH(CH_3)$—$CH_3$ | —$CH_3$ | —$CH_2$—$CH_2$—$CH_3$ | —$CH_2$—$CH_2$— |
| 644 | —$CH_2$—OH | —$CH_3$ | —$CH_2$—$CH_2$—$CH_3$ | —$CH_2$—$CH_2$— |
| 645 | —$CH_2$—$CH_2$—OH | —$CH_3$ | —$CH_2$—$CH_2$—$CH_3$ | —$CH_2$—$CH_2$— |
| 646 | —CH(OH)—$CH_3$ | —$CH_3$ | —$CH_2$—$CH_2$—$CH_3$ | —$CH_2$—$CH_2$— |
| 647 | —$CH_2$—$CH_2$—$CH_2$—OH | —$CH_3$ | —$CH_2$—$CH_2$—$CH_3$ | —$CH_2$—$CH_2$— |
| 648 | —$CH_2$—CH(OH)—$CH_3$ | —$CH_3$ | —$CH_2$—$CH_2$—$CH_3$ | —$CH_2$—$CH_2$— |
| 649 | —CH(OH)—$CH_2$—$CH_3$ | —$CH_3$ | —$CH_2$—$CH_2$—$CH_3$ | —$CH_2$—$CH_2$— |
| 650 | —H | —$CH_3$ | —$CH(CH_3)$—$CH_3$ | —$CH_2$—$CH_2$— |
| 651 | —$CH_3$ | —$CH_3$ | —$CH(CH_3)$—$CH_3$ | —$CH_2$—$CH_2$— |
| 652 | —$CH_2$—$CH_3$ | —$CH_3$ | —$CH(CH_3)$—$CH_3$ | —$CH_2$—$CH_2$— |
| 653 | —$CH_2$—$CH_2$—$CH_3$ | —$CH_3$ | —$CH(CH_3)$—$CH_3$ | —$CH_2$—$CH_2$— |
| 654 | —$CH(CH_3)$—$CH_3$ | —$CH_3$ | —$CH(CH_3)$—$CH_3$ | —$CH_2$—$CH_2$— |
| 655 | —$CH_2$—OH | —$CH_3$ | —$CH(CH_3)$—$CH_3$ | —$CH_2$—$CH_2$— |

-continued

| No. | $R^5$ | $R^6$ | $R^7$ | X |
|---|---|---|---|---|
| 656 | —$CH_2$—$CH_2$—OH | —$CH_3$ | —CH($CH_3$)—$CH_3$ | —$CH_2$—$CH_2$— |
| 657 | —CH(OH)—$CH_3$ | —$CH_3$ | —CH($CH_3$)—$CH_3$ | —$CH_2$—$CH_2$— |
| 658 | —$CH_2$—$CH_2$—$CH_2$—OH | —$CH_3$ | —CH($CH_3$)—$CH_3$ | —$CH_2$—$CH_2$— |
| 659 | —$CH_2$—CH(OH)—$CH_3$ | —$CH_3$ | —CH($CH_3$)—$CH_3$ | —$CH_2$—$CH_2$— |
| 660 | —CH(OH)—$CH_2$—$CH_3$ | —$CH_3$ | —CH($CH_3$)—$CH_3$ | —$CH_2$—$CH_2$— |
| 661 | —H | —$CH_2$—$CH_3$ | —H | —$CH_2$—$CH_2$— |
| 662 | —$CH_3$ | —$CH_2$—$CH_3$ | —H | —$CH_2$—$CH_2$— |
| 663 | —$CH_2$—$CH_3$ | —$CH_2$—$CH_3$ | —H | —$CH_2$—$CH_2$— |
| 664 | —$CH_2$—$CH_2$—$CH_3$ | —$CH_2$—$CH_3$ | —H | —$CH_2$—$CH_2$— |
| 665 | —CH($CH_3$)—$CH_3$ | —$CH_2$—$CH_3$ | —H | —$CH_2$—$CH_2$— |
| 666 | —$CH_2$—OH | —$CH_2$—$CH_3$ | —H | —$CH_2$—$CH_2$— |
| 667 | —$CH_2$—$CH_2$—OH | —$CH_2$—$CH_3$ | —H | —$CH_2$—$CH_2$— |
| 668 | —CH(OH)—$CH_3$ | —$CH_2$—$CH_3$ | —H | —$CH_2$—$CH_2$— |
| 669 | —$CH_2$—$CH_2$—$CH_2$—OH | —$CH_2$—$CH_3$ | —H | —$CH_2$—$CH_2$— |
| 670 | —$CH_2$—CH(OH)—$CH_3$ | —$CH_2$—$CH_3$ | —H | —$CH_2$—$CH_2$— |
| 671 | —CH(OH)—$CH_2$—$CH_3$ | —$CH_2$—$CH_3$ | —H | —$CH_2$—$CH_2$— |
| 672 | —H | —$CH_2$—$CH_3$ | —$CH_3$ | —$CH_2$—$CH_2$— |
| 673 | —$CH_3$ | —$CH_2$—$CH_3$ | —$CH_3$ | —$CH_2$—$CH_2$— |
| 674 | —$CH_2$—$CH_3$ | —$CH_2$—$CH_3$ | —$CH_3$ | —$CH_2$—$CH_2$— |
| 675 | —$CH_2$—$CH_2$—$CH_3$ | —$CH_2$—$CH_3$ | —$CH_3$ | —$CH_2$—$CH_2$— |
| 676 | —CH($CH_3$)—$CH_3$ | —$CH_2$—$CH_3$ | —$CH_3$ | —$CH_2$—$CH_2$— |
| 677 | —$CH_2$—OH | —$CH_2$—$CH_3$ | —$CH_3$ | —$CH_2$—$CH_2$— |
| 678 | —$CH_2$—$CH_2$—OH | —$CH_2$—$CH_3$ | —$CH_3$ | —$CH_2$—$CH_2$— |
| 679 | —CH(OH)—$CH_3$ | —$CH_2$—$CH_3$ | —$CH_3$ | —$CH_2$—$CH_2$— |
| 680 | —$CH_2$—$CH_2$—$CH_2$—OH | —$CH_2$—$CH_3$ | —$CH_3$ | —$CH_2$—$CH_2$— |
| 681 | —$CH_2$—CH(OH)—$CH_3$ | —$CH_2$—$CH_3$ | —$CH_3$ | —$CH_2$—$CH_2$— |
| 682 | —CH(OH)—$CH_2$—$CH_3$ | —$CH_2$—$CH_3$ | —$CH_3$ | —$CH_2$—$CH_2$— |
| 683 | —H | —$CH_2$—$CH_3$ | —$CH_2$—$CH_3$ | —$CH_2$—$CH_2$— |
| 684 | —$CH_3$ | —$CH_2$—$CH_3$ | —$CH_2$—$CH_3$ | —$CH_2$—$CH_2$— |
| 685 | —$CH_2$—$CH_3$ | —$CH_2$—$CH_3$ | —$CH_2$—$CH_3$ | —$CH_2$—$CH_2$— |
| 686 | —$CH_2$—$CH_2$—$CH_3$ | —$CH_2$—$CH_3$ | —$CH_2$—$CH_3$ | —$CH_2$—$CH_2$— |
| 687 | —CH($CH_3$)—$CH_3$ | —$CH_2$—$CH_3$ | —$CH_2$—$CH_3$ | —$CH_2$—$CH_2$— |
| 688 | —$CH_2$—OH | —$CH_2$—$CH_3$ | —$CH_2$—$CH_3$ | —$CH_2$—$CH_2$— |
| 689 | —$CH_2$—$CH_2$—OH | —$CH_2$—$CH_3$ | —$CH_2$—$CH_3$ | —$CH_2$—$CH_2$— |
| 690 | —CH(OH)—$CH_3$ | —$CH_2$—$CH_3$ | —$CH_2$—$CH_3$ | —$CH_2$—$CH_2$— |
| 691 | —$CH_2$—$CH_2$—$CH_2$—OH | —$CH_2$—$CH_3$ | —$CH_2$—$CH_3$ | —$CH_2$—$CH_2$— |
| 692 | —$CH_2$—CH(OH)—$CH_3$ | —$CH_2$—$CH_3$ | —$CH_2$—$CH_3$ | —$CH_2$—$CH_2$— |
| 693 | —CH(OH)—$CH_2$—$CH_3$ | —$CH_2$—$CH_3$ | —$CH_2$—$CH_3$ | —$CH_2$—$CH_2$— |
| 694 | —H | —$CH_2$—$CH_3$ | —$CH_2$—$CH_2$—$CH_3$ | —$CH_2$—$CH_2$— |
| 695 | —$CH_3$ | —$CH_2$—$CH_3$ | —$CH_2$—$CH_2$—$CH_3$ | —$CH_2$—$CH_2$— |
| 696 | —$CH_2$—$CH_3$ | —$CH_2$—$CH_3$ | —$CH_2$—$CH_2$—$CH_3$ | —$CH_2$—$CH_2$— |
| 697 | —$CH_2$—$CH_2$—$CH_3$ | —$CH_2$—$CH_3$ | —$CH_2$—$CH_2$—$CH_3$ | —$CH_2$—$CH_2$— |
| 698 | —CH($CH_3$)—$CH_3$ | —$CH_2$—$CH_3$ | —$CH_2$—$CH_2$—$CH_3$ | —$CH_2$—$CH_2$— |
| 699 | —$CH_2$—OH | —$CH_2$—$CH_3$ | —$CH_2$—$CH_2$—$CH_3$ | —$CH_2$—$CH_2$— |
| 700 | —$CH_2$—$CH_2$—OH | —$CH_2$—$CH_3$ | —$CH_2$—$CH_2$—$CH_3$ | —$CH_2$—$CH_2$— |
| 701 | —CH(OH)—$CH_3$ | —$CH_2$—$CH_3$ | —$CH_2$—$CH_2$—$CH_3$ | —$CH_2$—$CH_2$— |
| 702 | —$CH_2$—$CH_2$—$CH_2$—OH | —$CH_2$—$CH_3$ | —$CH_2$—$CH_2$—$CH_3$ | —$CH_2$—$CH_2$— |
| 703 | —$CH_2$—CH(OH)—$CH_3$ | —$CH_2$—$CH_3$ | —$CH_2$—$CH_2$—$CH_3$ | —$CH_2$—$CH_2$— |
| 704 | —CH(OH)—$CH_2$—$CH_3$ | —$CH_2$—$CH_3$ | —$CH_2$—$CH_2$—$CH_3$ | —$CH_2$—$CH_2$— |
| 705 | —H | —$CH_2$—$CH_3$ | —CH($CH_3$)—$CH_3$ | —$CH_2$—$CH_2$— |
| 706 | —$CH_3$ | —$CH_2$—$CH_3$ | —CH($CH_3$)—$CH_3$ | —$CH_2$—$CH_2$— |
| 707 | —$CH_2$—$CH_3$ | —$CH_2$—$CH_3$ | —CH($CH_3$)—$CH_3$ | —$CH_2$—$CH_2$— |
| 708 | —$CH_2$—$CH_2$—$CH_3$ | —$CH_2$—$CH_3$ | —CH($CH_3$)—$CH_3$ | —$CH_2$—$CH_2$— |
| 709 | —CH($CH_3$)—$CH_3$ | —$CH_2$—$CH_3$ | —CH($CH_3$)—$CH_3$ | —$CH_2$—$CH_2$— |
| 710 | —$CH_2$—OH | —$CH_2$—$CH_3$ | —CH($CH_3$)—$CH_3$ | —$CH_2$—$CH_2$— |
| 711 | —$CH_2$—$CH_2$—OH | —$CH_2$—$CH_3$ | —CH($CH_3$)—$CH_3$ | —$CH_2$—$CH_2$— |
| 712 | —CH(OH)—$CH_3$ | —$CH_2$—$CH_3$ | —CH($CH_3$)—$CH_3$ | —$CH_2$—$CH_2$— |
| 713 | —$CH_2$—$CH_2$—$CH_2$—OH | —$CH_2$—$CH_3$ | —CH($CH_3$)—$CH_3$ | —$CH_2$—$CH_2$— |
| 714 | —$CH_2$—CH(OH)—$CH_3$ | —$CH_2$—$CH_3$ | —CH($CH_3$)—$CH_3$ | —$CH_2$—$CH_2$— |
| 715 | —CH(OH)—$CH_2$—$CH_3$ | —$CH_2$—$CH_3$ | —CH($CH_3$)—$CH_3$ | —$CH_2$—$CH_2$— |
| 716 | —H | —$CH_2$—$CH_2$—$CH_3$ | —H | —$CH_2$—$CH_2$— |
| 717 | —$CH_3$ | —$CH_2$—$CH_2$—$CH_3$ | —H | —$CH_2$—$CH_2$— |
| 718 | —$CH_2$—$CH_3$ | —$CH_2$—$CH_2$—$CH_3$ | —H | —$CH_2$—$CH_2$— |
| 719 | —$CH_2$—$CH_2$—$CH_3$ | —$CH_2$—$CH_2$—$CH_3$ | —H | —$CH_2$—$CH_2$— |
| 720 | —CH($CH_3$)—$CH_3$ | —$CH_2$—$CH_2$—$CH_3$ | —H | —$CH_2$—$CH_2$— |
| 721 | —$CH_2$—OH | —$CH_2$—$CH_2$—$CH_3$ | —H | —$CH_2$—$CH_2$— |
| 722 | —$CH_2$—$CH_2$—OH | —$CH_2$—$CH_2$—$CH_3$ | —H | —$CH_2$—$CH_2$— |
| 723 | —CH(OH)—$CH_3$ | —$CH_2$—$CH_2$—$CH_3$ | —H | —$CH_2$—$CH_2$— |
| 724 | —$CH_2$—$CH_2$—$CH_2$—OH | —$CH_2$—$CH_2$—$CH_3$ | —H | —$CH_2$—$CH_2$— |
| 725 | —$CH_2$—CH(OH)—$CH_3$ | —$CH_2$—$CH_2$—$CH_3$ | —H | —$CH_2$—$CH_2$— |
| 726 | —CH(OH)—$CH_2$—$CH_3$ | —$CH_2$—$CH_2$—$CH_3$ | —H | —$CH_2$—$CH_2$— |
| 727 | —H | —$CH_2$—$CH_2$—$CH_3$ | —$CH_3$ | —$CH_2$—$CH_2$— |
| 728 | —$CH_3$ | —$CH_2$—$CH_2$—$CH_3$ | —$CH_3$ | —$CH_2$—$CH_2$— |
| 729 | —$CH_2$—$CH_3$ | —$CH_2$—$CH_2$—$CH_3$ | —$CH_3$ | —$CH_2$—$CH_2$— |
| 730 | —$CH_2$—$CH_2$—$CH_3$ | —$CH_2$—$CH_2$—$CH_3$ | —$CH_3$ | —$CH_2$—$CH_2$— |
| 731 | —CH($CH_3$)—$CH_3$ | —$CH_2$—$CH_2$—$CH_3$ | —$CH_3$ | —$CH_2$—$CH_2$— |
| 732 | —$CH_2$—OH | —$CH_2$—$CH_2$—$CH_3$ | —$CH_3$ | —$CH_2$—$CH_2$— |

-continued

| No. | $R^5$ | $R^6$ | $R^7$ | X |
|---|---|---|---|---|
| 733 | —$CH_2$—$CH_2$—OH | —$CH_2$—$CH_2$—$CH_3$ | —$CH_3$ | —$CH_2$—$CH_2$— |
| 734 | —CH(OH)—$CH_3$ | —$CH_2$—$CH_2$—$CH_3$ | —$CH_3$ | —$CH_2$—$CH_2$— |
| 735 | —$CH_2$—$CH_2$—$CH_2$—OH | —$CH_2$—$CH_2$—$CH_3$ | —$CH_3$ | —$CH_2$—$CH_2$— |
| 736 | —$CH_2$—CH(OH)—$CH_3$ | —$CH_2$—$CH_2$—$CH_3$ | —$CH_3$ | —$CH_2$—$CH_2$— |
| 737 | —CH(OH)—$CH_2$—$CH_3$ | —$CH_2$—$CH_2$—$CH_3$ | —$CH_3$ | —$CH_2$—$CH_2$— |
| 738 | —H | —$CH_2$—$CH_2$—$CH_3$ | —$CH_2$—$CH_3$ | —$CH_2$—$CH_2$— |
| 739 | —$CH_3$ | —$CH_2$—$CH_2$—$CH_3$ | —$CH_2$—$CH_3$ | —$CH_2$—$CH_2$— |
| 740 | —$CH_2$—$CH_3$ | —$CH_2$—$CH_2$—$CH_3$ | —$CH_2$—$CH_3$ | —$CH_2$—$CH_2$— |
| 741 | —$CH_2$—$CH_2$—$CH_3$ | —$CH_2$—$CH_2$—$CH_3$ | —$CH_2$—$CH_3$ | —$CH_2$—$CH_2$— |
| 742 | —$CH(CH_3)$—$CH_3$ | —$CH_2$—$CH_2$—$CH_3$ | —$CH_2$—$CH_3$ | —$CH_2$—$CH_2$— |
| 743 | —$CH_2$—OH | —$CH_2$—$CH_2$—$CH_3$ | —$CH_2$—$CH_3$ | —$CH_2$—$CH_2$— |
| 744 | —$CH_2$—$CH_2$—OH | —$CH_2$—$CH_2$—$CH_3$ | —$CH_2$—$CH_3$ | —$CH_2$—$CH_2$— |
| 745 | —CH(OH)—$CH_3$ | —$CH_2$—$CH_2$—$CH_3$ | —$CH_2$—$CH_3$ | —$CH_2$—$CH_2$— |
| 746 | —$CH_2$—$CH_2$—$CH_2$—OH | —$CH_2$—$CH_2$—$CH_3$ | —$CH_2$—$CH_3$ | —$CH_2$—$CH_2$— |
| 747 | —$CH_2$—CH(OH)—$CH_3$ | —$CH_2$—$CH_2$—$CH_3$ | —$CH_2$—$CH_3$ | —$CH_2$—$CH_2$— |
| 748 | —CH(OH)—$CH_2$—$CH_3$ | —$CH_2$—$CH_2$—$CH_3$ | —$CH_2$—$CH_3$ | —$CH_2$—$CH_2$— |
| 749 | —H | —$CH_2$—$CH_2$—$CH_3$ | —$CH_2$—$CH_2$—$CH_3$ | —$CH_2$—$CH_2$— |
| 750 | —$CH_3$ | —$CH_2$—$CH_2$—$CH_3$ | —$CH_2$—$CH_2$—$CH_3$ | —$CH_2$—$CH_2$— |
| 751 | —$CH_2$—$CH_3$ | —$CH_2$—$CH_2$—$CH_3$ | —$CH_2$—$CH_2$—$CH_3$ | —$CH_2$—$CH_2$— |
| 752 | —$CH_2$—$CH_2$—$CH_3$ | —$CH_2$—$CH_2$—$CH_3$ | —$CH_2$—$CH_2$—$CH_3$ | —$CH_2$—$CH_2$— |
| 753 | —$CH(CH_3)$—$CH_3$ | —$CH_2$—$CH_2$—$CH_3$ | —$CH_2$—$CH_2$—$CH_3$ | —$CH_2$—$CH_2$— |
| 754 | —$CH_2$—OH | —$CH_2$—$CH_2$—$CH_3$ | —$CH_2$—$CH_2$—$CH_3$ | —$CH_2$—$CH_2$— |
| 755 | —$CH_2$—$CH_2$—OH | —$CH_2$—$CH_2$—$CH_3$ | —$CH_2$—$CH_2$—$CH_3$ | —$CH_2$—$CH_2$— |
| 756 | —CH(OH)—$CH_3$ | —$CH_2$—$CH_2$—$CH_3$ | —$CH_2$—$CH_2$—$CH_3$ | —$CH_2$—$CH_2$— |
| 757 | —$CH_2$—$CH_2$—$CH_2$—OH | —$CH_2$—$CH_2$—$CH_3$ | —$CH_2$—$CH_2$—$CH_3$ | —$CH_2$—$CH_2$— |
| 758 | —$CH_2$—CH(OH)—$CH_3$ | —$CH_2$—$CH_2$—$CH_3$ | —$CH_2$—$CH_2$—$CH_3$ | —$CH_2$—$CH_2$— |
| 759 | —CH(OH)—$CH_2$—$CH_3$ | —$CH_2$—$CH_2$—$CH_3$ | —$CH_2$—$CH_2$—$CH_3$ | —$CH_2$—$CH_2$— |
| 760 | —H | —$CH_2$—$CH_2$—$CH_3$ | —$CH(CH_3)$—$CH_3$ | —$CH_2$—$CH_2$— |
| 761 | —$CH_3$ | —$CH_2$—$CH_2$—$CH_3$ | —$CH(CH_3)$—$CH_3$ | —$CH_2$—$CH_2$— |
| 762 | —$CH_2$—$CH_3$ | —$CH_2$—$CH_2$—$CH_3$ | —$CH(CH_3)$—$CH_3$ | —$CH_2$—$CH_2$— |
| 763 | —$CH_2$—$CH_2$—$CH_3$ | —$CH_2$—$CH_2$—$CH_3$ | —$CH(CH_3)$—$CH_3$ | —$CH_2$—$CH_2$— |
| 764 | —$CH(CH_3)$—$CH_3$ | —$CH_2$—$CH_2$—$CH_3$ | —$CH(CH_3)$—$CH_3$ | —$CH_2$—$CH_2$— |
| 765 | —$CH_2$—OH | —$CH_2$—$CH_2$—$CH_3$ | —$CH(CH_3)$—$CH_3$ | —$CH_2$—$CH_2$— |
| 766 | —$CH_2$—$CH_2$—OH | —$CH_2$—$CH_2$—$CH_3$ | —$CH(CH_3)$—$CH_3$ | —$CH_2$—$CH_2$— |
| 767 | —CH(OH)—$CH_3$ | —$CH_2$—$CH_2$—$CH_3$ | —$CH(CH_3)$—$CH_3$ | —$CH_2$—$CH_2$— |
| 768 | —$CH_2$—$CH_2$—$CH_2$—OH | —$CH_2$—$CH_2$—$CH_3$ | —$CH(CH_3)$—$CH_3$ | —$CH_2$—$CH_2$— |
| 769 | —$CH_2$—CH(OH)—$CH_3$ | —$CH_2$—$CH_2$—$CH_3$ | —$CH(CH_3)$—$CH_3$ | —$CH_2$—$CH_2$— |
| 770 | —CH(OH)—$CH_2$—$CH_3$ | —$CH_2$—$CH_2$—$CH_3$ | —$CH(CH_3)$—$CH_3$ | —$CH_2$—$CH_2$— |
| 771 | —H | —$CH(CH_3)$—$CH_3$ | —H | —$CH_2$—$CH_2$— |
| 772 | —$CH_3$ | —$CH(CH_3)$—$CH_3$ | —H | —$CH_2$—$CH_2$— |
| 773 | —$CH_2$—$CH_3$ | —$CH(CH_3)$—$CH_3$ | —H | —$CH_2$—$CH_2$— |
| 774 | —$CH_2$—$CH_2$—$CH_3$ | —$CH(CH_3)$—$CH_3$ | —H | —$CH_2$—$CH_2$— |
| 775 | —$CH(CH_3)$—$CH_3$ | —$CH(CH_3)$—$CH_3$ | —H | —$CH_2$—$CH_2$— |
| 776 | —$CH_2$—OH | —$CH(CH_3)$—$CH_3$ | —H | —$CH_2$—$CH_2$— |
| 777 | —$CH_2$—$CH_2$—OH | —$CH(CH_3)$—$CH_3$ | —H | —$CH_2$—$CH_2$— |
| 778 | —CH(OH)—$CH_3$ | —$CH(CH_3)$—$CH_3$ | —H | —$CH_2$—$CH_2$— |
| 779 | —$CH_2$—$CH_2$—$CH_2$—OH | —$CH(CH_3)$—$CH_3$ | —H | —$CH_2$—$CH_2$— |
| 780 | —$CH_2$—CH(OH)—$CH_3$ | —$CH(CH_3)$—$CH_3$ | —H | —$CH_2$—$CH_2$— |
| 781 | —CH(OH)—$CH_2$—$CH_3$ | —$CH(CH_3)$—$CH_3$ | —H | —$CH_2$—$CH_2$— |
| 782 | —H | —$CH(CH_3)$—$CH_3$ | —$CH_3$ | —$CH_2$—$CH_2$— |
| 783 | —$CH_3$ | —$CH(CH_3)$—$CH_3$ | —$CH_3$ | —$CH_2$—$CH_2$— |
| 784 | —$CH_2$—$CH_3$ | —$CH(CH_3)$—$CH_3$ | —$CH_3$ | —$CH_2$—$CH_2$— |
| 785 | —$CH_2$—$CH_2$—$CH_3$ | —$CH(CH_3)$—$CH_3$ | —$CH_3$ | —$CH_2$—$CH_2$— |
| 786 | —$CH(CH_3)$—$CH_3$ | —$CH(CH_3)$—$CH_3$ | —$CH_3$ | —$CH_2$—$CH_2$— |
| 787 | —$CH_2$—OH | —$CH(CH_3)$—$CH_3$ | —$CH_3$ | —$CH_2$—$CH_2$— |
| 788 | —$CH_2$—$CH_2$—OH | —$CH(CH_3)$—$CH_3$ | —$CH_3$ | —$CH_2$—$CH_2$— |
| 789 | —CH(OH)—$CH_3$ | —$CH(CH_3)$—$CH_3$ | —$CH_3$ | —$CH_2$—$CH_2$— |
| 790 | —$CH_2$—$CH_2$—$CH_2$—OH | —$CH(CH_3)$—$CH_3$ | —$CH_3$ | —$CH_2$—$CH_2$— |
| 791 | —$CH_2$—CH(OH)—$CH_3$ | —$CH(CH_3)$—$CH_3$ | —$CH_3$ | —$CH_2$—$CH_2$— |
| 792 | —CH(OH)—$CH_2$—$CH_3$ | —$CH(CH_3)$—$CH_3$ | —$CH_3$ | —$CH_2$—$CH_2$— |
| 793 | —H | —$CH(CH_3)$—$CH_3$ | —$CH_2$—$CH_3$ | —$CH_2$—$CH_2$— |
| 794 | —$CH_3$ | —$CH(CH_3)$—$CH_3$ | —$CH_2$—$CH_3$ | —$CH_2$—$CH_2$— |
| 795 | —$CH_2$—$CH_3$ | —$CH(CH_3)$—$CH_3$ | —$CH_2$—$CH_3$ | —$CH_2$—$CH_2$— |
| 796 | —$CH_2$—$CH_2$—$CH_3$ | —$CH(CH_3)$—$CH_3$ | —$CH_2$—$CH_3$ | —$CH_2$—$CH_2$— |
| 797 | —$CH(CH_3)$—$CH_3$ | —$CH(CH_3)$—$CH_3$ | —$CH_2$—$CH_3$ | —$CH_2$—$CH_2$— |
| 798 | —$CH_2$—OH | —$CH(CH_3)$—$CH_3$ | —$CH_2$—$CH_3$ | —$CH_2$—$CH_2$— |
| 799 | —$CH_2$—$CH_2$—OH | —$CH(CH_3)$—$CH_3$ | —$CH_2$—$CH_3$ | —$CH_2$—$CH_2$— |
| 800 | —CH(OH)—$CH_3$ | —$CH(CH_3)$—$CH_3$ | —$CH_2$—$CH_3$ | —$CH_2$—$CH_2$— |
| 801 | —$CH_2$—$CH_2$—$CH_2$—OH | —$CH(CH_3)$—$CH_3$ | —$CH_2$—$CH_3$ | —$CH_2$—$CH_2$— |
| 802 | —$CH_2$—CH(OH)—$CH_3$ | —$CH(CH_3)$—$CH_3$ | —$CH_2$—$CH_3$ | —$CH_2$—$CH_2$— |
| 803 | —CH(OH)—$CH_2$—$CH_3$ | —$CH(CH_3)$—$CH_3$ | —$CH_2$—$CH_3$ | —$CH_2$—$CH_2$— |
| 804 | —H | —$CH(CH_3)$—$CH_3$ | —$CH_2$—$CH_2$—$CH_3$ | —$CH_2$—$CH_2$— |
| 805 | —$CH_3$ | —$CH(CH_3)$—$CH_3$ | —$CH_2$—$CH_2$—$CH_3$ | —$CH_2$—$CH_2$— |
| 806 | —$CH_2$—$CH_3$ | —$CH(CH_3)$—$CH_3$ | —$CH_2$—$CH_2$—$CH_3$ | —$CH_2$—$CH_2$— |
| 807 | —$CH_2$—$CH_2$—$CH_3$ | —$CH(CH_3)$—$CH_3$ | —$CH_2$—$CH_2$—$CH_3$ | —$CH_2$—$CH_2$— |
| 808 | —$CH(CH_3)$—$CH_3$ | —$CH(CH_3)$—$CH_3$ | —$CH_2$—$CH_2$—$CH_3$ | —$CH_2$—$CH_2$— |
| 809 | —$CH_2$—OH | —$CH(CH_3)$—$CH_3$ | —$CH_2$—$CH_2$—$CH_3$ | —$CH_2$—$CH_2$— |

-continued

| No. | $R^5$ | $R^6$ | $R^7$ | X |
|---|---|---|---|---|
| 810 | —$CH_2$—$CH_2$—OH | —$CH(CH_3)$—$CH_3$ | —$CH_2$—$CH_2$—$CH_3$ | —$CH_2$—$CH_2$— |
| 811 | —CH(OH)—$CH_3$ | —$CH(CH_3)$—$CH_3$ | —$CH_2$—$CH_2$—$CH_3$ | —$CH_2$—$CH_2$— |
| 812 | —$CH_2$—$CH_2$—$CH_2$—OH | —$CH(CH_3)$—$CH_3$ | —$CH_2$—$CH_2$—$CH_3$ | —$CH_2$—$CH_2$— |
| 813 | —$CH_2$—CH(OH)—$CH_3$ | —$CH(CH_3)$—$CH_3$ | —$CH_2$—$CH_2$—$CH_3$ | —$CH_2$—$CH_2$— |
| 814 | —CH(OH)—$CH_2$—$CH_3$ | —$CH(CH_3)$—$CH_3$ | —$CH_2$—$CH_2$—$CH_3$ | —$CH_2$—$CH_2$— |
| 815 | —H | —$CH(CH_3)$—$CH_3$ | —$CH(CH_3)$—$CH_3$ | —$CH_2$—$CH_2$— |
| 816 | —$CH_3$ | —$CH(CH_3)$—$CH_3$ | —$CH(CH_3)$—$CH_3$ | —$CH_2$—$CH_2$— |
| 817 | —$CH_2$—$CH_3$ | —$CH(CH_3)$—$CH_3$ | —$CH(CH_3)$—$CH_3$ | —$CH_2$—$CH_2$— |
| 818 | —$CH_2$—$CH_2$—$CH_3$ | —$CH(CH_3)$—$CH_3$ | —$CH(CH_3)$—$CH_3$ | —$CH_2$—$CH_2$— |
| 819 | —$CH(CH_3)$—$CH_3$ | —$CH(CH_3)$—$CH_3$ | —$CH(CH_3)$—$CH_3$ | —$CH_2$—$CH_2$— |
| 820 | —$CH_2$—OH | —$CH(CH_3)$—$CH_3$ | —$CH(CH_3)$—$CH_3$ | —$CH_2$—$CH_2$— |
| 821 | —$CH_2$—$CH_2$—OH | —$CH(CH_3)$—$CH_3$ | —$CH(CH_3)$—$CH_3$ | —$CH_2$—$CH_2$— |
| 822 | —CH(OH)—$CH_3$ | —$CH(CH_3)$—$CH_3$ | —$CH(CH_3)$—$CH_3$ | —$CH_2$—$CH_2$— |
| 823 | —$CH_2$—$CH_2$—$CH_2$—OH | —$CH(CH_3)$—$CH_3$ | —$CH(CH_3)$—$CH_3$ | —$CH_2$—$CH_2$— |
| 824 | —$CH_2$—CH(OH)—$CH_3$ | —$CH(CH_3)$—$CH_3$ | —$CH(CH_3)$—$CH_3$ | —$CH_2$—$CH_2$— |
| 825 | —CH(OH)—$CH_2$—$CH_3$ | —$CH(CH_3)$—$CH_3$ | —$CH(CH_3)$—$CH_3$ | —$CH_2$—$CH_2$— |
| 826 | —H | —H | —H | —$CH_2$—$CH_2$—$CH_2$— |
| 827 | —$CH_3$ | —H | —H | —$CH_2$—$CH_2$—$CH_2$— |
| 828 | —$CH_2$—$CH_3$ | —H | —H | —$CH_2$—$CH_2$—$CH_2$— |
| 829 | —$CH_2$—$CH_2$—$CH_3$ | —H | —H | —$CH_2$—$CH_2$—$CH_2$— |
| 830 | —$CH(CH_3)$—$CH_3$ | —H | —H | —$CH_2$—$CH_2$—$CH_2$— |
| 831 | —$CH_2$—OH | —H | —H | —$CH_2$—$CH_2$—$CH_2$— |
| 832 | —$CH_2$—$CH_2$—OH | —H | —H | —$CH_2$—$CH_2$—$CH_2$— |
| 833 | —CH(OH)—$CH_3$ | —H | —H | —$CH_2$—$CH_2$—$CH_2$— |
| 834 | —$CH_2$—$CH_2$—$CH_2$—OH | —H | —H | —$CH_2$—$CH_2$—$CH_2$— |
| 835 | —$CH_2$—CH(OH)—$CH_3$ | —H | —H | —$CH_2$—$CH_2$—$CH_2$— |
| 836 | —CH(OH)—$CH_2$—$CH_3$ | —H | —H | —$CH_2$—$CH_2$—$CH_2$— |
| 837 | —H | —H | —$CH_3$ | —$CH_2$—$CH_2$—$CH_2$— |
| 838 | —$CH_3$ | —H | —$CH_3$ | —$CH_2$—$CH_2$—$CH_2$— |
| 839 | —$CH_2$—$CH_3$ | —H | —$CH_3$ | —$CH_2$—$CH_2$—$CH_2$— |
| 840 | —$CH_2$—$CH_2$—$CH_3$ | —H | —$CH_3$ | —$CH_2$—$CH_2$—$CH_2$— |
| 841 | —$CH(CH_3)$—$CH_3$ | —H | —$CH_3$ | —$CH_2$—$CH_2$—$CH_2$— |
| 842 | —$CH_2$—OH | —H | —$CH_3$ | —$CH_2$—$CH_2$—$CH_2$— |
| 843 | —$CH_2$—$CH_2$—OH | —H | —$CH_3$ | —$CH_2$—$CH_2$—$CH_2$— |
| 844 | —CH(OH)—$CH_3$ | —H | —$CH_3$ | —$CH_2$—$CH_2$—$CH_2$— |
| 845 | —$CH_2$—$CH_2$—$CH_2$—OH | —H | —$CH_3$ | —$CH_2$—$CH_2$—$CH_2$— |
| 846 | —$CH_2$—CH(OH)—$CH_3$ | —H | —$CH_3$ | —$CH_2$—$CH_2$—$CH_2$— |
| 847 | —CH(OH)—$CH_2$—$CH_3$ | —H | —$CH_3$ | —$CH_2$—$CH_2$—$CH_2$— |
| 848 | —H | —H | —$CH_2$—$CH_3$ | —$CH_2$—$CH_2$—$CH_2$— |
| 849 | —$CH_3$ | —H | —$CH_2$—$CH_3$ | —$CH_2$—$CH_2$—$CH_2$— |
| 850 | —$CH_2$—$CH_3$ | —H | —$CH_2$—$CH_3$ | —$CH_2$—$CH_2$—$CH_2$— |
| 851 | —$CH_2$—$CH_2$—$CH_3$ | —H | —$CH_2$—$CH_3$ | —$CH_2$—$CH_2$—$CH_2$— |
| 852 | —$CH(CH_3)$—$CH_3$ | —H | —$CH_2$—$CH_3$ | —$CH_2$—$CH_2$—$CH_2$— |
| 853 | —$CH_2$—OH | —H | —$CH_2$—$CH_3$ | —$CH_2$—$CH_2$—$CH_2$— |
| 854 | —$CH_2$—$CH_2$—OH | —H | —$CH_2$—$CH_3$ | —$CH_2$—$CH_2$—$CH_2$— |
| 855 | —CH(OH)—$CH_3$ | —H | —$CH_2$—$CH_3$ | —$CH_2$—$CH_2$—$CH_2$— |
| 856 | —$CH_2$—$CH_2$—$CH_2$—OH | —H | —$CH_2$—$CH_3$ | —$CH_2$—$CH_2$—$CH_2$— |
| 857 | —$CH_2$—CH(OH)—$CH_3$ | —H | —$CH_2$—$CH_3$ | —$CH_2$—$CH_2$—$CH_2$— |
| 858 | —CH(OH)—$CH_2$—$CH_3$ | —H | —$CH_2$—$CH_3$ | —$CH_2$—$CH_2$—$CH_2$— |
| 859 | —H | —H | —$CH_2$—$CH_2$—$CH_3$ | —$CH_2$—$CH_2$—$CH_2$— |
| 860 | —$CH_3$ | —H | —$CH_2$—$CH_2$—$CH_3$ | —$CH_2$—$CH_2$—$CH_2$— |
| 861 | —$CH_2$—$CH_3$ | —H | —$CH_2$—$CH_2$—$CH_3$ | —$CH_2$—$CH_2$—$CH_2$— |
| 862 | —$CH_2$—$CH_2$—$CH_3$ | —H | —$CH_2$—$CH_2$—$CH_3$ | —$CH_2$—$CH_2$—$CH_2$— |
| 863 | —$CH(CH_3)$—$CH_3$ | —H | —$CH_2$—$CH_2$—$CH_3$ | —$CH_2$—$CH_2$—$CH_2$— |
| 864 | —$CH_2$—OH | —H | —$CH_2$—$CH_2$—$CH_3$ | —$CH_2$—$CH_2$—$CH_2$— |
| 865 | —$CH_2$—$CH_2$—OH | —H | —$CH_2$—$CH_2$—$CH_3$ | —$CH_2$—$CH_2$—$CH_2$— |
| 866 | —CH(OH)—$CH_3$ | —H | —$CH_2$—$CH_2$—$CH_3$ | —$CH_2$—$CH_2$—$CH_2$— |
| 867 | —$CH_2$—$CH_2$—$CH_2$—OH | —H | —$CH_2$—$CH_2$—$CH_3$ | —$CH_2$—$CH_2$—$CH_2$— |
| 868 | —$CH_2$—CH(OH)—$CH_3$ | —H | —$CH_2$—$CH_2$—$CH_3$ | —$CH_2$—$CH_2$—$CH_2$— |
| 869 | —CH(OH)—$CH_2$—$CH_3$ | —H | —$CH_2$—$CH_2$—$CH_3$ | —$CH_2$—$CH_2$—$CH_2$— |
| 870 | —H | —H | —$CH(CH_3)$—$CH_3$ | —$CH_2$—$CH_2$—$CH_2$— |
| 871 | —$CH_3$ | —H | —$CH(CH_3)$—$CH_3$ | —$CH_2$—$CH_2$—$CH_2$— |
| 872 | —$CH_2$—$CH_3$ | —H | —$CH(CH_3)$—$CH_3$ | —$CH_2$—$CH_2$—$CH_2$— |
| 873 | —$CH_2$—$CH_2$—$CH_3$ | —H | —$CH(CH_3)$—$CH_3$ | —$CH_2$—$CH_2$—$CH_2$— |
| 874 | —$CH(CH_3)$—$CH_3$ | —H | —$CH(CH_3)$—$CH_3$ | —$CH_2$—$CH_2$—$CH_2$— |
| 875 | —$CH_2$—OH | —H | —$CH(CH_3)$—$CH_3$ | —$CH_2$—$CH_2$—$CH_2$— |
| 876 | —$CH_2$—$CH_2$—OH | —H | —$CH(CH_3)$—$CH_3$ | —$CH_2$—$CH_2$—$CH_2$— |
| 877 | —CH(OH)—$CH_3$ | —H | —$CH(CH_3)$—$CH_3$ | —$CH_2$—$CH_2$—$CH_2$— |
| 878 | —$CH_2$—$CH_2$—$CH_2$—OH | —H | —$CH(CH_3)$—$CH_3$ | —$CH_2$—$CH_2$—$CH_2$— |
| 879 | —$CH_2$—CH(OH)—$CH_3$ | —H | —$CH(CH_3)$—$CH_3$ | —$CH_2$—$CH_2$—$CH_2$— |
| 880 | —CH(OH)—$CH_2$—$CH_3$ | —H | —$CH(CH_3)$—$CH_3$ | —$CH_2$—$CH_2$—$CH_2$— |
| 881 | —H | —$CH_3$ | —H | —$CH_2$—$CH_2$—$CH_2$— |
| 882 | —$CH_3$ | —$CH_3$ | —H | —$CH_2$—$CH_2$—$CH_2$— |
| 883 | —$CH_2$—$CH_3$ | —$CH_3$ | —H | —$CH_2$—$CH_2$—$CH_2$— |
| 884 | —$CH_2$—$CH_2$—$CH_3$ | —$CH_3$ | —H | —$CH_2$—$CH_2$—$CH_2$— |
| 885 | —$CH(CH_3)$—$CH_3$ | —$CH_3$ | —H | —$CH_2$—$CH_2$—$CH_2$— |
| 886 | —$CH_2$—OH | —$CH_3$ | —H | —$CH_2$—$CH_2$—$CH_2$— |

-continued

| No. | $R^5$ | $R^6$ | $R^7$ | X |
|---|---|---|---|---|
| 887 | —$CH_2$—$CH_2$—OH | —$CH_3$ | —H | —$CH_2$—$CH_2$—$CH_2$— |
| 888 | —CH(OH)—$CH_3$ | —$CH_3$ | —H | —$CH_2$—$CH_2$—$CH_2$— |
| 889 | —$CH_2$—$CH_2$—$CH_2$—OH | —$CH_3$ | —H | —$CH_2$—$CH_2$—$CH_2$— |
| 890 | —$CH_2$—CH(OH)—$CH_3$ | —$CH_3$ | —H | —$CH_2$—$CH_2$—$CH_2$— |
| 891 | —CH(OH)—$CH_2$—$CH_3$ | —$CH_3$ | —H | —$CH_2$—$CH_2$—$CH_2$— |
| 892 | —H | —$CH_3$ | —$CH_3$ | —$CH_2$—$CH_2$—$CH_2$— |
| 893 | —$CH_3$ | —$CH_3$ | —$CH_3$ | —$CH_2$—$CH_2$—$CH_2$— |
| 894 | —$CH_2$—$CH_3$ | —$CH_3$ | —$CH_3$ | —$CH_2$—$CH_2$—$CH_2$— |
| 895 | —$CH_2$—$CH_2$—$CH_3$ | —$CH_3$ | —$CH_3$ | —$CH_2$—$CH_2$—$CH_2$— |
| 896 | —$CH(CH_3)$—$CH_3$ | —$CH_3$ | —$CH_3$ | —$CH_2$—$CH_2$—$CH_2$— |
| 897 | —$CH_2$—OH | —$CH_3$ | —$CH_3$ | —$CH_2$—$CH_2$—$CH_2$— |
| 898 | —$CH_2$—$CH_2$—OH | —$CH_3$ | —$CH_3$ | —$CH_2$—$CH_2$—$CH_2$— |
| 899 | —CH(OH)—$CH_3$ | —$CH_3$ | —$CH_3$ | —$CH_2$—$CH_2$—$CH_2$— |
| 900 | —$CH_2$—$CH_2$—$CH_2$—OH | —$CH_3$ | —$CH_3$ | —$CH_2$—$CH_2$—$CH_2$— |
| 901 | —$CH_2$—CH(OH)—$CH_3$ | —$CH_3$ | —$CH_3$ | —$CH_2$—$CH_2$—$CH_2$— |
| 902 | —CH(OH)—$CH_2$—$CH_3$ | —$CH_3$ | —$CH_3$ | —$CH_2$—$CH_2$—$CH_2$— |
| 903 | —H | —$CH_3$ | —$CH_2$—$CH_3$ | —$CH_2$—$CH_2$—$CH_2$— |
| 904 | —$CH_3$ | —$CH_3$ | —$CH_2$—$CH_3$ | —$CH_2$—$CH_2$—$CH_2$— |
| 905 | —$CH_2$—$CH_3$ | —$CH_3$ | —$CH_2$—$CH_3$ | —$CH_2$—$CH_2$—$CH_2$— |
| 906 | —$CH_2$—$CH_2$—$CH_3$ | —$CH_3$ | —$CH_2$—$CH_3$ | —$CH_2$—$CH_2$—$CH_2$— |
| 907 | —$CH(CH_3)$—$CH_3$ | —$CH_3$ | —$CH_2$—$CH_3$ | —$CH_2$—$CH_2$—$CH_2$— |
| 908 | —$CH_2$—OH | —$CH_3$ | —$CH_2$—$CH_3$ | —$CH_2$—$CH_2$—$CH_2$— |
| 909 | —$CH_2$—$CH_2$—OH | —$CH_3$ | —$CH_2$—$CH_3$ | —$CH_2$—$CH_2$—$CH_2$— |
| 910 | —CH(OH)—$CH_3$ | —$CH_3$ | —$CH_2$—$CH_3$ | —$CH_2$—$CH_2$—$CH_2$— |
| 911 | —$CH_2$—$CH_2$—$CH_2$—OH | —$CH_3$ | —$CH_2$—$CH_3$ | —$CH_2$—$CH_2$—$CH_2$— |
| 912 | —$CH_2$—CH(OH)—$CH_3$ | —$CH_3$ | —$CH_2$—$CH_3$ | —$CH_2$—$CH_2$—$CH_2$— |
| 913 | —CH(OH)—$CH_2$—$CH_3$ | —$CH_3$ | —$CH_2$—$CH_3$ | —$CH_2$—$CH_2$—$CH_2$— |
| 914 | —H | —$CH_3$ | —$CH_2$—$CH_2$—$CH_3$ | —$CH_2$—$CH_2$—$CH_2$— |
| 915 | —$CH_3$ | —$CH_3$ | —$CH_2$—$CH_2$—$CH_3$ | —$CH_2$—$CH_2$—$CH_2$— |
| 916 | —$CH_2$—$CH_3$ | —$CH_3$ | —$CH_2$—$CH_2$—$CH_3$ | —$CH_2$—$CH_2$—$CH_2$— |
| 917 | —$CH_2$—$CH_2$—$CH_3$ | —$CH_3$ | —$CH_2$—$CH_2$—$CH_3$ | —$CH_2$—$CH_2$—$CH_2$— |
| 918 | —$CH(CH_3)$—$CH_3$ | —$CH_3$ | —$CH_2$—$CH_2$—$CH_3$ | —$CH_2$—$CH_2$—$CH_2$— |
| 919 | —$CH_2$—OH | —$CH_3$ | —$CH_2$—$CH_2$—$CH_3$ | —$CH_2$—$CH_2$—$CH_2$— |
| 920 | —$CH_2$—$CH_2$—OH | —$CH_3$ | —$CH_2$—$CH_2$—$CH_3$ | —$CH_2$—$CH_2$—$CH_2$— |
| 921 | —CH(OH)—$CH_3$ | —$CH_3$ | —$CH_2$—$CH_2$—$CH_3$ | —$CH_2$—$CH_2$—$CH_2$— |
| 922 | —$CH_2$—$CH_2$—$CH_2$—OH | —$CH_3$ | —$CH_2$—$CH_2$—$CH_3$ | —$CH_2$—$CH_2$—$CH_2$— |
| 923 | —$CH_2$—CH(OH)—$CH_3$ | —$CH_3$ | —$CH_2$—$CH_2$—$CH_3$ | —$CH_2$—$CH_2$—$CH_2$— |
| 924 | —CH(OH)—$CH_2$—$CH_3$ | —$CH_3$ | —$CH_2$—$CH_2$—$CH_3$ | —$CH_2$—$CH_2$—$CH_2$— |
| 925 | —H | —$CH_3$ | —$CH(CH_3)$—$CH_3$ | —$CH_2$—$CH_2$—$CH_2$— |
| 926 | —$CH_3$ | —$CH_3$ | —$CH(CH_3)$—$CH_3$ | —$CH_2$—$CH_2$—$CH_2$— |
| 927 | —$CH_2$—$CH_3$ | —$CH_3$ | —$CH(CH_3)$—$CH_3$ | —$CH_2$—$CH_2$—$CH_2$— |
| 928 | —$CH_2$—$CH_2$—$CH_3$ | —$CH_3$ | —$CH(CH_3)$—$CH_3$ | —$CH_2$—$CH_2$—$CH_2$— |
| 929 | —$CH(CH_3)$—$CH_3$ | —$CH_3$ | —$CH(CH_3)$—$CH_3$ | —$CH_2$—$CH_2$—$CH_2$— |
| 930 | —$CH_2$—OH | —$CH_3$ | —$CH(CH_3)$—$CH_3$ | —$CH_2$—$CH_2$—$CH_2$— |
| 931 | —$CH_2$—$CH_2$—OH | —$CH_3$ | —$CH(CH_3)$—$CH_3$ | —$CH_2$—$CH_2$—$CH_2$— |
| 932 | —CH(OH)—$CH_3$ | —$CH_3$ | —$CH(CH_3)$—$CH_3$ | —$CH_2$—$CH_2$—$CH_2$— |
| 933 | —$CH_2$—$CH_2$—$CH_2$—OH | —$CH_3$ | —$CH(CH_3)$—$CH_3$ | —$CH_2$—$CH_2$—$CH_2$— |
| 934 | —$CH_2$—CH(OH)—$CH_3$ | —$CH_3$ | —$CH(CH_3)$—$CH_3$ | —$CH_2$—$CH_2$—$CH_2$— |
| 935 | —CH(OH)—$CH_2$—$CH_3$ | —$CH_3$ | —$CH(CH_3)$—$CH_3$ | —$CH_2$—$CH_2$—$CH_2$— |
| 936 | —H | —$CH_2$—$CH_3$ | —H | —$CH_2$—$CH_2$—$CH_2$— |
| 937 | —$CH_3$ | —$CH_2$—$CH_3$ | —H | —$CH_2$—$CH_2$—$CH_2$— |
| 938 | —$CH_2$—$CH_3$ | —$CH_2$—$CH_3$ | —H | —$CH_2$—$CH_2$—$CH_2$— |
| 939 | —$CH_2$—$CH_2$—$CH_3$ | —$CH_2$—$CH_3$ | —H | —$CH_2$—$CH_2$—$CH_2$— |
| 940 | —$CH(CH_3)$—$CH_3$ | —$CH_2$—$CH_3$ | —H | —$CH_2$—$CH_2$—$CH_2$— |
| 941 | —$CH_2$—OH | —$CH_2$—$CH_3$ | —H | —$CH_2$—$CH_2$—$CH_2$— |
| 942 | —$CH_2$—$CH_2$—OH | —$CH_2$—$CH_3$ | —H | —$CH_2$—$CH_2$—$CH_2$— |
| 943 | —CH(OH)—$CH_3$ | —$CH_2$—$CH_3$ | —H | —$CH_2$—$CH_2$—$CH_2$— |
| 944 | —$CH_2$—$CH_2$—$CH_2$—OH | —$CH_2$—$CH_3$ | —H | —$CH_2$—$CH_2$—$CH_2$— |
| 945 | —$CH_2$—CH(OH)—$CH_3$ | —$CH_2$—$CH_3$ | —H | —$CH_2$—$CH_2$—$CH_2$— |
| 946 | —CH(OH)—$CH_2$—$CH_3$ | —$CH_2$—$CH_3$ | —H | —$CH_2$—$CH_2$—$CH_2$— |
| 947 | —H | —$CH_2$—$CH_3$ | —$CH_3$ | —$CH_2$—$CH_2$—$CH_2$— |
| 948 | —$CH_3$ | —$CH_2$—$CH_3$ | —$CH_3$ | —$CH_2$—$CH_2$—$CH_2$— |
| 949 | —$CH_2$—$CH_3$ | —$CH_2$—$CH_3$ | —$CH_3$ | —$CH_2$—$CH_2$—$CH_2$— |
| 950 | —$CH_2$—$CH_2$—$CH_3$ | —$CH_2$—$CH_3$ | —$CH_3$ | —$CH_2$—$CH_2$—$CH_2$— |
| 951 | —$CH(CH_3)$—$CH_3$ | —$CH_2$—$CH_3$ | —$CH_3$ | —$CH_2$—$CH_2$—$CH_2$— |
| 952 | —$CH_2$—OH | —$CH_2$—$CH_3$ | —$CH_3$ | —$CH_2$—$CH_2$—$CH_2$— |
| 953 | —$CH_2$—$CH_2$—OH | —$CH_2$—$CH_3$ | —$CH_3$ | —$CH_2$—$CH_2$—$CH_2$— |
| 954 | —CH(OH)—$CH_3$ | —$CH_2$—$CH_3$ | —$CH_3$ | —$CH_2$—$CH_2$—$CH_2$— |
| 955 | —$CH_2$—$CH_2$—$CH_2$—OH | —$CH_2$—$CH_3$ | —$CH_3$ | —$CH_2$—$CH_2$—$CH_2$— |
| 956 | —$CH_2$—CH(OH)—$CH_3$ | —$CH_2$—$CH_3$ | —$CH_3$ | —$CH_2$—$CH_2$—$CH_2$— |
| 957 | —CH(OH)—$CH_2$—$CH_3$ | —$CH_2$—$CH_3$ | —$CH_3$ | —$CH_2$—$CH_2$—$CH_2$— |
| 958 | —H | —$CH_2$—$CH_3$ | —$CH_2$—$CH_3$ | —$CH_2$—$CH_2$—$CH_2$— |
| 959 | —$CH_3$ | —$CH_2$—$CH_3$ | —$CH_2$—$CH_3$ | —$CH_2$—$CH_2$—$CH_2$— |
| 960 | —$CH_2$—$CH_3$ | —$CH_2$—$CH_3$ | —$CH_2$—$CH_3$ | —$CH_2$—$CH_2$—$CH_2$— |
| 961 | —$CH_2$—$CH_2$—$CH_3$ | —$CH_2$—$CH_3$ | —$CH_2$—$CH_3$ | —$CH_2$—$CH_2$—$CH_2$— |
| 962 | —$CH(CH_3)$—$CH_3$ | —$CH_2$—$CH_3$ | —$CH_2$—$CH_3$ | —$CH_2$—$CH_2$—$CH_2$— |
| 963 | —$CH_2$—OH | —$CH_2$—$CH_3$ | —$CH_2$—$CH_3$ | —$CH_2$—$CH_2$—$CH_2$— |

-continued

| No. | $R^5$ | $R^6$ | $R^7$ | X |
|---|---|---|---|---|
| 964 | —$CH_2$—$CH_2$—OH | —$CH_2$—$CH_3$ | —$CH_2$—$CH_3$ | —$CH_2$—$CH_2$—$CH_2$— |
| 965 | —CH(OH)—$CH_3$ | —$CH_2$—$CH_3$ | —$CH_2$—$CH_3$ | —$CH_2$—$CH_2$—$CH_2$— |
| 966 | —$CH_2$—$CH_2$—$CH_2$—OH | —$CH_2$—$CH_3$ | —$CH_2$—$CH_3$ | —$CH_2$—$CH_2$—$CH_2$— |
| 967 | —$CH_2$—CH(OH)—$CH_3$ | —$CH_2$—$CH_3$ | —$CH_2$—$CH_3$ | —$CH_2$—$CH_2$—$CH_2$— |
| 968 | —CH(OH)—$CH_2$—$CH_3$ | —$CH_2$—$CH_3$ | —$CH_2$—$CH_3$ | —$CH_2$—$CH_2$—$CH_2$— |
| 969 | —H | —$CH_2$—$CH_3$ | —$CH_2$—$CH_2$—$CH_3$ | —$CH_2$—$CH_2$—$CH_2$— |
| 970 | —$CH_3$ | —$CH_2$—$CH_3$ | —$CH_2$—$CH_2$—$CH_3$ | —$CH_2$—$CH_2$—$CH_2$— |
| 971 | —$CH_2$—$CH_3$ | —$CH_2$—$CH_3$ | —$CH_2$—$CH_2$—$CH_3$ | —$CH_2$—$CH_2$—$CH_2$— |
| 972 | —$CH_2$—$CH_2$—$CH_3$ | —$CH_2$—$CH_3$ | —$CH_2$—$CH_2$—$CH_3$ | —$CH_2$—$CH_2$—$CH_2$— |
| 973 | —$CH(CH_3)$—$CH_3$ | —$CH_2$—$CH_3$ | —$CH_2$—$CH_2$—$CH_3$ | —$CH_2$—$CH_2$—$CH_2$— |
| 974 | —$CH_2$—OH | —$CH_2$—$CH_3$ | —$CH_2$—$CH_2$—$CH_3$ | —$CH_2$—$CH_2$—$CH_2$— |
| 975 | —$CH_2$—$CH_2$—OH | —$CH_2$—$CH_3$ | —$CH_2$—$CH_2$—$CH_3$ | —$CH_2$—$CH_2$—$CH_2$— |
| 976 | —CH(OH)—$CH_3$ | —$CH_2$—$CH_3$ | —$CH_2$—$CH_2$—$CH_3$ | —$CH_2$—$CH_2$—$CH_2$— |
| 977 | —$CH_2$—$CH_2$—$CH_2$—OH | —$CH_2$—$CH_3$ | —$CH_2$—$CH_2$—$CH_3$ | —$CH_2$—$CH_2$—$CH_2$— |
| 978 | —$CH_2$—CH(OH)—$CH_3$ | —$CH_2$—$CH_3$ | —$CH_2$—$CH_2$—$CH_3$ | —$CH_2$—$CH_2$—$CH_2$— |
| 979 | —CH(OH)—$CH_2$—$CH_3$ | —$CH_2$—$CH_3$ | —$CH_2$—$CH_2$—$CH_3$ | —$CH_2$—$CH_2$—$CH_2$— |
| 980 | —H | —$CH_2$—$CH_3$ | —$CH(CH_3)$—$CH_3$ | —$CH_2$—$CH_2$—$CH_2$— |
| 981 | —$CH_3$ | —$CH_2$—$CH_3$ | —$CH(CH_3)$—$CH_3$ | —$CH_2$—$CH_2$—$CH_2$— |
| 982 | —$CH_2$—$CH_3$ | —$CH_2$—$CH_3$ | —$CH(CH_3)$—$CH_3$ | —$CH_2$—$CH_2$—$CH_2$— |
| 983 | —$CH_2$—$CH_2$—$CH_3$ | —$CH_2$—$CH_3$ | —$CH(CH_3)$—$CH_3$ | —$CH_2$—$CH_2$—$CH_2$— |
| 984 | —$CH(CH_3)$—$CH_3$ | —$CH_2$—$CH_3$ | —$CH(CH_3)$—$CH_3$ | —$CH_2$—$CH_2$—$CH_2$— |
| 985 | —$CH_2$—OH | —$CH_2$—$CH_3$ | —$CH(CH_3)$—$CH_3$ | —$CH_2$—$CH_2$—$CH_2$— |
| 986 | —$CH_2$—$CH_2$—OH | —$CH_2$—$CH_3$ | —$CH(CH_3)$—$CH_3$ | —$CH_2$—$CH_2$—$CH_2$— |
| 987 | —CH(OH)—$CH_3$ | —$CH_2$—$CH_3$ | —$CH(CH_3)$—$CH_3$ | —$CH_2$—$CH_2$—$CH_2$— |
| 988 | —$CH_2$—$CH_2$—$CH_2$—OH | —$CH_2$—$CH_3$ | —$CH(CH_3)$—$CH_3$ | —$CH_2$—$CH_2$—$CH_2$— |
| 989 | —$CH_2$—CH(OH)—$CH_3$ | —$CH_2$—$CH_3$ | —$CH(CH_3)$—$CH_3$ | —$CH_2$—$CH_2$—$CH_2$— |
| 990 | —CH(OH)—$CH_2$—$CH_3$ | —$CH_2$—$CH_3$ | —$CH(CH_3)$—$CH_3$ | —$CH_2$—$CH_2$—$CH_2$— |
| 991 | —H | —$CH_2$—$CH_2$—$CH_3$ | —H | —$CH_2$—$CH_2$—$CH_2$— |
| 992 | —$CH_3$ | —$CH_2$—$CH_2$—$CH_3$ | —H | —$CH_2$—$CH_2$—$CH_2$— |
| 993 | —$CH_2$—$CH_3$ | —$CH_2$—$CH_2$—$CH_3$ | —H | —$CH_2$—$CH_2$—$CH_2$— |
| 994 | —$CH_2$—$CH_2$—$CH_3$ | —$CH_2$—$CH_2$—$CH_3$ | —H | —$CH_2$—$CH_2$—$CH_2$— |
| 995 | —$CH(CH_3)$—$CH_3$ | —$CH_2$—$CH_2$—$CH_3$ | —H | —$CH_2$—$CH_2$—$CH_2$— |
| 996 | —$CH_2$—OH | —$CH_2$—$CH_2$—$CH_3$ | —H | —$CH_2$—$CH_2$—$CH_2$— |
| 997 | —$CH_2$—$CH_2$—OH | —$CH_2$—$CH_2$—$CH_3$ | —H | —$CH_2$—$CH_2$—$CH_2$— |
| 998 | —CH(OH)—$CH_3$ | —$CH_2$—$CH_2$—$CH_3$ | —H | —$CH_2$—$CH_2$—$CH_2$— |
| 999 | —$CH_2$—$CH_2$—$CH_2$—OH | —$CH_2$—$CH_2$—$CH_3$ | —H | —$CH_2$—$CH_2$—$CH_2$— |
| 1000 | —$CH_2$—CH(OH)—$CH_3$ | —$CH_2$—$CH_2$—$CH_3$ | —H | —$CH_2$—$CH_2$—$CH_2$— |
| 1001 | —CH(OH)—$CH_2$—$CH_3$ | —$CH_2$—$CH_2$—$CH_3$ | —H | —$CH_2$—$CH_2$—$CH_2$— |
| 1002 | —H | —$CH_2$—$CH_2$—$CH_3$ | —$CH_3$ | —$CH_2$—$CH_2$—$CH_2$— |
| 1003 | —$CH_3$ | —$CH_2$—$CH_2$—$CH_3$ | —$CH_3$ | —$CH_2$—$CH_2$—$CH_2$— |
| 1004 | —$CH_2$—$CH_3$ | —$CH_2$—$CH_2$—$CH_3$ | —$CH_3$ | —$CH_2$—$CH_2$—$CH_2$— |
| 1005 | —$CH_2$—$CH_2$—$CH_3$ | —$CH_2$—$CH_2$—$CH_3$ | —$CH_3$ | —$CH_2$—$CH_2$—$CH_2$— |
| 1006 | —$CH(CH_3)$—$CH_3$ | —$CH_2$—$CH_2$—$CH_3$ | —$CH_3$ | —$CH_2$—$CH_2$—$CH_2$— |
| 1007 | —$CH_2$—OH | —$CH_2$—$CH_2$—$CH_3$ | —$CH_3$ | —$CH_2$—$CH_2$—$CH_2$— |
| 1008 | —$CH_2$—$CH_2$—OH | —$CH_2$—$CH_2$—$CH_3$ | —$CH_3$ | —$CH_2$—$CH_2$—$CH_2$— |
| 1009 | —CH(OH)—$CH_3$ | —$CH_2$—$CH_2$—$CH_3$ | —$CH_3$ | —$CH_2$—$CH_2$—$CH_2$— |
| 1010 | —$CH_2$—$CH_2$—$CH_2$—OH | —$CH_2$—$CH_2$—$CH_3$ | —$CH_3$ | —$CH_2$—$CH_2$—$CH_2$— |
| 1011 | —$CH_2$—CH(OH)—$CH_3$ | —$CH_2$—$CH_2$—$CH_3$ | —$CH_3$ | —$CH_2$—$CH_2$—$CH_2$— |
| 1012 | —CH(OH)—$CH_2$—$CH_3$ | —$CH_2$—$CH_2$—$CH_3$ | —$CH_3$ | —$CH_2$—$CH_2$—$CH_2$— |
| 1013 | —H | —$CH_2$—$CH_2$—$CH_3$ | —$CH_2$—$CH_3$ | —$CH_2$—$CH_2$—$CH_2$— |
| 1014 | —$CH_3$ | —$CH_2$—$CH_2$—$CH_3$ | —$CH_2$—$CH_3$ | —$CH_2$—$CH_2$—$CH_2$— |
| 1015 | —$CH_2$—$CH_3$ | —$CH_2$—$CH_2$—$CH_3$ | —$CH_2$—$CH_3$ | —$CH_2$—$CH_2$—$CH_2$— |
| 1016 | —$CH_2$—$CH_2$—$CH_3$ | —$CH_2$—$CH_2$—$CH_3$ | —$CH_2$—$CH_3$ | —$CH_2$—$CH_2$—$CH_2$— |
| 1017 | —$CH(CH_3)$—$CH_3$ | —$CH_2$—$CH_2$—$CH_3$ | —$CH_2$—$CH_3$ | —$CH_2$—$CH_2$—$CH_2$— |
| 1018 | —$CH_2$—OH | —$CH_2$—$CH_2$—$CH_3$ | —$CH_2$—$CH_3$ | —$CH_2$—$CH_2$—$CH_2$— |
| 1019 | —$CH_2$—$CH_2$—OH | —$CH_2$—$CH_2$—$CH_3$ | —$CH_2$—$CH_3$ | —$CH_2$—$CH_2$—$CH_2$— |
| 1020 | —CH(OH)—$CH_3$ | —$CH_2$—$CH_2$—$CH_3$ | —$CH_2$—$CH_3$ | —$CH_2$—$CH_2$—$CH_2$— |
| 1021 | —$CH_2$—$CH_2$—$CH_2$—OH | —$CH_2$—$CH_2$—$CH_3$ | —$CH_2$—$CH_3$ | —$CH_2$—$CH_2$—$CH_2$— |
| 1022 | —$CH_2$—CH(OH)—$CH_3$ | —$CH_2$—$CH_2$—$CH_3$ | —$CH_2$—$CH_3$ | —$CH_2$—$CH_2$—$CH_2$— |
| 1023 | —CH(OH)—$CH_2$—$CH_3$ | —$CH_2$—$CH_2$—$CH_3$ | —$CH_2$—$CH_3$ | —$CH_2$—$CH_2$—$CH_2$— |
| 1024 | —H | —$CH_2$—$CH_2$—$CH_3$ | —$CH_2$—$CH_2$—$CH_3$ | —$CH_2$—$CH_2$—$CH_2$— |
| 1025 | —$CH_3$ | —$CH_2$—$CH_2$—$CH_3$ | —$CH_2$—$CH_2$—$CH_3$ | —$CH_2$—$CH_2$—$CH_2$— |
| 1026 | —$CH_2$—$CH_3$ | —$CH_2$—$CH_2$—$CH_3$ | —$CH_2$—$CH_2$—$CH_3$ | —$CH_2$—$CH_2$—$CH_2$— |
| 1027 | —$CH_2$—$CH_2$—$CH_3$ | —$CH_2$—$CH_2$—$CH_3$ | —$CH_2$—$CH_2$—$CH_3$ | —$CH_2$—$CH_2$—$CH_2$— |
| 1028 | —$CH(CH_3)$—$CH_3$ | —$CH_2$—$CH_2$—$CH_3$ | —$CH_2$—$CH_2$—$CH_3$ | —$CH_2$—$CH_2$—$CH_2$— |
| 1029 | —$CH_2$—OH | —$CH_2$—$CH_2$—$CH_3$ | —$CH_2$—$CH_2$—$CH_3$ | —$CH_2$—$CH_2$—$CH_2$— |
| 1030 | —$CH_2$—$CH_2$—OH | —$CH_2$—$CH_2$—$CH_3$ | —$CH_2$—$CH_2$—$CH_3$ | —$CH_2$—$CH_2$—$CH_2$— |
| 1031 | —CH(OH)—$CH_3$ | —$CH_2$—$CH_2$—$CH_3$ | —$CH_2$—$CH_2$—$CH_3$ | —$CH_2$—$CH_2$—$CH_2$— |
| 1032 | —$CH_2$—$CH_2$—$CH_2$—OH | —$CH_2$—$CH_2$—$CH_3$ | —$CH_2$—$CH_2$—$CH_3$ | —$CH_2$—$CH_2$—$CH_2$— |
| 1033 | —$CH_2$—CH(OH)—$CH_3$ | —$CH_2$—$CH_2$—$CH_3$ | —$CH_2$—$CH_2$—$CH_3$ | —$CH_2$—$CH_2$—$CH_2$— |
| 1034 | —CH(OH)—$CH_2$—$CH_3$ | —$CH_2$—$CH_2$—$CH_3$ | —$CH_2$—$CH_2$—$CH_3$ | —$CH_2$—$CH_2$—$CH_2$— |
| 1035 | —H | —$CH_2$—$CH_2$—$CH_3$ | —$CH(CH_3)$—$CH_3$ | —$CH_2$—$CH_2$—$CH_2$— |
| 1036 | —$CH_3$ | —$CH_2$—$CH_2$—$CH_3$ | —$CH(CH_3)$—$CH_3$ | —$CH_2$—$CH_2$—$CH_2$— |
| 1037 | —$CH_2$—$CH_3$ | —$CH_2$—$CH_2$—$CH_3$ | —$CH(CH_3)$—$CH_3$ | —$CH_2$—$CH_2$—$CH_2$— |
| 1038 | —$CH_2$—$CH_2$—$CH_3$ | —$CH_2$—$CH_2$—$CH_3$ | —$CH(CH_3)$—$CH_3$ | —$CH_2$—$CH_2$—$CH_2$— |
| 1039 | —$CH(CH_3)$—$CH_3$ | —$CH_2$—$CH_2$—$CH_3$ | —$CH(CH_3)$—$CH_3$ | —$CH_2$—$CH_2$—$CH_2$— |
| 1040 | —$CH_2$—OH | —$CH_2$—$CH_2$—$CH_3$ | —$CH(CH_3)$—$CH_3$ | —$CH_2$—$CH_2$—$CH_2$— |

-continued

| No. | $R^5$ | $R^6$ | $R^7$ | X |
|---|---|---|---|---|
| 1041 | —$CH_2$—$CH_2$—OH | —$CH_2$—$CH_2$—$CH_3$ | —$CH(CH_3)$—$CH_3$ | —$CH_2$—$CH_2$—$CH_2$— |
| 1042 | —CH(OH)—$CH_3$ | —$CH_2$—$CH_2$—$CH_3$ | —$CH(CH_3)$—$CH_3$ | —$CH_2$—$CH_2$—$CH_2$— |
| 1043 | —$CH_2$—$CH_2$—$CH_2$—OH | —$CH_2$—$CH_2$—$CH_3$ | —$CH(CH_3)$—$CH_3$ | —$CH_2$—$CH_2$—$CH_2$— |
| 1044 | —$CH_2$—CH(OH)—$CH_3$ | —$CH_2$—$CH_2$—$CH_3$ | —$CH(CH_3)$—$CH_3$ | —$CH_2$—$CH_2$—$CH_2$— |
| 1045 | —CH(OH)—$CH_2$—$CH_3$ | —$CH_2$—$CH_2$—$CH_3$ | —$CH(CH_3)$—$CH_3$ | —$CH_2$—$CH_2$—$CH_2$— |
| 1046 | —H | —$CH(CH_3)$—$CH_3$ | —H | —$CH_2$—$CH_2$—$CH_2$— |
| 1047 | —$CH_3$ | —$CH(CH_3)$—$CH_3$ | —H | —$CH_2$—$CH_2$—$CH_2$— |
| 1048 | —$CH_2$—$CH_3$ | —$CH(CH_3)$—$CH_3$ | —H | —$CH_2$—$CH_2$—$CH_2$— |
| 1049 | —$CH_2$—$CH_2$—$CH_3$ | —$CH(CH_3)$—$CH_3$ | —H | —$CH_2$—$CH_2$—$CH_2$— |
| 1050 | —$CH(CH_3)$—$CH_3$ | —$CH(CH_3)$—$CH_3$ | —H | —$CH_2$—$CH_2$—$CH_2$— |
| 1051 | —$CH_2$—OH | —$CH(CH_3)$—$CH_3$ | —H | —$CH_2$—$CH_2$—$CH_2$— |
| 1052 | —$CH_2$—$CH_2$—OH | —$CH(CH_3)$—$CH_3$ | —H | —$CH_2$—$CH_2$—$CH_2$— |
| 1053 | —CH(OH)—$CH_3$ | —$CH(CH_3)$—$CH_3$ | —H | —$CH_2$—$CH_2$—$CH_2$— |
| 1054 | —$CH_2$—$CH_2$—$CH_2$—OH | —$CH(CH_3)$—$CH_3$ | —H | —$CH_2$—$CH_2$—$CH_2$— |
| 1055 | —$CH_2$—CH(OH)—$CH_3$ | —$CH(CH_3)$—$CH_3$ | —H | —$CH_2$—$CH_2$—$CH_2$— |
| 1056 | —CH(OH)—$CH_2$—$CH_3$ | —$CH(CH_3)$—$CH_3$ | —H | —$CH_2$—$CH_2$—$CH_2$— |
| 1057 | —H | —$CH(CH_3)$—$CH_3$ | —$CH_3$ | —$CH_2$—$CH_2$—$CH_2$— |
| 1058 | —$CH_3$ | —$CH(CH_3)$—$CH_3$ | —$CH_3$ | —$CH_2$—$CH_2$—$CH_2$— |
| 1059 | —$CH_2$—$CH_3$ | —$CH(CH_3)$—$CH_3$ | —$CH_3$ | —$CH_2$—$CH_2$—$CH_2$— |
| 1060 | —$CH_2$—$CH_2$—$CH_3$ | —$CH(CH_3)$—$CH_3$ | —$CH_3$ | —$CH_2$—$CH_2$—$CH_2$— |
| 1061 | —$CH(CH_3)$—$CH_3$ | —$CH(CH_3)$—$CH_3$ | —$CH_3$ | —$CH_2$—$CH_2$—$CH_2$— |
| 1062 | —$CH_2$—OH | —$CH(CH_3)$—$CH_3$ | —$CH_3$ | —$CH_2$—$CH_2$—$CH_2$— |
| 1063 | —$CH_2$—$CH_2$—OH | —$CH(CH_3)$—$CH_3$ | —$CH_3$ | —$CH_2$—$CH_2$—$CH_2$— |
| 1064 | —CH(OH)—$CH_3$ | —$CH(CH_3)$—$CH_3$ | —$CH_3$ | —$CH_2$—$CH_2$—$CH_2$— |
| 1065 | —$CH_2$—$CH_2$—$CH_2$—OH | —$CH(CH_3)$—$CH_3$ | —$CH_3$ | —$CH_2$—$CH_2$—$CH_2$— |
| 1066 | —$CH_2$—CH(OH)—$CH_3$ | —$CH(CH_3)$—$CH_3$ | —$CH_3$ | —$CH_2$—$CH_2$—$CH_2$— |
| 1067 | —CH(OH)—$CH_2$—$CH_3$ | —$CH(CH_3)$—$CH_3$ | —$CH_3$ | —$CH_2$—$CH_2$—$CH_2$— |
| 1068 | —H | —$CH(CH_3)$—$CH_3$ | —$CH_2$—$CH_3$ | —$CH_2$—$CH_2$—$CH_2$— |
| 1069 | —$CH_3$ | —$CH(CH_3)$—$CH_3$ | —$CH_2$—$CH_3$ | —$CH_2$—$CH_2$—$CH_2$— |
| 1070 | —$CH_2$—$CH_3$ | —$CH(CH_3)$—$CH_3$ | —$CH_2$—$CH_3$ | —$CH_2$—$CH_2$—$CH_2$— |
| 1071 | —$CH_2$—$CH_2$—$CH_3$ | —$CH(CH_3)$—$CH_3$ | —$CH_2$—$CH_3$ | —$CH_2$—$CH_2$—$CH_2$— |
| 1072 | —$CH(CH_3)$—$CH_3$ | —$CH(CH_3)$—$CH_3$ | —$CH_2$—$CH_3$ | —$CH_2$—$CH_2$—$CH_2$— |
| 1073 | —$CH_2$—OH | —$CH(CH_3)$—$CH_3$ | —$CH_2$—$CH_3$ | —$CH_2$—$CH_2$—$CH_2$— |
| 1074 | —$CH_2$—$CH_2$—OH | —$CH(CH_3)$—$CH_3$ | —$CH_2$—$CH_3$ | —$CH_2$—$CH_2$—$CH_2$— |
| 1075 | —CH(OH)—$CH_3$ | —$CH(CH_3)$—$CH_3$ | —$CH_2$—$CH_3$ | —$CH_2$—$CH_2$—$CH_2$— |
| 1076 | —$CH_2$—$CH_2$—$CH_2$—OH | —$CH(CH_3)$—$CH_3$ | —$CH_2$—$CH_3$ | —$CH_2$—$CH_2$—$CH_2$— |
| 1077 | —$CH_2$—CH(OH)—$CH_3$ | —$CH(CH_3)$—$CH_3$ | —$CH_2$—$CH_3$ | —$CH_2$—$CH_2$—$CH_2$— |
| 1078 | —CH(OH)—$CH_2$—$CH_3$ | —$CH(CH_3)$—$CH_3$ | —$CH_2$—$CH_3$ | —$CH_2$—$CH_2$—$CH_2$— |
| 1079 | —H | —$CH(CH_3)$—$CH_3$ | —$CH_2$—$CH_2$—$CH_3$ | —$CH_2$—$CH_2$—$CH_2$— |
| 1080 | —$CH_3$ | —$CH(CH_3)$—$CH_3$ | —$CH_2$—$CH_2$—$CH_3$ | —$CH_2$—$CH_2$—$CH_2$— |
| 1081 | —$CH_2$—$CH_3$ | —$CH(CH_3)$—$CH_3$ | —$CH_2$—$CH_2$—$CH_3$ | —$CH_2$—$CH_2$—$CH_2$— |
| 1082 | —$CH_2$—$CH_2$—$CH_3$ | —$CH(CH_3)$—$CH_3$ | —$CH_2$—$CH_2$—$CH_3$ | —$CH_2$—$CH_2$—$CH_2$— |
| 1083 | —$CH(CH_3)$—$CH_3$ | —$CH(CH_3)$—$CH_3$ | —$CH_2$—$CH_2$—$CH_3$ | —$CH_2$—$CH_2$—$CH_2$— |
| 1084 | —$CH_2$—OH | —$CH(CH_3)$—$CH_3$ | —$CH_2$—$CH_2$—$CH_3$ | —$CH_2$—$CH_2$—$CH_2$— |
| 1085 | —$CH_2$—$CH_2$—OH | —$CH(CH_3)$—$CH_3$ | —$CH_2$—$CH_2$—$CH_3$ | —$CH_2$—$CH_2$—$CH_2$— |
| 1086 | —CH(OH)—$CH_3$ | —$CH(CH_3)$—$CH_3$ | —$CH_2$—$CH_2$—$CH_3$ | —$CH_2$—$CH_2$—$CH_2$— |
| 1087 | —$CH_2$—$CH_2$—$CH_2$—OH | —$CH(CH_3)$—$CH_3$ | —$CH_2$—$CH_2$—$CH_3$ | —$CH_2$—$CH_2$—$CH_2$— |
| 1088 | —$CH_2$—CH(OH)—$CH_3$ | —$CH(CH_3)$—$CH_3$ | —$CH_2$—$CH_2$—$CH_3$ | —$CH_2$—$CH_2$—$CH_2$— |
| 1089 | —CH(OH)—$CH_2$—$CH_3$ | —$CH(CH_3)$—$CH_3$ | —$CH_2$—$CH_2$—$CH_3$ | —$CH_2$—$CH_2$—$CH_2$— |
| 1090 | —H | —$CH(CH_3)$—$CH_3$ | —$CH(CH_3)$—$CH_3$ | —$CH_2$—$CH_2$—$CH_2$— |
| 1091 | —$CH_3$ | —$CH(CH_3)$—$CH_3$ | —$CH(CH_3)$—$CH_3$ | —$CH_2$—$CH_2$—$CH_2$— |
| 1092 | —$CH_2$—$CH_3$ | —$CH(CH_3)$—$CH_3$ | —$CH(CH_3)$—$CH_3$ | —$CH_2$—$CH_2$—$CH_2$— |
| 1093 | —$CH_2$—$CH_2$—$CH_3$ | —$CH(CH_3)$—$CH_3$ | —$CH(CH_3)$—$CH_3$ | —$CH_2$—$CH_2$—$CH_2$— |
| 1094 | —$CH(CH_3)$—$CH_3$ | —$CH(CH_3)$—$CH_3$ | —$CH(CH_3)$—$CH_3$ | —$CH_2$—$CH_2$—$CH_2$— |
| 1095 | —$CH_2$—OH | —$CH(CH_3)$—$CH_3$ | —$CH(CH_3)$—$CH_3$ | —$CH_2$—$CH_2$—$CH_2$— |
| 1096 | —$CH_2$—$CH_2$—OH | —$CH(CH_3)$—$CH_3$ | —$CH(CH_3)$—$CH_3$ | —$CH_2$—$CH_2$—$CH_2$— |
| 1097 | —CH(OH)—$CH_3$ | —$CH(CH_3)$—$CH_3$ | —$CH(CH_3)$—$CH_3$ | —$CH_2$—$CH_2$—$CH_2$— |
| 1098 | —$CH_2$—$CH_2$—$CH_2$—OH | —$CH(CH_3)$—$CH_3$ | —$CH(CH_3)$—$CH_3$ | —$CH_2$—$CH_2$—$CH_2$— |
| 1099 | —$CH_2$—CH(OH)—$CH_3$ | —$CH(CH_3)$—$CH_3$ | —$CH(CH_3)$—$CH_3$ | —$CH_2$—$CH_2$—$CH_2$— |
| 1100 | —CH(OH)—$CH_2$—$CH_3$ | —$CH(CH_3)$—$CH_3$ | —$CH(CH_3)$—$CH_3$ | —$CH_2$—$CH_2$—$CH_2$— |
| 1101 | —H | —H | —H | —$CH_2$—$CH_2$—$CH_2$—$CH_2$— |
| 1102 | —$CH_3$ | —H | —H | —$CH_2$—$CH_2$—$CH_2$—$CH_2$— |
| 1103 | —$CH_2$—$CH_3$ | —H | —H | —$CH_2$—$CH_2$—$CH_2$—$CH_2$— |
| 1104 | —$CH_2$—$CH_2$—$CH_3$ | —H | —H | —$CH_2$—$CH_2$—$CH_2$—$CH_2$— |
| 1105 | —$CH(CH_3)$—$CH_3$ | —H | —H | —$CH_2$—$CH_2$—$CH_2$—$CH_2$— |
| 1106 | —$CH_2$—OH | —H | —H | —$CH_2$—$CH_2$—$CH_2$—$CH_2$— |
| 1107 | —$CH_2$—$CH_2$—OH | —H | —H | —$CH_2$—$CH_2$—$CH_2$—$CH_2$— |
| 1108 | —CH(OH)—$CH_3$ | —H | —H | —$CH_2$—$CH_2$—$CH_2$—$CH_2$— |
| 1109 | —$CH_2$—$CH_2$—$CH_2$—OH | —H | —H | —$CH_2$—$CH_2$—$CH_2$—$CH_2$— |
| 1110 | —$CH_2$—CH(OH)—$CH_3$ | —H | —H | —$CH_2$—$CH_2$—$CH_2$—$CH_2$— |
| 1111 | —CH(OH)—$CH_2$—$CH_3$ | —H | —H | —$CH_2$—$CH_2$—$CH_2$—$CH_2$— |
| 1112 | —H | —H | —$CH_3$ | —$CH_2$—$CH_2$—$CH_2$—$CH_2$— |
| 1113 | —$CH_3$ | —H | —$CH_3$ | —$CH_2$—$CH_2$—$CH_2$—$CH_2$— |
| 1114 | —$CH_2$—$CH_3$ | —H | —$CH_3$ | —$CH_2$—$CH_2$—$CH_2$—$CH_2$— |
| 1115 | —$CH_2$—$CH_2$—$CH_3$ | —H | —$CH_3$ | —$CH_2$—$CH_2$—$CH_2$—$CH_2$— |
| 1116 | —$CH(CH_3)$—$CH_3$ | —H | —$CH_3$ | —$CH_2$—$CH_2$—$CH_2$—$CH_2$— |
| 1117 | —$CH_2$—OH | —H | —$CH_3$ | —$CH_2$—$CH_2$—$CH_2$—$CH_2$— |

-continued

| No. | $R^5$ | $R^6$ | $R^7$ | X |
|---|---|---|---|---|
| 1118 | —$CH_2$—$CH_2$—OH | —H | —$CH_3$ | —$CH_2$—$CH_2$—$CH_2$—$CH_2$— |
| 1119 | —CH(OH)—$CH_3$ | —H | —$CH_3$ | —$CH_2$—$CH_2$—$CH_2$—$CH_2$— |
| 1120 | —$CH_2$—$CH_2$—$CH_2$—OH | —H | —$CH_3$ | —$CH_2$—$CH_2$—$CH_2$—$CH_2$— |
| 1121 | —$CH_2$—CH(OH)—$CH_3$ | —H | —$CH_3$ | —$CH_2$—$CH_2$—$CH_2$—$CH_2$— |
| 1122 | —CH(OH)—$CH_2$—$CH_3$ | —H | —$CH_3$ | —$CH_2$—$CH_2$—$CH_2$—$CH_2$— |
| 1123 | —H | —H | —$CH_2$—$CH_3$ | —$CH_2$—$CH_2$—$CH_2$—$CH_2$— |
| 1124 | —$CH_3$ | —H | —$CH_2$—$CH_3$ | —$CH_2$—$CH_2$—$CH_2$—$CH_2$— |
| 1125 | —$CH_2$—$CH_3$ | —H | —$CH_2$—$CH_3$ | —$CH_2$—$CH_2$—$CH_2$—$CH_2$— |
| 1126 | —$CH_2$—$CH_2$—$CH_3$ | —H | —$CH_2$—$CH_3$ | —$CH_2$—$CH_2$—$CH_2$—$CH_2$— |
| 1127 | —$CH(CH_3)$—$CH_3$ | —H | —$CH_2$—$CH_3$ | —$CH_2$—$CH_2$—$CH_2$—$CH_2$— |
| 1128 | —$CH_2$—OH | —H | —$CH_2$—$CH_3$ | —$CH_2$—$CH_2$—$CH_2$—$CH_2$— |
| 1129 | —$CH_2$—$CH_2$—OH | —H | —$CH_2$—$CH_3$ | —$CH_2$—$CH_2$—$CH_2$—$CH_2$— |
| 1130 | —CH(OH)—$CH_3$ | —H | —$CH_2$—$CH_3$ | —$CH_2$—$CH_2$—$CH_2$—$CH_2$— |
| 1131 | —$CH_2$—$CH_2$—$CH_2$—OH | —H | —$CH_2$—$CH_3$ | —$CH_2$—$CH_2$—$CH_2$—$CH_2$— |
| 1132 | —$CH_2$—CH(OH)—$CH_3$ | —H | —$CH_2$—$CH_3$ | —$CH_2$—$CH_2$—$CH_2$—$CH_2$— |
| 1133 | —CH(OH)—$CH_2$—$CH_3$ | —H | —$CH_2$—$CH_3$ | —$CH_2$—$CH_2$—$CH_2$—$CH_2$— |
| 1134 | —H | —H | —$CH_2$—$CH_2$—$CH_3$ | —$CH_2$—$CH_2$—$CH_2$—$CH_2$— |
| 1135 | —$CH_3$ | —H | —$CH_2$—$CH_2$—$CH_3$ | —$CH_2$—$CH_2$—$CH_2$—$CH_2$— |
| 1136 | —$CH_2$—$CH_3$ | —H | —$CH_2$—$CH_2$—$CH_3$ | —$CH_2$—$CH_2$—$CH_2$—$CH_2$— |
| 1137 | —$CH_2$—$CH_2$—$CH_3$ | —H | —$CH_2$—$CH_2$—$CH_3$ | —$CH_2$—$CH_2$—$CH_2$—$CH_2$— |
| 1138 | —$CH(CH_3)$—$CH_3$ | —H | —$CH_2$—$CH_2$—$CH_3$ | —$CH_2$—$CH_2$—$CH_2$—$CH_2$— |
| 1139 | —$CH_2$—OH | —H | —$CH_2$—$CH_2$—$CH_3$ | —$CH_2$—$CH_2$—$CH_2$—$CH_2$— |
| 1140 | —$CH_2$—$CH_2$—OH | —H | —$CH_2$—$CH_2$—$CH_3$ | —$CH_2$—$CH_2$—$CH_2$—$CH_2$— |
| 1141 | —CH(OH)—$CH_3$ | —H | —$CH_2$—$CH_2$—$CH_3$ | —$CH_2$—$CH_2$—$CH_2$—$CH_2$— |
| 1142 | —$CH_2$—$CH_2$—$CH_2$—OH | —H | —$CH_2$—$CH_2$—$CH_3$ | —$CH_2$—$CH_2$—$CH_2$—$CH_2$— |
| 1143 | —$CH_2$—CH(OH)—$CH_3$ | —H | —$CH_2$—$CH_2$—$CH_3$ | —$CH_2$—$CH_2$—$CH_2$—$CH_2$— |
| 1144 | —CH(OH)—$CH_2$—$CH_3$ | —H | —$CH_2$—$CH_2$—$CH_3$ | —$CH_2$—$CH_2$—$CH_2$—$CH_2$— |
| 1145 | —H | —H | —$CH(CH_3)$—$CH_3$ | —$CH_2$—$CH_2$—$CH_2$—$CH_2$— |
| 1146 | —$CH_3$ | —H | —$CH(CH_3)$—$CH_3$ | —$CH_2$—$CH_2$—$CH_2$—$CH_2$— |
| 1147 | —$CH_2$—$CH_3$ | —H | —$CH(CH_3)$—$CH_3$ | —$CH_2$—$CH_2$—$CH_2$—$CH_2$— |
| 1148 | —$CH_2$—$CH_2$—$CH_3$ | —H | —$CH(CH_3)$—$CH_3$ | —$CH_2$—$CH_2$—$CH_2$—$CH_2$— |
| 1149 | —$CH(CH_3)$—$CH_3$ | —H | —$CH(CH_3)$—$CH_3$ | —$CH_2$—$CH_2$—$CH_2$—$CH_2$— |
| 1150 | —$CH_2$—OH | —H | —$CH(CH_3)$—$CH_3$ | —$CH_2$—$CH_2$—$CH_2$—$CH_2$— |
| 1151 | —$CH_2$—$CH_2$—OH | —H | —$CH(CH_3)$—$CH_3$ | —$CH_2$—$CH_2$—$CH_2$—$CH_2$— |
| 1152 | —CH(OH)—$CH_3$ | —H | —$CH(CH_3)$—$CH_3$ | —$CH_2$—$CH_2$—$CH_2$—$CH_2$— |
| 1153 | —$CH_2$—$CH_2$—$CH_2$—OH | —H | —$CH(CH_3)$—$CH_3$ | —$CH_2$—$CH_2$—$CH_2$—$CH_2$— |
| 1154 | —$CH_2$—CH(OH)—$CH_3$ | —H | —$CH(CH_3)$—$CH_3$ | —$CH_2$—$CH_2$—$CH_2$—$CH_2$— |
| 1155 | —CH(OH)—$CH_2$—$CH_3$ | —H | —$CH(CH_3)$—$CH_3$ | —$CH_2$—$CH_2$—$CH_2$—$CH_2$— |
| 1156 | —H | —$CH_3$ | —H | —$CH_2$—$CH_2$—$CH_2$—$CH_2$— |
| 1157 | —$CH_3$ | —$CH_3$ | —H | —$CH_2$—$CH_2$—$CH_2$—$CH_2$— |
| 1158 | —$CH_2$—$CH_3$ | —$CH_3$ | —H | —$CH_2$—$CH_2$—$CH_2$—$CH_2$— |
| 1159 | —$CH_2$—$CH_2$—$CH_3$ | —$CH_3$ | —H | —$CH_2$—$CH_2$—$CH_2$—$CH_2$— |
| 1160 | —$CH(CH_3)$—$CH_3$ | —$CH_3$ | —H | —$CH_2$—$CH_2$—$CH_2$—$CH_2$— |
| 1161 | —$CH_2$—OH | —$CH_3$ | —H | —$CH_2$—$CH_2$—$CH_2$—$CH_2$— |
| 1162 | —$CH_2$—$CH_2$—OH | —$CH_3$ | —H | —$CH_2$—$CH_2$—$CH_2$—$CH_2$— |
| 1163 | —CH(OH)—$CH_3$ | —$CH_3$ | —H | —$CH_2$—$CH_2$—$CH_2$—$CH_2$— |
| 1164 | —$CH_2$—$CH_2$—$CH_2$—OH | —$CH_3$ | —H | —$CH_2$—$CH_2$—$CH_2$—$CH_2$— |
| 1165 | —$CH_2$—CH(OH)—$CH_3$ | —$CH_3$ | —H | —$CH_2$—$CH_2$—$CH_2$—$CH_2$— |
| 1166 | —CH(OH)—$CH_2$—$CH_3$ | —$CH_3$ | —H | —$CH_2$—$CH_2$—$CH_2$—$CH_2$— |
| 1167 | —H | —$CH_3$ | —$CH_3$ | —$CH_2$—$CH_2$—$CH_2$—$CH_2$— |
| 1168 | —$CH_3$ | —$CH_3$ | —$CH_3$ | —$CH_2$—$CH_2$—$CH_2$—$CH_2$— |
| 1169 | —$CH_2$—$CH_3$ | —$CH_3$ | —$CH_3$ | —$CH_2$—$CH_2$—$CH_2$—$CH_2$— |
| 1170 | —$CH_2$—$CH_2$—$CH_3$ | —$CH_3$ | —$CH_3$ | —$CH_2$—$CH_2$—$CH_2$—$CH_2$— |
| 1171 | —$CH(CH_3)$—$CH_3$ | —$CH_3$ | —$CH_3$ | —$CH_2$—$CH_2$—$CH_2$—$CH_2$— |
| 1172 | —$CH_2$—OH | —$CH_3$ | —$CH_3$ | —$CH_2$—$CH_2$—$CH_2$—$CH_2$— |
| 1173 | —$CH_2$—$CH_2$—OH | —$CH_3$ | —$CH_3$ | —$CH_2$—$CH_2$—$CH_2$—$CH_2$— |
| 1174 | —CH(OH)—$CH_3$ | —$CH_3$ | —$CH_3$ | —$CH_2$—$CH_2$—$CH_2$—$CH_2$— |
| 1175 | —$CH_2$—$CH_2$—$CH_2$—OH | —$CH_3$ | —$CH_3$ | —$CH_2$—$CH_2$—$CH_2$—$CH_2$— |
| 1176 | —$CH_2$—CH(OH)—$CH_3$ | —$CH_3$ | —$CH_3$ | —$CH_2$—$CH_2$—$CH_2$—$CH_2$— |
| 1177 | —CH(OH)—$CH_2$—$CH_3$ | —$CH_3$ | —$CH_3$ | —$CH_2$—$CH_2$—$CH_2$—$CH_2$— |
| 1178 | —H | —$CH_3$ | —$CH_2$—$CH_3$ | —$CH_2$—$CH_2$—$CH_2$—$CH_2$— |
| 1179 | —$CH_3$ | —$CH_3$ | —$CH_2$—$CH_3$ | —$CH_2$—$CH_2$—$CH_2$—$CH_2$— |
| 1180 | —$CH_2$—$CH_3$ | —$CH_3$ | —$CH_2$—$CH_3$ | —$CH_2$—$CH_2$—$CH_2$—$CH_2$— |
| 1181 | —$CH_2$—$CH_2$—$CH_3$ | —$CH_3$ | —$CH_2$—$CH_3$ | —$CH_2$—$CH_2$—$CH_2$—$CH_2$— |
| 1182 | —$CH(CH_3)$—$CH_3$ | —$CH_3$ | —$CH_2$—$CH_3$ | —$CH_2$—$CH_2$—$CH_2$—$CH_2$— |
| 1183 | —$CH_2$—OH | —$CH_3$ | —$CH_2$—$CH_3$ | —$CH_2$—$CH_2$—$CH_2$—$CH_2$— |
| 1184 | —$CH_2$—$CH_2$—OH | —$CH_3$ | —$CH_2$—$CH_3$ | —$CH_2$—$CH_2$—$CH_2$—$CH_2$— |
| 1185 | —CH(OH)—$CH_3$ | —$CH_3$ | —$CH_2$—$CH_3$ | —$CH_2$—$CH_2$—$CH_2$—$CH_2$— |
| 1186 | —$CH_2$—$CH_2$—$CH_2$—OH | —$CH_3$ | —$CH_2$—$CH_3$ | —$CH_2$—$CH_2$—$CH_2$—$CH_2$— |
| 1187 | —$CH_2$—CH(OH)—$CH_3$ | —$CH_3$ | —$CH_2$—$CH_3$ | —$CH_2$—$CH_2$—$CH_2$—$CH_2$— |
| 1188 | —CH(OH)—$CH_2$—$CH_3$ | —$CH_3$ | —$CH_2$—$CH_3$ | —$CH_2$—$CH_2$—$CH_2$—$CH_2$— |
| 1189 | —H | —$CH_3$ | —$CH_2$—$CH_2$—$CH_3$ | —$CH_2$—$CH_2$—$CH_2$—$CH_2$— |
| 1190 | —$CH_3$ | —$CH_3$ | —$CH_2$—$CH_2$—$CH_3$ | —$CH_2$—$CH_2$—$CH_2$—$CH_2$— |
| 1191 | —$CH_2$—$CH_3$ | —$CH_3$ | —$CH_2$—$CH_2$—$CH_3$ | —$CH_2$—$CH_2$—$CH_2$—$CH_2$— |
| 1192 | —$CH_2$—$CH_2$—$CH_3$ | —$CH_3$ | —$CH_2$—$CH_2$—$CH_3$ | —$CH_2$—$CH_2$—$CH_2$—$CH_2$— |
| 1193 | —$CH(CH_3)$—$CH_3$ | —$CH_3$ | —$CH_2$—$CH_2$—$CH_3$ | —$CH_2$—$CH_2$—$CH_2$—$CH_2$— |
| 1194 | —$CH_2$—OH | —$CH_3$ | —$CH_2$—$CH_2$—$CH_3$ | —$CH_2$—$CH_2$—$CH_2$—$CH_2$— |

-continued

| No. | $R^5$ | $R^6$ | $R^7$ | X |
|---|---|---|---|---|
| 1195 | —$CH_2$—$CH_2$—OH | —$CH_3$ | —$CH_2$—$CH_2$—$CH_3$ | —$CH_2$—$CH_2$—$CH_2$—$CH_2$— |
| 1196 | —CH(OH)—$CH_3$ | —$CH_3$ | —$CH_2$—$CH_2$—$CH_3$ | —$CH_2$—$CH_2$—$CH_2$—$CH_2$— |
| 1197 | —$CH_2$—$CH_2$—$CH_2$—OH | —$CH_3$ | —$CH_2$—$CH_2$—$CH_3$ | —$CH_2$—$CH_2$—$CH_2$—$CH_2$— |
| 1198 | —$CH_2$—CH(OH)—$CH_3$ | —$CH_3$ | —$CH_2$—$CH_2$—$CH_3$ | —$CH_2$—$CH_2$—$CH_2$—$CH_2$— |
| 1199 | —CH(OH)—$CH_2$—$CH_3$ | —$CH_3$ | —$CH_2$—$CH_2$—$CH_3$ | —$CH_2$—$CH_2$—$CH_2$—$CH_2$— |
| 1200 | —H | —$CH_3$ | —CH($CH_3$)—$CH_3$ | —$CH_2$—$CH_2$—$CH_2$—$CH_2$— |
| 1201 | —$CH_3$ | —$CH_3$ | —CH($CH_3$)—$CH_3$ | —$CH_2$—$CH_2$—$CH_2$—$CH_2$— |
| 1202 | —$CH_2$—$CH_3$ | —$CH_3$ | —CH($CH_3$)—$CH_3$ | —$CH_2$—$CH_2$—$CH_2$—$CH_2$— |
| 1203 | —$CH_2$—$CH_2$—$CH_3$ | —$CH_3$ | —CH($CH_3$)—$CH_3$ | —$CH_2$—$CH_2$—$CH_2$—$CH_2$— |
| 1204 | —CH($CH_3$)—$CH_3$ | —$CH_3$ | —CH($CH_3$)—$CH_3$ | —$CH_2$—$CH_2$—$CH_2$—$CH_2$— |
| 1205 | —$CH_2$—OH | —$CH_3$ | —CH($CH_3$)—$CH_3$ | —$CH_2$—$CH_2$—$CH_2$—$CH_2$— |
| 1206 | —$CH_2$—$CH_2$—OH | —$CH_3$ | —CH($CH_3$)—$CH_3$ | —$CH_2$—$CH_2$—$CH_2$—$CH_2$— |
| 1207 | —CH(OH)—$CH_3$ | —$CH_3$ | —CH($CH_3$)—$CH_3$ | —$CH_2$—$CH_2$—$CH_2$—$CH_2$— |
| 1208 | —$CH_2$—$CH_2$—$CH_2$—OH | —$CH_3$ | —CH($CH_3$)—$CH_3$ | —$CH_2$—$CH_2$—$CH_2$—$CH_2$— |
| 1209 | —$CH_2$—CH(OH)—$CH_3$ | —$CH_3$ | —CH($CH_3$)—$CH_3$ | —$CH_2$—$CH_2$—$CH_2$—$CH_2$— |
| 1210 | —CH(OH)—$CH_2$—$CH_3$ | —$CH_3$ | —CH($CH_3$)—$CH_3$ | —$CH_2$—$CH_2$—$CH_2$—$CH_2$— |
| 1211 | —H | —$CH_2$—$CH_3$ | —H | —$CH_2$—$CH_2$—$CH_2$—$CH_2$— |
| 1212 | —$CH_3$ | —$CH_2$—$CH_3$ | —H | —$CH_2$—$CH_2$—$CH_2$—$CH_2$— |
| 1213 | —$CH_2$—$CH_3$ | —$CH_2$—$CH_3$ | —H | —$CH_2$—$CH_2$—$CH_2$—$CH_2$— |
| 1214 | —$CH_2$—$CH_2$—$CH_3$ | —$CH_2$—$CH_3$ | —H | —$CH_2$—$CH_2$—$CH_2$—$CH_2$— |
| 1215 | —CH($CH_3$)—$CH_3$ | —$CH_2$—$CH_3$ | —H | —$CH_2$—$CH_2$—$CH_2$—$CH_2$— |
| 1216 | —$CH_2$—OH | —$CH_2$—$CH_3$ | —H | —$CH_2$—$CH_2$—$CH_2$—$CH_2$— |
| 1217 | —$CH_2$—$CH_2$—OH | —$CH_2$—$CH_3$ | —H | —$CH_2$—$CH_2$—$CH_2$—$CH_2$— |
| 1218 | —CH(OH)—$CH_3$ | —$CH_2$—$CH_3$ | —H | —$CH_2$—$CH_2$—$CH_2$—$CH_2$— |
| 1219 | —$CH_2$—$CH_2$—$CH_2$—OH | —$CH_2$—$CH_3$ | —H | —$CH_2$—$CH_2$—$CH_2$—$CH_2$— |
| 1220 | —$CH_2$—CH(OH)—$CH_3$ | —$CH_2$—$CH_3$ | —H | —$CH_2$—$CH_2$—$CH_2$—$CH_2$— |
| 1221 | —CH(OH)—$CH_2$—$CH_3$ | —$CH_2$—$CH_3$ | —H | —$CH_2$—$CH_2$—$CH_2$—$CH_2$— |
| 1222 | —H | —$CH_2$—$CH_3$ | —$CH_3$ | —$CH_2$—$CH_2$—$CH_2$—$CH_2$— |
| 1223 | —$CH_3$ | —$CH_2$—$CH_3$ | —$CH_3$ | —$CH_2$—$CH_2$—$CH_2$—$CH_2$— |
| 1224 | —$CH_2$—$CH_3$ | —$CH_2$—$CH_3$ | —$CH_3$ | —$CH_2$—$CH_2$—$CH_2$—$CH_2$— |
| 1225 | —$CH_2$—$CH_2$—$CH_3$ | —$CH_2$—$CH_3$ | —$CH_3$ | —$CH_2$—$CH_2$—$CH_2$—$CH_2$— |
| 1226 | —CH($CH_3$)—$CH_3$ | —$CH_2$—$CH_3$ | —$CH_3$ | —$CH_2$—$CH_2$—$CH_2$—$CH_2$— |
| 1227 | —$CH_2$—OH | —$CH_2$—$CH_3$ | —$CH_3$ | —$CH_2$—$CH_2$—$CH_2$—$CH_2$— |
| 1228 | —$CH_2$—$CH_2$—OH | —$CH_2$—$CH_3$ | —$CH_3$ | —$CH_2$—$CH_2$—$CH_2$—$CH_2$— |
| 1229 | —CH(OH)—$CH_3$ | —$CH_2$—$CH_3$ | —$CH_3$ | —$CH_2$—$CH_2$—$CH_2$—$CH_2$— |
| 1230 | —$CH_2$—$CH_2$—$CH_2$—OH | —$CH_2$—$CH_3$ | —$CH_3$ | —$CH_2$—$CH_2$—$CH_2$—$CH_2$— |
| 1231 | —$CH_2$—CH(OH)—$CH_3$ | —$CH_2$—$CH_3$ | —$CH_3$ | —$CH_2$—$CH_2$—$CH_2$—$CH_2$— |
| 1232 | —CH(OH)—$CH_2$—$CH_3$ | —$CH_2$—$CH_3$ | —$CH_3$ | —$CH_2$—$CH_2$—$CH_2$—$CH_2$— |
| 1233 | —H | —$CH_2$—$CH_3$ | —$CH_2$—$CH_3$ | —$CH_2$—$CH_2$—$CH_2$—$CH_2$— |
| 1234 | —$CH_3$ | —$CH_2$—$CH_3$ | —$CH_2$—$CH_3$ | —$CH_2$—$CH_2$—$CH_2$—$CH_2$— |
| 1235 | —$CH_2$—$CH_3$ | —$CH_2$—$CH_3$ | —$CH_2$—$CH_3$ | —$CH_2$—$CH_2$—$CH_2$—$CH_2$— |
| 1236 | —$CH_2$—$CH_2$—$CH_3$ | —$CH_2$—$CH_3$ | —$CH_2$—$CH_3$ | —$CH_2$—$CH_2$—$CH_2$—$CH_2$— |
| 1237 | —CH($CH_3$)—$CH_3$ | —$CH_2$—$CH_3$ | —$CH_2$—$CH_3$ | —$CH_2$—$CH_2$—$CH_2$—$CH_2$— |
| 1238 | —$CH_2$—OH | —$CH_2$—$CH_3$ | —$CH_2$—$CH_3$ | —$CH_2$—$CH_2$—$CH_2$—$CH_2$— |
| 1239 | —$CH_2$—$CH_2$—OH | —$CH_2$—$CH_3$ | —$CH_2$—$CH_3$ | —$CH_2$—$CH_2$—$CH_2$—$CH_2$— |
| 1240 | —CH(OH)—$CH_3$ | —$CH_2$—$CH_3$ | —$CH_2$—$CH_3$ | —$CH_2$—$CH_2$—$CH_2$—$CH_2$— |
| 1241 | —$CH_2$—$CH_2$—$CH_2$—OH | —$CH_2$—$CH_3$ | —$CH_2$—$CH_3$ | —$CH_2$—$CH_2$—$CH_2$—$CH_2$— |
| 1242 | —$CH_2$—CH(OH)—$CH_3$ | —$CH_2$—$CH_3$ | —$CH_2$—$CH_3$ | —$CH_2$—$CH_2$—$CH_2$—$CH_2$— |
| 1243 | —CH(OH)—$CH_2$—$CH_3$ | —$CH_2$—$CH_3$ | —$CH_2$—$CH_3$ | —$CH_2$—$CH_2$—$CH_2$—$CH_2$— |
| 1244 | —H | —$CH_2$—$CH_3$ | —$CH_2$—$CH_2$—$CH_3$ | —$CH_2$—$CH_2$—$CH_2$—$CH_2$— |
| 1245 | —$CH_3$ | —$CH_2$—$CH_3$ | —$CH_2$—$CH_2$—$CH_3$ | —$CH_2$—$CH_2$—$CH_2$—$CH_2$— |
| 1246 | —$CH_2$—$CH_3$ | —$CH_2$—$CH_3$ | —$CH_2$—$CH_2$—$CH_3$ | —$CH_2$—$CH_2$—$CH_2$—$CH_2$— |
| 1247 | —$CH_2$—$CH_2$—$CH_3$ | —$CH_2$—$CH_3$ | —$CH_2$—$CH_2$—$CH_3$ | —$CH_2$—$CH_2$—$CH_2$—$CH_2$— |
| 1248 | —CH($CH_3$)—$CH_3$ | —$CH_2$—$CH_3$ | —$CH_2$—$CH_2$—$CH_3$ | —$CH_2$—$CH_2$—$CH_2$—$CH_2$— |
| 1249 | —$CH_2$—OH | —$CH_2$—$CH_3$ | —$CH_2$—$CH_2$—$CH_3$ | —$CH_2$—$CH_2$—$CH_2$—$CH_2$— |
| 1250 | —$CH_2$—$CH_2$—OH | —$CH_2$—$CH_3$ | —$CH_2$—$CH_2$—$CH_3$ | —$CH_2$—$CH_2$—$CH_2$—$CH_2$— |
| 1251 | —CH(OH)—$CH_3$ | —$CH_2$—$CH_3$ | —$CH_2$—$CH_2$—$CH_3$ | —$CH_2$—$CH_2$—$CH_2$—$CH_2$— |
| 1252 | —$CH_2$—$CH_2$—$CH_2$—OH | —$CH_2$—$CH_3$ | —$CH_2$—$CH_2$—$CH_3$ | —$CH_2$—$CH_2$—$CH_2$—$CH_2$— |
| 1253 | —$CH_2$—CH(OH)—$CH_3$ | —$CH_2$—$CH_3$ | —$CH_2$—$CH_2$—$CH_3$ | —$CH_2$—$CH_2$—$CH_2$—$CH_2$— |
| 1254 | —CH(OH)—$CH_2$—$CH_3$ | —$CH_2$—$CH_3$ | —$CH_2$—$CH_2$—$CH_3$ | —$CH_2$—$CH_2$—$CH_2$—$CH_2$— |
| 1255 | —H | —$CH_2$—$CH_3$ | —CH($CH_3$)—$CH_3$ | —$CH_2$—$CH_2$—$CH_2$—$CH_2$— |
| 1256 | —$CH_3$ | —$CH_2$—$CH_3$ | —CH($CH_3$)—$CH_3$ | —$CH_2$—$CH_2$—$CH_2$—$CH_2$— |
| 1257 | —$CH_2$—$CH_3$ | —$CH_2$—$CH_3$ | —CH($CH_3$)—$CH_3$ | —$CH_2$—$CH_2$—$CH_2$—$CH_2$— |
| 1258 | —$CH_2$—$CH_2$—$CH_3$ | —$CH_2$—$CH_3$ | —CH($CH_3$)—$CH_3$ | —$CH_2$—$CH_2$—$CH_2$—$CH_2$— |
| 1259 | —CH($CH_3$)—$CH_3$ | —$CH_2$—$CH_3$ | —CH($CH_3$)—$CH_3$ | —$CH_2$—$CH_2$—$CH_2$—$CH_2$— |
| 1260 | —$CH_2$—OH | —$CH_2$—$CH_3$ | —CH($CH_3$)—$CH_3$ | —$CH_2$—$CH_2$—$CH_2$—$CH_2$— |
| 1261 | —$CH_2$—$CH_2$—OH | —$CH_2$—$CH_3$ | —CH($CH_3$)—$CH_3$ | —$CH_2$—$CH_2$—$CH_2$—$CH_2$— |
| 1262 | —CH(OH)—$CH_3$ | —$CH_2$—$CH_3$ | —CH($CH_3$)—$CH_3$ | —$CH_2$—$CH_2$—$CH_2$—$CH_2$— |
| 1263 | —$CH_2$—$CH_2$—$CH_2$—OH | —$CH_2$—$CH_3$ | —CH($CH_3$)—$CH_3$ | —$CH_2$—$CH_2$—$CH_2$—$CH_2$— |
| 1264 | —$CH_2$—CH(OH)—$CH_3$ | —$CH_2$—$CH_3$ | —CH($CH_3$)—$CH_3$ | —$CH_2$—$CH_2$—$CH_2$—$CH_2$— |
| 1265 | —CH(OH)—$CH_2$—$CH_3$ | —$CH_2$—$CH_3$ | —CH($CH_3$)—$CH_3$ | —$CH_2$—$CH_2$—$CH_2$—$CH_2$— |
| 1266 | —H | —$CH_2$—$CH_2$—$CH_3$ | —H | —$CH_2$—$CH_2$—$CH_2$—$CH_2$— |
| 1267 | —$CH_3$ | —$CH_2$—$CH_2$—$CH_3$ | —H | —$CH_2$—$CH_2$—$CH_2$—$CH_2$— |
| 1268 | —$CH_2$—$CH_3$ | —$CH_2$—$CH_2$—$CH_3$ | —H | —$CH_2$—$CH_2$—$CH_2$—$CH_2$— |
| 1269 | —$CH_2$—$CH_2$—$CH_3$ | —$CH_2$—$CH_2$—$CH_3$ | —H | —$CH_2$—$CH_2$—$CH_2$—$CH_2$— |
| 1270 | —CH($CH_3$)—$CH_3$ | —$CH_2$—$CH_2$—$CH_3$ | —H | —$CH_2$—$CH_2$—$CH_2$—$CH_2$— |
| 1271 | —$CH_2$—OH | —$CH_2$—$CH_2$—$CH_3$ | —H | —$CH_2$—$CH_2$—$CH_2$—$CH_2$— |

-continued

| No. | $R^5$ | $R^6$ | $R^7$ | X |
|---|---|---|---|---|
| 1272 | —$CH_2$—$CH_2$—OH | —$CH_2$—$CH_2$—$CH_3$ | —H | —$CH_2$—$CH_2$—$CH_2$—$CH_2$— |
| 1273 | —CH(OH)—$CH_3$ | —$CH_2$—$CH_2$—$CH_3$ | —H | —$CH_2$—$CH_2$—$CH_2$—$CH_2$— |
| 1274 | —$CH_2$—$CH_2$—$CH_2$—OH | —$CH_2$—$CH_2$—$CH_3$ | —H | —$CH_2$—$CH_2$—$CH_2$—$CH_2$— |
| 1275 | —$CH_2$—CH(OH)—$CH_3$ | —$CH_2$—$CH_2$—$CH_3$ | —H | —$CH_2$—$CH_2$—$CH_2$—$CH_2$— |
| 1276 | —CH(OH)—$CH_2$—$CH_3$ | —$CH_2$—$CH_2$—$CH_3$ | —H | —$CH_2$—$CH_2$—$CH_2$—$CH_2$— |
| 1277 | —H | —$CH_2$—$CH_2$—$CH_3$ | —$CH_3$ | —$CH_2$—$CH_2$—$CH_2$—$CH_2$— |
| 1278 | —$CH_3$ | —$CH_2$—$CH_2$—$CH_3$ | —$CH_3$ | —$CH_2$—$CH_2$—$CH_2$—$CH_2$— |
| 1279 | —$CH_2$—$CH_3$ | —$CH_2$—$CH_2$—$CH_3$ | —$CH_3$ | —$CH_2$—$CH_2$—$CH_2$—$CH_2$— |
| 1280 | —$CH_2$—$CH_2$—$CH_3$ | —$CH_2$—$CH_2$—$CH_3$ | —$CH_3$ | —$CH_2$—$CH_2$—$CH_2$—$CH_2$— |
| 1281 | —$CH(CH_3)$—$CH_3$ | —$CH_2$—$CH_2$—$CH_3$ | —$CH_3$ | —$CH_2$—$CH_2$—$CH_2$—$CH_2$— |
| 1282 | —$CH_2$—OH | —$CH_2$—$CH_2$—$CH_3$ | —$CH_3$ | —$CH_2$—$CH_2$—$CH_2$—$CH_2$— |
| 1283 | —$CH_2$—$CH_2$—OH | —$CH_2$—$CH_2$—$CH_3$ | —$CH_3$ | —$CH_2$—$CH_2$—$CH_2$—$CH_2$— |
| 1284 | —CH(OH)—$CH_3$ | —$CH_2$—$CH_2$—$CH_3$ | —$CH_3$ | —$CH_2$—$CH_2$—$CH_2$—$CH_2$— |
| 1285 | —$CH_2$—$CH_2$—$CH_2$—OH | —$CH_2$—$CH_2$—$CH_3$ | —$CH_3$ | —$CH_2$—$CH_2$—$CH_2$—$CH_2$— |
| 1286 | —$CH_2$—CH(OH)—$CH_3$ | —$CH_2$—$CH_2$—$CH_3$ | —$CH_3$ | —$CH_2$—$CH_2$—$CH_2$—$CH_2$— |
| 1287 | —CH(OH)—$CH_2$—$CH_3$ | —$CH_2$—$CH_2$—$CH_3$ | —$CH_3$ | —$CH_2$—$CH_2$—$CH_2$—$CH_2$— |
| 1288 | —H | —$CH_2$—$CH_2$—$CH_3$ | —$CH_2$—$CH_3$ | —$CH_2$—$CH_2$—$CH_2$—$CH_2$— |
| 1289 | —$CH_3$ | —$CH_2$—$CH_2$—$CH_3$ | —$CH_2$—$CH_3$ | —$CH_2$—$CH_2$—$CH_2$—$CH_2$— |
| 1290 | —$CH_2$—$CH_3$ | —$CH_2$—$CH_2$—$CH_3$ | —$CH_2$—$CH_3$ | —$CH_2$—$CH_2$—$CH_2$—$CH_2$— |
| 1291 | —$CH_2$—$CH_2$—$CH_3$ | —$CH_2$—$CH_2$—$CH_3$ | —$CH_2$—$CH_3$ | —$CH_2$—$CH_2$—$CH_2$—$CH_2$— |
| 1292 | —$CH(CH_3)$—$CH_3$ | —$CH_2$—$CH_2$—$CH_3$ | —$CH_2$—$CH_3$ | —$CH_2$—$CH_2$—$CH_2$—$CH_2$— |
| 1293 | —$CH_2$—OH | —$CH_2$—$CH_2$—$CH_3$ | —$CH_2$—$CH_3$ | —$CH_2$—$CH_2$—$CH_2$—$CH_2$— |
| 1294 | —$CH_2$—$CH_2$—OH | —$CH_2$—$CH_2$—$CH_3$ | —$CH_2$—$CH_3$ | —$CH_2$—$CH_2$—$CH_2$—$CH_2$— |
| 1295 | —CH(OH)—$CH_3$ | —$CH_2$—$CH_2$—$CH_3$ | —$CH_2$—$CH_3$ | —$CH_2$—$CH_2$—$CH_2$—$CH_2$— |
| 1296 | —$CH_2$—$CH_2$—$CH_2$—OH | —$CH_2$—$CH_2$—$CH_3$ | —$CH_2$—$CH_3$ | —$CH_2$—$CH_2$—$CH_2$—$CH_2$— |
| 1297 | —$CH_2$—CH(OH)—$CH_3$ | —$CH_2$—$CH_2$—$CH_3$ | —$CH_2$—$CH_3$ | —$CH_2$—$CH_2$—$CH_2$—$CH_2$— |
| 1298 | —CH(OH)—$CH_2$—$CH_3$ | —$CH_2$—$CH_2$—$CH_3$ | —$CH_2$—$CH_3$ | —$CH_2$—$CH_2$—$CH_2$—$CH_2$— |
| 1299 | —H | —$CH_2$—$CH_2$—$CH_3$ | —$CH_2$—$CH_2$—$CH_3$ | —$CH_2$—$CH_2$—$CH_2$—$CH_2$— |
| 1300 | —$CH_3$ | —$CH_2$—$CH_2$—$CH_3$ | —$CH_2$—$CH_2$—$CH_3$ | —$CH_2$—$CH_2$—$CH_2$—$CH_2$— |
| 1301 | —$CH_2$—$CH_3$ | —$CH_2$—$CH_2$—$CH_3$ | —$CH_2$—$CH_2$—$CH_3$ | —$CH_2$—$CH_2$—$CH_2$—$CH_2$— |
| 1302 | —$CH_2$—$CH_2$—$CH_3$ | —$CH_2$—$CH_2$—$CH_3$ | —$CH_2$—$CH_2$—$CH_3$ | —$CH_2$—$CH_2$—$CH_2$—$CH_2$— |
| 1303 | —$CH(CH_3)$—$CH_3$ | —$CH_2$—$CH_2$—$CH_3$ | —$CH_2$—$CH_2$—$CH_3$ | —$CH_2$—$CH_2$—$CH_2$—$CH_2$— |
| 1304 | —$CH_2$—OH | —$CH_2$—$CH_2$—$CH_3$ | —$CH_2$—$CH_2$—$CH_3$ | —$CH_2$—$CH_2$—$CH_2$—$CH_2$— |
| 1305 | —$CH_2$—$CH_2$—OH | —$CH_2$—$CH_2$—$CH_3$ | —$CH_2$—$CH_2$—$CH_3$ | —$CH_2$—$CH_2$—$CH_2$—$CH_2$— |
| 1306 | —CH(OH)—$CH_3$ | —$CH_2$—$CH_2$—$CH_3$ | —$CH_2$—$CH_2$—$CH_3$ | —$CH_2$—$CH_2$—$CH_2$—$CH_2$— |
| 1307 | —$CH_2$—$CH_2$—$CH_2$—OH | —$CH_2$—$CH_2$—$CH_3$ | —$CH_2$—$CH_2$—$CH_3$ | —$CH_2$—$CH_2$—$CH_2$—$CH_2$— |
| 1308 | —$CH_2$—CH(OH)—$CH_3$ | —$CH_2$—$CH_2$—$CH_3$ | —$CH_2$—$CH_2$—$CH_3$ | —$CH_2$—$CH_2$—$CH_2$—$CH_2$— |
| 1309 | —CH(OH)—$CH_2$—$CH_3$ | —$CH_2$—$CH_2$—$CH_3$ | —$CH_2$—$CH_2$—$CH_3$ | —$CH_2$—$CH_2$—$CH_2$—$CH_2$— |
| 1310 | —H | —$CH_2$—$CH_2$—$CH_3$ | —$CH(CH_3)$—$CH_3$ | —$CH_2$—$CH_2$—$CH_2$—$CH_2$— |
| 1311 | —$CH_3$ | —$CH_2$—$CH_2$—$CH_3$ | —$CH(CH_3)$—$CH_3$ | —$CH_2$—$CH_2$—$CH_2$—$CH_2$— |
| 1312 | —$CH_2$—$CH_3$ | —$CH_2$—$CH_2$—$CH_3$ | —$CH(CH_3)$—$CH_3$ | —$CH_2$—$CH_2$—$CH_2$—$CH_2$— |
| 1313 | —$CH_2$—$CH_2$—$CH_3$ | —$CH_2$—$CH_2$—$CH_3$ | —$CH(CH_3)$—$CH_3$ | —$CH_2$—$CH_2$—$CH_2$—$CH_2$— |
| 1314 | —$CH(CH_3)$—$CH_3$ | —$CH_2$—$CH_2$—$CH_3$ | —$CH(CH_3)$—$CH_3$ | —$CH_2$—$CH_2$—$CH_2$—$CH_2$— |
| 1315 | —$CH_2$—OH | —$CH_2$—$CH_2$—$CH_3$ | —$CH(CH_3)$—$CH_3$ | —$CH_2$—$CH_2$—$CH_2$—$CH_2$— |
| 1316 | —$CH_2$—$CH_2$—OH | —$CH_2$—$CH_2$—$CH_3$ | —$CH(CH_3)$—$CH_3$ | —$CH_2$—$CH_2$—$CH_2$—$CH_2$— |
| 1317 | —CH(OH)—$CH_3$ | —$CH_2$—$CH_2$—$CH_3$ | —$CH(CH_3)$—$CH_3$ | —$CH_2$—$CH_2$—$CH_2$—$CH_2$— |
| 1318 | —$CH_2$—$CH_2$—$CH_2$—OH | —$CH_2$—$CH_2$—$CH_3$ | —$CH(CH_3)$—$CH_3$ | —$CH_2$—$CH_2$—$CH_2$—$CH_2$— |
| 1319 | —$CH_2$—CH(OH)—$CH_3$ | —$CH_2$—$CH_2$—$CH_3$ | —$CH(CH_3)$—$CH_3$ | —$CH_2$—$CH_2$—$CH_2$—$CH_2$— |
| 1320 | —CH(OH)—$CH_2$—$CH_3$ | —$CH_2$—$CH_2$—$CH_3$ | —$CH(CH_3)$—$CH_3$ | —$CH_2$—$CH_2$—$CH_2$—$CH_2$— |
| 1321 | —H | —$CH(CH_3)$—$CH_3$ | —H | —$CH_2$—$CH_2$—$CH_2$—$CH_2$— |
| 1322 | —$CH_3$ | —$CH(CH_3)$—$CH_3$ | —H | —$CH_2$—$CH_2$—$CH_2$—$CH_2$— |
| 1323 | —$CH_2$—$CH_3$ | —$CH(CH_3)$—$CH_3$ | —H | —$CH_2$—$CH_2$—$CH_2$—$CH_2$— |
| 1324 | —$CH_2$—$CH_2$—$CH_3$ | —$CH(CH_3)$—$CH_3$ | —H | —$CH_2$—$CH_2$—$CH_2$—$CH_2$— |
| 1325 | —$CH(CH_3)$—$CH_3$ | —$CH(CH_3)$—$CH_3$ | —H | —$CH_2$—$CH_2$—$CH_2$—$CH_2$— |
| 1326 | —$CH_2$—OH | —$CH(CH_3)$—$CH_3$ | —H | —$CH_2$—$CH_2$—$CH_2$—$CH_2$— |
| 1327 | —$CH_2$—$CH_2$—OH | —$CH(CH_3)$—$CH_3$ | —H | —$CH_2$—$CH_2$—$CH_2$—$CH_2$— |
| 1328 | —CH(OH)—$CH_3$ | —$CH(CH_3)$—$CH_3$ | —H | —$CH_2$—$CH_2$—$CH_2$—$CH_2$— |
| 1329 | —$CH_2$—$CH_2$—$CH_2$—OH | —$CH(CH_3)$—$CH_3$ | —H | —$CH_2$—$CH_2$—$CH_2$—$CH_2$— |
| 1330 | —$CH_2$—CH(OH)—$CH_3$ | —$CH(CH_3)$—$CH_3$ | —H | —$CH_2$—$CH_2$—$CH_2$—$CH_2$— |
| 1331 | —CH(OH)—$CH_2$—$CH_3$ | —$CH(CH_3)$—$CH_3$ | —H | —$CH_2$—$CH_2$—$CH_2$—$CH_2$— |
| 1332 | —H | —$CH(CH_3)$—$CH_3$ | —$CH_3$ | —$CH_2$—$CH_2$—$CH_2$—$CH_2$— |
| 1333 | —$CH_3$ | —$CH(CH_3)$—$CH_3$ | —$CH_3$ | —$CH_2$—$CH_2$—$CH_2$—$CH_2$— |
| 1334 | —$CH_2$—$CH_3$ | —$CH(CH_3)$—$CH_3$ | —$CH_3$ | —$CH_2$—$CH_2$—$CH_2$—$CH_2$— |
| 1335 | —$CH_2$—$CH_2$—$CH_3$ | —$CH(CH_3)$—$CH_3$ | —$CH_3$ | —$CH_2$—$CH_2$—$CH_2$—$CH_2$— |
| 1336 | —$CH(CH_3)$—$CH_3$ | —$CH(CH_3)$—$CH_3$ | —$CH_3$ | —$CH_2$—$CH_2$—$CH_2$—$CH_2$— |
| 1337 | —$CH_2$—OH | —$CH(CH_3)$—$CH_3$ | —$CH_3$ | —$CH_2$—$CH_2$—$CH_2$—$CH_2$— |
| 1338 | —$CH_2$—$CH_2$—OH | —$CH(CH_3)$—$CH_3$ | —$CH_3$ | —$CH_2$—$CH_2$—$CH_2$—$CH_2$— |
| 1339 | —CH(OH)—$CH_3$ | —$CH(CH_3)$—$CH_3$ | —$CH_3$ | —$CH_2$—$CH_2$—$CH_2$—$CH_2$— |
| 1340 | —$CH_2$—$CH_2$—$CH_2$—OH | —$CH(CH_3)$—$CH_3$ | —$CH_3$ | —$CH_2$—$CH_2$—$CH_2$—$CH_2$— |
| 1341 | —$CH_2$—CH(OH)—$CH_3$ | —$CH(CH_3)$—$CH_3$ | —$CH_3$ | —$CH_2$—$CH_2$—$CH_2$—$CH_2$— |
| 1342 | —CH(OH)—$CH_2$—$CH_3$ | —$CH(CH_3)$—$CH_3$ | —$CH_3$ | —$CH_2$—$CH_2$—$CH_2$—$CH_2$— |
| 1343 | —H | —$CH(CH_3)$—$CH_3$ | —$CH_2$—$CH_3$ | —$CH_2$—$CH_2$—$CH_2$—$CH_2$— |
| 1344 | —$CH_3$ | —$CH(CH_3)$—$CH_3$ | —$CH_2$—$CH_3$ | —$CH_2$—$CH_2$—$CH_2$—$CH_2$— |
| 1345 | —$CH_2$—$CH_3$ | —$CH(CH_3)$—$CH_3$ | —$CH_2$—$CH_3$ | —$CH_2$—$CH_2$—$CH_2$—$CH_2$— |
| 1346 | —$CH_2$—$CH_2$—$CH_3$ | —$CH(CH_3)$—$CH_3$ | —$CH_2$—$CH_3$ | —$CH_2$—$CH_2$—$CH_2$—$CH_2$— |
| 1347 | —$CH(CH_3)$—$CH_3$ | —$CH(CH_3)$—$CH_3$ | —$CH_2$—$CH_3$ | —$CH_2$—$CH_2$—$CH_2$—$CH_2$— |
| 1348 | —$CH_2$—OH | —$CH(CH_3)$—$CH_3$ | —$CH_2$—$CH_3$ | —$CH_2$—$CH_2$—$CH_2$—$CH_2$— |

-continued

| No. | $R^5$ | $R^6$ | $R^7$ | X |
|---|---|---|---|---|
| 1349 | —$CH_2$—$CH_2$—OH | —$CH(CH_3)$—$CH_3$ | —$CH_2$—$CH_3$ | —$CH_2$—$CH_2$—$CH_2$—$CH_2$— |
| 1350 | —CH(OH)—$CH_3$ | —$CH(CH_3)$—$CH_3$ | —$CH_2$—$CH_3$ | —$CH_2$—$CH_2$—$CH_2$—$CH_2$— |
| 1351 | —$CH_2$—$CH_2$—$CH_2$—OH | —$CH(CH_3)$—$CH_3$ | —$CH_2$—$CH_3$ | —$CH_2$—$CH_2$—$CH_2$—$CH_2$— |
| 1352 | —$CH_2$—CH(OH)—$CH_3$ | —$CH(CH_3)$—$CH_3$ | —$CH_2$—$CH_3$ | —$CH_2$—$CH_2$—$CH_2$—$CH_2$— |
| 1353 | —CH(OH)—$CH_2$—$CH_3$ | —$CH(CH_3)$—$CH_3$ | —$CH_2$—$CH_3$ | —$CH_2$—$CH_2$—$CH_2$—$CH_2$— |
| 1354 | —H | —$CH(CH_3)$—$CH_3$ | —$CH_2$—$CH_2$—$CH_3$ | —$CH_2$—$CH_2$—$CH_2$—$CH_2$— |
| 1355 | —$CH_3$ | —$CH(CH_3)$—$CH_3$ | —$CH_2$—$CH_2$—$CH_3$ | —$CH_2$—$CH_2$—$CH_2$—$CH_2$— |
| 1356 | —$CH_2$—$CH_3$ | —$CH(CH_3)$—$CH_3$ | —$CH_2$—$CH_2$—$CH_3$ | —$CH_2$—$CH_2$—$CH_2$—$CH_2$— |
| 1357 | —$CH_2$—$CH_2$—$CH_3$ | —$CH(CH_3)$—$CH_3$ | —$CH_2$—$CH_2$—$CH_3$ | —$CH_2$—$CH_2$—$CH_2$—$CH_2$— |
| 1358 | —$CH(CH_3)$—$CH_3$ | —$CH(CH_3)$—$CH_3$ | —$CH_2$—$CH_2$—$CH_3$ | —$CH_2$—$CH_2$—$CH_2$—$CH_2$— |
| 1359 | —$CH_2$—OH | —$CH(CH_3)$—$CH_3$ | —$CH_2$—$CH_2$—$CH_3$ | —$CH_2$—$CH_2$—$CH_2$—$CH_2$— |
| 1360 | —$CH_2$—$CH_2$—OH | —$CH(CH_3)$—$CH_3$ | —$CH_2$—$CH_2$—$CH_3$ | —$CH_2$—$CH_2$—$CH_2$—$CH_2$— |
| 1361 | —CH(OH)—$CH_3$ | —$CH(CH_3)$—$CH_3$ | —$CH_2$—$CH_2$—$CH_3$ | —$CH_2$—$CH_2$—$CH_2$—$CH_2$— |
| 1362 | —$CH_2$—$CH_2$—$CH_2$—OH | —$CH(CH_3)$—$CH_3$ | —$CH_2$—$CH_2$—$CH_3$ | —$CH_2$—$CH_2$—$CH_2$—$CH_2$— |
| 1363 | —$CH_2$—OH(OH)—$CH_3$ | —$CH(CH_3)$—$CH_3$ | —$CH_2$—$CH_2$—$CH_3$ | —$CH_2$—$CH_2$—$CH_2$—$CH_2$— |
| 1364 | —CH(OH)—$CH_2$—$CH_3$ | —$CH(CH_3)$—$CH_3$ | —$CH_2$—$CH_2$—$CH_3$ | —$CH_2$—$CH_2$—$CH_2$—$CH_2$— |
| 1365 | —H | —$CH(CH_3)$—$CH_3$ | —$CH(CH_3)$—$CH_3$ | —$CH_2$—$CH_2$—$CH_2$—$CH_2$— |
| 1366 | —$CH_3$ | —$CH(CH_3)$—$CH_3$ | —$CH(CH_3)$—$CH_3$ | —$CH_2$—$CH_2$—$CH_2$—$CH_2$— |
| 1367 | —$CH_2$—$CH_3$ | —$CH(CH_3)$—$CH_3$ | —$CH(CH_3)$—$CH_3$ | —$CH_2$—$CH_2$—$CH_2$—$CH_2$— |
| 1368 | —$CH_2$—$CH_2$—$CH_3$ | —$CH(CH_3)$—$CH_3$ | —$CH(CH_3)$—$CH_3$ | —$CH_2$—$CH_2$—$CH_2$—$CH_2$— |
| 1369 | —$CH(CH_3)$—$CH_3$ | —$CH(CH_3)$—$CH_3$ | —$CH(CH_3)$—$CH_3$ | —$CH_2$—$CH_2$—$CH_2$—$CH_2$— |
| 1370 | —$CH_2$—OH | —$CH(CH_3)$—$CH_3$ | —$CH(CH_3)$—$CH_3$ | —$CH_2$—$CH_2$—$CH_2$—$CH_2$— |
| 1371 | —$CH_2$—$CH_2$—OH | —$CH(CH_3)$—$CH_3$ | —$CH(CH_3)$—$CH_3$ | —$CH_2$—$CH_2$—$CH_2$—$CH_2$— |
| 1372 | —CH(OH)—$CH_3$ | —$CH(CH_3)$—$CH_3$ | —$CH(CH_3)$—$CH_3$ | —$CH_2$—$CH_2$—$CH_2$—$CH_2$— |
| 1373 | —$CH_2$—$CH_2$—$CH_2$—OH | —$CH(CH_3)$—$CH_3$ | —$CH(CH_3)$—$CH_3$ | —$CH_2$—$CH_2$—$CH_2$—$CH_2$— |
| 1374 | —$CH_2$—CH(OH)—$CH_3$ | —$CH(CH_3)$—$CH_3$ | —$CH(CH_3)$—$CH_3$ | —$CH_2$—$CH_2$—$CH_2$—$CH_2$— |
| 1375 | —CH(OH)—$CH_2$—$CH_3$ | —$CH(CH_3)$—$CH_3$ | —$CH(CH_3)$—$CH_3$ | —$CH_2$—$CH_2$—$CH_2$—$CH_2$— |
| 1376 | —H | —H | —H | —COO—$(CH_2)_k$— where k = from 1 to 6 |
| 1377 | —$CH_3$ | —H | —H | —COO—$(CH_2)_k$— where k = from 1 to 6 |
| 1378 | —$CH_2$—$CH_3$ | —H | —H | —COO—$(CH_2)_k$— where k = from 1 to 6 |
| 1379 | —$CH_2$—$CH_2$—$CH_3$ | —H | —H | —COO—$(CH_2)_k$— where k = from 1 to 6 |
| 1380 | —$CH(CH_3)$—$CH_3$ | —H | —H | —COO—$(CH_2)_k$— where k = from 1 to 6 |
| 1381 | —$CH_2$—OH | —H | —H | —COO—$(CH_2)_k$— where k = from 1 to 6 |
| 1382 | —$CH_2$—$CH_2$—OH | —H | —H | —COO—$(CH_2)_k$— where k = from 1 to 6 |
| 1383 | —CH(OH)—$CH_3$ | —H | —H | —COO—$(CH_2)_k$— where k = from 1 to 6 |
| 1384 | —$CH_2$—$CH_2$—$CH_2$—OH | —H | —H | —COO—$(CH_2)_k$— where k = from 1 to 6 |
| 1385 | —$CH_2$—CH(OH)—$CH_3$ | —H | —H | —COO—$(CH_2)_k$— where k = from 1 to 6 |
| 1386 | —CH(OH)—$CH_2$—$CH_3$ | —H | —H | —COO—$(CH_2)_k$— where k = from 1 to 6 |
| 1387 | —H | —H | —$CH_3$ | —COO—$(CH_2)_k$— where k = from 1 to 6 |
| 1388 | —$CH_3$ | —H | —$CH_3$ | —COO—$(CH_2)_k$— where k = from 1 to 6 |
| 1389 | —$CH_2$—$CH_3$ | —H | —$CH_3$ | —COO—$(CH_2)_k$— where k = from 1 to 6 |
| 1390 | —$CH_2$—$CH_2$—$CH_3$ | —H | —$CH_3$ | —COO—$(CH_2)_k$— where k = from 1 to 6 |
| 1391 | —$CH(CH_3)$—$CH_3$ | —H | —$CH_3$ | —COO—$(CH_2)_k$— where k = from 1 to 6 |
| 1392 | —$CH_2$—OH | —H | —$CH_3$ | —COO—$(CH_2)_k$— where k = from 1 to 6 |
| 1393 | —$CH_2$—$CH_2$—OH | —H | —$CH_3$ | —COO—$(CH_2)_k$— where k = from 1 to 6 |
| 1394 | —CH(OH)—$CH_3$ | —H | —$CH_3$ | —COO—$(CH_2)_k$— where k = from 1 to 6 |
| 1395 | —$CH_2$—$CH_2$—$CH_2$—OH | —H | —$CH_3$ | —COO—$(CH_2)_k$— where k = from 1 to 6 |
| 1396 | —$CH_2$—CH(OH)—$CH_3$ | —H | —$CH_3$ | —COO—$(CH_2)_k$— where k = from 1 to 6 |
| 1397 | —CH(OH)—$CH_2$—$CH_3$ | —H | —$CH_3$ | —COO—$(CH_2)_k$— where k = from 1 to 6 |
| 1398 | —H | —H | —$CH_2$—$CH_3$ | —COO—$(CH_2)_k$— where k = from 1 to 6 |
| 1399 | —$CH_3$ | —H | —$CH_2$—$CH_3$ | —COO—$(CH_2)_k$— where k = from 1 to 6 |
| 1400 | —$CH_2$—$CH_3$ | —H | —$CH_2$—$CH_3$ | —COO—$(CH_2)_k$— where k = from 1 to 6 |

-continued

| No. | $R^5$ | $R^6$ | $R^7$ | X |
|---|---|---|---|---|
| 1401 | —$CH_2$—$CH_2$—$CH_3$ | —H | —$CH_2$—$CH_3$ | —COO—$(CH_2)_k$— where k = from 1 to 6 |
| 1402 | —CH($CH_3$)—$CH_3$ | —H | —$CH_2$—$CH_3$ | —COO—$(CH_2)_k$— where k = from 1 to 6 |
| 1403 | —$CH_2$—OH | —H | —$CH_2$—$CH_3$ | —COO—$(CH_2)_k$— where k = from 1 to 6 |
| 1404 | —$CH_2$—$CH_2$—OH | —H | —$CH_2$—$CH_3$ | —COO—$(CH_2)_k$— where k = from 1 to 6 |
| 1405 | —CH(OH)—$CH_3$ | —H | —$CH_2$—$CH_3$ | —COO—$(CH_2)_k$— where k = from 1 to 6 |
| 1406 | —$CH_2$—$CH_2$—$CH_2$—OH | —H | —$CH_2$—$CH_3$ | —COO—$(CH_2)_k$— where k = from 1 to 6 |
| 1407 | —$CH_2$—CH(OH)—$CH_3$ | —H | —$CH_2$—$CH_3$ | —COO—$(CH_2)_k$— where k = from 1 to 6 |
| 1408 | —CH(OH)—$CH_2$—$CH_3$ | —H | —$CH_2$—$CH_3$ | —COO—$(CH_2)_k$— where k = from 1 to 6 |
| 1409 | —H | —H | —$CH_2$—$CH_2$—$CH_3$ | —COO—$(CH_2)_k$— where k = from 1 to 6 |
| 1410 | —$CH_3$ | —H | —$CH_2$—$CH_2$—$CH_3$ | —COO—$(CH_2)_k$— where k = from 1 to 6 |
| 1411 | —$CH_2$—$CH_3$ | —H | —$CH_2$—$CH_2$—$CH_3$ | —COO—$(CH_2)_k$— where k = from 1 to 6 |
| 1412 | —$CH_2$—$CH_2$—$CH_3$ | —H | —$CH_2$—$CH_2$—$CH_3$ | —COO—$(CH_2)_k$— where k = from 1 to 6 |
| 1413 | —CH($CH_3$)—$CH_3$ | —H | —$CH_2$—$CH_2$—$CH_3$ | —COO—$(CH_2)_k$— where k = from 1 to 6 |
| 1414 | —$CH_2$—OH | —H | —$CH_2$—$CH_2$—$CH_3$ | —COO—$(CH_2)_k$— where k = from 1 to 6 |
| 1415 | —$CH_2$—$CH_2$—OH | —H | —$CH_2$—$CH_2$—$CH_3$ | —COO—$(CH_2)_k$— where k = from 1 to 6 |
| 1416 | —CH(OH)—$CH_3$ | —H | —$CH_2$—$CH_2$—$CH_3$ | —COO—$(CH_2)_k$— where k = from 1 to 6 |
| 1417 | —$CH_2$—$CH_2$—$CH_2$—OH | —H | —$CH_2$—$CH_2$—$CH_3$ | —COO—$(CH_2)_k$— where k = from 1 to 6 |
| 1418 | —$CH_2$—CH(OH)—$CH_3$ | —H | —$CH_2$—$CH_2$—$CH_3$ | —COO—$(CH_2)_k$— where k = from 1 to 6 |
| 1419 | —CH(OH)—$CH_2$—$CH_3$ | —H | —$CH_2$—$CH_2$—$CH_3$ | —COO—$(CH_2)_k$— where k = from 1 to 6 |
| 1420 | —H | —H | —CH($CH_3$)—$CH_3$ | —COO—$(CH_2)_k$— where k = from 1 to 6 |
| 1421 | —$CH_3$ | —H | —CH($CH_3$)—$CH_3$ | —COO—$(CH_2)_k$— where k = from 1 to 6 |
| 1422 | —$CH_2$—$CH_3$ | —H | —CH($CH_3$)—$CH_3$ | —COO—$(CH_2)_k$— where k = from 1 to 6 |
| 1423 | —$CH_2$—$CH_2$—$CH_3$ | —H | —CH($CH_3$)—$CH_3$ | —COO—$(CH_2)_k$— where k = from 1 to 6 |
| 1424 | —CH($CH_3$)—$CH_3$ | —H | —CH($CH_3$)—$CH_3$ | —COO—$(CH_2)_k$— where k = from 1 to 6 |
| 1425 | —$CH_2$—OH | —H | —CH($CH_3$)—$CH_3$ | —COO—$(CH_2)_k$— where k = from 1 to 6 |
| 1426 | —$CH_2$—$CH_2$—OH | —H | —CH($CH_3$)—$CH_3$ | —COO—$(CH_2)_k$— where k = from 1 to 6 |
| 1427 | —CH(OH)—$CH_3$ | —H | —CH($CH_3$)—$CH_3$ | —COO—$(CH_2)_k$— where k = from 1 to 6 |
| 1428 | —$CH_2$—$CH_2$—$CH_2$—OH | —H | —CH($CH_3$)—$CH_3$ | —COO—$(CH_2)_k$— where k = from 1 to 6 |
| 1429 | —$CH_2$—CH(OH)—$CH_3$ | —H | —CH($CH_3$)—$CH_3$ | —COO—$(CH_2)_k$— where k = from 1 to 6 |
| 1430 | —CH(OH)—$CH_2$—$CH_3$ | —H | —CH($CH_3$)—$CH_3$ | —COO—$(CH_2)_k$— where k = from 1 to 6 |
| 1431 | —H | —$CH_3$ | —H | —COO—$(CH_2)_k$— where k = from 1 to 6 |
| 1432 | —$CH_3$ | —$CH_3$ | —H | —COO—$(CH_2)_k$— where k = from 1 to 6 |
| 1433 | —$CH_2$—$CH_3$ | —$CH_3$ | —H | —COO—$(CH_2)_k$— where k = from 1 to 6 |
| 1434 | —$CH_2$—$CH_2$—$CH_3$ | —$CH_3$ | —H | —COO—$(CH_2)_k$— where k = from 1 to 6 |
| 1435 | —CH($CH_3$)—$CH_3$ | —$CH_3$ | —H | —COO—$(CH_2)_k$— where k = from 1 to 6 |
| 1436 | —$CH_2$—OH | —$CH_3$ | —H | —COO—$(CH_2)_k$— where k = from 1 to 6 |
| 1437 | —$CH_2$—$CH_2$—OH | —$CH_3$ | —H | —COO—$(CH_2)_k$— where k = from 1 to 6 |
| 1438 | —CH(OH)—$CH_3$ | —$CH_3$ | —H | —COO—$(CH_2)_k$— where k = from 1 to 6 |

-continued

| No. | $R^5$ | $R^6$ | $R^7$ | X |
|---|---|---|---|---|
| 1439 | —$CH_2$—$CH_2$—$CH_2$—OH | —$CH_3$ | —H | —COO—$(CH_2)_k$— where k = from 1 to 6 |
| 1440 | —$CH_2$—CH(OH)—$CH_3$ | —$CH_3$ | —H | —COO—$(CH_2)_k$— where k = from 1 to 6 |
| 1441 | —CH(OH)—$CH_2$—$CH_3$ | —$CH_3$ | —H | —COO—$(CH_2)_k$— where k = from 1 to 6 |
| 1442 | —H | —$CH_3$ | —$CH_3$ | —COO—$(CH_2)_k$— where k = from 1 to 6 |
| 1443 | —$CH_3$ | —$CH_3$ | —$CH_3$ | —COO—$(CH_2)_k$— where k = from 1 to 6 |
| 1444 | —$CH_2$—$CH_3$ | —$CH_3$ | —$CH_3$ | —COO—$(CH_2)_k$— where k = from 1 to 6 |
| 1445 | —$CH_2$—$CH_2$—$CH_3$ | —$CH_3$ | —$CH_3$ | —COO—$(CH_2)_k$— where k = from 1 to 6 |
| 1446 | —CH($CH_3$)—$CH_3$ | —$CH_3$ | —$CH_3$ | —COO—$(CH_2)_k$— where k = from 1 to 6 |
| 1447 | —$CH_2$—OH | —$CH_3$ | —$CH_3$ | —COO—$(CH_2)_k$— where k = from 1 to 6 |
| 1448 | —$CH_2$—$CH_2$—OH | —$CH_3$ | —$CH_3$ | —COO—$(CH_2)_k$— where k = from 1 to 6 |
| 1449 | —CH(OH)—$CH_3$ | —$CH_3$ | —$CH_3$ | —COO—$(CH_2)_k$— where k = from 1 to 6 |
| 1450 | —$CH_2$—$CH_2$—$CH_2$—OH | —$CH_3$ | —$CH_3$ | —COO—$(CH_2)_k$— where k = from 1 to 6 |
| 1451 | —$CH_2$—CH(OH)—$CH_3$ | —$CH_3$ | —$CH_3$ | —COO—$(CH_2)_k$— where k = from 1 to 6 |
| 1452 | —CH(OH)—$CH_2$—$CH_3$ | —$CH_3$ | —$CH_3$ | —COO—$(CH_2)_k$— where k = from 1 to 6 |
| 1453 | —H | —$CH_3$ | —$CH_2$—$CH_3$ | —COO—$(CH_2)_k$— where k = from 1 to 6 |
| 1454 | —$CH_3$ | —$CH_3$ | —$CH_2$—$CH_3$ | —COO—$(CH_2)_k$— where k = from 1 to 6 |
| 1455 | —$CH_2$—$CH_3$ | —$CH_3$ | —$CH_2$—$CH_3$ | —COO—$(CH_2)_k$— where k = from 1 to 6 |
| 1456 | —$CH_2$—$CH_2$—$CH_3$ | —$CH_3$ | —$CH_2$—$CH_3$ | —COO—$(CH_2)_k$— where k = from 1 to 6 |
| 1457 | —CH($CH_3$)—$CH_3$ | —$CH_3$ | —$CH_2$—$CH_3$ | —COO—$(CH_2)_k$— where k = from 1 to 6 |
| 1458 | —$CH_2$—OH | —$CH_3$ | —$CH_2$—$CH_3$ | —COO—$(CH_2)_k$— where k = from 1 to 6 |
| 1459 | —$CH_2$—$CH_2$—OH | —$CH_3$ | —$CH_2$—$CH_3$ | —COO—$(CH_2)_k$— where k = from 1 to 6 |
| 1460 | —CH(OH)—$CH_3$ | —$CH_3$ | —$CH_2$—$CH_3$ | —COO—$(CH_2)_k$— where k = from 1 to 6 |
| 1461 | —$CH_2$—$CH_2$—$CH_2$—OH | —$CH_3$ | —$CH_2$—$CH_3$ | —COO—$(CH_2)_k$— where k = from 1 to 6 |
| 1462 | —$CH_2$—CH(OH)—$CH_3$ | —$CH_3$ | —$CH_2$—$CH_3$ | —COO—$(CH_2)_k$— where k = from 1 to 6 |
| 1463 | —CH(OH)—$CH_2$—$CH_3$ | —$CH_3$ | —$CH_2$—$CH_3$ | —COO—$(CH_2)_k$— where k = from 1 to 6 |
| 1464 | —H | —$CH_3$ | —$CH_2$—$CH_2$—$CH_3$ | —COO—$(CH_2)_k$— where k = from 1 to 6 |
| 1465 | —$CH_3$ | —$CH_3$ | —$CH_2$—$CH_2$—$CH_3$ | —COO—$(CH_2)_k$— where k = from 1 to 6 |
| 1466 | —$CH_2$—$CH_3$ | —$CH_3$ | —$CH_2$—$CH_2$—$CH_3$ | —COO—$(CH_2)_k$— where k = from 1 to 6 |
| 1467 | —$CH_2$—$CH_2$—$CH_3$ | —$CH_3$ | —$CH_2$—$CH_2$—$CH_3$ | —COO—$(CH_2)_k$— where k = from 1 to 6 |
| 1468 | —CH($CH_3$)—$CH_3$ | —$CH_3$ | —$CH_2$—$CH_2$—$CH_3$ | —COO—$(CH_2)_k$— where k = from 1 to 6 |
| 1469 | —$CH_2$—OH | —$CH_3$ | —$CH_2$—$CH_2$—$CH_3$ | —COO—$(CH_2)_k$— where k = from 1 to 6 |
| 1470 | —$CH_2$—$CH_2$—OH | —$CH_3$ | —$CH_2$—$CH_2$—$CH_3$ | —COO—$(CH_2)_k$— where k = from 1 to 6 |
| 1471 | —CH(OH)—$CH_3$ | —$CH_3$ | —$CH_2$—$CH_2$—$CH_3$ | —COO—$(CH_2)_k$— where k = from 1 to 6 |
| 1472 | —$CH_2$—$CH_2$—$CH_2$—OH | —$CH_3$ | —$CH_2$—$CH_2$—$CH_3$ | —COO—$(CH_2)_k$— where k = from 1 to 6 |
| 1473 | —$CH_2$—CH(OH)—$CH_3$ | —$CH_3$ | —$CH_2$—$CH_2$—$CH_3$ | —COO—$(CH_2)_k$— where k = from 1 to 6 |
| 1474 | —CH(OH)—$CH_2$—$CH_3$ | —$CH_3$ | —$CH_2$—$CH_2$—$CH_3$ | —COO—$(CH_2)_k$— where k = from 1 to 6 |
| 1475 | —H | —$CH_3$ | —CH($CH_3$)—$CH_3$ | —COO—$(CH_2)_k$— where k = from 1 to 6 |
| 1476 | —$CH_3$ | —$CH_3$ | —CH($CH_3$)—$CH_3$ | —COO—$(CH_2)_k$— where k = from 1 to 6 |

-continued

| No. | $R^5$ | $R^6$ | $R^7$ | X |
|---|---|---|---|---|
| 1477 | —$CH_2$—$CH_3$ | —$CH_3$ | —$CH(CH_3)$—$CH_3$ | —COO—$(CH_2)_k$— where k = from 1 to 6 |
| 1478 | —$CH_2$—$CH_2$—$CH_3$ | —$CH_3$ | —$CH(CH_3)$—$CH_3$ | —COO—$(CH_2)_k$— where k = from 1 to 6 |
| 1479 | —$CH(CH_3)$—$CH_3$ | —$CH_3$ | —$CH(CH_3)$—$CH_3$ | —COO—$(CH_2)_k$— where k = from 1 to 6 |
| 1480 | —$CH_2$—OH | —$CH_3$ | —$CH(CH_3)$—$CH_3$ | —COO—$(CH_2)_k$— where k = from 1 to 6 |
| 1481 | —$CH_2$—$CH_2$—OH | —$CH_3$ | —$CH(CH_3)$—$CH_3$ | —COO—$(CH_2)_k$— where k = from 1 to 6 |
| 1482 | —CH(OH)—$CH_3$ | —$CH_3$ | —$CH(CH_3)$—$CH_3$ | —COO—$(CH_2)_k$— where k = from 1 to 6 |
| 1483 | —$CH_2$—$CH_2$—$CH_2$—OH | —$CH_3$ | —$CH(CH_3)$—$CH_3$ | —COO—$(CH_2)_k$— where k = from 1 to 6 |
| 1484 | —$CH_2$—CH(OH)—$CH_3$ | —$CH_3$ | —$CH(CH_3)$—$CH_3$ | —COO—$(CH_2)_k$— where k = from 1 to 6 |
| 1485 | —CH(OH)—$CH_2$—$CH_3$ | —$CH_3$ | —$CH(CH_3)$—$CH_3$ | —COO—$(CH_2)_k$— where k = from 1 to 6 |
| 1486 | —H | —$CH_2$—$CH_3$ | —H | —COO—$(CH_2)_k$— where k = from 1 to 6 |
| 1487 | —$CH_3$ | —$CH_2$—$CH_3$ | —H | —COO—$(CH_2)_k$— where k = from 1 to 6 |
| 1488 | —$CH_2$—$CH_3$ | —$CH_2$—$CH_3$ | —H | —COO—$(CH_2)_k$— where k = from 1 to 6 |
| 1489 | —$CH_2$—$CH_2$—$CH_3$ | —$CH_2$—$CH_3$ | —H | —COO—$(CH_2)_k$— where k = from 1 to 6 |
| 1490 | —$CH(CH_3)$—$CH_3$ | —$CH_2$—$CH_3$ | —H | —COO—$(CH_2)_k$— where k = from 1 to 6 |
| 1491 | —$CH_2$—OH | —$CH_2$—$CH_3$ | —H | —COO—$(CH_2)_k$— where k = from 1 to 6 |
| 1492 | —$CH_2$—$CH_2$—OH | —$CH_2$—$CH_3$ | —H | —COO—$(CH_2)_k$— where k = from 1 to 6 |
| 1493 | —CH(OH)—$CH_3$ | —$CH_2$—$CH_3$ | —H | —COO—$(CH_2)_k$— where k = from 1 to 6 |
| 1494 | —$CH_2$—$CH_2$—$CH_2$—OH | —$CH_2$—$CH_3$ | —H | —COO—$(CH_2)_k$— where k = from 1 to 6 |
| 1495 | —$CH_2$—CH(OH)—$CH_3$ | —$CH_2$—$CH_3$ | —H | —COO—$(CH_2)_k$— where k = from 1 to 6 |
| 1496 | —CH(OH)—$CH_2$—$CH_3$ | —$CH_2$—$CH_3$ | —H | —COO—$(CH_2)_k$— where k = from 1 to 6 |
| 1497 | —H | —$CH_2$—$CH_3$ | —$CH_3$ | —COO—$(CH_2)_k$— where k = from 1 to 6 |
| 1498 | —$CH_3$ | —$CH_2$—$CH_3$ | —$CH_3$ | —COO—$(CH_2)_k$— where k = from 1 to 6 |
| 1499 | —$CH_2$—$CH_3$ | —$CH_2$—$CH_3$ | —$CH_3$ | —COO—$(CH_2)_k$— where k = from 1 to 6 |
| 1500 | —$CH_2$—$CH_2$—$CH_3$ | —$CH_2$—$CH_3$ | —$CH_3$ | —COO—$(CH_2)_k$— where k = from 1 to 6 |
| 1501 | —$CH(CH_3)$—$CH_3$ | —$CH_2$—$CH_3$ | —$CH_3$ | —COO—$(CH_2)_k$— where k = from 1 to 6 |
| 1502 | —$CH_2$—OH | —$CH_2$—$CH_3$ | —$CH_3$ | —COO—$(CH_2)_k$— where k = from 1 to 6 |
| 1503 | —$CH_2$—$CH_2$—OH | —$CH_2$—$CH_3$ | —$CH_3$ | —COO—$(CH_2)_k$— where k = from 1 to 6 |
| 1504 | —CH(OH)—$CH_3$ | —$CH_2$—$CH_3$ | —$CH_3$ | —COO—$(CH_2)_k$— where k = from 1 to 6 |
| 1505 | —$CH_2$—$CH_2$—$CH_2$—OH | —$CH_2$—$CH_3$ | —$CH_3$ | —COO—$(CH_2)_k$— where k = from 1 to 6 |
| 1506 | —$CH_2$—CH(OH)—$CH_3$ | —$CH_2$—$CH_3$ | —$CH_3$ | —COO—$(CH_2)_k$— where k = from 1 to 6 |
| 1507 | —CH(OH)—$CH_2$—$CH_3$ | —$CH_2$—$CH_3$ | —$CH_3$ | —COO—$(CH_2)_k$— where k = from 1 to 6 |
| 1508 | —H | —$CH_2$—$CH_3$ | —$CH_2$—$CH_3$ | —COO—$(CH_2)_k$— where k = from 1 to 6 |
| 1509 | —$CH_3$ | —$CH_2$—$CH_3$ | —$CH_2$—$CH_3$ | —COO—$(CH_2)_k$— where k = from 1 to 6 |
| 1510 | —$CH_2$—$CH_3$ | —$CH_2$—$CH_3$ | —$CH_2$—$CH_3$ | —COO—$(CH_2)_k$— where k = from 1 to 6 |
| 1511 | —$CH_2$—$CH_2$—$CH_3$ | —$CH_2$—$CH_3$ | —$CH_2$—$CH_3$ | —COO—$(CH_2)_k$— where k = from 1 to 6 |
| 1512 | —$CH(CH_3)$—$CH_3$ | —$CH_2$—$CH_3$ | —$CH_2$—$CH_3$ | —COO—$(CH_2)_k$— where k = from 1 to 6 |
| 1513 | —$CH_2$—OH | —$CH_2$—$CH_3$ | —$CH_2$—$CH_3$ | —COO—$(CH_2)_k$— where k = from 1 to 6 |
| 1514 | —$CH_2$—$CH_2$—OH | —$CH_2$—$CH_3$ | —$CH_2$—$CH_3$ | —COO—$(CH_2)_k$— where k = from 1 to 6 |

-continued

| No. | $R^5$ | $R^6$ | $R^7$ | X |
|---|---|---|---|---|
| 1515 | —CH(OH)—$CH_3$ | —$CH_2$—$CH_3$ | —$CH_2$—$CH_3$ | —COO—$(CH_2)_k$— where k = from 1 to 6 |
| 1516 | —$CH_2$—$CH_2$—$CH_2$—OH | —$CH_2$—$CH_3$ | —$CH_2$—$CH_3$ | —COO—$(CH_2)_k$— where k = from 1 to 6 |
| 1517 | —$CH_2$—CH(OH)—$CH_3$ | —$CH_2$—$CH_3$ | —$CH_2$—$CH_3$ | —COO—$(CH_2)_k$— where k = from 1 to 6 |
| 1518 | —CH(OH)—$CH_2$—$CH_3$ | —$CH_2$—$CH_3$ | —$CH_2$—$CH_3$ | —COO—$(CH_2)_k$— where k = from 1 to 6 |
| 1519 | —H | —$CH_2$—$CH_3$ | —$CH_2$—$CH_2$—$CH_3$ | —COO—$(CH_2)_k$— where k = from 1 to 6 |
| 1520 | —$CH_3$ | —$CH_2$—$CH_3$ | —$CH_2$—$CH_2$—$CH_3$ | —COO—$(CH_2)_k$— where k = from 1 to 6 |
| 1521 | —$CH_2$—$CH_3$ | —$CH_2$—$CH_3$ | —$CH_2$—$CH_2$—$CH_3$ | —COO—$(CH_2)_k$— where k = from 1 to 6 |
| 1522 | —$CH_2$—$CH_2$—$CH_3$ | —$CH_2$—$CH_3$ | —$CH_2$—$CH_2$—$CH_3$ | —COO—$(CH_2)_k$— where k = from 1 to 6 |
| 1523 | —CH($CH_3$)—$CH_3$ | —$CH_2$—$CH_3$ | —$CH_2$—$CH_2$—$CH_3$ | —COO—$(CH_2)_k$— where k = from 1 to 6 |
| 1524 | —$CH_2$—OH | —$CH_2$—$CH_3$ | —$CH_2$—$CH_2$—$CH_3$ | —COO—$(CH_2)_k$— where k = from 1 to 6 |
| 1525 | —$CH_2$—$CH_2$—OH | —$CH_2$—$CH_3$ | —$CH_2$—$CH_2$—$CH_3$ | —COO—$(CH_2)_k$— where k = from 1 to 6 |
| 1526 | —CH(OH)—$CH_3$ | —$CH_2$—$CH_3$ | —$CH_2$—$CH_2$—$CH_3$ | —COO—$(CH_2)_k$— where k = from 1 to 6 |
| 1527 | —$CH_2$—$CH_2$—$CH_2$—OH | —$CH_2$—$CH_3$ | —$CH_2$—$CH_2$—$CH_3$ | —COO—$(CH_2)_k$— where k = from 1 to 6 |
| 1528 | —$CH_2$—CH(OH)—$CH_3$ | —$CH_2$—$CH_3$ | —$CH_2$—$CH_2$—$CH_3$ | —COO—$(CH_2)_k$— where k = from 1 to 6 |
| 1529 | —CH(OH)—$CH_2$—$CH_3$ | —$CH_2$—$CH_3$ | —$CH_2$—$CH_2$—$CH_3$ | —COO—$(CH_2)_k$— where k = from 1 to 6 |
| 1530 | —H | —$CH_2$—$CH_3$ | —CH($CH_3$)—$CH_3$ | —COO—$(CH_2)_k$— where k = from 1 to 6 |
| 1531 | —$CH_3$ | —$CH_2$—$CH_3$ | —CH($CH_3$)—$CH_3$ | —COO—$(CH_2)_k$— where k = from 1 to 6 |
| 1532 | —$CH_2$—$CH_3$ | —$CH_2$—$CH_3$ | —CH($CH_3$)—$CH_3$ | —COO—$(CH_2)_k$— where k = from 1 to 6 |
| 1533 | —$CH_2$—$CH_2$—$CH_3$ | —$CH_2$—$CH_3$ | —CH($CH_3$)—$CH_3$ | —COO—$(CH_2)_k$— where k = from 1 to 6 |
| 1534 | —CH($CH_3$)—$CH_3$ | —$CH_2$—$CH_3$ | —CH($CH_3$)—$CH_3$ | —COO—$(CH_2)_k$— where k = from 1 to 6 |
| 1535 | —$CH_2$—OH | —$CH_2$—$CH_3$ | —CH($CH_3$)—$CH_3$ | —COO—$(CH_2)_k$— where k = from 1 to 6 |
| 1536 | —$CH_2$—$CH_2$—OH | —$CH_2$—$CH_3$ | —CH($CH_3$)—$CH_3$ | —COO—$(CH_2)_k$— where k = from 1 to 6 |
| 1537 | —CH(OH)—$CH_3$ | —$CH_2$—$CH_3$ | —CH($CH_3$)—$CH_3$ | —COO—$(CH_2)_k$— where k = from 1 to 6 |
| 1538 | —$CH_2$—$CH_2$—$CH_2$—OH | —$CH_2$—$CH_3$ | —CH($CH_3$)—$CH_3$ | —COO—$(CH_2)_k$— where k = from 1 to 6 |
| 1539 | —$CH_2$—CH(OH)—$CH_3$ | —$CH_2$—$CH_3$ | —CH($CH_3$)—$CH_3$ | —COO—$(CH_2)_k$— where k = from 1 to 6 |
| 1540 | —CH(OH)—$CH_2$—$CH_3$ | —$CH_2$—$CH_3$ | —CH($CH_3$)—$CH_3$ | —COO—$(CH_2)_k$— where k = from 1 to 6 |
| 1541 | —H | —$CH_2$—$CH_2$—$CH_3$ | —H | —COO—$(CH_2)_k$— where k = from 1 to 6 |
| 1542 | —$CH_3$ | —$CH_2$—$CH_2$—$CH_3$ | —H | —COO—$(CH_2)_k$— where k = from 1 to 6 |
| 1543 | —$CH_2$—$CH_3$ | —$CH_2$—$CH_2$—$CH_3$ | —H | —COO—$(CH_2)_k$— where k = from 1 to 6 |
| 1544 | —$CH_2$—$CH_2$—$CH_3$ | —$CH_2$—$CH_2$—$CH_3$ | —H | —COO—$(CH_2)_k$— where k = from 1 to 6 |
| 1545 | —CH($CH_3$)—$CH_3$ | —$CH_2$—$CH_2$—$CH_3$ | —H | —COO—$(CH_2)_k$— where k = from 1 to 6 |
| 1546 | —$CH_2$—OH | —$CH_2$—$CH_2$—$CH_3$ | —H | —COO—$(CH_2)_k$— where k = from 1 to 6 |
| 1547 | —$CH_2$—$CH_2$—OH | —$CH_2$—$CH_2$—$CH_3$ | —H | —COO—$(CH_2)_k$— where k = from 1 to 6 |
| 1548 | —CH(OH)—$CH_3$ | —$CH_2$—$CH_2$—$CH_3$ | —H | —COO—$(CH_2)_k$— where k = from 1 to 6 |
| 1549 | —$CH_2$—$CH_2$—$CH_2$—OH | —$CH_2$—$CH_2$—$CH_3$ | —H | —COO—$(CH_2)_k$— where k = from 1 to 6 |
| 1550 | —$CH_2$—CH(OH)—$CH_3$ | —$CH_2$—$CH_2$—$CH_3$ | —H | —COO—$(CH_2)_k$— where k = from 1 to 6 |
| 1551 | —CH(OH)—$CH_2$—$CH_3$ | —$CH_2$—$CH_2$—$CH_3$ | —H | —COO—$(CH_2)_k$— where k = from 1 to 6 |
| 1552 | —H | —$CH_2$—$CH_2$—$CH_3$ | —$CH_3$ | —COO—$(CH_2)_k$— where k = from 1 to 6 |

-continued

| No. | $R^5$ | $R^6$ | $R^7$ | X |
|---|---|---|---|---|
| 1553 | —$CH_3$ | —$CH_2$—$CH_2$—$CH_3$ | —$CH_3$ | —COO—$(CH_2)_k$— where k = from 1 to 6 |
| 1554 | —$CH_2$—$CH_3$ | —$CH_2$—$CH_2$—$CH_3$ | —$CH_3$ | —COO—$(CH_2)_k$— where k = from 1 to 6 |
| 1555 | —$CH_2$—$CH_2$—$CH_3$ | —$CH_2$—$CH_2$—$CH_3$ | —$CH_3$ | —COO—$(CH_2)_k$— where k = from 1 to 6 |
| 1556 | —$CH(CH_3)$—$CH_3$ | —$CH_2$—$CH_2$—$CH_3$ | —$CH_3$ | —COO—$(CH_2)_k$— where k = from 1 to 6 |
| 1557 | —$CH_2$—OH | —$CH_2$—$CH_2$—$CH_3$ | —$CH_3$ | —COO—$(CH_2)_k$— where k = from 1 to 6 |
| 1558 | —$CH_2$—$CH_2$—OH | —$CH_2$—$CH_2$—$CH_3$ | —$CH_3$ | —COO—$(CH_2)_k$— where k = from 1 to 6 |
| 1559 | —CH(OH)—$CH_3$ | —$CH_2$—$CH_2$—$CH_3$ | —$CH_3$ | —COO—$(CH_2)_k$— where k = from 1 to 6 |
| 1560 | —$CH_2$—$CH_2$—$CH_2$—OH | —$CH_2$—$CH_2$—$CH_3$ | —$CH_3$ | —COO—$(CH_2)_k$— where k = from 1 to 6 |
| 1561 | —$CH_2$—CH(OH)—$CH_3$ | —$CH_2$—$CH_2$—$CH_3$ | —$CH_3$ | —COO—$(CH_2)_k$— where k = from 1 to 6 |
| 1562 | —CH(OH)—$CH_2$—$CH_3$ | —$CH_2$—$CH_2$—$CH_3$ | —$CH_3$ | —COO—$(CH_2)_k$— where k = from 1 to 6 |
| 1563 | —H | —$CH_2$—$CH_2$—$CH_3$ | —$CH_2$—$CH_3$ | —COO—$(CH_2)_k$— where k = from 1 to 6 |
| 1564 | —$CH_3$ | —$CH_2$—$CH_2$—$CH_3$ | —$CH_2$—$CH_3$ | —COO—$(CH_2)_k$— where k = from 1 to 6 |
| 1565 | —$CH_2$—$CH_3$ | —$CH_2$—$CH_2$—$CH_3$ | —$CH_2$—$CH_3$ | —COO—$(CH_2)_k$— where k = from 1 to 6 |
| 1566 | —$CH_2$—$CH_2$—$CH_3$ | —$CH_2$—$CH_2$—$CH_3$ | —$CH_2$—$CH_3$ | —COO—$(CH_2)_k$— where k = from 1 to 6 |
| 1567 | —$CH(CH_3)$—$CH_3$ | —$CH_2$—$CH_2$—$CH_3$ | —$CH_2$—$CH_3$ | —COO—$(CH_2)_k$— where k = from 1 to 6 |
| 1568 | —$CH_2$—OH | —$CH_2$—$CH_2$—$CH_3$ | —$CH_2$—$CH_3$ | —COO—$(CH_2)_k$— where k = from 1 to 6 |
| 1569 | —$CH_2$—$CH_2$—OH | —$CH_2$—$CH_2$—$CH_3$ | —$CH_2$—$CH_3$ | —COO—$(CH_2)_k$— where k = from 1 to 6 |
| 1570 | —CH(OH)—$CH_3$ | —$CH_2$—$CH_2$—$CH_3$ | —$CH_2$—$CH_3$ | —COO—$(CH_2)_k$— where k = from 1 to 6 |
| 1571 | —$CH_2$—$CH_2$—$CH_2$—OH | —$CH_2$—$CH_2$—$CH_3$ | —$CH_2$—$CH_3$ | —COO—$(CH_2)_k$— where k = from 1 to 6 |
| 1572 | —$CH_2$—CH(OH)—$CH_3$ | —$CH_2$—$CH_2$—$CH_3$ | —$CH_2$—$CH_3$ | —COO—$(CH_2)_k$— where k = from 1 to 6 |
| 1573 | —CH(OH)—$CH_2$—$CH_3$ | —$CH_2$—$CH_2$—$CH_3$ | —$CH_2$—$CH_3$ | —COO—$(CH_2)_k$— where k = from 1 to 6 |
| 1574 | —H | —$CH_2$—$CH_2$—$CH_3$ | —$CH_2$—$CH_2$—$CH_3$ | —COO—$(CH_2)_k$— where k = from 1 to 6 |
| 1575 | —$CH_3$ | —$CH_2$—$CH_2$—$CH_3$ | —$CH_2$—$CH_2$—$CH_3$ | —COO—$(CH_2)_k$— where k = from 1 to 6 |
| 1576 | —$CH_2$—$CH_3$ | —$CH_2$—$CH_2$—$CH_3$ | —$CH_2$—$CH_2$—$CH_3$ | —COO—$(CH_2)_k$— where k = from 1 to 6 |
| 1577 | —$CH_2$—$CH_2$—$CH_3$ | —$CH_2$—$CH_2$—$CH_3$ | —$CH_2$—$CH_2$—$CH_3$ | —COO—$(CH_2)_k$— where k = from 1 to 6 |
| 1578 | —$CH(CH_3)$—$CH_3$ | —$CH_2$—$CH_2$—$CH_3$ | —$CH_2$—$CH_2$—$CH_3$ | —COO—$(CH_2)_k$— where k = from 1 to 6 |
| 1579 | —$CH_2$—OH | —$CH_2$—$CH_2$—$CH_3$ | —$CH_2$—$CH_2$—$CH_3$ | —COO—$(CH_2)_k$— where k = from 1 to 6 |
| 1580 | —$CH_2$—$CH_2$—OH | —$CH_2$—$CH_2$—$CH_3$ | —$CH_2$—$CH_2$—$CH_3$ | —COO—$(CH_2)_k$— where k = from 1 to 6 |
| 1581 | —CH(OH)—$CH_3$ | —$CH_2$—$CH_2$—$CH_3$ | —$CH_2$—$CH_2$—$CH_3$ | —COO—$(CH_2)_k$— where k = from 1 to 6 |
| 1582 | —$CH_2$—$CH_2$—$CH_2$—OH | —$CH_2$—$CH_2$—$CH_3$ | —$CH_2$—$CH_2$—$CH_3$ | —COO—$(CH_2)_k$— where k = from 1 to 6 |
| 1583 | —$CH_2$—CH(OH)—$CH_3$ | —$CH_2$—$CH_2$—$CH_3$ | —$CH_2$—$CH_2$—$CH_3$ | —COO—$(CH_2)_k$— where k = from 1 to 6 |
| 1584 | —CH(OH)—$CH_2$—$CH_3$ | —$CH_2$—$CH_2$—$CH_3$ | —$CH_2$—$CH_2$—$CH_3$ | —COO—$(CH_2)_k$— where k = from 1 to 6 |
| 1585 | —H | —$CH_2$—$CH_2$—$CH_3$ | —$CH(CH_3)$—$CH_3$ | —COO—$(CH_2)_k$— where k = from 1 to 6 |
| 1586 | —$CH_3$ | —$CH_2$—$CH_2$—$CH_3$ | —$CH(CH_3)$—$CH_3$ | —COO—$(CH_2)_k$— where k = from 1 to 6 |
| 1587 | —$CH_2$—$CH_3$ | —$CH_2$—$CH_2$—$CH_3$ | —$CH(CH_3)$—$CH_3$ | —COO—$(CH_2)_k$— where k = from 1 to 6 |
| 1588 | —$CH_2$—$CH_2$—$CH_3$ | —$CH_2$—$CH_2$—$CH_3$ | —$CH(CH_3)$—$CH_3$ | —COO—$(CH_2)_k$— where k = from 1 to 6 |
| 1589 | —$CH(CH_3)$—$CH_3$ | —$CH_2$—$CH_2$—$CH_3$ | —$CH(CH_3)$—$CH_3$ | —COO—$(CH_2)_k$— where k = from 1 to 6 |
| 1590 | —$CH_2$—OH | —$CH_2$—$CH_2$—$CH_3$ | —$CH(CH_3)$—$CH_3$ | —COO—$(CH_2)_k$— where k = from 1 to 6 |

-continued

| No. | $R^5$ | $R^6$ | $R^7$ | X |
|---|---|---|---|---|
| 1591 | —$CH_2$—$CH_2$—OH | —$CH_2$—$CH_2$—$CH_3$ | —CH($CH_3$)—$CH_3$ | —COO—$(CH_2)_k$— where k = from 1 to 6 |
| 1592 | —CH(OH)—$CH_3$ | —$CH_2$—$CH_2$—$CH_3$ | —CH($CH_3$)—$CH_3$ | —COO—$(CH_2)_k$— where k = from 1 to 6 |
| 1593 | —$CH_2$—$CH_2$—$CH_2$—OH | —$CH_2$—$CH_2$—$CH_3$ | —CH($CH_3$)—$CH_3$ | —COO—$(CH_2)_k$— where k = from 1 to 6 |
| 1594 | —$CH_2$—CH(OH)—$CH_3$ | —$CH_2$—$CH_2$—$CH_3$ | —CH($CH_3$)—$CH_3$ | —COO—$(CH_2)_k$— where k = from 1 to 6 |
| 1595 | —CH(OH)—$CH_2$—$CH_3$ | —$CH_2$—$CH_2$—$CH_3$ | —CH($CH_3$)—$CH_3$ | —COO—$(CH_2)_k$— where k = from 1 to 6 |
| 1596 | —H | —CH($CH_3$)—$CH_3$ | —H | —COO—$(CH_2)_k$— where k = from 1 to 6 |
| 1597 | —$CH_3$ | —CH($CH_3$)—$CH_3$ | —H | —COO—$(CH_2)_k$— where k = from 1 to 6 |
| 1598 | —$CH_2$—$CH_3$ | —CH($CH_3$)—$CH_3$ | —H | —COO—$(CH_2)_k$— where k = from 1 to 6 |
| 1599 | —$CH_2$—$CH_2$—$CH_3$ | —CH($CH_3$)—$CH_3$ | —H | —COO—$(CH_2)_k$— where k = from 1 to 6 |
| 1600 | —CH($CH_3$)—$CH_3$ | —CH($CH_3$)—$CH_3$ | —H | —COO—$(CH_2)_k$— where k = from 1 to 6 |
| 1601 | —$CH_2$—OH | —CH($CH_3$)—$CH_3$ | —H | —COO—$(CH_2)_k$— where k = from 1 to 6 |
| 1602 | —$CH_2$—$CH_2$—OH | —CH($CH_3$)—$CH_3$ | —H | —COO—$(CH_2)_k$— where k = from 1 to 6 |
| 1603 | —CH(OH)—$CH_3$ | —CH($CH_3$)—$CH_3$ | —H | —COO—$(CH_2)_k$— where k = from 1 to 6 |
| 1604 | —$CH_2$—$CH_2$—$CH_2$—OH | —CH($CH_3$)—$CH_3$ | —H | —COO—$(CH_2)_k$— where k = from 1 to 6 |
| 1605 | —$CH_2$—CH(OH)—$CH_3$ | —CH($CH_3$)—$CH_3$ | —H | —COO—$(CH_2)_k$— where k = from 1 to 6 |
| 1606 | —CH(OH)—$CH_2$—$CH_3$ | —CH($CH_3$)—$CH_3$ | —H | —COO—$(CH_2)_k$— where k = from 1 to 6 |
| 1607 | —H | —CH($CH_3$)—$CH_3$ | —$CH_3$ | —COO—$(CH_2)_k$— where k = from 1 to 6 |
| 1608 | —$CH_3$ | —CH($CH_3$)—$CH_3$ | —$CH_3$ | —COO—$(CH_2)_k$— where k = from 1 to 6 |
| 1609 | —$CH_2$—$CH_3$ | —CH($CH_3$)—$CH_3$ | —$CH_3$ | —COO—$(CH_2)_k$— where k = from 1 to 6 |
| 1610 | —$CH_2$—$CH_2$—$CH_3$ | —CH($CH_3$)—$CH_3$ | —$CH_3$ | —COO—$(CH_2)_k$— where k = from 1 to 6 |
| 1611 | —CH($CH_3$)—$CH_3$ | —CH($CH_3$)—$CH_3$ | —$CH_3$ | —COO—$(CH_2)_k$— where k = from 1 to 6 |
| 1612 | —$CH_2$—OH | —CH($CH_3$)—$CH_3$ | —$CH_3$ | —COO—$(CH_2)_k$— where k = from 1 to 6 |
| 1613 | —$CH_2$—$CH_2$—OH | —CH($CH_3$)—$CH_3$ | —$CH_3$ | —COO—$(CH_2)_k$— where k = from 1 to 6 |
| 1614 | —CH(OH)—$CH_3$ | —CH($CH_3$)—$CH_3$ | —$CH_3$ | —COO—$(CH_2)_k$— where k = from 1 to 6 |
| 1615 | —$CH_2$—$CH_2$—$CH_2$—OH | —CH($CH_3$)—$CH_3$ | —$CH_3$ | —COO—$(CH_2)_k$— where k = from 1 to 6 |
| 1616 | —$CH_2$—CH(OH)—$CH_3$ | —CH($CH_3$)—$CH_3$ | —$CH_3$ | —COO—$(CH_2)_k$— where k = from 1 to 6 |
| 1617 | —CH(OH)—$CH_2$—$CH_3$ | —CH($CH_3$)—$CH_3$ | —$CH_3$ | —COO—$(CH_2)_k$— where k = from 1 to 6 |
| 1618 | —H | —CH($CH_3$)—$CH_3$ | —$CH_2$—$CH_3$ | —COO—$(CH_2)_k$— where k = from 1 to 6 |
| 1619 | —$CH_3$ | —CH($CH_3$)—$CH_3$ | —$CH_2$—$CH_3$ | —COO—$(CH_2)_k$— where k = from 1 to 6 |
| 1620 | —$CH_2$—$CH_3$ | —CH($CH_3$)—$CH_3$ | —$CH_2$—$CH_3$ | —COO—$(CH_2)_k$— where k = from 1 to 6 |
| 1621 | —$CH_2$—$CH_2$—$CH_3$ | —CH($CH_3$)—$CH_3$ | —$CH_2$—$CH_3$ | —COO—$(CH_2)_k$— where k = from 1 to 6 |
| 1622 | —CH($CH_3$)—$CH_3$ | —CH($CH_3$)—$CH_3$ | —$CH_2$—$CH_3$ | —COO—$(CH_2)_k$— where k = from 1 to 6 |
| 1623 | —$CH_2$—OH | —CH($CH_3$)—$CH_3$ | —$CH_2$—$CH_3$ | —COO—$(CH_2)_k$— where k = from 1 to 6 |
| 1624 | —$CH_2$—$CH_2$—OH | —CH($CH_3$)—$CH_3$ | —$CH_2$—$CH_3$ | —COO—$(CH_2)_k$— where k = from 1 to 6 |
| 1625 | —CH(OH)—$CH_3$ | —CH($CH_3$)—$CH_3$ | —$CH_2$—$CH_3$ | —COO—$(CH_2)_k$— where k = from 1 to 6 |
| 1626 | —$CH_2$—$CH_2$—$CH_2$—OH | —CH($CH_3$)—$CH_3$ | —$CH_2$—$CH_3$ | —COO—$(CH_2)_k$— where k = from 1 to 6 |
| 1627 | —$CH_2$—CH(OH)—$CH_3$ | —CH($CH_3$)—$CH_3$ | —$CH_2$—$CH_3$ | —COO—$(CH_2)_k$— where k = from 1 to 6 |
| 1628 | —CH(OH)—$CH_2$—$CH_3$ | —CH($CH_3$)—$CH_3$ | —$CH_2$—$CH_3$ | —COO—$(CH_2)_k$— where k = from 1 to 6 |

-continued

| No. | $R^5$ | $R^6$ | $R^7$ | X |
|---|---|---|---|---|
| 1629 | —H | —CH(CH$_3$)—CH$_3$ | —CH$_2$—CH$_2$—CH$_3$ | —COO—(CH$_2$)$_k$— where k = from 1 to 6 |
| 1630 | —CH$_3$ | —CH(CH$_3$)—CH$_3$ | —CH$_2$—CH$_2$—CH$_3$ | —COO—(CH$_2$)$_k$— where k = from 1 to 6 |
| 1631 | —CH$_2$—CH$_3$ | —CH(CH$_3$)—CH$_3$ | —CH$_2$—CH$_2$—CH$_3$ | —COO—(CH$_2$)$_k$— where k = from 1 to 6 |
| 1632 | —CH$_2$—CH$_2$—CH$_3$ | —CH(CH$_3$)—CH$_3$ | —CH$_2$—CH$_2$—CH$_3$ | —COO—(CH$_2$)$_k$— where k = from 1 to 6 |
| 1633 | —CH(CH$_3$)—CH$_3$ | —CH(CH$_3$)—CH$_3$ | —CH$_2$—CH$_2$—CH$_3$ | —COO—(CH$_2$)$_k$— where k = from 1 to 6 |
| 1634 | —CH$_2$—OH | —CH(CH$_3$)—CH$_3$ | —CH$_2$—CH$_2$—CH$_3$ | —COO—(CH$_2$)$_k$— where k = from 1 to 6 |
| 1635 | —CH$_2$—CH$_2$—OH | —CH(CH$_3$)—CH$_3$ | —CH$_2$—CH$_2$—CH$_3$ | —COO—(CH$_2$)$_k$— where k = from 1 to 6 |
| 1636 | —CH(OH)—CH$_3$ | —CH(CH$_3$)—CH$_3$ | —CH$_2$—CH$_2$—CH$_3$ | —COO—(CH$_2$)$_k$— where k = from 1 to 6 |
| 1637 | —CH$_2$—CH$_2$—CH$_2$—OH | —CH(CH$_3$)—CH$_3$ | —CH$_2$—CH$_2$—CH$_3$ | —COO—(CH$_2$)$_k$— where k = from 1 to 6 |
| 1638 | —CH$_2$—CH(OH)—CH$_3$ | —CH(CH$_3$)—CH$_3$ | —CH$_2$—CH$_2$—CH$_3$ | —COO—(CH$_2$)$_k$— where k = from 1 to 6 |
| 1639 | —CH(OH)—CH$_2$—CH$_3$ | —CH(CH$_3$)—CH$_3$ | —CH$_2$—CH$_2$—CH$_3$ | —COO—(CH$_2$)$_k$— where k = from 1 to 6 |
| 1640 | —H | —CH(CH$_3$)—CH$_3$ | —CH(CH$_3$)—CH$_3$ | —COO—(CH$_2$)$_k$— where k = from 1 to 6 |
| 1641 | —CH$_3$ | —CH(CH$_3$)—CH$_3$ | —CH(CH$_3$)—CH$_3$ | —COO—(CH$_2$)$_k$— where k = from 1 to 6 |
| 1642 | —CH$_2$—CH$_3$ | —CH(CH$_3$)—CH$_3$ | —CH(CH$_3$)—CH$_3$ | —COO—(CH$_2$)$_k$— where k = from 1 to 6 |
| 1643 | —CH$_2$—CH$_2$—CH$_3$ | —CH(CH$_3$)—CH$_3$ | —CH(CH$_3$)—CH$_3$ | —COO—(CH$_2$)$_k$— where k = from 1 to 6 |
| 1644 | —CH(CH$_3$)—CH$_3$ | —CH(CH$_3$)—CH$_3$ | —CH(CH$_3$)—CH$_3$ | —COO—(CH$_2$)$_k$— where k = from 1 to 6 |
| 1645 | —CH$_2$—OH | —CH(CH$_3$)—CH$_3$ | —CH(CH$_3$)—CH$_3$ | —COO—(CH$_2$)$_k$— where k = from 1 to 6 |
| 1646 | —CH$_2$—CH$_2$—OH | —CH(CH$_3$)—CH$_3$ | —CH(CH$_3$)—CH$_3$ | —COO—(CH$_2$)$_k$— where k = from 1 to 6 |
| 1647 | —CH(OH)—CH$_3$ | —CH(CH$_3$)—CH$_3$ | —CH(CH$_3$)—CH$_3$ | —COO—(CH$_2$)$_k$— where k = from 1 to 6 |
| 1648 | —CH$_2$—CH$_2$—CH$_2$—OH | —CH(CH$_3$)—CH$_3$ | —CH(CH$_3$)—CH$_3$ | —COO—(CH$_2$)$_k$— where k = from 1 to 6 |
| 1649 | —CH$_2$—CH(OH)—CH$_3$ | —CH(CH$_3$)—CH$_3$ | —CH(CH$_3$)—CH$_3$ | —COO—(CH$_2$)$_k$— where k = from 1 to 6 |
| 1650 | —CH(OH)—CH$_2$—CH$_3$ | —CH(CH$_3$)—CH$_3$ | —CH(CH$_3$)—CH$_3$ | —COO—(CH$_2$)$_k$— where k = from 1 to 6 |
| 1651 | —H | —H | —H | —C(O)—NH—C(CH$_3$)$_2$— |
| 1652 | —CH$_3$ | —H | —H | —C(O)—NH—C(CH$_3$)$_2$— |
| 1653 | —CH$_2$—CH$_3$ | —H | —H | —C(O)—NH—C(CH$_3$)$_2$— |
| 1654 | —CH$_2$—CH$_2$—CH$_3$ | —H | —H | —C(O)—NH—C(CH$_3$)$_2$— |
| 1655 | —CH(CH$_3$)—CH$_3$ | —H | —H | —C(O)—NH—C(CH$_3$)$_2$— |
| 1656 | —CH$_2$—OH | —H | —H | —C(O)—NH—C(CH$_3$)$_2$— |
| 1657 | —CH$_2$—CH$_2$—OH | —H | —H | —C(O)—NH—C(CH$_3$)$_2$— |
| 1658 | —CH(OH)—CH$_3$ | —H | —H | —C(O)—NH—C(CH$_3$)$_2$— |
| 1659 | —CH$_2$—CH$_2$—CH$_2$—OH | —H | —H | —C(O)—NH—C(CH$_3$)$_2$— |
| 1660 | —CH$_2$—CH(OH)—CH$_3$ | —H | —H | —C(O)—NH—C(CH$_3$)$_2$— |
| 1661 | —CH(OH)—CH$_2$—CH$_3$ | —H | —H | —C(O)—NH—C(CH$_3$)$_2$— |
| 1662 | —H | —H | —CH$_3$ | —C(O)—NH—C(CH$_3$)$_2$— |
| 1663 | —CH$_3$ | —H | —CH$_3$ | —C(O)—NH—C(CH$_3$)$_2$— |
| 1664 | —CH$_2$—CH$_3$ | —H | —CH$_3$ | —C(O)—NH—C(CH$_3$)$_2$— |
| 1665 | —CH$_2$—CH$_2$—CH$_3$ | —H | —CH$_3$ | —C(O)—NH—C(CH$_3$)$_2$— |
| 1666 | —CH(CH$_3$)—CH$_3$ | —H | —CH$_3$ | —C(O)—NH—C(CH$_3$)$_2$— |
| 1667 | —CH$_2$—OH | —H | —CH$_3$ | —C(O)—NH—C(CH$_3$)$_2$— |
| 1668 | —CH$_2$—CH$_2$—OH | —H | —CH$_3$ | —C(O)—NH—C(CH$_3$)$_2$— |
| 1669 | —CH(OH)—CH$_3$ | —H | —CH$_3$ | —C(O)—NH—C(CH$_3$)$_2$— |
| 1670 | —CH$_2$—CH$_2$—CH$_2$—OH | —H | —CH$_3$ | —C(O)—NH—C(CH$_3$)$_2$— |
| 1671 | —CH$_2$—CH(OH)—CH$_3$ | —H | —CH$_3$ | —C(O)—NH—C(CH$_3$)$_2$— |
| 1672 | —CH(OH)—CH$_2$—CH$_3$ | —H | —CH$_3$ | —C(O)—NH—C(CH$_3$)$_2$— |
| 1673 | —H | —H | —CH$_2$—CH$_3$ | —C(O)—NH—C(CH$_3$)$_2$— |
| 1674 | —CH$_3$ | —H | —CH$_2$—CH$_3$ | —C(O)—NH—C(CH$_3$)$_2$— |
| 1675 | —CH$_2$—CH$_3$ | —H | —CH$_2$—CH$_3$ | —C(O)—NH—C(CH$_3$)$_2$— |
| 1676 | —CH$_2$—CH$_2$—CH$_3$ | —H | —CH$_2$—CH$_3$ | —C(O)—NH—C(CH$_3$)$_2$— |
| 1677 | —CH(CH$_3$)—CH$_3$ | —H | —CH$_2$—CH$_3$ | —C(O)—NH—C(CH$_3$)$_2$— |
| 1678 | —CH$_2$—OH | —H | —CH$_2$—CH$_3$ | —C(O)—NH—C(CH$_3$)$_2$— |
| 1679 | —CH$_2$—CH$_2$—OH | —H | —CH$_2$—CH$_3$ | —C(O)—NH—C(CH$_3$)$_2$— |
| 1680 | —CH(OH)—CH$_3$ | —H | —CH$_2$—CH$_3$ | —C(O)—NH—C(CH$_3$)$_2$— |
| 1681 | —CH$_2$—CH$_2$—CH$_2$—OH | —H | —CH$_2$—CH$_3$ | —C(O)—NH—C(CH$_3$)$_2$— |
| 1682 | —CH$_2$—CH(OH)—CH$_3$ | —H | —CH$_2$—CH$_3$ | —C(O)—NH—C(CH$_3$)$_2$— |
| 1683 | —CH(OH)—CH$_2$—CH$_3$ | —H | —CH$_2$—CH$_3$ | —C(O)—NH—C(CH$_3$)$_2$— |

-continued

| No. | $R^5$ | $R^6$ | $R^7$ | X |
|---|---|---|---|---|
| 1684 | —H | —H | —$CH_2$—$CH_2$—$CH_3$ | —C(O)—NH—$C(CH_3)_2$— |
| 1685 | —$CH_3$ | —H | —$CH_2$—$CH_2$—$CH_3$ | —C(O)—NH—$C(CH_3)_2$— |
| 1686 | —$CH_2$—$CH_3$ | —H | —$CH_2$—$CH_2$—$CH_3$ | —C(O)—NH—$C(CH_3)_2$— |
| 1687 | —$CH_2$—$CH_2$—$CH_3$ | —H | —$CH_2$—$CH_2$—$CH_3$ | —C(O)—NH—$C(CH_3)_2$— |
| 1688 | —$CH(CH_3)$—$CH_3$ | —H | —$CH_2$—$CH_2$—$CH_3$ | —C(O)—NH—$C(CH_3)_2$— |
| 1689 | —$CH_2$—OH | —H | —$CH_2$—$CH_2$—$CH_3$ | —C(O)—NH—$C(CH_3)_2$— |
| 1690 | —$CH_2$—$CH_2$—OH | —H | —$CH_2$—$CH_2$—$CH_3$ | —C(O)—NH—$C(CH_3)_2$— |
| 1691 | —CH(OH)—$CH_3$ | —H | —$CH_2$—$CH_2$—$CH_3$ | —C(O)—NH—$C(CH_3)_2$— |
| 1692 | —$CH_2$—$CH_2$—$CH_2$—OH | —H | —$CH_2$—$CH_2$—$CH_3$ | —C(O)—NH—$C(CH_3)_2$— |
| 1693 | —$CH_2$—CH(OH)—$CH_3$ | —H | —$CH_2$—$CH_2$—$CH_3$ | —C(O)—NH—$C(CH_3)_2$— |
| 1694 | —CH(OH)—$CH_2$—$CH_3$ | —H | —$CH_2$—$CH_2$—$CH_3$ | —C(O)—NH—$C(CH_3)_2$— |
| 1695 | —H | —H | —$CH(CH_3)$—$CH_3$ | —C(O)—NH—$C(CH_3)_2$— |
| 1696 | —$CH_3$ | —H | —$CH(CH_3)$—$CH_3$ | —C(O)—NH—$C(CH_3)_2$— |
| 1697 | —$CH_2$—$CH_3$ | —H | —$CH(CH_3)$—$CH_3$ | —C(O)—NH—$C(CH_3)_2$— |
| 1698 | —$CH_2$—$CH_2$—$CH_3$ | —H | —$CH(CH_3)$—$CH_3$ | —C(O)—NH—$C(CH_3)_2$— |
| 1699 | —$CH(CH_3)$—$CH_3$ | —H | —$CH(CH_3)$—$CH_3$ | —C(O)—NH—$C(CH_3)_2$— |
| 1700 | —$CH_2$—OH | —H | —$CH(CH_3)$—$CH_3$ | —C(O)—NH—$C(CH_3)_2$— |
| 1701 | —$CH_2$—$CH_2$—OH | —H | —$CH(CH_3)$—$CH_3$ | —C(O)—NH—$C(CH_3)_2$— |
| 1702 | —CH(OH)—$CH_3$ | —H | —$CH(CH_3)$—$CH_3$ | —C(O)—NH—$C(CH_3)_2$— |
| 1703 | —$CH_2$—$CH_2$—$CH_2$—OH | —H | —$CH(CH_3)$—$CH_3$ | —C(O)—NH—$C(CH_3)_2$— |
| 1704 | —$CH_2$—CH(OH)—$CH_3$ | —H | —$CH(CH_3)$—$CH_3$ | —C(O)—NH—$C(CH_3)_2$— |
| 1705 | —CH(OH)—$CH_2$—$CH_3$ | —H | —$CH(CH_3)$—$CH_3$ | —C(O)—NH—$C(CH_3)_2$— |
| 1706 | —H | —$CH_3$ | —H | —C(O)—NH—$C(CH_3)_2$— |
| 1707 | —$CH_3$ | —$CH_3$ | —H | —C(O)—NH—$C(CH_3)_2$— |
| 1708 | —$CH_2$—$CH_3$ | —$CH_3$ | —H | —C(O)—NH—$C(CH_3)_2$— |
| 1709 | —$CH_2$—$CH_2$—$CH_3$ | —$CH_3$ | —H | —C(O)—NH—$C(CH_3)_2$— |
| 1710 | —$CH(CH_3)$—$CH_3$ | —$CH_3$ | —H | —C(O)—NH—$C(CH_3)_2$— |
| 1711 | —$CH_2$—OH | —$CH_3$ | —H | —C(O)—NH—$C(CH_3)_2$— |
| 1712 | —$CH_2$—$CH_2$—OH | —$CH_3$ | —H | —C(O)—NH—$C(CH_3)_2$— |
| 1713 | —CH(OH)—$CH_3$ | —$CH_3$ | —H | —C(O)—NH—$C(CH_3)_2$— |
| 1714 | —$CH_2$—$CH_2$—$CH_2$—OH | —$CH_3$ | —H | —C(O)—NH—$C(CH_3)_2$— |
| 1715 | —$CH_2$—CH(OH)—$CH_3$ | —$CH_3$ | —H | —C(O)—NH—$C(CH_3)_2$— |
| 1716 | —CH(OH)—$CH_2$—$CH_3$ | —$CH_3$ | —H | —C(O)—NH—$C(CH_3)_2$— |
| 1717 | —H | —$CH_3$ | —$CH_3$ | —C(O)—NH—$C(CH_3)_2$— |
| 1718 | —$CH_3$ | —$CH_3$ | —$CH_3$ | —C(O)—NH—$C(CH_3)_2$— |
| 1719 | —$CH_2$—$CH_3$ | —$CH_3$ | —$CH_3$ | —C(O)—NH—$C(CH_3)_2$— |
| 1720 | —$CH_2$—$CH_2$—$CH_3$ | —$CH_3$ | —$CH_3$ | —C(O)—NH—$C(CH_3)_2$— |
| 1721 | —$CH(CH_3)$—$CH_3$ | —$CH_3$ | —$CH_3$ | —C(O)—NH—$C(CH_3)_2$— |
| 1722 | —$CH_2$—OH | —$CH_3$ | —$CH_3$ | —C(O)—NH—$C(CH_3)_2$— |
| 1723 | —$CH_2$—$CH_2$—OH | —$CH_3$ | —$CH_3$ | —C(O)—NH—$C(CH_3)_2$— |
| 1724 | —CH(OH)—$CH_3$ | —$CH_3$ | —$CH_3$ | —C(O)—NH—$C(CH_3)_2$— |
| 1725 | —$CH_2$—$CH_2$—$CH_2$—OH | —$CH_3$ | —$CH_3$ | —C(O)—NH—$C(CH_3)_2$— |
| 1726 | —$CH_2$—CH(OH)—$CH_3$ | —$CH_3$ | —$CH_3$ | —C(O)—NH—$C(CH_3)_2$— |
| 1727 | —CH(OH)—$CH_2$—$CH_3$ | —$CH_3$ | —$CH_3$ | —C(O)—NH—$C(CH_3)_2$— |
| 1728 | —H | —$CH_3$ | —$CH_2$—$CH_3$ | —C(O)—NH—$C(CH_3)_2$— |
| 1729 | —$CH_3$ | —$CH_3$ | —$CH_2$—$CH_3$ | —C(O)—NH—$C(CH_3)_2$— |
| 1730 | —$CH_2$—$CH_3$ | —$CH_3$ | —$CH_2$—$CH_3$ | —C(O)—NH—$C(CH_3)_2$— |
| 1731 | —$CH_2$—$CH_2$—$CH_3$ | —$CH_3$ | —$CH_2$—$CH_3$ | —C(O)—NH—$C(CH_3)_2$— |
| 1732 | —$CH(CH_3)$—$CH_3$ | —$CH_3$ | —$CH_2$—$CH_3$ | —C(O)—NH—$C(CH_3)_2$— |
| 1733 | —$CH_2$—OH | —$CH_3$ | —$CH_2$—$CH_3$ | —C(O)—NH—$C(CH_3)_2$— |
| 1734 | —$CH_2$—$CH_2$—OH | —$CH_3$ | —$CH_2$—$CH_3$ | —C(O)—NH—$C(CH_3)_2$— |
| 1735 | —CH(OH)—$CH_3$ | —$CH_3$ | —$CH_2$—$CH_3$ | —C(O)—NH—$C(CH_3)_2$— |
| 1736 | —$CH_2$—$CH_2$—$CH_2$—OH | —$CH_3$ | —$CH_2$—$CH_3$ | —C(O)—NH—$C(CH_3)_2$— |
| 1737 | —$CH_2$—CH(OH)—$CH_3$ | —$CH_3$ | —$CH_2$—$CH_3$ | —C(O)—NH—$C(CH_3)_2$— |
| 1738 | —CH(OH)—$CH_2$—$CH_3$ | —$CH_3$ | —$CH_2$—$CH_3$ | —C(O)—NH—$C(CH_3)_2$— |
| 1739 | —H | —$CH_3$ | —$CH_2$—$CH_2$—$CH_3$ | —C(O)—NH—$C(CH_3)_2$— |
| 1740 | —$CH_3$ | —$CH_3$ | —$CH_2$—$CH_2$—$CH_3$ | —C(O)—NH—$C(CH_3)_2$— |
| 1741 | —$CH_2$—$CH_3$ | —$CH_3$ | —$CH_2$—$CH_2$—$CH_3$ | —C(O)—NH—$C(CH_3)_2$— |
| 1742 | —$CH_2$—$CH_2$—$CH_3$ | —$CH_3$ | —$CH_2$—$CH_2$—$CH_3$ | —C(O)—NH—$C(CH_3)_2$— |
| 1743 | —$CH(CH_3)$—$CH_3$ | —$CH_3$ | —$CH_2$—$CH_2$—$CH_3$ | —C(O)—NH—$C(CH_3)_2$— |
| 1744 | —$CH_2$—OH | —$CH_3$ | —$CH_2$—$CH_2$—$CH_3$ | —C(O)—NH—$C(CH_3)_2$— |
| 1745 | —$CH_2$—$CH_2$—OH | —$CH_3$ | —$CH_2$—$CH_2$—$CH_3$ | —C(O)—NH—$C(CH_3)_2$— |
| 1746 | —CH(OH)—$CH_3$ | —$CH_3$ | —$CH_2$—$CH_2$—$CH_3$ | —C(O)—NH—$C(CH_3)_2$— |
| 1747 | —$CH_2$—$CH_2$—$CH_2$—OH | —$CH_3$ | —$CH_2$—$CH_2$—$CH_3$ | —C(O)—NH—$C(CH_3)_2$— |
| 1748 | —$CH_2$—CH(OH)—$CH_3$ | —$CH_3$ | —$CH_2$—$CH_2$—$CH_3$ | —C(O)—NH—$C(CH_3)_2$— |
| 1749 | —CH(OH)—$CH_2$—$CH_3$ | —$CH_3$ | —$CH_2$—$CH_2$—$CH_3$ | —C(O)—NH—$C(CH_3)_2$— |
| 1750 | —H | —$CH_3$ | —$CH(CH_3)$—$CH_3$ | —C(O)—NH—$C(CH_3)_2$— |
| 1751 | —$CH_3$ | —$CH_3$ | —$CH(CH_3)$—$CH_3$ | —C(O)—NH—$C(CH_3)_2$— |
| 1752 | —$CH_2$—$CH_3$ | —$CH_3$ | —$CH(CH_3)$—$CH_3$ | —C(O)—NH—$C(CH_3)_2$— |
| 1753 | —$CH_2$—$CH_2$—$CH_3$ | —$CH_3$ | —$CH(CH_3)$—$CH_3$ | —C(O)—NH—$C(CH_3)_2$— |
| 1754 | —$CH(CH_3)$—$CH_3$ | —$CH_3$ | —$CH(CH_3)$—$CH_3$ | —C(O)—NH—$C(CH_3)_2$— |
| 1755 | —$CH_2$—OH | —$CH_3$ | —$CH(CH_3)$—$CH_3$ | —C(O)—NH—$C(CH_3)_2$— |
| 1756 | —$CH_2$—$CH_2$—OH | —$CH_3$ | —$CH(CH_3)$—$CH_3$ | —C(O)—NH—$C(CH_3)_2$— |
| 1757 | —CH(OH)—$CH_3$ | —$CH_3$ | —$CH(CH_3)$—$CH_3$ | —C(O)—NH—$C(CH_3)_2$— |
| 1758 | —$CH_2$—$CH_2$—$CH_2$—OH | —$CH_3$ | —$CH(CH_3)$—$CH_3$ | —C(O)—NH—$C(CH_3)_2$— |
| 1759 | —$CH_2$—CH(OH)—$CH_3$ | —$CH_3$ | —$CH(CH_3)$—$CH_3$ | —C(O)—NH—$C(CH_3)_2$— |
| 1760 | —CH(OH)—$CH_2$—$CH_3$ | —$CH_3$ | —$CH(CH_3)$—$CH_3$ | —C(O)—NH—$C(CH_3)_2$— |

-continued

| No. | $R^5$ | $R^6$ | $R^7$ | X |
|---|---|---|---|---|
| 1761 | —H | —$CH_2$—$CH_3$ | —H | —C(O)—NH—$C(CH_3)_2$— |
| 1762 | —$CH_3$ | —$CH_2$—$CH_3$ | —H | —C(O)—NH—$C(CH_3)_2$— |
| 1763 | —$CH_2$—$CH_3$ | —$CH_2$—$CH_3$ | —H | —C(O)—NH—$C(CH_3)_2$— |
| 1764 | —$CH_2$—$CH_2$—$CH_3$ | —$CH_2$—$CH_3$ | —H | —C(O)—NH—$C(CH_3)_2$— |
| 1765 | —$CH(CH_3)$—$CH_3$ | —$CH_2$—$CH_3$ | —H | —C(O)—NH—$C(CH_3)_2$— |
| 1766 | —$CH_2$—OH | —$CH_2$—$CH_3$ | —H | —C(O)—NH—$C(CH_3)_2$— |
| 1767 | —$CH_2$—$CH_2$—OH | —$CH_2$—$CH_3$ | —H | —C(O)—NH—$C(CH_3)_2$— |
| 1768 | —CH(OH)—$CH_3$ | —$CH_2$—$CH_3$ | —H | —C(O)—NH—$C(CH_3)_2$— |
| 1769 | —$CH_2$—$CH_2$—$CH_2$—OH | —$CH_2$—$CH_3$ | —H | —C(O)—NH—$C(CH_3)_2$— |
| 1770 | —$CH_2$—CH(OH)—$CH_3$ | —$CH_2$—$CH_3$ | —H | —C(O)—NH—$C(CH_3)_2$— |
| 1771 | —CH(OH)—$CH_2$—$CH_3$ | —$CH_2$—$CH_3$ | —H | —C(O)—NH—$C(CH_3)_2$— |
| 1772 | —H | —$CH_2$—$CH_3$ | —$CH_3$ | —C(O)—NH—$C(CH_3)_2$— |
| 1773 | —$CH_3$ | —$CH_2$—$CH_3$ | —$CH_3$ | —C(O)—NH—$C(CH_3)_2$— |
| 1774 | —$CH_2$—$CH_3$ | —$CH_2$—$CH_3$ | —$CH_3$ | —C(O)—NH—$C(CH_3)_2$— |
| 1775 | —$CH_2$—$CH_2$—$CH_3$ | —$CH_2$—$CH_3$ | —$CH_3$ | —C(O)—NH—$C(CH_3)_2$— |
| 1776 | —$CH(CH_3)$—$CH_3$ | —$CH_2$—$CH_3$ | —$CH_3$ | —C(O)—NH—$C(CH_3)_2$— |
| 1777 | —$CH_2$—OH | —$CH_2$—$CH_3$ | —$CH_3$ | —C(O)—NH—$C(CH_3)_2$— |
| 1778 | —$CH_2$—$CH_2$—OH | —$CH_2$—$CH_3$ | —$CH_3$ | —C(O)—NH—$C(CH_3)_2$— |
| 1779 | —CH(OH)—$CH_3$ | —$CH_2$—$CH_3$ | —$CH_3$ | —C(O)—NH—$C(CH_3)_2$— |
| 1780 | —$CH_2$—$CH_2$—$CH_2$—OH | —$CH_2$—$CH_3$ | —$CH_3$ | —C(O)—NH—$C(CH_3)_2$— |
| 1781 | —$CH_2$—CH(OH)—$CH_3$ | —$CH_2$—$CH_3$ | —$CH_3$ | —C(O)—NH—$C(CH_3)_2$— |
| 1782 | —CH(OH)—$CH_2$—$CH_3$ | —$CH_2$—$CH_3$ | —$CH_3$ | —C(O)—NH—$C(CH_3)_2$— |
| 1783 | —H | —$CH_2$—$CH_3$ | —$CH_2$—$CH_3$ | —C(O)—NH—$C(CH_3)_2$— |
| 1784 | —$CH_3$ | —$CH_2$—$CH_3$ | —$CH_2$—$CH_3$ | —C(O)—NH—$C(CH_3)_2$— |
| 1785 | —$CH_2$—$CH_3$ | —$CH_2$—$CH_3$ | —$CH_2$—$CH_3$ | —C(O)—NH—$C(CH_3)_2$— |
| 1786 | —$CH_2$—$CH_2$—$CH_3$ | —$CH_2$—$CH_3$ | —$CH_2$—$CH_3$ | —C(O)—NH—$C(CH_3)_2$— |
| 1787 | —$CH(CH_3)$—$CH_3$ | —$CH_2$—$CH_3$ | —$CH_2$—$CH_3$ | —C(O)—NH—$C(CH_3)_2$— |
| 1788 | —$CH_2$—OH | —$CH_2$—$CH_3$ | —$CH_2$—$CH_3$ | —C(O)—NH—$C(CH_3)_2$— |
| 1789 | —$CH_2$—$CH_2$—OH | —$CH_2$—$CH_3$ | —$CH_2$—$CH_3$ | —C(O)—NH—$C(CH_3)_2$— |
| 1790 | —CH(OH)—$CH_3$ | —$CH_2$—$CH_3$ | —$CH_2$—$CH_3$ | —C(O)—NH—$C(CH_3)_2$— |
| 1791 | —$CH_2$—$CH_2$—$CH_2$—OH | —$CH_2$—$CH_3$ | —$CH_2$—$CH_3$ | —C(O)—NH—$C(CH_3)_2$— |
| 1792 | —$CH_2$—CH(OH)—$CH_3$ | —$CH_2$—$CH_3$ | —$CH_2$—$CH_3$ | —C(O)—NH—$C(CH_3)_2$— |
| 1793 | —CH(OH)—$CH_2$—$CH_3$ | —$CH_2$—$CH_3$ | —$CH_2$—$CH_3$ | —C(O)—NH—$C(CH_3)_2$— |
| 1794 | —H | —$CH_2$—$CH_3$ | —$CH_2$—$CH_2$—$CH_3$ | —C(O)—NH—$C(CH_3)_2$— |
| 1795 | —$CH_3$ | —$CH_2$—$CH_3$ | —$CH_2$—$CH_2$—$CH_3$ | —C(O)—NH—$C(CH_3)_2$— |
| 1796 | —$CH_2$—$CH_3$ | —$CH_2$—$CH_3$ | —$CH_2$—$CH_2$—$CH_3$ | —C(O)—NH—$C(CH_3)_2$— |
| 1797 | —$CH_2$—$CH_2$—$CH_3$ | —$CH_2$—$CH_3$ | —$CH_2$—$CH_2$—$CH_3$ | —C(O)—NH—$C(CH_3)_2$— |
| 1798 | —$CH(CH_3)$—$CH_3$ | —$CH_2$—$CH_3$ | —$CH_2$—$CH_2$—$CH_3$ | —C(O)—NH—$C(CH_3)_2$— |
| 1799 | —$CH_2$—OH | —$CH_2$—$CH_3$ | —$CH_2$—$CH_2$—$CH_3$ | —C(O)—NH—$C(CH_3)_2$— |
| 1800 | —$CH_2$—$CH_2$—OH | —$CH_2$—$CH_3$ | —$CH_2$—$CH_2$—$CH_3$ | —C(O)—NH—$C(CH_3)_2$— |
| 1801 | —CH(OH)—$CH_3$ | —$CH_2$—$CH_3$ | —$CH_2$—$CH_2$—$CH_3$ | —C(O)—NH—$C(CH_3)_2$— |
| 1802 | —$CH_2$—$CH_2$—$CH_2$—OH | —$CH_2$—$CH_3$ | —$CH_2$—$CH_2$—$CH_3$ | —C(O)—NH—$C(CH_3)_2$— |
| 1803 | —$CH_2$—CH(OH)—$CH_3$ | —$CH_2$—$CH_3$ | —$CH_2$—$CH_2$—$CH_3$ | —C(O)—NH—$C(CH_3)_2$— |
| 1804 | —CH(OH)—$CH_2$—$CH_3$ | —$CH_2$—$CH_3$ | —$CH_2$—$CH_2$—$CH_3$ | —C(O)—NH—$C(CH_3)_2$— |
| 1805 | —H | —$CH_2$—$CH_3$ | —$CH(CH_3)$—$CH_3$ | —C(O)—NH—$C(CH_3)_2$— |
| 1806 | —$CH_3$ | —$CH_2$—$CH_3$ | —$CH(CH_3)$—$CH_3$ | —C(O)—NH—$C(CH_3)_2$— |
| 1807 | —$CH_2$—$CH_3$ | —$CH_2$—$CH_3$ | —$CH(CH_3)$—$CH_3$ | —C(O)—NH—$C(CH_3)_2$— |
| 1808 | —$CH_2$—$CH_2$—$CH_3$ | —$CH_2$—$CH_3$ | —$CH(CH_3)$—$CH_3$ | —C(O)—NH—$C(CH_3)_2$— |
| 1809 | —$CH(CH_3)$—$CH_3$ | —$CH_2$—$CH_3$ | —$CH(CH_3)$—$CH_3$ | —C(O)—NH—$C(CH_3)_2$— |
| 1810 | —$CH_2$—OH | —$CH_2$—$CH_3$ | —$CH(CH_3)$—$CH_3$ | —C(O)—NH—$C(CH_3)_2$— |
| 1811 | —$CH_2$—$CH_2$—OH | —$CH_2$—$CH_3$ | —$CH(CH_3)$—$CH_3$ | —C(O)—NH—$C(CH_3)_2$— |
| 1812 | —CH(OH)—$CH_3$ | —$CH_2$—$CH_3$ | —$CH(CH_3)$—$CH_3$ | —C(O)—NH—$C(CH_3)_2$— |
| 1813 | —$CH_2$—$CH_2$—$CH_2$—OH | —$CH_2$—$CH_3$ | —$CH(CH_3)$—$CH_3$ | —C(O)—NH—$C(CH_3)_2$— |
| 1814 | —$CH_2$—CH(OH)—$CH_3$ | —$CH_2$—$CH_3$ | —$CH(CH_3)$—$CH_3$ | —C(O)—NH—$C(CH_3)_2$— |
| 1815 | —CH(OH)—$CH_2$—$CH_3$ | —$CH_2$—$CH_3$ | —$CH(CH_3)$—$CH_3$ | —C(O)—NH—$C(CH_3)_2$— |
| 1816 | —H | —$CH_2$—$CH_2$—$CH_3$ | —H | —C(O)—NH—$C(CH_3)_2$— |
| 1817 | —$CH_3$ | —$CH_2$—$CH_2$—$CH_3$ | —H | —C(O)—NH—$C(CH_3)_2$— |
| 1818 | —$CH_2$—$CH_3$ | —$CH_2$—$CH_2$—$CH_3$ | —H | —C(O)—NH—$C(CH_3)_2$— |
| 1819 | —$CH_2$—$CH_2$—$CH_3$ | —$CH_2$—$CH_2$—$CH_3$ | —H | —C(O)—NH—$C(CH_3)_2$— |
| 1820 | —$CH(CH_3)$—$CH_3$ | —$CH_2$—$CH_2$—$CH_3$ | —H | —C(O)—NH—$C(CH_3)_2$— |
| 1821 | —$CH_2$—OH | —$CH_2$—$CH_2$—$CH_3$ | —H | —C(O)—NH—$C(CH_3)_2$— |
| 1822 | —$CH_2$—$CH_2$—OH | —$CH_2$—$CH_2$—$CH_3$ | —H | —C(O)—NH—$C(CH_3)_2$— |
| 1823 | —CH(OH)—$CH_3$ | —$CH_2$—$CH_2$—$CH_3$ | —H | —C(O)—NH—$C(CH_3)_2$— |
| 1824 | —$CH_2$—$CH_2$—$CH_2$—OH | —$CH_2$—$CH_2$—$CH_3$ | —H | —C(O)—NH—$C(CH_3)_2$— |
| 1825 | —$CH_2$—CH(OH)—$CH_3$ | —$CH_2$—$CH_2$—$CH_3$ | —H | —C(O)—NH—$C(CH_3)_2$— |
| 1826 | —CH(OH)—$CH_2$—$CH_3$ | —$CH_2$—$CH_2$—$CH_3$ | —H | —C(O)—NH—$C(CH_3)_2$— |
| 1827 | —H | —$CH_2$—$CH_2$—$CH_3$ | —$CH_3$ | —C(O)—NH—$C(CH_3)_2$— |
| 1828 | —$CH_3$ | —$CH_2$—$CH_2$—$CH_3$ | —$CH_3$ | —C(O)—NH—$C(CH_3)_2$— |
| 1829 | —$CH_2$—$CH_3$ | —$CH_2$—$CH_2$—$CH_3$ | —$CH_3$ | —C(O)—NH—$C(CH_3)_2$— |
| 1830 | —$CH_2$—$CH_2$—$CH_3$ | —$CH_2$—$CH_2$—$CH_3$ | —$CH_3$ | —C(O)—NH—$C(CH_3)_2$— |
| 1831 | —$CH(CH_3)$—$CH_3$ | —$CH_2$—$CH_2$—$CH_3$ | —$CH_3$ | —C(O)—NH—$C(CH_3)_2$— |
| 1832 | —$CH_2$—OH | —$CH_2$—$CH_2$—$CH_3$ | —$CH_3$ | —C(O)—NH—$C(CH_3)_2$— |
| 1833 | —$CH_2$—$CH_2$—OH | —$CH_2$—$CH_2$—$CH_3$ | —$CH_3$ | —C(O)—NH—$C(CH_3)_2$— |
| 1834 | —CH(OH)—$CH_3$ | —$CH_2$—$CH_2$—$CH_3$ | —$CH_3$ | —C(O)—NH—$C(CH_3)_2$— |
| 1835 | —$CH_2$—$CH_2$—$CH_2$—OH | —$CH_2$—$CH_2$—$CH_3$ | —$CH_3$ | —C(O)—NH—$C(CH_3)_2$— |
| 1836 | —$CH_2$—CH(OH)—$CH_3$ | —$CH_2$—$CH_2$—$CH_3$ | —$CH_3$ | —C(O)—NH—$C(CH_3)_2$— |
| 1837 | —CH(OH)—$CH_2$—$CH_3$ | —$CH_2$—$CH_2$—$CH_3$ | —$CH_3$ | —C(O)—NH—$C(CH_3)_2$— |

-continued

| No. | $R^5$ | $R^6$ | $R^7$ | X |
|---|---|---|---|---|
| 1838 | —H | —$CH_2$—$CH_2$—$CH_3$ | —$CH_2$—$CH_3$ | —C(O)—NH—$C(CH_3)_2$— |
| 1839 | —$CH_3$ | —$CH_2$—$CH_2$—$CH_3$ | —$CH_2$—$CH_3$ | —C(O)—NH—$C(CH_3)_2$— |
| 1840 | —$CH_2$—$CH_3$ | —$CH_2$—$CH_2$—$CH_3$ | —$CH_2$—$CH_3$ | —C(O)—NH—$C(CH_3)_2$— |
| 1841 | —$CH_2$—$CH_2$—$CH_3$ | —$CH_2$—$CH_2$—$CH_3$ | —$CH_2$—$CH_3$ | —C(O)—NH—$C(CH_3)_2$— |
| 1842 | —$CH(CH_3)$—$CH_3$ | —$CH_2$—$CH_2$—$CH_3$ | —$CH_2$—$CH_3$ | —C(O)—NH—$C(CH_3)_2$— |
| 1843 | —$CH_2$—OH | —$CH_2$—$CH_2$—$CH_3$ | —$CH_2$—$CH_3$ | —C(O)—NH—$C(CH_3)_2$— |
| 1844 | —$CH_2$—$CH_2$—OH | —$CH_2$—$CH_2$—$CH_3$ | —$CH_2$—$CH_3$ | —C(O)—NH—$C(CH_3)_2$— |
| 1845 | —CH(OH)—$CH_3$ | —$CH_2$—$CH_2$—$CH_3$ | —$CH_2$—$CH_3$ | —C(O)—NH—$C(CH_3)_2$— |
| 1846 | —$CH_2$—$CH_2$—$CH_2$—OH | —$CH_2$—$CH_2$—$CH_3$ | —$CH_2$—$CH_3$ | —C(O)—NH—$C(CH_3)_2$— |
| 1847 | —$CH_2$—CH(OH)—$CH_3$ | —$CH_2$—$CH_2$—$CH_3$ | —$CH_2$—$CH_3$ | —C(O)—NH—$C(CH_3)_2$— |
| 1848 | —CH(OH)—$CH_2$—$CH_3$ | —$CH_2$—$CH_2$—$CH_3$ | —$CH_2$—$CH_3$ | —C(O)—NH—$C(CH_3)_2$— |
| 1849 | —H | —$CH_2$—$CH_2$—$CH_3$ | —$CH_2$—$CH_2$—$CH_3$ | —C(O)—NH—$C(CH_3)_2$— |
| 1850 | —$CH_3$ | —$CH_2$—$CH_2$—$CH_3$ | —$CH_2$—$CH_2$—$CH_3$ | —C(O)—NH—$C(CH_3)_2$— |
| 1851 | —$CH_2$—$CH_3$ | —$CH_2$—$CH_2$—$CH_3$ | —$CH_2$—$CH_2$—$CH_3$ | —C(O)—NH—$C(CH_3)_2$— |
| 1852 | —$CH_2$—$CH_2$—$CH_3$ | —$CH_2$—$CH_2$—$CH_3$ | —$CH_2$—$CH_2$—$CH_3$ | —C(O)—NH—$C(CH_3)_2$— |
| 1853 | —$CH(CH_3)$—$CH_3$ | —$CH_2$—$CH_2$—$CH_3$ | —$CH_2$—$CH_2$—$CH_3$ | —C(O)—NH—$C(CH_3)_2$— |
| 1854 | —$CH_2$—OH | —$CH_2$—$CH_2$—$CH_3$ | —$CH_2$—$CH_2$—$CH_3$ | —C(O)—NH—$C(CH_3)_2$— |
| 1855 | —$CH_2$—$CH_2$—OH | —$CH_2$—$CH_2$—$CH_3$ | —$CH_2$—$CH_2$—$CH_3$ | —C(O)—NH—$C(CH_3)_2$— |
| 1856 | —CH(OH)—$CH_3$ | —$CH_2$—$CH_2$—$CH_3$ | —$CH_2$—$CH_2$—$CH_3$ | —C(O)—NH—$C(CH_3)_2$— |
| 1857 | —$CH_2$—$CH_2$—$CH_2$—OH | —$CH_2$—$CH_2$—$CH_3$ | —$CH_2$—$CH_2$—$CH_3$ | —C(O)—NH—$C(CH_3)_2$— |
| 1858 | —$CH_2$—CH(OH)—$CH_3$ | —$CH_2$—$CH_2$—$CH_3$ | —$CH_2$—$CH_2$—$CH_3$ | —C(O)—NH—$C(CH_3)_2$— |
| 1859 | —CH(OH)—$CH_2$—$CH_3$ | —$CH_2$—$CH_2$—$CH_3$ | —$CH_2$—$CH_2$—$CH_3$ | —C(O)—NH—$C(CH_3)_2$— |
| 1860 | —H | —$CH_2$—$CH_2$—$CH_3$ | —$CH(CH_3)$—$CH_3$ | —C(O)—NH—$C(CH_3)_2$— |
| 1861 | —$CH_3$ | —$CH_2$—$CH_2$—$CH_3$ | —$CH(CH_3)$—$CH_3$ | —C(O)—NH—$C(CH_3)_2$— |
| 1862 | —$CH_2$—$CH_3$ | —$CH_2$—$CH_2$—$CH_3$ | —$CH(CH_3)$—$CH_3$ | —C(O)—NH—$C(CH_3)_2$— |
| 1863 | —$CH_2$—$CH_2$—$CH_3$ | —$CH_2$—$CH_2$—$CH_3$ | —$CH(CH_3)$—$CH_3$ | —C(O)—NH—$C(CH_3)_2$— |
| 1864 | —$CH(CH_3)$—$CH_3$ | —$CH_2$—$CH_2$—$CH_3$ | —$CH(CH_3)$—$CH_3$ | —C(O)—NH—$C(CH_3)_2$— |
| 1865 | —$CH_2$—OH | —$CH_2$—$CH_2$—$CH_3$ | —$CH(CH_3)$—$CH_3$ | —C(O)—NH—$C(CH_3)_2$— |
| 1866 | —$CH_2$—$CH_2$—OH | —$CH_2$—$CH_2$—$CH_3$ | —$CH(CH_3)$—$CH_3$ | —C(O)—NH—$C(CH_3)_2$— |
| 1867 | —CH(OH)—$CH_3$ | —$CH_2$—$CH_2$—$CH_3$ | —$CH(CH_3)$—$CH_3$ | —C(O)—NH—$C(CH_3)_2$— |
| 1868 | —$CH_2$—$CH_2$—$CH_2$—OH | —$CH_2$—$CH_2$—$CH_3$ | —$CH(CH_3)$—$CH_3$ | —C(O)—NH—$C(CH_3)_2$— |
| 1869 | —$CH_2$—CH(OH)—$CH_3$ | —$CH_2$—$CH_2$—$CH_3$ | —$CH(CH_3)$—$CH_3$ | —C(O)—NH—$C(CH_3)_2$— |
| 1870 | —CH(OH)—$CH_2$—$CH_3$ | —$CH_2$—$CH_2$—$CH_3$ | —$CH(CH_3)$—$CH_3$ | —C(O)—NH—$C(CH_3)_2$— |
| 1871 | —H | —$CH(CH_3)$—$CH_3$ | —H | —C(O)—NH—$C(CH_3)_2$— |
| 1872 | —$CH_3$ | —$CH(CH_3)$—$CH_3$ | —H | —C(O)—NH—$C(CH_3)_2$— |
| 1873 | —$CH_2$—$CH_3$ | —$CH(CH_3)$—$CH_3$ | —H | —C(O)—NH—$C(CH_3)_2$— |
| 1874 | —$CH_2$—$CH_2$—$CH_3$ | —$CH(CH_3)$—$CH_3$ | —H | —C(O)—NH—$C(CH_3)_2$— |
| 1875 | —$CH(CH_3)$—$CH_3$ | —$CH(CH_3)$—$CH_3$ | —H | —C(O)—NH—$C(CH_3)_2$— |
| 1876 | —$CH_2$—OH | —$CH(CH_3)$—$CH_3$ | —H | —C(O)—NH—$C(CH_3)_2$— |
| 1877 | —$CH_2$—$CH_2$—OH | —$CH(CH_3)$—$CH_3$ | —H | —C(O)—NH—$C(CH_3)_2$— |
| 1878 | —CH(OH)—$CH_3$ | —$CH(CH_3)$—$CH_3$ | —H | —C(O)—NH—$C(CH_3)_2$— |
| 1879 | —$CH_2$—$CH_2$—$CH_2$—OH | —$CH(CH_3)$—$CH_3$ | —H | —C(O)—NH—$C(CH_3)_2$— |
| 1880 | —$CH_2$—CH(OH)—$CH_3$ | —$CH(CH_3)$—$CH_3$ | —H | —C(O)—NH—$C(CH_3)_2$— |
| 1881 | —CH(OH)—$CH_2$—$CH_3$ | —$CH(CH_3)$—$CH_3$ | —H | —C(O)—NH—$C(CH_3)_2$— |
| 1882 | —H | —$CH(CH_3)$—$CH_3$ | —$CH_3$ | —C(O)—NH—$C(CH_3)_2$— |
| 1883 | —$CH_3$ | —$CH(CH_3)$—$CH_3$ | —$CH_3$ | —C(O)—NH—$C(CH_3)_2$— |
| 1884 | —$CH_2$—$CH_3$ | —$CH(CH_3)$—$CH_3$ | —$CH_3$ | —C(O)—NH—$C(CH_3)_2$— |
| 1885 | —$CH_2$—$CH_2$—$CH_3$ | —$CH(CH_3)$—$CH_3$ | —$CH_3$ | —C(O)—NH—$C(CH_3)_2$— |
| 1886 | —$CH(CH_3)$—$CH_3$ | —$CH(CH_3)$—$CH_3$ | —$CH_3$ | —C(O)—NH—$C(CH_3)_2$— |
| 1887 | —$CH_2$—OH | —$CH(CH_3)$—$CH_3$ | —$CH_3$ | —C(O)—NH—$C(CH_3)_2$— |
| 1888 | —$CH_2$—$CH_2$—OH | —$CH(CH_3)$—$CH_3$ | —$CH_3$ | —C(O)—NH—$C(CH_3)_2$— |
| 1889 | —CH(OH)—$CH_3$ | —$CH(CH_3)$—$CH_3$ | —$CH_3$ | —C(O)—NH—$C(CH_3)_2$— |
| 1890 | —$CH_2$—$CH_2$—$CH_2$—OH | —$CH(CH_3)$—$CH_3$ | —$CH_3$ | —C(O)—NH—$C(CH_3)_2$— |
| 1891 | —$CH_2$—CH(OH)—$CH_3$ | —$CH(CH_3)$—$CH_3$ | —$CH_3$ | —C(O)—NH—$C(CH_3)_2$— |
| 1892 | —CH(OH)—$CH_2$—$CH_3$ | —$CH(CH_3)$—$CH_3$ | —$CH_3$ | —C(O)—NH—$C(CH_3)_2$— |
| 1893 | —H | —$CH(CH_3)$—$CH_3$ | —$CH_2$—$CH_3$ | —C(O)—NH—$C(CH_3)_2$— |
| 1894 | —$CH_3$ | —$CH(CH_3)$—$CH_3$ | —$CH_2$—$CH_3$ | —C(O)—NH—$C(CH_3)_2$— |
| 1895 | —$CH_2$—$CH_3$ | —$CH(CH_3)$—$CH_3$ | —$CH_2$—$CH_3$ | —C(O)—NH—$C(CH_3)_2$— |
| 1896 | —$CH_2$—$CH_2$—$CH_3$ | —$CH(CH_3)$—$CH_3$ | —$CH_2$—$CH_3$ | —C(O)—NH—$C(CH_3)_2$— |
| 1897 | —$CH(CH_3)$—$CH_3$ | —$CH(CH_3)$—$CH_3$ | —$CH_2$—$CH_3$ | —C(O)—NH—$C(CH_3)_2$— |
| 1898 | —$CH_2$—OH | —$CH(CH_3)$—$CH_3$ | —$CH_2$—$CH_3$ | —C(O)—NH—$C(CH_3)_2$— |
| 1899 | —$CH_2$—$CH_2$—OH | —$CH(CH_3)$—$CH_3$ | —$CH_2$—$CH_3$ | —C(O)—NH—$C(CH_3)_2$— |
| 1900 | —CH(OH)—$CH_3$ | —$CH(CH_3)$—$CH_3$ | —$CH_2$—$CH_3$ | —C(O)—NH—$C(CH_3)_2$— |
| 1901 | —$CH_2$—$CH_2$—$CH_2$—OH | —$CH(CH_3)$—$CH_3$ | —$CH_2$—$CH_3$ | —C(O)—NH—$C(CH_3)_2$— |
| 1902 | —$CH_2$—CH(OH)—$CH_3$ | —$CH(CH_3)$—$CH_3$ | —$CH_2$—$CH_3$ | —C(O)—NH—$C(CH_3)_2$— |
| 1903 | —CH(OH)—$CH_2$—$CH_3$ | —$CH(CH_3)$—$CH_3$ | —$CH_2$—$CH_3$ | —C(O)—NH—$C(CH_3)_2$— |
| 1904 | —H | —$CH(CH_3)$—$CH_3$ | —$CH_2$—$CH_2$—$CH_3$ | —C(O)—NH—$C(CH_3)_2$— |
| 1905 | —$CH_3$ | —$CH(CH_3)$—$CH_3$ | —$CH_2$—$CH_2$—$CH_3$ | —C(O)—NH—$C(CH_3)_2$— |
| 1906 | —$CH_2$—$CH_3$ | —$CH(CH_3)$—$CH_3$ | —$CH_2$—$CH_2$—$CH_3$ | —C(O)—NH—$C(CH_3)_2$— |
| 1907 | —$CH_2$—$CH_2$—$CH_3$ | —$CH(CH_3)$—$CH_3$ | —$CH_2$—$CH_2$—$CH_3$ | —C(O)—NH—$C(CH_3)_2$— |
| 1908 | —$CH(CH_3)$—$CH_3$ | —$CH(CH_3)$—$CH_3$ | —$CH_2$—$CH_2$—$CH_3$ | —C(O)—NH—$C(CH_3)_2$— |
| 1909 | —$CH_2$—OH | —$CH(CH_3)$—$CH_3$ | —$CH_2$—$CH_2$—$CH_3$ | —C(O)—NH—$C(CH_3)_2$— |
| 1910 | —$CH_2$—$CH_2$—OH | —$CH(CH_3)$—$CH_3$ | —$CH_2$—$CH_2$—$CH_3$ | —C(O)—NH—$C(CH_3)_2$— |
| 1911 | —CH(OH)—$CH_3$ | —$CH(CH_3)$—$CH_3$ | —$CH_2$—$CH_2$—$CH_3$ | —C(O)—NH—$C(CH_3)_2$— |
| 1912 | —$CH_2$—$CH_2$—$CH_2$—OH | —$CH(CH_3)$—$CH_3$ | —$CH_2$—$CH_2$—$CH_3$ | —C(O)—NH—$C(CH_3)_2$— |
| 1913 | —$CH_2$—CH(OH)—$CH_3$ | —$CH(CH_3)$—$CH_3$ | —$CH_2$—$CH_2$—$CH_3$ | —C(O)—NH—$C(CH_3)_2$— |
| 1914 | —CH(OH)—$CH_2$—$CH_3$ | —$CH(CH_3)$—$CH_3$ | —$CH_2$—$CH_2$—$CH_3$ | —C(O)—NH—$C(CH_3)_2$— |

-continued

| No. | $R^5$ | $R^6$ | $R^7$ | X |
|---|---|---|---|---|
| 1915 | —H | —CH(CH$_3$)—CH$_3$ | —CH(CH$_3$)—CH$_3$ | —C(O)—NH—C(CH$_3$)$_2$— |
| 1916 | —CH$_3$ | —CH(CH$_3$)—CH$_3$ | —CH(CH$_3$)—CH$_3$ | —C(O)—NH—C(CH$_3$)$_2$— |
| 1917 | —CH$_2$—CH$_3$ | —CH(CH$_3$)—CH$_3$ | —CH(CH$_3$)—CH$_3$ | —C(O)—NH—C(CH$_3$)$_2$— |
| 1918 | —CH$_2$—CH$_2$—CH$_3$ | —CH(CH$_3$)—CH$_3$ | —CH(CH$_3$)—CH$_3$ | —C(O)—NH—C(CH$_3$)$_2$— |
| 1919 | —CH(CH$_3$)—CH$_3$ | —CH(CH$_3$)—CH$_3$ | —CH(CH$_3$)—CH$_3$ | —C(O)—NH—C(CH$_3$)$_2$— |
| 1920 | —CH$_2$—OH | —CH(CH$_3$)—CH$_3$ | —CH(CH$_3$)—CH$_3$ | —C(O)—NH—C(CH$_3$)$_2$— |
| 1921 | —CH$_2$—CH$_2$—OH | —CH(CH$_3$)—CH$_3$ | —CH(CH$_3$)—CH$_3$ | —C(O)—NH—C(CH$_3$)$_2$— |
| 1922 | —CH(OH)—CH$_3$ | —CH(CH$_3$)—CH$_3$ | —CH(CH$_3$)—CH$_3$ | —C(O)—NH—C(CH$_3$)$_2$— |
| 1923 | —CH$_2$—CH$_2$—CH$_2$—OH | —CH(CH$_3$)—CH$_3$ | —CH(CH$_3$)—CH$_3$ | —C(O)—NH—C(CH$_3$)$_2$— |
| 1924 | —CH$_2$—CH(OH)—CH$_3$ | —CH(CH$_3$)—CH$_3$ | —CH(CH$_3$)—CH$_3$ | —C(O)—NH—C(CH$_3$)$_2$— |
| 1925 | —CH(OH)—CH$_2$—CH$_3$ | —CH(CH$_3$)—CH$_3$ | —CH(CH$_3$)—CH$_3$ | —C(O)—NH—C(CH$_3$)$_2$— |
| 1926 | —H | —H | —H | —C(O)—NH—CH(CH$_2$CH$_3$)— |
| 1927 | —CH$_3$ | —H | —H | —C(O)—NH—CH(CH$_2$CH$_3$)— |
| 1928 | —CH$_2$—CH$_3$ | —H | —H | —C(O)—NH—CH(CH$_2$CH$_3$)— |
| 1929 | —CH$_2$—CH$_2$—CH$_3$ | —H | —H | —C(O)—NH—CH(CH$_2$CH$_3$)— |
| 1930 | —CH(CH$_3$)—CH$_3$ | —H | —H | —C(O)—NH—CH(CH$_2$CH$_3$)— |
| 1931 | —CH$_2$—OH | —H | —H | —C(O)—NH—CH(CH$_2$CH$_3$)— |
| 1932 | —CH$_2$—CH$_2$—OH | —H | —H | —C(O)—NH—CH(CH$_2$CH$_3$)— |
| 1933 | —CH(OH)—CH$_3$ | —H | —H | —C(O)—NH—CH(CH$_2$CH$_3$)— |
| 1934 | —CH$_2$—CH$_2$—CH$_2$—OH | —H | —H | —C(O)—NH—CH(CH$_2$CH$_3$)— |
| 1935 | —CH$_2$—CH(OH)—CH$_3$ | —H | —H | —C(O)—NH—CH(CH$_2$CH$_3$)— |
| 1936 | —CH(OH)—CH$_2$—CH$_3$ | —H | —H | —C(O)—NH—CH(CH$_2$CH$_3$)— |
| 1937 | —H | —H | —CH$_3$ | —C(O)—NH—CH(CH$_2$CH$_3$)— |
| 1938 | —CH$_3$ | —H | —CH$_3$ | —C(O)—NH—CH(CH$_2$CH$_3$)— |
| 1939 | —CH$_2$—CH$_3$ | —H | —CH$_3$ | —C(O)—NH—CH(CH$_2$CH$_3$)— |
| 1940 | —CH$_2$—CH$_2$—CH$_3$ | —H | —CH$_3$ | —C(O)—NH—CH(CH$_2$CH$_3$)— |
| 1941 | —CH(CH$_3$)—CH$_3$ | —H | —CH$_3$ | —C(O)—NH—CH(CH$_2$CH$_3$)— |
| 1942 | —CH$_2$—OH | —H | —CH$_3$ | —C(O)—NH—CH(CH$_2$CH$_3$)— |
| 1943 | —CH$_2$—CH$_2$—OH | —H | —CH$_3$ | —C(O)—NH—CH(CH$_2$CH$_3$)— |
| 1944 | —CH(OH)—CH$_3$ | —H | —CH$_3$ | —C(O)—NH—CH(CH$_2$CH$_3$)— |
| 1945 | —CH$_2$—CH$_2$—CH$_2$—OH | —H | —CH$_3$ | —C(O)—NH—CH(CH$_2$CH$_3$)— |
| 1946 | —CH$_2$—CH(OH)—CH$_3$ | —H | —CH$_3$ | —C(O)—NH—CH(CH$_2$CH$_3$)— |
| 1947 | —CH(OH)—CH$_2$—CH$_3$ | —H | —CH$_3$ | —C(O)—NH—CH(CH$_2$CH$_3$)— |
| 1948 | —H | —H | —CH$_2$—CH$_3$ | —C(O)—NH—CH(CH$_2$CH$_3$)— |
| 1949 | —CH$_3$ | —H | —CH$_2$—CH$_3$ | —C(O)—NH—CH(CH$_2$CH$_3$)— |
| 1950 | —CH$_2$—CH$_3$ | —H | —CH$_2$—CH$_3$ | —C(O)—NH—CH(CH$_2$CH$_3$)— |
| 1951 | —CH$_2$—CH$_2$—CH$_3$ | —H | —CH$_2$—CH$_3$ | —C(O)—NH—CH(CH$_2$CH$_3$)— |
| 1952 | —CH(CH$_3$)—CH$_3$ | —H | —CH$_2$—CH$_3$ | —C(O)—NH—CH(CH$_2$CH$_3$)— |
| 1953 | —CH$_2$—OH | —H | —CH$_2$—CH$_3$ | —C(O)—NH—CH(CH$_2$CH$_3$)— |
| 1954 | —CH$_2$—CH$_2$—OH | —H | —CH$_2$—CH$_3$ | —C(O)—NH—CH(CH$_2$CH$_3$)— |
| 1955 | —CH(OH)—CH$_3$ | —H | —CH$_2$—CH$_3$ | —C(O)—NH—CH(CH$_2$CH$_3$)— |
| 1956 | —CH$_2$—CH$_2$—CH$_2$—OH | —H | —CH$_2$—CH$_3$ | —C(O)—NH—CH(CH$_2$CH$_3$)— |
| 1957 | —CH$_2$—CH(OH)—CH$_3$ | —H | —CH$_2$—CH$_3$ | —C(O)—NH—CH(CH$_2$CH$_3$)— |
| 1958 | —CH(OH)—CH$_2$—CH$_3$ | —H | —CH$_2$—CH$_3$ | —C(O)—NH—CH(CH$_2$CH$_3$)— |
| 1959 | —H | —H | —CH$_2$—CH$_2$—CH$_3$ | —C(O)—NH—CH(CH$_2$CH$_3$)— |
| 1960 | —CH$_3$ | —H | —CH$_2$—CH$_2$—CH$_3$ | —C(O)—NH—CH(CH$_2$CH$_3$)— |
| 1961 | —CH$_2$—CH$_3$ | —H | —CH$_2$—CH$_2$—CH$_3$ | —C(O)—NH—CH(CH$_2$CH$_3$)— |
| 1962 | —CH$_2$—CH$_2$—CH$_3$ | —H | —CH$_2$—CH$_2$—CH$_3$ | —C(O)—NH—CH(CH$_2$CH$_3$)— |
| 1963 | —CH(CH$_3$)—CH$_3$ | —H | —CH$_2$—CH$_2$—CH$_3$ | —C(O)—NH—CH(CH$_2$CH$_3$)— |
| 1964 | —CH$_2$—OH | —H | —CH$_2$—CH$_2$—CH$_3$ | —C(O)—NH—CH(CH$_2$CH$_3$)— |
| 1965 | —CH$_2$—CH$_2$—OH | —H | —CH$_2$—CH$_2$—CH$_3$ | —C(O)—NH—CH(CH$_2$CH$_3$)— |
| 1966 | —CH(OH)—CH$_3$ | —H | —CH$_2$—CH$_2$—CH$_3$ | —C(O)—NH—CH(CH$_2$CH$_3$)— |
| 1967 | —CH$_2$—CH$_2$—CH$_2$—OH | —H | —CH$_2$—CH$_2$—CH$_3$ | —C(O)—NH—CH(CH$_2$CH$_3$)— |
| 1968 | —CH$_2$—CH(OH)—CH$_3$ | —H | —CH$_2$—CH$_2$—CH$_3$ | —C(O)—NH—CH(CH$_2$CH$_3$)— |
| 1969 | —CH(OH)—CH$_2$—CH$_3$ | —H | —CH$_2$—CH$_2$—CH$_3$ | —C(O)—NH—CH(CH$_2$CH$_3$)— |
| 1970 | —H | —H | —CH(CH$_3$)—CH$_3$ | —C(O)—NH—CH(CH$_2$CH$_3$)— |
| 1971 | —CH$_3$ | —H | —CH(CH$_3$)—CH$_3$ | —C(O)—NH—CH(CH$_2$CH$_3$)— |
| 1972 | —CH$_2$—CH$_3$ | —H | —CH(CH$_3$)—CH$_3$ | —C(O)—NH—CH(CH$_2$CH$_3$)— |
| 1973 | —CH$_2$—CH$_2$—CH$_3$ | —H | —CH(CH$_3$)—CH$_3$ | —C(O)—NH—CH(CH$_2$CH$_3$)— |
| 1974 | —CH(CH$_3$)—CH$_3$ | —H | —CH(CH$_3$)—CH$_3$ | —C(O)—NH—CH(CH$_2$CH$_3$)— |
| 1975 | —CH$_2$—OH | —H | —CH(CH$_3$)—CH$_3$ | —C(O)—NH—CH(CH$_2$CH$_3$)— |
| 1976 | —CH$_2$—CH$_2$—OH | —H | —CH(CH$_3$)—CH$_3$ | —C(O)—NH—CH(CH$_2$CH$_3$)— |
| 1977 | —CH(OH)—CH$_3$ | —H | —CH(CH$_3$)—CH$_3$ | —C(O)—NH—CH(CH$_2$CH$_3$)— |
| 1978 | —CH$_2$—CH$_2$—CH$_2$—OH | —H | —CH(CH$_3$)—CH$_3$ | —C(O)—NH—CH(CH$_2$CH$_3$)— |
| 1979 | —CH$_2$—CH(OH)—CH$_3$ | —H | —CH(CH$_3$)—CH$_3$ | —C(O)—NH—CH(CH$_2$CH$_3$)— |
| 1980 | —CH(OH)—CH$_2$—CH$_3$ | —H | —CH(CH$_3$)—CH$_3$ | —C(O)—NH—CH(CH$_2$CH$_3$)— |
| 1981 | —H | —CH$_3$ | —H | —C(O)—NH—CH(CH$_2$CH$_3$)— |
| 1982 | —CH$_3$ | —CH$_3$ | —H | —C(O)—NH—CH(CH$_2$CH$_3$)— |
| 1983 | —CH$_2$—CH$_3$ | —CH$_3$ | —H | —C(O)—NH—CH(CH$_2$CH$_3$)— |
| 1984 | —CH$_2$—CH$_2$—CH$_3$ | —CH$_3$ | —H | —C(O)—NH—CH(CH$_2$CH$_3$)— |
| 1985 | —CH(CH$_3$)—CH$_3$ | —CH$_3$ | —H | —C(O)—NH—CH(CH$_2$CH$_3$)— |
| 1986 | —CH$_2$—OH | —CH$_3$ | —H | —C(O)—NH—CH(CH$_2$CH$_3$)— |
| 1987 | —CH$_2$—CH$_2$—OH | —CH$_3$ | —H | —C(O)—NH—CH(CH$_2$CH$_3$)— |
| 1988 | —CH(OH)—CH$_3$ | —CH$_3$ | —H | —C(O)—NH—CH(CH$_2$CH$_3$)— |
| 1989 | —CH$_2$—CH$_2$—CH$_2$—OH | —CH$_3$ | —H | —C(O)—NH—CH(CH$_2$CH$_3$)— |
| 1990 | —CH$_2$—CH(OH)—CH$_3$ | —CH$_3$ | —H | —C(O)—NH—CH(CH$_2$CH$_3$)— |
| 1991 | —CH(OH)—CH$_2$—CH$_3$ | —CH$_3$ | —H | —C(O)—NH—CH(CH$_2$CH$_3$)— |

-continued

| No. | $R^5$ | $R^6$ | $R^7$ | X |
|---|---|---|---|---|
| 1992 | —H | —$CH_3$ | —$CH_3$ | —C(O)—NH—CH($CH_2CH_3$)— |
| 1993 | —$CH_3$ | —$CH_3$ | —$CH_3$ | —C(O)—NH—CH($CH_2CH_3$)— |
| 1994 | —$CH_2$—$CH_3$ | —$CH_3$ | —$CH_3$ | —C(O)—NH—CH($CH_2CH_3$)— |
| 1995 | —$CH_2$—$CH_2$—$CH_3$ | —$CH_3$ | —$CH_3$ | —C(O)—NH—CH($CH_2CH_3$)— |
| 1996 | —CH($CH_3$)—$CH_3$ | —$CH_3$ | —$CH_3$ | —C(O)—NH—CH($CH_2CH_3$)— |
| 1997 | —$CH_2$—OH | —$CH_3$ | —$CH_3$ | —C(O)—NH—CH($CH_2CH_3$)— |
| 1998 | —$CH_2$—$CH_2$—OH | —$CH_3$ | —$CH_3$ | —C(O)—NH—CH($CH_2CH_3$)— |
| 1999 | —CH(OH)—$CH_3$ | —$CH_3$ | —$CH_3$ | —C(O)—NH—CH($CH_2CH_3$)— |
| 2000 | —$CH_2$—$CH_2$—$CH_2$—OH | —$CH_3$ | —$CH_3$ | —C(O)—NH—CH($CH_2CH_3$)— |
| 2001 | —$CH_2$—CH(OH)—$CH_3$ | —$CH_3$ | —$CH_3$ | —C(O)—NH—CH($CH_2CH_3$)— |
| 2002 | —CH(OH)—$CH_2$—$CH_3$ | —$CH_3$ | —$CH_3$ | —C(O)—NH—CH($CH_2CH_3$)— |
| 2003 | —H | —$CH_3$ | —$CH_2$—$CH_3$ | —C(O)—NH—CH($CH_2CH_3$)— |
| 2004 | —$CH_3$ | —$CH_3$ | —$CH_2$—$CH_3$ | —C(O)—NH—CH($CH_2CH_3$)— |
| 2005 | —$CH_2$—$CH_3$ | —$CH_3$ | —$CH_2$—$CH_3$ | —C(O)—NH—CH($CH_2CH_3$)— |
| 2006 | —$CH_2$—$CH_2$—$CH_3$ | —$CH_3$ | —$CH_2$—$CH_3$ | —C(O)—NH—CH($CH_2CH_3$)— |
| 2007 | —CH($CH_3$)—$CH_3$ | —$CH_3$ | —$CH_2$—$CH_3$ | —C(O)—NH—CH($CH_2CH_3$)— |
| 2008 | —$CH_2$—OH | —$CH_3$ | —$CH_2$—$CH_3$ | —C(O)—NH—CH($CH_2CH_3$)— |
| 2009 | —$CH_2$—$CH_2$—OH | —$CH_3$ | —$CH_2$—$CH_3$ | —C(O)—NH—CH($CH_2CH_3$)— |
| 2010 | —CH(OH)—$CH_3$ | —$CH_3$ | —$CH_2$—$CH_3$ | —C(O)—NH—CH($CH_2CH_3$)— |
| 2011 | —$CH_2$—$CH_2$—$CH_2$—OH | —$CH_3$ | —$CH_2$—$CH_3$ | —C(O)—NH—CH($CH_2CH_3$)— |
| 2012 | —$CH_2$—CH(OH)—$CH_3$ | —$CH_3$ | —$CH_2$—$CH_3$ | —C(O)—NH—CH($CH_2CH_3$)— |
| 2013 | —CH(OH)—$CH_2$—$CH_3$ | —$CH_3$ | —$CH_2$—$CH_3$ | —C(O)—NH—CH($CH_2CH_3$)— |
| 2014 | —H | —$CH_3$ | —$CH_2$—$CH_2$—$CH_3$ | —C(O)—NH—CH($CH_2CH_3$)— |
| 2015 | —$CH_3$ | —$CH_3$ | —$CH_2$—$CH_2$—$CH_3$ | —C(O)—NH—CH($CH_2CH_3$)— |
| 2016 | —$CH_2$—$CH_3$ | —$CH_3$ | —$CH_2$—$CH_2$—$CH_3$ | —C(O)—NH—CH($CH_2CH_3$)— |
| 2017 | —$CH_2$—$CH_2$—$CH_3$ | —$CH_3$ | —$CH_2$—$CH_2$—$CH_3$ | —C(O)—NH—CH($CH_2CH_3$)— |
| 2018 | —CH($CH_3$)—$CH_3$ | —$CH_3$ | —$CH_2$—$CH_2$—$CH_3$ | —C(O)—NH—CH($CH_2CH_3$)— |
| 2019 | —$CH_2$—OH | —$CH_3$ | —$CH_2$—$CH_2$—$CH_3$ | —C(O)—NH—CH($CH_2CH_3$)— |
| 2020 | —$CH_2$—$CH_2$—OH | —$CH_3$ | —$CH_2$—$CH_2$—$CH_3$ | —C(O)—NH—CH($CH_2CH_3$)— |
| 2021 | —CH(OH)—$CH_3$ | —$CH_3$ | —$CH_2$—$CH_2$—$CH_3$ | —C(O)—NH—CH($CH_2CH_3$)— |
| 2022 | —$CH_2$—$CH_2$—$CH_2$—OH | —$CH_3$ | —$CH_2$—$CH_2$—$CH_3$ | —C(O)—NH—CH($CH_2CH_3$)— |
| 2023 | —$CH_2$—CH(OH)—$CH_3$ | —$CH_3$ | —$CH_2$—$CH_2$—$CH_3$ | —C(O)—NH—CH($CH_2CH_3$)— |
| 2024 | —CH(OH)—$CH_2$—$CH_3$ | —$CH_3$ | —$CH_2$—$CH_2$—$CH_3$ | —C(O)—NH—CH($CH_2CH_3$)— |
| 2025 | —H | —$CH_3$ | —CH($CH_3$)—$CH_3$ | —C(O)—NH—CH($CH_2CH_3$)— |
| 2026 | —$CH_3$ | —$CH_3$ | —CH($CH_3$)—$CH_3$ | —C(O)—NH—CH($CH_2CH_3$)— |
| 2027 | —$CH_2$—$CH_3$ | —$CH_3$ | —CH($CH_3$)—$CH_3$ | —C(O)—NH—CH($CH_2CH_3$)— |
| 2028 | —$CH_2$—$CH_2$—$CH_3$ | —$CH_3$ | —CH($CH_3$)—$CH_3$ | —C(O)—NH—CH($CH_2CH_3$)— |
| 2029 | —CH($CH_3$)—$CH_3$ | —$CH_3$ | —CH($CH_3$)—$CH_3$ | —C(O)—NH—CH($CH_2CH_3$)— |
| 2030 | —$CH_2$—OH | —$CH_3$ | —CH($CH_3$)—$CH_3$ | —C(O)—NH—CH($CH_2CH_3$)— |
| 2031 | —$CH_2$—$CH_2$—OH | —$CH_3$ | —CH($CH_3$)—$CH_3$ | —C(O)—NH—CH($CH_2CH_3$)— |
| 2032 | —CH(OH)—$CH_3$ | —$CH_3$ | —CH($CH_3$)—$CH_3$ | —C(O)—NH—CH($CH_2CH_3$)— |
| 2033 | —$CH_2$—$CH_2$—$CH_2$—OH | —$CH_3$ | —CH($CH_3$)—$CH_3$ | —C(O)—NH—CH($CH_2CH_3$)— |
| 2034 | —$CH_2$—CH(OH)—$CH_3$ | —$CH_3$ | —CH($CH_3$)—$CH_3$ | —C(O)—NH—CH($CH_2CH_3$)— |
| 2035 | —CH(OH)—$CH_2$—$CH_3$ | —$CH_3$ | —CH($CH_3$)—$CH_3$ | —C(O)—NH—CH($CH_2CH_3$)— |
| 2036 | —H | —$CH_2$—$CH_3$ | —H | —C(O)—NH—CH($CH_2CH_3$)— |
| 2037 | —$CH_3$ | —$CH_2$—$CH_3$ | —H | —C(O)—NH—CH($CH_2CH_3$)— |
| 2038 | —$CH_2$—$CH_3$ | —$CH_2$—$CH_3$ | —H | —C(O)—NH—CH($CH_2CH_3$)— |
| 2039 | —$CH_2$—$CH_2$—$CH_3$ | —$CH_2$—$CH_3$ | —H | —C(O)—NH—CH($CH_2CH_3$)— |
| 2040 | —CH($CH_3$)—$CH_3$ | —$CH_2$—$CH_3$ | —H | —C(O)—NH—CH($CH_2CH_3$)— |
| 2041 | —$CH_2$—OH | —$CH_2$—$CH_3$ | —H | —C(O)—NH—CH($CH_2CH_3$)— |
| 2042 | —$CH_2$—$CH_2$—OH | —$CH_2$—$CH_3$ | —H | —C(O)—NH—CH($CH_2CH_3$)— |
| 2043 | —CH(OH)—$CH_3$ | —$CH_2$—$CH_3$ | —H | —C(O)—NH—CH($CH_2CH_3$)— |
| 2044 | —$CH_2$—$CH_2$—$CH_2$—OH | —$CH_2$—$CH_3$ | —H | —C(O)—NH—CH($CH_2CH_3$)— |
| 2045 | —$CH_2$—CH(OH)—$CH_3$ | —$CH_2$—$CH_3$ | —H | —C(O)—NH—CH($CH_2CH_3$)— |
| 2046 | —CH(OH)—$CH_2$—$CH_3$ | —$CH_2$—$CH_3$ | —H | —C(O)—NH—CH($CH_2CH_3$)— |
| 2047 | —H | —$CH_2$—$CH_3$ | —$CH_3$ | —C(O)—NH—CH($CH_2CH_3$)— |
| 2048 | —$CH_3$ | —$CH_2$—$CH_3$ | —$CH_3$ | —C(O)—NH—CH($CH_2CH_3$)— |
| 2049 | —$CH_2$—$CH_3$ | —$CH_2$—$CH_3$ | —$CH_3$ | —C(O)—NH—CH($CH_2CH_3$)— |
| 2050 | —$CH_2$—$CH_2$—$CH_3$ | —$CH_2$—$CH_3$ | —$CH_3$ | —C(O)—NH—CH($CH_2CH_3$)— |
| 2051 | —CH($CH_3$)—$CH_3$ | —$CH_2$—$CH_3$ | —$CH_3$ | —C(O)—NH—CH($CH_2CH_3$)— |
| 2052 | —$CH_2$—OH | —$CH_2$—$CH_3$ | —$CH_3$ | —C(O)—NH—CH($CH_2CH_3$)— |
| 2053 | —$CH_2$—$CH_2$—OH | —$CH_2$—$CH_3$ | —$CH_3$ | —C(O)—NH—CH($CH_2CH_3$)— |
| 2054 | —CH(OH)—$CH_3$ | —$CH_2$—$CH_3$ | —$CH_3$ | —C(O)—NH—CH($CH_2CH_3$)— |
| 2055 | —$CH_2$—$CH_2$—$CH_2$—OH | —$CH_2$—$CH_3$ | —$CH_3$ | —C(O)—NH—CH($CH_2CH_3$)— |
| 2056 | —$CH_2$—CH(OH)—$CH_3$ | —$CH_2$—$CH_3$ | —$CH_3$ | —C(O)—NH—CH($CH_2CH_3$)— |
| 2057 | —CH(OH)—$CH_2$—$CH_3$ | —$CH_2$—$CH_3$ | —$CH_3$ | —C(O)—NH—CH($CH_2CH_3$)— |
| 2058 | —H | —$CH_2$—$CH_3$ | —$CH_2$—$CH_3$ | —C(O)—NH—CH($CH_2CH_3$)— |
| 2059 | —$CH_3$ | —$CH_2$—$CH_3$ | —$CH_2$—$CH_3$ | —C(O)—NH—CH($CH_2CH_3$)— |
| 2060 | —$CH_2$—$CH_3$ | —$CH_2$—$CH_3$ | —$CH_2$—$CH_3$ | —C(O)—NH—CH($CH_2CH_3$)— |
| 2061 | —$CH_2$—$CH_2$—$CH_3$ | —$CH_2$—$CH_3$ | —$CH_2$—$CH_3$ | —C(O)—NH—CH($CH_2CH_3$)— |
| 2062 | —CH($CH_3$)—$CH_3$ | —$CH_2$—$CH_3$ | —$CH_2$—$CH_3$ | —C(O)—NH—CH($CH_2CH_3$)— |
| 2063 | —$CH_2$—OH | —$CH_2$—$CH_3$ | —$CH_2$—$CH_3$ | —C(O)—NH—CH($CH_2CH_3$)— |
| 2064 | —$CH_2$—$CH_2$—OH | —$CH_2$—$CH_3$ | —$CH_2$—$CH_3$ | —C(O)—NH—CH($CH_2CH_3$)— |
| 2065 | —CH(OH)—$CH_3$ | —$CH_2$—$CH_3$ | —$CH_2$—$CH_3$ | —C(O)—NH—CH($CH_2CH_3$)— |
| 2066 | —$CH_2$—$CH_2$—$CH_2$—OH | —$CH_2$—$CH_3$ | —$CH_2$—$CH_3$ | —C(O)—NH—CH($CH_2CH_3$)— |
| 2067 | —$CH_2$—CH(OH)—$CH_3$ | —$CH_2$—$CH_3$ | —$CH_2$—$CH_3$ | —C(O)—NH—CH($CH_2CH_3$)— |
| 2068 | —CH(OH)—$CH_2$—$CH_3$ | —$CH_2$—$CH_3$ | —$CH_2$—$CH_3$ | —C(O)—NH—CH($CH_2CH_3$)— |

-continued

| No. | $R^5$ | $R^6$ | $R^7$ | X |
|---|---|---|---|---|
| 2069 | —H | —$CH_2$—$CH_3$ | —$CH_2$—$CH_2$—$CH_3$ | —C(O)—NH—CH($CH_2CH_3$)— |
| 2070 | —$CH_3$ | —$CH_2$—$CH_3$ | —$CH_2$—$CH_2$—$CH_3$ | —C(O)—NH—CH($CH_2CH_3$)— |
| 2071 | —$CH_2$—$CH_3$ | —$CH_2$—$CH_3$ | —$CH_2$—$CH_2$—$CH_3$ | —C(O)—NH—CH($CH_2CH_3$)— |
| 2072 | —$CH_2$—$CH_2$—$CH_3$ | —$CH_2$—$CH_3$ | —$CH_2$—$CH_2$—$CH_3$ | —C(O)—NH—CH($CH_2CH_3$)— |
| 2073 | —CH($CH_3$)—$CH_3$ | —$CH_2$—$CH_3$ | —$CH_2$—$CH_2$—$CH_3$ | —C(O)—NH—CH($CH_2CH_3$)— |
| 2074 | —$CH_2$—OH | —$CH_2$—$CH_3$ | —$CH_2$—$CH_2$—$CH_3$ | —C(O)—NH—CH($CH_2CH_3$)— |
| 2075 | —$CH_2$—$CH_2$—OH | —$CH_2$—$CH_3$ | —$CH_2$—$CH_2$—$CH_3$ | —C(O)—NH—CH($CH_2CH_3$)— |
| 2076 | —CH(OH)—$CH_3$ | —$CH_2$—$CH_3$ | —$CH_2$—$CH_2$—$CH_3$ | —C(O)—NH—CH($CH_2CH_3$)— |
| 2077 | —$CH_2$—$CH_2$—$CH_2$—OH | —$CH_2$—$CH_3$ | —$CH_2$—$CH_2$—$CH_3$ | —C(O)—NH—CH($CH_2CH_3$)— |
| 2078 | —$CH_2$—CH(OH)—$CH_3$ | —$CH_2$—$CH_3$ | —$CH_2$—$CH_2$—$CH_3$ | —C(O)—NH—CH($CH_2CH_3$)— |
| 2079 | —CH(OH)—$CH_2$—$CH_3$ | —$CH_2$—$CH_3$ | —$CH_2$—$CH_2$—$CH_3$ | —C(O)—NH—CH($CH_2CH_3$)— |
| 2080 | —H | —$CH_2$—$CH_3$ | —CH($CH_3$)—$CH_3$ | —C(O)—NH—CH($CH_2CH_3$)— |
| 2081 | —$CH_3$ | —$CH_2$—$CH_3$ | —CH($CH_3$)—$CH_3$ | —C(O)—NH—CH($CH_2CH_3$)— |
| 2082 | —$CH_2$—$CH_3$ | —$CH_2$—$CH_3$ | —CH($CH_3$)—$CH_3$ | —C(O)—NH—CH($CH_2CH_3$)— |
| 2083 | —$CH_2$—$CH_2$—$CH_3$ | —$CH_2$—$CH_3$ | —CH($CH_3$)—$CH_3$ | —C(O)—NH—CH($CH_2CH_3$)— |
| 2084 | —CH($CH_3$)—$CH_3$ | —$CH_2$—$CH_3$ | —CH($CH_3$)—$CH_3$ | —C(O)—NH—CH($CH_2CH_3$)— |
| 2085 | —$CH_2$—OH | —$CH_2$—$CH_3$ | —CH($CH_3$)—$CH_3$ | —C(O)—NH—CH($CH_2CH_3$)— |
| 2086 | —$CH_2$—$CH_2$—OH | —$CH_2$—$CH_3$ | —CH($CH_3$)—$CH_3$ | —C(O)—NH—CH($CH_2CH_3$)— |
| 2087 | —CH(OH)—$CH_3$ | —$CH_2$—$CH_3$ | —CH($CH_3$)—$CH_3$ | —C(O)—NH—CH($CH_2CH_3$)— |
| 2088 | —$CH_2$—$CH_2$—$CH_2$—OH | —$CH_2$—$CH_3$ | —CH($CH_3$)—$CH_3$ | —C(O)—NH—CH($CH_2CH_3$)— |
| 2089 | —$CH_2$—CH(OH)—$CH_3$ | —$CH_2$—$CH_3$ | —CH($CH_3$)—$CH_3$ | —C(O)—NH—CH($CH_2CH_3$)— |
| 2090 | —CH(OH)—$CH_2$—$CH_3$ | —$CH_2$—$CH_3$ | —CH($CH_3$)—$CH_3$ | —C(O)—NH—CH($CH_2CH_3$)— |
| 2091 | —H | —$CH_2$—$CH_2$—$CH_3$ | —H | —C(O)—NH—CH($CH_2CH_3$)— |
| 2092 | —$CH_3$ | —$CH_2$—$CH_2$—$CH_3$ | —H | —C(O)—NH—CH($CH_2CH_3$)— |
| 2093 | —$CH_2$—$CH_3$ | —$CH_2$—$CH_2$—$CH_3$ | —H | —C(O)—NH—CH($CH_2CH_3$)— |
| 2094 | —$CH_2$—$CH_2$—$CH_3$ | —$CH_2$—$CH_2$—$CH_3$ | —H | —C(O)—NH—CH($CH_2CH_3$)— |
| 2095 | —CH($CH_3$)—$CH_3$ | —$CH_2$—$CH_2$—$CH_3$ | —H | —C(O)—NH—CH($CH_2CH_3$)— |
| 2096 | —$CH_2$—OH | —$CH_2$—$CH_2$—$CH_3$ | —H | —C(O)—NH—CH($CH_2CH_3$)— |
| 2097 | —$CH_2$—$CH_2$—OH | —$CH_2$—$CH_2$—$CH_3$ | —H | —C(O)—NH—CH($CH_2CH_3$)— |
| 2098 | —CH(OH)—$CH_3$ | —$CH_2$—$CH_2$—$CH_3$ | —H | —C(O)—NH—CH($CH_2CH_3$)— |
| 2099 | —$CH_2$—$CH_2$—$CH_2$—OH | —$CH_2$—$CH_2$—$CH_3$ | —H | —C(O)—NH—CH($CH_2CH_3$)— |
| 2100 | —$CH_2$—CH(OH)—$CH_3$ | —$CH_2$—$CH_2$—$CH_3$ | —H | —C(O)—NH—CH($CH_2CH_3$)— |
| 2101 | —CH(OH)—$CH_2$—$CH_3$ | —$CH_2$—$CH_2$—$CH_3$ | —H | —C(O)—NH—CH($CH_2CH_3$)— |
| 2102 | —H | —$CH_2$—$CH_2$—$CH_3$ | —$CH_3$ | —C(O)—NH—CH($CH_2CH_3$)— |
| 2103 | —$CH_3$ | —$CH_2$—$CH_2$—$CH_3$ | —$CH_3$ | —C(O)—NH—CH($CH_2CH_3$)— |
| 2104 | —$CH_2$—$CH_3$ | —$CH_2$—$CH_2$—$CH_3$ | —$CH_3$ | —C(O)—NH—CH($CH_2CH_3$)— |
| 2105 | —$CH_2$—$CH_2$—$CH_3$ | —$CH_2$—$CH_2$—$CH_3$ | —$CH_3$ | —C(O)—NH—CH($CH_2CH_3$)— |
| 2106 | —CH($CH_3$)—$CH_3$ | —$CH_2$—$CH_2$—$CH_3$ | —$CH_3$ | —C(O)—NH—CH($CH_2CH_3$)— |
| 2107 | —$CH_2$—OH | —$CH_2$—$CH_2$—$CH_3$ | —$CH_3$ | —C(O)—NH—CH($CH_2CH_3$)— |
| 2108 | —$CH_2$—$CH_2$—OH | —$CH_2$—$CH_2$—$CH_3$ | —$CH_3$ | —C(O)—NH—CH($CH_2CH_3$)— |
| 2109 | —CH(OH)—$CH_3$ | —$CH_2$—$CH_2$—$CH_3$ | —$CH_3$ | —C(O)—NH—CH($CH_2CH_3$)— |
| 2110 | —$CH_2$—$CH_2$—$CH_2$—OH | —$CH_2$—$CH_2$—$CH_3$ | —$CH_3$ | —C(O)—NH—CH($CH_2CH_3$)— |
| 2111 | —$CH_2$—CH(OH)—$CH_3$ | —$CH_2$—$CH_2$—$CH_3$ | —$CH_3$ | —C(O)—NH—CH($CH_2CH_3$)— |
| 2112 | —CH(OH)—$CH_2$—$CH_3$ | —$CH_2$—$CH_2$—$CH_3$ | —$CH_3$ | —C(O)—NH—CH($CH_2CH_3$)— |
| 2113 | —H | —$CH_2$—$CH_2$—$CH_3$ | —$CH_2$—$CH_3$ | —C(O)—NH—CH($CH_2CH_3$)— |
| 2114 | —$CH_3$ | —$CH_2$—$CH_2$—$CH_3$ | —$CH_2$—$CH_3$ | —C(O)—NH—CH($CH_2CH_3$)— |
| 2115 | —$CH_2$—$CH_3$ | —$CH_2$—$CH_2$—$CH_3$ | —$CH_2$—$CH_3$ | —C(O)—NH—CH($CH_2CH_3$)— |
| 2116 | —$CH_2$—$CH_2$—$CH_3$ | —$CH_2$—$CH_2$—$CH_3$ | —$CH_2$—$CH_3$ | —C(O)—NH—CH($CH_2CH_3$)— |
| 2117 | —CH($CH_3$)—$CH_3$ | —$CH_2$—$CH_2$—$CH_3$ | —$CH_2$—$CH_3$ | —C(O)—NH—CH($CH_2CH_3$)— |
| 2118 | —$CH_2$—OH | —$CH_2$—$CH_2$—$CH_3$ | —$CH_2$—$CH_3$ | —C(O)—NH—CH($CH_2CH_3$)— |
| 2119 | —$CH_2$—$CH_2$—OH | —$CH_2$—$CH_2$—$CH_3$ | —$CH_2$—$CH_3$ | —C(O)—NH—CH($CH_2CH_3$)— |
| 2120 | —CH(OH)—$CH_3$ | —$CH_2$—$CH_2$—$CH_3$ | —$CH_2$—$CH_3$ | —C(O)—NH—CH($CH_2CH_3$)— |
| 2121 | —$CH_2$—$CH_2$—$CH_2$—OH | —$CH_2$—$CH_2$—$CH_3$ | —$CH_2$—$CH_3$ | —C(O)—NH—CH($CH_2CH_3$)— |
| 2122 | —$CH_2$—CH(OH)—$CH_3$ | —$CH_2$—$CH_2$—$CH_3$ | —$CH_2$—$CH_3$ | —C(O)—NH—CH($CH_2CH_3$)— |
| 2123 | —CH(OH)—$CH_2$—$CH_3$ | —$CH_2$—$CH_2$—$CH_3$ | —$CH_2$—$CH_3$ | —C(O)—NH—CH($CH_2CH_3$)— |
| 2124 | —H | —$CH_2$—$CH_2$—$CH_3$ | —$CH_2$—$CH_2$—$CH_3$ | —C(O)—NH—CH($CH_2CH_3$)— |
| 2125 | —$CH_3$ | —$CH_2$—$CH_2$—$CH_3$ | —$CH_2$—$CH_2$—$CH_3$ | —C(O)—NH—CH($CH_2CH_3$)— |
| 2126 | —$CH_2$—$CH_3$ | —$CH_2$—$CH_2$—$CH_3$ | —$CH_2$—$CH_2$—$CH_3$ | —C(O)—NH—CH($CH_2CH_3$)— |
| 2127 | —$CH_2$—$CH_2$—$CH_3$ | —$CH_2$—$CH_2$—$CH_3$ | —$CH_2$—$CH_2$—$CH_3$ | —C(O)—NH—CH($CH_2CH_3$)— |
| 2128 | —CH($CH_3$)—$CH_3$ | —$CH_2$—$CH_2$—$CH_3$ | —$CH_2$—$CH_2$—$CH_3$ | —C(O)—NH—CH($CH_2CH_3$)— |
| 2129 | —$CH_2$—OH | —$CH_2$—$CH_2$—$CH_3$ | —$CH_2$—$CH_2$—$CH_3$ | —C(O)—NH—CH($CH_2CH_3$)— |
| 2130 | —$CH_2$—$CH_2$—OH | —$CH_2$—$CH_2$—$CH_3$ | —$CH_2$—$CH_2$—$CH_3$ | —C(O)—NH—CH($CH_2CH_3$)— |
| 2131 | —CH(OH)—$CH_3$ | —$CH_2$—$CH_2$—$CH_3$ | —$CH_2$—$CH_2$—$CH_3$ | —C(O)—NH—CH($CH_2CH_3$)— |
| 2132 | —$CH_2$—$CH_2$—$CH_2$—OH | —$CH_2$—$CH_2$—$CH_3$ | —$CH_2$—$CH_2$—$CH_3$ | —C(O)—NH—CH($CH_2CH_3$)— |
| 2133 | —$CH_2$—CH(OH)—$CH_3$ | —$CH_2$—$CH_2$—$CH_3$ | —$CH_2$—$CH_2$—$CH_3$ | —C(O)—NH—CH($CH_2CH_3$)— |
| 2134 | —CH(OH)—$CH_2$—$CH_3$ | —$CH_2$—$CH_2$—$CH_3$ | —$CH_2$—$CH_2$—$CH_3$ | —C(O)—NH—CH($CH_2CH_3$)— |
| 2135 | —H | —$CH_2$—$CH_2$—$CH_3$ | —CH($CH_3$)—$CH_3$ | —C(O)—NH—CH($CH_2CH_3$)— |
| 2136 | —$CH_3$ | —$CH_2$—$CH_2$—$CH_3$ | —CH($CH_3$)—$CH_3$ | —C(O)—NH—CH($CH_2CH_3$)— |
| 2137 | —$CH_2$—$CH_3$ | —$CH_2$—$CH_2$—$CH_3$ | —CH($CH_3$)—$CH_3$ | —C(O)—NH—CH($CH_2CH_3$)— |
| 2138 | —$CH_2$—$CH_2$—$CH_3$ | —$CH_2$—$CH_2$—$CH_3$ | —CH($CH_3$)—$CH_3$ | —C(O)—NH—CH($CH_2CH_3$)— |
| 2139 | —CH($CH_3$)—$CH_3$ | —$CH_2$—$CH_2$—$CH_3$ | —CH($CH_3$)—$CH_3$ | —C(O)—NH—CH($CH_2CH_3$)— |
| 2140 | —$CH_2$—OH | —$CH_2$—$CH_2$—$CH_3$ | —CH($CH_3$)—$CH_3$ | —C(O)—NH—CH($CH_2CH_3$)— |
| 2141 | —$CH_2$—$CH_2$—OH | —$CH_2$—$CH_2$—$CH_3$ | —CH($CH_3$)—$CH_3$ | —C(O)—NH—CH($CH_2CH_3$)— |
| 2142 | —CH(OH)—$CH_3$ | —$CH_2$—$CH_2$—$CH_3$ | —CH($CH_3$)—$CH_3$ | —C(O)—NH—CH($CH_2CH_3$)— |
| 2143 | —$CH_2$—$CH_2$—$CH_2$—OH | —$CH_2$—$CH_2$—$CH_3$ | —CH($CH_3$)—$CH_3$ | —C(O)—NH—CH($CH_2CH_3$)— |
| 2144 | —$CH_2$—CH(OH)—$CH_3$ | —$CH_2$—$CH_2$—$CH_3$ | —CH($CH_3$)—$CH_3$ | —C(O)—NH—CH($CH_2CH_3$)— |
| 2145 | —CH(OH)—$CH_2$—$CH_3$ | —$CH_2$—$CH_2$—$CH_3$ | —CH($CH_3$)—$CH_3$ | —C(O)—NH—CH($CH_2CH_3$)— |

-continued

| No. | $R^5$ | $R^6$ | $R^7$ | X |
|---|---|---|---|---|
| 2146 | —H | —CH(CH$_3$)—CH$_3$ | —H | —C(O)—NH—CH(CH$_2$CH$_3$)— |
| 2147 | —CH$_3$ | —CH(CH$_3$)—CH$_3$ | —H | —C(O)—NH—CH(CH$_2$CH$_3$)— |
| 2148 | —CH$_2$—CH$_3$ | —CH(CH$_3$)—CH$_3$ | —H | —C(O)—NH—CH(CH$_2$CH$_3$)— |
| 2149 | —CH$_2$—CH$_2$—CH$_3$ | —CH(CH$_3$)—CH$_3$ | —H | —C(O)—NH—CH(CH$_2$CH$_3$)— |
| 2150 | —CH(CH$_3$)—CH$_3$ | —CH(CH$_3$)—CH$_3$ | —H | —C(O)—NH—CH(CH$_2$CH$_3$)— |
| 2151 | —CH$_2$—OH | —CH(CH$_3$)—CH$_3$ | —H | —C(O)—NH—CH(CH$_2$CH$_3$)— |
| 2152 | —CH$_2$—CH$_2$—OH— | —CH(CH$_3$)—CH$_3$ | —H | —C(O)—NH—CH(CH$_2$CH$_3$)— |
| 2153 | —CH(OH)—CH$_3$ | —CH(CH$_3$)—CH$_3$ | —H | —C(O)—NH—CH(CH$_2$CH$_3$)— |
| 2154 | —CH$_2$—CH$_2$—CH$_2$—OH | —CH(CH$_3$)—CH$_3$ | —H | —C(O)—NH—CH(CH$_2$CH$_3$)— |
| 2155 | —CH$_2$—CH(OH)—CH$_3$ | —CH(CH$_3$)—CH$_3$ | —H | —C(O)—NH—CH(CH$_2$CH$_3$)— |
| 2156 | —CH(OH)—CH$_2$—CH$_3$ | —CH(CH$_3$)—CH$_3$ | —H | —C(O)—NH—CH(CH$_2$CH$_3$)— |
| 2157 | —H | —CH(CH$_3$)—CH$_3$ | —CH$_3$ | —C(O)—NH—CH(CH$_2$CH$_3$)— |
| 2158 | —CH$_3$ | —CH(CH$_3$)—CH$_3$ | —CH$_3$ | —C(O)—NH—CH(CH$_2$CH$_3$)— |
| 2159 | —CH$_2$—CH$_3$ | —CH(CH$_3$)—CH$_3$ | —CH$_3$ | —C(O)—NH—CH(CH$_2$CH$_3$)— |
| 2160 | —CH$_2$—CH$_2$—CH$_3$ | —CH(CH$_3$)—CH$_3$ | —CH$_3$ | —C(O)—NH—CH(CH$_2$CH$_3$)— |
| 2161 | —CH(CH$_3$)—CH$_3$ | —CH(CH$_3$)—CH$_3$ | —CH$_3$ | —C(O)—NH—CH(CH$_2$CH$_3$)— |
| 2162 | —CH$_2$—OH | —CH(CH$_3$)—CH$_3$ | —CH$_3$ | —C(O)—NH—CH(CH$_2$CH$_3$)— |
| 2163 | —CH$_2$—CH$_2$—OH | —CH(CH$_3$)—CH$_3$ | —CH$_3$ | —C(O)—NH—CH(CH$_2$CH$_3$)— |
| 2164 | —CH(OH)—CH$_3$ | —CH(CH$_3$)—CH$_3$ | —CH$_3$ | —C(O)—NH—CH(CH$_2$CH$_3$)— |
| 2165 | —CH$_2$—CH$_2$—CH$_2$—OH | —CH(CH$_3$)—CH$_3$ | —CH$_3$ | —C(O)—NH—CH(CH$_2$CH$_3$)— |
| 2166 | —CH$_2$—CH(OH)—CH$_3$ | —CH(CH$_3$)—CH$_3$ | —CH$_3$ | —C(O)—NH—CH(CH$_2$CH$_3$)— |
| 2167 | —CH(OH)—CH$_2$—CH$_3$ | —CH(CH$_3$)—CH$_3$ | —CH$_3$ | —C(O)—NH—CH(CH$_2$CH$_3$)— |
| 2168 | —H | —CH(CH$_3$)—CH$_3$ | —CH$_2$—CH$_3$ | —C(O)—NH—CH(CH$_2$CH$_3$)— |
| 2169 | —CH$_3$ | —CH(CH$_3$)—CH$_3$ | —CH$_2$—CH$_3$ | —C(O)—NH—CH(CH$_2$CH$_3$)— |
| 2170 | —CH$_2$—CH$_3$ | —CH(CH$_3$)—CH$_3$ | —CH$_2$—CH$_3$ | —C(O)—NH—CH(CH$_2$CH$_3$)— |
| 2171 | —CH$_2$—CH$_2$—CH$_3$ | —CH(CH$_3$)—CH$_3$ | —CH$_2$—CH$_3$ | —C(O)—NH—CH(CH$_2$CH$_3$)— |
| 2172 | —CH(CH$_3$)—CH$_3$ | —CH(CH$_3$)—CH$_3$ | —CH$_2$—CH$_3$ | —C(O)—NH—CH(CH$_2$CH$_3$)— |
| 2173 | —CH$_2$—OH | —CH(CH$_3$)—CH$_3$ | —CH$_2$—CH$_3$ | —C(O)—NH—CH(CH$_2$CH$_3$)— |
| 2174 | —CH$_2$—CH$_2$—OH | —CH(CH$_3$)—CH$_3$ | —CH$_2$—CH$_3$ | —C(O)—NH—CH(CH$_2$CH$_3$)— |
| 2175 | —CH(OH)—CH$_3$ | —CH(CH$_3$)—CH$_3$ | —CH$_2$—CH$_3$ | —C(O)—NH—CH(CH$_2$CH$_3$)— |
| 2176 | —CH$_2$—CH$_2$—CH$_2$—OH | —CH(CH$_3$)—CH$_3$ | —CH$_2$—CH$_3$ | —C(O)—NH—CH(CH$_2$CH$_3$)— |
| 2177 | —CH$_2$—CH(OH)—CH$_3$ | —CH(CH$_3$)—CH$_3$ | —CH$_2$—CH$_3$ | —C(O)—NH—CH(CH$_2$CH$_3$)— |
| 2178 | —CH(OH)—CH$_2$—CH$_3$ | —CH(CH$_3$)—CH$_3$ | —CH$_2$—CH$_3$ | —C(O)—NH—CH(CH$_2$CH$_3$)— |
| 2179 | —H | —CH(CH$_3$)—CH$_3$ | —CH$_2$—CH$_2$—CH$_3$ | —C(O)—NH—CH(CH$_2$CH$_3$)— |
| 2180 | —CH$_3$ | —CH(CH$_3$)—CH$_3$ | —CH$_2$—CH$_2$—CH$_3$ | —C(O)—NH—CH(CH$_2$CH$_3$)— |
| 2181 | —CH$_2$—CH$_3$ | —CH(CH$_3$)—CH$_3$ | —CH$_2$—CH$_2$—CH$_3$ | —C(O)—NH—CH(CH$_2$CH$_3$)— |
| 2182 | —CH$_2$—CH$_2$—CH$_3$ | —CH(CH$_3$)—CH$_3$ | —CH$_2$—CH$_2$—CH$_3$ | —C(O)—NH—CH(CH$_2$CH$_3$)— |
| 2183 | —CH(CH$_3$)—CH$_3$ | —CH(CH$_3$)—CH$_3$ | —CH$_2$—CH$_2$—CH$_3$ | —C(O)—NH—CH(CH$_2$CH$_3$)— |
| 2184 | —CH$_2$—OH | —CH(CH$_3$)—CH$_3$ | —CH$_2$—CH$_2$—CH$_3$ | —C(O)—NH—CH(CH$_2$CH$_3$)— |
| 2185 | —CH$_2$—CH$_2$—OH | —CH(CH$_3$)—CH$_3$ | —CH$_2$—CH$_2$—CH$_3$ | —C(O)—NH—CH(CH$_2$CH$_3$)— |
| 2186 | —CH(OH)—CH$_3$ | —CH(CH$_3$)—CH$_3$ | —CH$_2$—CH$_2$—CH$_3$ | —C(O)—NH—CH(CH$_2$CH$_3$)— |
| 2187 | —CH$_2$—CH$_2$—CH$_2$—OH | —CH(CH$_3$)—CH$_3$ | —CH$_2$—CH$_2$—CH$_3$ | —C(O)—NH—CH(CH$_2$CH$_3$)— |
| 2188 | —CH$_2$—CH(OH)—CH$_3$ | —CH(CH$_3$)—CH$_3$ | —CH$_2$—CH$_2$—CH$_3$ | —C(O)—NH—CH(CH$_2$CH$_3$)— |
| 2189 | —CH(OH)—CH$_2$—CH$_3$ | —CH(CH$_3$)—CH$_3$ | —CH$_2$—CH$_2$—CH$_3$ | —C(O)—NH—CH(CH$_2$CH$_3$)— |
| 2190 | —H | —CH(CH$_3$)—CH$_3$ | —CH(CH$_3$)—CH$_3$ | —C(O)—NH—CH(CH$_2$CH$_3$)— |
| 2191 | —CH$_3$ | —CH(CH$_3$)—CH$_3$ | —CH(CH$_3$)—CH$_3$ | —C(O)—NH—CH(CH$_2$CH$_3$)— |
| 2192 | —CH$_2$—CH$_3$ | —CH(CH$_3$)—CH$_3$ | —CH(CH$_3$)—CH$_3$ | —C(O)—NH—CH(CH$_2$CH$_3$)— |
| 2193 | —CH$_2$—CH$_2$—CH$_3$ | —CH(CH$_3$)—CH$_3$ | —CH(CH$_3$)—CH$_3$ | —C(O)—NH—CH(CH$_2$CH$_3$)— |
| 2194 | —CH(CH$_3$)—CH$_3$ | —CH(CH$_3$)—CH$_3$ | —CH(CH$_3$)—CH$_3$ | —C(O)—NH—CH(CH$_2$CH$_3$)— |
| 2195 | —CH$_2$—OH | —CH(CH$_3$)—CH$_3$ | —CH(CH$_3$)—CH$_3$ | —C(O)—NH—CH(CH$_2$CH$_3$)— |
| 2196 | —CH$_2$—CH$_2$—OH | —CH(CH$_3$)—CH$_3$ | —CH(CH$_3$)—CH$_3$ | —C(O)—NH—CH(CH$_2$CH$_3$)— |
| 2197 | —CH(OH)—CH$_3$ | —CH(CH$_3$)—CH$_3$ | —CH(CH$_3$)—CH$_3$ | —C(O)—NH—CH(CH$_2$CH$_3$)— |
| 2198 | —CH$_2$—CH$_2$—CH$_2$—OH | —CH(CH$_3$)—CH$_3$ | —CH(CH$_3$)—CH$_3$ | —C(O)—NH—CH(CH$_2$CH$_3$)— |
| 2199 | —CH$_2$—CH(OH)—CH$_3$ | —CH(CH$_3$)—CH$_3$ | —CH(CH$_3$)—CH$_3$ | —C(O)—NH—CH(CH$_2$CH$_3$)— |
| 2200 | —CH(OH)—CH$_2$—CH$_3$ | —CH(CH$_3$)—CH$_3$ | —CH(CH$_3$)—CH$_3$ | —C(O)—NH—CH(CH$_2$CH$_3$)— |

As constituents iii), the polymers may contain further ionic or nonionogenic monomers. Examples include vinylpyrrolidone, vinyl esters, vinyl acetate, alkylacrylamide, alkylamidoalkyl(meth)acrylic acid, cationically derivatized unsaturated carboxylic acids, acrylamidoalkyltrialkylammonium chloride, methacryloylethylbetaine, crotonic acid, N-tert-butylacrylamide.

In the polymers, the phosphate groups may be present fully or partly in neutralized form, i.e. the acidic hydrogen atom of the phosphate group in some or all phosphate groups may be exchanged for metal ions, preferably alkali metal ions and especially for sodium ions. It will be appreciated that compliance with the pH criterion has to be ensured.

The monomer distribution in the copolymers is, in the case of copolymers which contain only monomers from groups (i) and (ii), preferably in each case from 5 to 95% by weight of (i) and (ii), more preferably from 50 to 90% by weight of monomer from (i) and from 10 to 50% by weight of monomer from group (ii), based in each case on the polymer.

In the case of terpolymers, particular preference is given to those which contain from 20 to 85% by weight of monomer from group (i), from 10 to 60% by weight of monomer from group (ii) and from 5 to 30% by weight of monomer from group (iii).

The molar mass of the polymers can be varied in order to adjust the properties of the polymers to the desired end use. Preferred copolymers have molar masses of from 2,000 to 200,000 gmol$^{-1}$, preferably of from 4000 to 25 000 gmol$^{-1}$ and, in particular, of from 5,000 to 15,000 gmol$^{-1}$.

A further preferred inventive machine dishwasher detergent is characterized in that it comprises a polymer composed of (i) unsaturated carboxylic acids (ii) phosphonate-containing monomers (iii) optionally further ionic or nonionogenic monomers.

Owing to the description of the monomers (i), reference may be made to the above remarks. The phosphonate-containing monomers can be summarized by the general formula III $$R^5(R^6)C{=}C(R^7)—X—PO_3H \quad (III)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are each —COOH or —$COOR^4$, where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—CH$(CH_2CH_3)$—.

Among these monomers, preference is given to those of formulas IIIa, IIIb and/or IIIc $$H_2C{=}CH—X—PO_3H \quad (IIIa),$$

$$H_2C{=}C(CH_3)—X—PO_3H \quad (IIIb),$$

$$HO_4P—X—(R^6)C{=}C(R^7)—X—PO_3H \quad (IIIc),$$

in which $R^6$ and $R^7$ are each independently selected from —H, —$CH_3$, —$CH_2CH_3$, —$CH_2CH_2CH_3$, —$CH(CH_3)_2$, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Further preferred monomers with their $R^5$, $R^6$ and $R^7$ radicals and also the spacer groups X are compiled in the table above.

In the polymers, the phosphonate groups may be present fully or partly in neutralized form, i.e. the acidic hydrogen atom of the phosphonate group in some or all phosphonate groups may be exchanged for metal ions, preferably alkali metal ions and especially for sodium ions. It will be appreciated that compliance with the pH criterion has to be ensured.

The monomer distribution in the copolymers is, in the case of copolymers which contain only monomers from groups (i) and (ii), preferably in each case from 5 to 95% by weight of (i) and (ii), more preferably from 50 to 90% by weight of monomer from (i) and from 10 to 50% by weight of monomer from group (ii), based in each case on the polymer.

In the case of terpolymers, particular preference is given to those which contain from 20 to 85% by weight of monomer from group (i), from 10 to 60% by weight of monomer from group (ii) and from 5 to 30% by weight of monomer from group (iii).

The molar mass of the polymers can be varied in order to adjust the properties of the polymers to the desired end use. Preferred copolymers have molar masses of from 2,000 to 200,000 $gmol^{-1}$, preferably of from 4000 to 25 000 $gmol^{-1}$ and, in particular, of from 5,000 to 15,000 $gmol^{-1}$.

A further preferred inventive machine dishwasher detergent is characterized in that it comprises a polymer composed of (i) unsaturated carboxylic acids (ii) phosphite-containing monomers (iii) optionally further ionic or nonionogenic monomers.

Owing to the description of the monomers (i), reference may be made to the remarks above. The phosphite-containing monomers can be described by the general formula IV $$R^5(R^6)C{=}C(R^7)—X—P(O)(OM^1)_2 \quad (IV)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are each —COOH or —$COOR^4$, where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—CH$(CH_2CH_3)$—.

Among these monomers, preference is given to those of formulas IVa, IVb and/or IVc $$H_2C{=}CH—X—P(O)(OM^1)_2 \quad (IVa),$$

$$H_2C{=}C(CH_3)—X—P(O)(OM^1)_2 \quad (IVb),$$

$$HO_4P—X—(R^6)C{=}C(R^7)—X—P(O)(OM^1)_2 \quad (IVc),$$

in which $R^6$ and $R^7$ are each independently selected from —H, —$CH_3$, —$CH_2CH_3$, —$CH_2CH_2CH_3$, —$CH(CH_3)_2$, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—, where $M^1$ is hydrogen or a monovalent metal ion, preferably sodium.

Further preferred monomers with their $R^5$, $R^6$ and $R^7$ radicals and also the spacer groups X are compiled in the table above.

In the polymers, the phosphite groups may be present fully or partly in neutralized form, i.e. the acidic hydrogen atom of the phosphite group in some or all phosphite groups may be exchanged for metal ions, preferably alkali metal ions and especially for sodium ions. It will be appreciated that compliance with the pH criterion has to be ensured.

The monomer distribution in the copolymers is, in the case of copolymers which contain only monomers from groups (i) and (ii), preferably in each case from 5 to 95% by weight of (i) and (ii), more preferably from 50 to 90% by weight of monomer from (i) and from 10 to 50% by weight of monomer from group (ii), based in each case on the polymer.

In the case of terpolymers, particular preference is given to those which contain from 20 to 85% by weight of monomer from group (i), from 10 to 60% by weight of monomer from group (ii) and from 5 to 30% by weight of monomer from group (iii).

The molar mass of the polymers can be varied in order to adjust the properties of the polymers to the desired end use. Preferred copolymers have molar masses of from 2000 to 200,000 $gmol^{-1}$, preferably of from 4,000 to 25,000 $gmol^{-1}$ and, in particular, of from 5,000 to 15,000 $gmol^{-1}$.

A further inventive machine dishwasher detergent is characterized in that it comprises a polymer composed of i) unsaturated carboxylic acids ii) phosphine oxide-containing monomers iii) optionally further ionic or nonionogenic monomers.

Owing to the description of the monomers (i), reference may be made to the above remarks. The phosphine oxide-containing monomers can be described by the general formula (V)

$$R^5(R^6)C{=}C(R^7)—X—P(O)R^8R^9 \quad (V)$$

in which $R^5$ to $R^9$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are each —COOH or —$COOR^4$, where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—CH$(CH_2CH_3)$—.

Among these monomers, preference is given to those of formulas Va, Vb and/or Vc $$H_2C{=}CH—X—P(O)R^8R^9 \quad (Va),$$

$$H_2C{=}C(CH_3)—X—P(O)R^8R^9 \quad (Vb),$$

$$HO_4P—X—(R^6)C{=}C(R^7)—X—P(O)R^8R^9 \quad (Vc),$$

in which $R^6$ and $R^7$ are each independently selected from —H, —$CH_3$, —$CH_2CH_3$, —$CH_2CH_2CH_3$, —$CH_3)_2$, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Further preferred monomers with their $R^5$, $R^6$ and $R^7$ radicals and also the spacer groups X are compiled in the table above. The tables which follow show preferred monomers of formula V, reference being made to the table above with regard to the $R^5$, $R^6$ and $R^7$ radicals and also the spacer groups X.

Lengthy table referenced here

US07514395-20090407-T00001

Please refer to the end of the specification for access instructions.

Particularly preferred inventive machine dishwasher detergents are characterized in that the polymer modified with phosphorus-containing groups has, at least in part, terminal phosphorus-containing groups.

The inventive compositions may comprise varying amounts of the polymers mentioned. Preferred inventive machine dishwasher detergents are characterized in that it comprises the polymer(s) modified with phosphorus-containing groups preferably in amounts of from 0.1 to 20% by weight, more preferably of from 0.2% to 10% by weight and, in particular, of from 0.5 to 7.5% by weight, based in each case on the overall composition.

Irrespective of the remarks made for the individual polymers, preference is given to inventive machine dishwasher detergents in which the polymer(s) modified with phosphorus-containing groups has/have mean molar masses of from 1,000 to 10,000,000 $gmol^{-1}$, preferably of from 1,500 to 1,000,000 $gmol^{-1}$, more preferably of from 2,000 to 100,000 $gmol^{-1}$ and, in particular, of from 2,500 to 50,000 $gmol^{-1}$.

Corresponding statements can also be made for the degrees of polymerization. Preference is given here to inventive machine dishwasher detergents in which the polymer(s) modified with phosphorus-containing groups has/have a degree of polymerization of from 10 to 10,000, preferably of from 20 to 5,000, more preferably of from 40 to 2,000 and, in particular, of from 80 to 1,000.

In polymers to be used with preference, irrespective of whether they are phosphates, phosphonates, phosphites or phosphine oxides, the molar ratio of monomers (i) to (ii) is from 1:1 to 200:1, preferably from 1:1 to 100:1 and, in particular, from 1:1 to 10:1.

Particularly preferred inventive machine dishwashers are characterized in that the polymer(s) modified with phosphorus-containing groups has/have a phosphorus content of from 0.5 to 5.0% by weight, preferably of from 0.7 to 4.0% by weight and, in particular, of from 0.9 to 3.0% by weight, based in each case on the total weight of the phosphorus-containing polymer(s).

Likewise irrespective of whether they are phosphates, phosphonates, phosphites or phosphine oxides, preference is given to inventive machine dishwasher detergents in which the content in the polymers of monomers (iii) is not more than 20 mol %, preferably not more than 10 mol % and, in particular, not more than 5 mol %.

In addition to the P-containing polymers, the inventive machine dishwasher detergents may comprise further polymers. Preference is given here to machine dishwasher detergents which additionally comprise one or more cationic and/or amphoteric polymer(s), preferably in amounts of from 0.1 to 20% by weight, more preferably of from 0.2 to 10% by weight and, in particular, of from 0.5 to 7.5% by weight, based in each case on the overall composition.

These polymers are described below.

Preferred amphoteric polymers stem from the group of the (1) alkylacrylamide/acrylic acid copolymers
(2) alkylacrylamide/methacrylic acid copolymers
(3) alkylacrylamide/methylmethacrylic acid copolymers
(4) alkylacrylamide/acrylic acid/alkylaminoalkyl(meth) acrylic acid copolymers
(5) alkylacrylamide/methacrylic acid/alkylaminoalkyl(meth) acrylic acid copolymers
(6) alkylacrylamide/methylmethacrylic acid/alkylaminoalkyl(meth)acrylic acid copolymers
(7) alkylacrylamide/alkyl methacrylate/alkylaminoethyl methacrylate/alkyl methacrylate copolymers
(8) copolymers of
  (8i) unsaturated carboxylic acids
  (8ii) cationically derivatized unsaturated carboxylic acids
  (8iii) optionally further ionic or nonionogenic monomers Preferred zwitterionic polymers stem from the group of the (1) acrylamidoalkyltrialkylammonium chloride/acrylic acid copolymers and their alkali metal and ammonium salts
(2) acrylamidoalkyltrialkylammonium chloride/methacrylic acid copolymers and their alkali metal and ammonium salts
(3) methacrylethylbetaine/methacrylate copolymers.

Preferred water-soluble cationic polymers stem preferably from the group of the (1) quaternized cellulose derivatives
(2) polysiloxanes with quaternary groups
(3) cationic guar derivatives
(4) polymeric dimethyldiallylammonium salts and their copolymers with esters and amides of acrylic acid and methacrylic acid
(5) copolymers of vinylpyrrolidone with quaternized derivatives of dialkylaminoacrylate and methacrylate (6) vinylpyrrolidone-methoimidazolinium chloride copolymers (7) quaternized polyvinyl alcohol (8) polymers specified under the INCl designations Polyquaternium 2, Polyquaternium 17, Polyquaternium 18 and Polyquaternium 27.

A particularly preferred ingredient for machine dishwasher detergents is a polymer which contains sulfonic acid groups. Preferred inventive compositions are, therefore, characterized in that they comprise at least one copolymer composed of unsaturated carboxylic acid, sulfonic acid-containing monomers and optionally further ionic or nonionogenic monomers.

Preferred inventive machine dishwasher detergents are, therefore, characterized in that they additionally comprise one or more polymer(s) composed of (i) unsaturated carboxylic acids (ii) sulfonic acid-containing monomers (iii) optionally further ionic or nonionogenic monomers, preferably in amounts of from 0.1 to 20% by weight, more preferably of from 0.2 to 10% by weight and, in particular, of from 0.5 to 7.5% by weight, based in each case on the overall composition.

In the context of the present invention, for the sulfonic acid-containing polymers too, preference is given to unsaturated carboxylic acids of formula I as a monomer $$R^1(R^2)C{=}C(R^3)COOH \quad (I)$$

in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms.

Among the unsaturated carboxylic acids which can be described by formula I, preference is given, in particular, to acrylic acid ($R^1{=}R^2{=}R^3{=}H$), methacrylic acid ($R^1{=}R^2{=}H$; $R^3{=}CH_3$) and/or maleic acid ($R^1{=}COOH$; $R^2{=}R^3{=}H$).

The monomers containing sulfonic acid groups are preferably those of formula VI $$R^5(R^6)C{=}C(R^7)—X—SO_3H \quad (VI)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Among these monomers, preference is given to those of formulas VIa, VIb and/or VIc $$H_2C{=}CH—X—SO_3H \quad (VIa)$$

$$H_2C{=}C(CH_3)—X—SO_3H \quad (VIb)$$

$$HO_3S—X—(R^6)C{=}C(R^7)—X—SO_3H \quad (VIc)$$

in which $R^6$ and $R^7$ are each independently selected from —H, —$CH_3$, —$CH_2CH_3$, —$CH_2CH_2CH_3$, —$CH(CH_3)_2$ and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Particularly preferred monomers containing sulfonic acid groups are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethacrylamide, sulfomethylmethacrylamide and water-soluble salts of the acids mentioned.

Useful further ionic or nonionogenic monomers are, in particular, ethylenically unsaturated compounds. The content of monomers of group (iii) in the polymers used in accordance with the invention is preferably less than 20% by weight, based on the polymer. Polymers to be used with particular preference consist only of monomers of groups (i) and (ii).

In summary, particular preference is given to copolymers of i) unsaturated carboxylic acids of formula I $$R^1(R^2)C{=}C(R^3)COOH \quad (I)$$

in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, ii) monomers of formula VI containing sulfonic acid groups $$R^5(R^6)C{=}C(R^7)—X—SO_3H \quad (VI)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$— iii) optionally further ionic or nonionogenic monomers.

Further particularly preferred copolymers consist of i) one or more unsaturated carboxylic acids from the group of acrylic acid, methacrylic acid and/or maleic acid, ii) one or more monomers containing sulfonic acid groups of formulas VIa, VIb and/or VIc:

$$H_2C{=}CH—X—SO_3H \quad (VIa)$$

$$H_2C{=}C(CH_3)—X—SO_3H \quad (VIb)$$

$$HO_3S—X—(R^6)C{=}C(R^7)—X—SO_3H \quad (VIc)$$

in which $R^6$ and $R^7$ are each independently selected from —H, —$CH_3$, —$CH_2CH_3$, —$CH_2CH_2CH_3$, —$CH(CH_3)_2$ and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$— iii) optionally further ionic or nonionogenic monomers.

The copolymers may contain the monomers from groups (i) and (ii) and optionally (iii) in varying amounts, and it is possible to combine any of the representatives from group (i) with any of the representatives from group (ii) and any of the representatives from group (iii). Particularly preferred polymers have certain structural units which are described below.

Thus, preference is given, for example, to inventive compositions which are characterized in that they comprise one or more copolymers which contain structural units of formula VII $$—[CH_2—CHCOOH]_m—[CH_2—CHC(O)—Y—SO_3H]_p— \quad (VII)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

These polymers are prepared by copolymerization of acrylic acid with an acrylic acid derivative containing sulfonic acid groups. Copolymerizing the acrylic acid derivative containing sulfonic acid groups with methacrylic acid leads to another polymer, the use of which in the inventive compositions is likewise preferred and which is characterized in that the compositions comprise one or more copolymers which contain structural units of formula VIII $$—[CH_2—C(CH_3)COOH]_m—[CH_2—CHC(O)—Y—SO_3H]_p— \quad (VIII)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

Acrylic acid and/or methacrylic acid can also be copolymerized entirely analogously with methacrylic acid derivatives containing sulfonic acid groups, which changes the structural units within the molecule. Thus, inventive compositions which comprise one or more copolymers which contain structural units of formula IX $$—[CH_2—CHCOOH]_m—[CH_2C(CH_3)C(O)—Y—SO_3H]_p— \quad (IX)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—, are likewise a preferred embodiment of the present invention, just as preference is given to compositions which are characterized in that they comprise one or more copolymers which contain structural units of formula X $$—[CH_2—C(CH_3)COOH]_m—[CH_2—C(CH_3)C(O)—Y—SO_3H]_p— \quad (X)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

Instead of acrylic acid and/or methacrylic acid, or in addition thereto, it is also possible to use maleic acid as a particularly preferred monomer from group (i). This leads to compositions which are preferred in accordance with the invention and are characterized in that they comprise one or more copolymers which contain structural units of formula XI $$—[HOOCCH—CHCOOH]_m—[CH_2—CHC(O)—Y—SO_3H]_p— \quad (XI)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_r$— where n=from 0 to 4, is —O—$(C_6H_4)$—, is —NH—$C(CH_3)_2$— or —NH—$CH(CH_2CH_3)$—, and to compositions which are characterized in that they comprise one or more copolymers which contain structural units of formula XII $$—[HOOCCH—CHCOOH]_m—[CH_2—C(CH_3)C(O)O—Y—SO_3H]_p— \quad (XII)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

In summary, preference is given to those inventive compositions which comprise one or more copolymers which contain structural units of formulas VII and/or VIII and/or 1× and/or X and/or XI and/or XII $$—[CH_2—CHCOOH]_m—[CH_2—CHC(O)—Y—SO_3H]_p— \quad (VII)$$

$$—[CH_2—C(CH_3)COOH]_m—[CH_2—CHC(O)—Y—SO_3H]_p— \quad (VIII)$$

$$—[CH_2—CHCOOH]_m—[CH_2—C(CH_3)C(O)—Y—SO_3H]_p— \quad (IX)$$

$$—[CH_2—C(CH_3)COOH]_m—[CH_2—C(CH_3)C(O)—Y—SO_3H]_p— \quad (X)$$

$$—[HOOCCH—CHCOOH]_m—[CH_2—CHC(O)—Y—SO_3H]_p— \quad (XI)$$

$$—[HOOCCH—CHCOOH]_m—[CH_2—C(CH_3)C(O)O—Y—SO_3H]_p— \quad (XII)$$

in which m and p are each a whole natural number between 1 and 2000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)_n$— where n=from 0 to 4, is —O—$(C_6H_4)$—, is —NH—$C(CH_3)_2$— or —NH—$CH(CH_2CH_3)$—.

In the polymers, all or some of the sulfonic acid groups may be in neutralized form, i.e. the acidic hydrogen atom of the sulfonic acid group may be replaced in some or all of the sulfonic acid groups by metal ions, preferably alkali metal ions and, in particular, by sodium ions. Preference is given in accordance with the invention to corresponding compositions which are characterized in that the sulfonic acid groups in the copolymer are present in partly or fully neutralized form.

The monomer distribution of the copolymers used in the inventive compositions is, in the case of copolymers which contain only monomers from groups (i) and (ii), preferably in each case from 5 to 95% by weight of (i) or (ii), more preferably from 50 to 90% by weight of monomer from group (i) and from 10 to 50% by weight of monomer from group (ii), based in each case on the polymer.

In the case of terpolymers, particular preference is given to those which contain from 20 to 85% by weight of monomer from group (i), from 10 to 60% by weight of monomer from group (ii), and from 5 to 30% by weight of monomer from group (iii).

The molar mass of the sulfo copolymers described above and used in the inventive compositions can be varied in order to adapt the properties of the polymers to the desired end use. Preferred compositions are characterized in that the copolymers have molar masses of from 2,000 to 200,000 $gmol^{-1}$, preferably from 4,000 to 25,000 $gmol^{-1}$ and, in particular, from 5,000 to 15,000 $gmol^{-1}$.

Preferred inventive machine dishwasher detergents additionally comprise one or more surfactants, preferably nonionic surfactant(s), preferably in amounts of from 0.1 to 20% by weight, more preferably of from 0.2 to 15% by weight and, in particular, of from 0.5 to 12% by weight, based in each case on the overall composition.

These stem from the groups of the anionic, nonionic, cationic and/or amphoteric surfactants, distinct preference being given in the case of machine dishwashing to nonionic surfactants and the surfactants from the other groups being used only in minor amounts or preferably not at all.

The anionic surfactants used are, for example, those of the sulfonate and sulfate type. Useful surfactants of the sulfonate type are preferably $C_{9-13}$-alkylbenzenesulfonates, olefinsulfonates, i.e. mixtures of alkene- and hydroxyalkanesulfonates, and disulfonates, as are obtained, for example, from $C_{12-18}$-monoolefins with terminal or internal double bond by sulfonation with gaseous sulfur trioxide and subsequent alkaline or acidic hydrolysis of the sulfonation products. Also suitable are alkanesulfonates which are obtained from $C_{12-18}$-alkanes, for example, by sulfochlorination or sulfoxidation with subsequent hydrolysis or neutralization. The esters of α-sulfo fatty acids (ester sulfonates), for example, the α-sulfonated methyl esters of hydrogenated coconut, palm kernel or tallow fatty acids, are also likewise suitable.

Further suitable anionic surfactants are sulfated fatty acid glycerol esters. Fatty acid glycerol esters refer to the mono-, di- and triesters, and mixtures thereof, as are obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having from 6 to 22 carbon atoms, for example, of caproic acid, caprylic acid, capric acid, myristic acid, lauric acid, palmitic acid, stearic acid or behenic acid.

Preferred alk(en)yl sulfates are the alkali metal and, in particular, the sodium salts of the sulfuric monoesters of $C_{12}$-$C_{18}$ fatty alcohols, for example, of coconut fatty alcohol, tallow fatty alcohol, lauryl, myristyl, cetyl or stearyl alcohol, or of $C_{10}$-$C_{20}$ oxo alcohols and those monoesters of secondary alcohols of these chain lengths. Also preferred are alk(en)yl sulfates of the chain length mentioned which contain a synthetic straight-chain alkyl radical prepared on a petrochemical basis and which have analogous degradation behavior to the equivalent compounds based on fatty chemical raw materials. From the washing point of view, preference is given to the $C_{12}$-$C_{16}$-alkyl sulfates and $C_{12}$-$C_{15}$-alkyl sulfates, and $C_{14}$-$C_{15}$-alkyl sulfates. 2,3-Alkyl sulfates, which can be obtained as commercial products from the Shell Oil Company under the name DAN®, are also suitable anionic surfactants.

Also suitable are the sulfuric monoesters of the straight-chain or branched $C_{7-21}$-alcohols ethoxylated with 1 to 6 mol of ethylene oxide, such as 2-methyl-branched $C_{9-11}$-alcohols with on average 3.5 mol of ethylene oxide (EO) or $C_{12-18}$-fatty alcohols with from 1 to 4 EO. Owing to their high tendency to foam, they are used in detergents only in relatively small amounts, for example, amounts of from 1 to 5% by weight.

Further suitable anionic surfactants are also the salts of alkylsulfosuccinic acid, which are also referred to as sulfosuccinates or as sulfosuccinic esters and are the monoesters and/or diesters of sulfosuccinic acid with alcohols, preferably fatty alcohols and, in particular, ethoxylated fatty alcohols. Preferred sulfosuccinates contain $C_{8-18}$ fatty alcohol radicals or mixtures thereof. Especially preferred sulfosuccinates contain a fatty alcohol radical which is derived from ethoxylated fatty alcohols which, considered alone, constitute nonionic surfactants (for description see below). In this context, particular preference is again given to sulfosuccinates whose fatty alcohol radicals are derived from ethoxylated fatty alcohols with a narrowed homolog distribution. It is also equally possible to use alk(en)ylsuccinic acid having preferably from 8 to 18 carbon atoms in the alk(en)yl chain or salts thereof.

Useful further anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived, in particular, from natural fatty acids, for example, coconut, palm kernel or tallow fatty acids.

The anionic surfactants including the soaps may be present in the form of their sodium, potassium or ammonium salts, and also in the form of soluble salts of organic bases, such as mono-, di- or triethanolamine. The anionic surfactants are preferably present in the form of their sodium or potassium salts, in particular, in the form of the sodium salts.

A further group of cleaning-active substances is that of the nonionic surfactants. The nonionic surfactants used are preferably alkoxylated, advantageously ethoxylated, in particular, primary alcohols having preferably from 8 to 18 carbon atoms and on average from 1 to 12 mol of ethylene oxide (EO) per mole of alcohol in which the alcohol radical may be linear or preferably 2-methyl-branched, or may contain a mixture of linear and methyl-branched radicals, as are typically present in oxo alcohol radicals. However, especially preferred alcohol ethoxylates have linear radicals of alcohols of native origin having from 12 to 18 carbon atoms, for example, of coconut, palm, tallow fat or oleyl alcohol, and on average from 2 to 8 EO per mole of alcohol. The preferred ethoxylated alcohols include, for example, $C_{12-14}$-alcohols having 3 EO or 4 EO, $C_{9-11}$-alcohol having 7 EO, $C_{13-15}$-alcohols having 3 EO, 5 EO, 7 EO or 8 EO, $C_{12-18}$-alcohols having 3 EO, 5 EO or 7 EO and mixtures thereof, such as mixtures of $C_{12-14}$-alcohol having 3 EO and $C_{12-18}$-alcohol having 5 EO. The degrees of ethoxylation specified are statistical average values which may be an integer or a fraction for a specific product. Preferred alcohol ethoxylates have a narrowed homolog distribution (narrow range ethoxylates, NRE). In addition to these nonionic surfactants, it is also possible to use fatty alcohols having more than 12 EO. Examples thereof are tallow fatty alcohol having 14 EO, 25 EO, 30 EO or 40 EO.

A further class of nonionic surfactants used with preference, which are used either as the sole nonionic surfactant or in combination with other nonionic surfactants, are alkoxylated, preferably ethoxylated or ethoxylated and propoxylated, fatty acid alkyl esters, preferably having from 1 to 4 carbon atoms in the alkyl chain, in particular, fatty acid methyl esters.

A further class of nonionic surfactants which may be used advantageously is that of the alkyl polyglycosides. Usable alkyl polyglycosides satisfy the general formula $RO(G)_z$ in which R is a linear or branched, in particular, 2-methyl-branched, saturated or unsaturated aliphatic radical having from 8 to 22, preferably from 12 to 18, carbon atoms and G is the symbol which represents a glycose unit having 5 or 6 carbon atoms, preferably glucose. The degree of glycosylation z is between 1.0 and 4.0, preferably between 1.0 and 2.0 and, in particular, between 1.1 and 1.4. Preference is thus given to using linear alkyl polyglucosides, i.e. alkyl polyglycosides which consist of a glucose residue and an n-alkyl chain.

Nonionic surfactants of the amine oxide type, for example, N-cocoalkyl-N,N-dimethylamine oxide and N-tallow alkyl-N,N-dihydroxyethylamine oxide, and of the fatty acid alkanolamide type may also be suitable. The amount of these nonionic surfactants is preferably not more than that of the ethoxylated fatty alcohols, in particular, not more than half thereof.

Further suitable surfactants are polyhydroxy fatty acid amides of formula (XII)

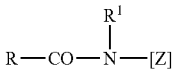

(XII)

in which RCO is an aliphatic acyl radical having from 6 to 22 carbon atoms, $R^1$ is hydrogen, an alkyl or hydroxyalkyl radical having from 1 to 4 carbon atoms and [Z] is a linear or branched polyhydroxyalkyl radical having from 3 to 10 carbon atoms and from 3 to 10 hydroxyl groups. The polyhydroxy fatty acid amides are known substances which can typically be obtained by reductively aminating a reducing sugar with ammonia, an alkylamine or an alkanolamine, and subsequently acylating with a fatty acid, a fatty acid alkyl ester or a fatty acid chloride.

The group of polyhydroxy fatty acid amides also includes compounds of formula (XIII)

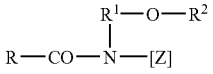

(XIII)

in which R is a linear or branched alkyl or alkenyl radical having from 7 to 12 carbon atoms, $R^1$ is a linear, branched or cyclic alkyl radical or an aryl radical having from 2 to 8 carbon atoms and $R^2$ is a linear, branched or cyclic alkyl radical or an aryl radical or an oxyalkyl radical having from 1 to 8 carbon atoms, preference being given to $C_{1-4}$-alkyl or phenyl radicals, and [Z] is a linear polyhydroxyalkyl radical whose alkyl chain is substituted by at least two hydroxyl groups, or alkoxylated, preferably ethoxylated or propoxylated, derivatives of this radical.

[Z] is preferably obtained by reductive amination of a reduced sugar, for example, glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide as catalyst.

In detergents for machine dishwashing, useful surfactants are generally all surfactants. However, preference is given for this end use to the above-described nonionic surfactants and here, in particular, the low-foaming nonionic surfactants. Particular preference is given to the alkoxylated alcohols, particularly the ethoxylated and/or propoxylated alcohols. Those skilled in the art will generally regard alkoxylated alcohols to mean the reaction products of alkylene oxide, preferably ethylene oxide, with alcohols, preferably in the context of the present invention the relatively long-chain alcohols ($C_{10}$ to $C_{18}$, preferably between $C_{12}$ and $C_{16}$, for example, $C_{11}$, $C_{12}$, $C_{13}$, $C_{14}$, $C_{15}$, $C_{16}$, $C_{17}$ and $C_{18}$ alcohols). In general, n moles of ethylene oxide and one mole of alcohol, depending on the reaction conditions, form a complex mixture of addition products of different degrees of ethoxylation. A further embodiment consists in the use of mixtures of alkylene oxides, preferably of the mixture of ethylene oxide and propylene oxide. It is also possible if desired, by a final etherification with short-chain alkyl groups, preferably the butyl group, to obtain the substance class of the "capped" alcohol ethoxylates, which may likewise be used in the context of the invention. In the context of the present invention, very particular preference is given to using highly ethoxylated fatty alcohols or mixtures thereof with end group-capped fatty alcohol ethoxylates.

Particularly preferred nonionic surfactants in the context of the present invention have been found to be low-foaming nonionic surfactants which have alternating ethylene oxide and alkylene oxide units. Among these, preference is given in turn to surfactants having EO-AO-EO-AO blocks, and in each case from 1 to 10 EO and/or AO groups are bonded to one another before a block of the other groups in each case follows. Preference is given here to inventive machine dishwasher detergents which comprise, as nonionic surfactant(s), surfactants of the general formula (XIV)

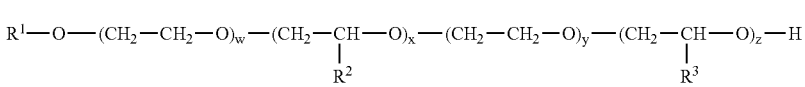

(XIV)

in which $R^1$ is a straight-chain or branched, saturated or mono- or polyunsaturated $C_{6-24}$-alkyl or -alkenyl radical; each $R^2$ or $R^3$ group is independently selected from $—CH_3$, $—CH_2CH_3$, $—CH_2CH_2CH_3$, $—CH(CH_3)_2$ and the indices w, x, y, z are each independently integers from 1 to 6.

The preferred nonionic surfactants of formula III can be prepared by known methods from the corresponding alcohols $R^1$—OH and ethylene oxide or alkylene oxide. The $R^1$ radical in the above formula I may vary depending on the origin of the alcohol. When native sources are utilized, the $R^1$ radical has an even number of carbon atoms and is generally unbranched, and preference is given to the linear radicals of alcohols of native origin having from 12 to 18 carbon atoms, for example, from coconut, palm, tallow fat or oleyl alcohol. Alcohols obtainable from synthetic sources are, for example, the Guerbet alcohols or 2-methyl-branched or linear and methyl-branched radicals in a mixture, as are typically present in oxo alcohol radicals. Irrespective of the type of the alcohol used to prepare the nonionic surfactants present in accordance with the invention in the compositions, preference is given to inventive machine dishwasher detergents in which $R^1$ in formula I is an alkyl radical having from 6 to 24, preferably from 8 to 20, more preferably 9 to 15 and, in particular, 9 to 11 carbon atoms.

A useful alkylene oxide unit which is present in the preferred nonionic surfactants in alternation to the ethylene oxide unit is, as well as propylene oxide, especially butylene oxide. However, further alkylene oxides in which $R^2$ and $R^3$ are each independently selected from —$CH_2CH_2$—$CH_3$ and —$CH(CH_3)_2$ are also suitable. Preferred machine dishwasher detergents are characterized in that $R^2$ and $R^3$ are each a —$CH_3$ radical, w and x are each independently values of 3 or 4 and y and z are each independently values of 1 or 2.

In summary, preference is given for use in the inventive compositions especially to nonionic surfactants which have a $C_{9-15}$ alkyl radical having from 1 to 4 ethylene oxide units, followed by from 1 to 4 propylene oxide units, followed by from 1 to 4 ethylene oxide units, followed by from 1 to 4 propylene oxide units.

The additional surfactants used with preference are low-foaming nonionic surfactants. With particular preference, the inventive machine dishwasher detergents comprise a nonionic surfactant which has a melting point above room temperature. Accordingly, preferred compositions are characterized in that they comprise nonionic surfactant(s) having a melting point above 20° C., preferably above 25° C., more preferably between 25 and 60° C. and, in particular, between 26.6 and 43.3° C.

In addition to the nonionic surfactants present in accordance with the invention in the compositions, suitable nonionic surfactants which have melting or softening points within the temperature range specified are, for example, low-foaming nonionic surfactants which may be solid or highly viscous at room temperature. When highly viscous nonionic surfactants are used at room temperature, it is preferred that they have a viscosity above 20 Pas, preferably above 35 Pas and, in particular, above 40 Pas. Preference is also given to nonionic surfactants which have waxlike consistency at room temperature.

Preferred nonionic surfactants solid at room temperature which are to be used stem from the group of the alkoxylated nonionic surfactants, especially of the ethoxylated primary alcohols and mixtures of these surfactants with surfactants having a complicated structure, such as polyoxypropylene/polyoxyethylene/polyoxypropylene (PO/EO/PO) surfactants. Such (PO/EO/PO) nonionic surfactants additionally feature good foam control.

In a preferred embodiment of the present invention, the nonionic surfactant having a melting point above room temperature is an ethoxylated nonionic surfactant which arises from the reaction of a monohydroxyalkanol or alkylphenol having from 6 to 20 carbon atoms with preferably at least 12 mol, more preferably at least 15 mol, in particular, at least 20 mol, of ethylene oxide per mole of alcohol or alkylphenol.

A particularly preferred nonionic surfactant solid at room temperature which is to be used is obtained from a straight-chain fatty alcohol having from 16 to 20 carbon atoms ($C_{16-20}$ alcohol), preferably a $C_{18}$ alcohol, and at least 12 mol, preferably at least 15 mol and, in particular, at least 20 mol, of ethylene oxide. Particular preference among these is given to the narrow range ethoxylates (see above).

Accordingly, particularly preferred inventive compositions comprise ethoxylated nonionic surfactant(s) which has/have been obtained from $C_{6-20}$ monohydroxyalkanols or $C_{6-20}$ alkylphenols or $C_{16-20}$ fatty alcohols and more than 12 mol, preferably more than 15 mol and, in particular, more than 20 mol, of ethylene oxide per mole of alcohol.

The nonionic surfactant preferably additionally has propylene oxide units in the molecule. Such PO units preferably comprise up to 25% by weight, more preferably up to 20% by weight and, in particular, up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules preferably makes up more than 30% by weight, more preferably more than 50% by weight and, in particular, more than 70% by weight, of the total molar mass of such nonionic surfactants. Preferred machine dishwasher detergents are characterized in that they contain ethoxylated and propoxylated nonionic surfactants in which the propylene oxide units in the molecule make up up to 25% by weight, preferably up to 20% by weight and, in particular, up to 15% by weight, of the total molar mass of the nonionic surfactant.

Further nonionic surfactants which have melting points above room temperature and are to be used with particular preference contain from 40 to 70% of a polyoxypropylene/polyoxyethylene/polyoxypropylene block polymer blend which contains 75% by weight of a reverse block copolymer of polyoxyethylene and polyoxypropylene having 17 moles of ethylene oxide and 44 moles of propylene oxide and 25% by weight of a block copolymer of polyoxyethylene and polyoxypropylene initiated with trimethylolpropane and containing 24 mol of ethylene oxide and 99 mol of propylene oxide per mole of trimethylolpropane.

Nonionic surfactants which can be used with particular preference are available, for example, from Olin Chemicals under the name Poly Tergent® SLF-18.

A further preferred inventive machine dishwasher detergent comprises nonionic surfactants of the formula $$R^1O[CH_2CH(CH_3)O]_x[CH_2CH_2O]_y[CH_2CH(OH)R^2],$$

in which $R^1$ is a linear or branched aliphatic hydrocarbon radical having from 4 to 18 carbon atoms or mixtures thereof, $R^2$ is a linear or branched hydrocarbon radical having from 2 to 26 carbon atoms or mixtures thereof, and x is a value between 0.5 and 1.5, and y is a value of at least 15.

Further nonionic surfactants which can be used with preference are the end group-capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having from 1 to 30 carbon atoms, $R^3$ is H or a methyl, ethyl, n-propyl, isopropyl, n-butyl, 2-butyl or 2-methyl-2-butyl radical, x is a value between 1 and 30, k and j represent values between 1 and 12, preferably between 1 and 5. If the value x is $\geqq 2$, each $R^3$ in the above formula may be different. $R^1$ and $R^2$ are preferably linear or branched, saturated or unsaturated, aliphatic or aromatic hydrocarbon radicals having from 6 to 22 carbon atoms, and particular preference is given to radicals having from 8 to 18 carbon atoms. For the $R^3$ radical, particular preference is given to H, —$CH_3$ or —$CH_2CH_3$. Particularly preferred values for x are in the range from 1 to 20, in particular, from 6 to 15.

As described above, each $R^3$ in the above formula may be different if x is ≧2. This allows the alkylene oxide unit in the square brackets to be varied. If x, for example, is 3, the $R^3$ radical may be selected so as to form ethylene oxide ($R^3$═H) or propylene oxide ($R^3$ $CH_3$) units, which may be added to one another in any sequence, for example, (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and it is entirely possible for it to be larger, the scope of variation increasing with increasing values of x and including, for example, a large number of (EO) groups combined with a small number of (PO) groups, or vice versa.

Especially preferred end group-capped poly(oxyalkylated) alcohols of the above formula have values of k=1 and j=1, so as to simplify the above formula to $$R^1O[CH_2CH(R^3)O]_xCH_2CH(OH)CH_2OR^2.$$

In the latter formula, $R^1$, $R^2$ and $R^3$ are each as defined above and x represents numbers from 1 to 30, preferably from 1 to 20 and, in particular, from 6 to 18. Particular preference is given to surfactants in which the $R^1$ and $R^2$ radicals have from 9 to 14 carbon atoms, $R^3$ is H, and x assumes values from 6 to 15.

Summarizing the latter statements, preference is given to inventive detergent compositions which contain end group-capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are each linear or branched, saturated or unsaturated, aliphatic or aromatic hydrocarbon radicals having from 1 to 30 carbon atoms, $R^3$ is H or a methyl, ethyl, n-propyl, isopropyl, n-butyl, 2-butyl or 2-methyl-2-butyl radical, x is a value between 1 and 30, k and j are values between 1 and 12, preferably between 1 and 5, and particular preference is given to surfactants of the $$R^1O[CH_2CH(R^3)O]_xCH_2CH(OH)CH_2OR^2$$

type in which x represents numbers from 1 to 30, preferably from 1 to 20 and, in particular, from 6 to 18.

In conjunction with the surfactants mentioned, it is also possible to use anionic, cationic and/or amphoteric surfactants, although, owing to their foaming behavior in machine dishwashing detergents, they are only of minor importance and are usually used only in amounts below 10% by weight, in most cases even below 5% by weight, for example, from 0.01 to 2.5% by weight, based in each case on the composition. The inventive compositions can thus also comprise anionic, cationic and/or amphoteric surfactants as the surfactant component.

Preferred inventive machine dishwasher detergents comprise, in addition to the ingredients previously mentioned, one or more substances from the group of the builders, cobuilders, bleaches, bleach activators, enzymes, dyes, fragrances, corrosion inhibitors, polymers, or a further customary constituent of washing and cleaning compositions. These substances will be described below.

Builders

In the present invention, all builders typically used in washing or cleaning compositions may be incorporated into the washing or cleaning compositions, especially silicates, carbonates, organic cobuilders and also the phosphates.

Suitable crystalline, sheet-type sodium silicates have the general formula $NaMSi_xO_{2x+1}.H_2O$ where M is sodium or hydrogen, x is a number from 1.9 to 4, y is a number from 0 to 20, and preferred values for x are 2, 3 or 4. Preferred crystalline sheet silicates of the formula specified are those in which M is sodium and x assumes the values of 2 or 3. In particular, preference is given to both β- and also δ-sodium disilicates $Na_2Si_2O_5.yH_2O$.

It is also possible to use amorphous sodium silicates having an $Na_2O:SiO_2$ modulus of from 1:2 to 1:3.3, preferably from 1:2 to 1:2.8 and, in particular, from 1:2 to 1:2.6, which have retarded dissolution and secondary washing properties. The retardation of dissolution relative to conventional amorphous sodium silicates may have been brought about in a variety of ways, for example, by surface treatment, compounding, compacting or by overdrying. In the context of this invention, the term "amorphous" also includes "X-ray-amorphous." This means that, in X-ray diffraction experiments, the silicates do not afford any sharp X-ray reflections typical of crystalline substances, but rather yield at best one or more maxima of the scattered X-radiation, which have a width of several degree units of the diffraction angle. However, it may quite possibly lead to even particularly good builder properties if the silicate particles in electron diffraction experiments yield vague or even sharp diffraction maxima. This is to be interpreted such that the products have microcrystalline regions with a size of from 10 to several hundred nm, preference being given to values up to a maximum of 50 nm and, in particular, up to a maximum of 20 nm. Special preference is given to compacted amorphous silicates, compounded amorphous silicates and overdried X-ray-amorphous silicates.

The carbonates present in the compositions may be either the monoalkali metal salts or the dialkali metal salts of carbonic acid, or else sesquicarbonates. Preferred alkali metal ions are sodium and/or potassium ions. In one embodiment, it may be preferable to at least partly mix in the carbonate and/or bicarbonate separately or subsequently as a further component. It is also possible for compounds of, for example, carbonate, silicate and optionally further assistants, for example, anionic surfactants or other, especially organic, builder substances, to be present as a separate component in the finished compositions.

It is of course also possible to use the commonly known phosphates as builder substances, as long as such a use is not to be avoided for ecological reasons. Among the multitude of commercially available phosphates, the alkali metal phosphates, with particular preference for pentasodium triphosphate or pentapotassium triphosphate (sodium tripolyphosphate or potassium tripolyphosphate), have the greatest significance in the washing and cleaning compositions industry.

Alkali metal phosphates is the collective term for the alkali metal (especially sodium and potassium) salts of the various phosphoric acids, for which a distinction may be drawn between metaphosphoric acids $(HPO_3)_n$ and orthophosphoric acid $H_3PO_4$, in addition to higher molecular weight representatives. The phosphates combine a number of advantages: they act as alkali carriers, prevent limescale deposits on machine components or limescale deposits on the ware, and additionally contribute to the cleaning performance.

Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water and which lose the water of crystallization upon heating and are converted at 200° C. to the weakly acidic diphosphate (disodium hydrogendiphosphate, $Na_2H_2P_2O_7$), and at higher temperature to sodium trimetaphosphate ($Na_3P_3O_9$) and Maddrell's salt (see below). $NaH_2PO_4$ reacts acidically; it is formed when phosphoric acid is adjusted to a pH of 4.5 using sodium hydroxide solution and the slurry is sprayed. Potassium dihydrogenphosphate (primary or monobasic potassium phosphate, potassium biphosphate, KDP), $KH_2PO_4$, is a white salt of density of 2.33 $gcm^{-3}$, has a melting point of 253° [decomposition with formation of potassium polyphosphate $(KPO_3)_x$] and is readily soluble in water.

Disodium hydrogenphosphate (secondary sodium phosphate), $Na_2HPO_4$, is a colorless crystalline salt which is very readily soluble in water. It exists in anhydrous form and with 2 mol of water (density 2.066 $gcm^{-3}$, loss of water at 95°), 7 mol of water (density 1.68 $gcm^{-3}$, melting point 48° with loss of $5H_2O$) and 12 mol of water (density 1.52 $gcm^{-3}$, melting point 35° with loss of $5H_2O$), becomes anhydrous at 100° and, when heated more strongly, is converted to the diphosphate $Na_4P_2O_7$. Disodium hydrogenphosphate is prepared by neutralizing phosphoric acid with sodium carbonate solution using phenolphthalein as an indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, are colorless crystals which have a density of 1.62 $gcm^{-3}$ and a melting point of 73-76° C. (decomposition) in the form of the dodecahydrate, have a melting point of 100° C. in the form of the decahydrate (corresponding to 19-20% $P_2O_5$), and have a density of 2.536 $gcm^{-3}$ in anhydrous form (corresponding to 39-40% $P_2O_5$). Trisodium phosphate is readily soluble in water, with an alkaline reaction, and is prepared by evaporatively concentrating a solution of precisely 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1340° and is readily soluble in water with an alkaline reaction. It is formed, for example, when Thomas slag is heated with charcoal and potassium sulfate. Despite the relatively high cost, the more readily soluble and, therefore, highly active potassium phosphates are frequently preferred in the cleaning composition industry over corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and in the form of the decahydrate (density 1.815-1.836 $gcm^{-3}$, melting point 94° with loss of water). Both substances are colorless crystals which dissolve in water with an alkaline reaction. $Na_4P_2O_7$ is formed when disodium phosphate is heated to >200° or by reacting phosphoric acid with sodium carbonate in the stoichiometric ratio and dewatering the solution by spraying. The decahydrate complexes heavy metal salts and hardness formers and, therefore, reduces the hardness of water. Potassium diphosphate (potassium pyrophosphate), $K_4P_2O_7$, exists in the form of the trihydrate and is a colorless, hygroscopic powder of density 2.33 $gcm^{-3}$, which is soluble in water, the pH of the 1% solution at 25° being 10.4.

Condensation of $NaH_2PO_4$ or of $KH_2PO_4$ gives rise to higher molecular weight sodium phosphates and potassium phosphates, for which a distinction can be drawn between cyclic representatives, the sodium metaphosphates and potassium metaphosphates, and catenated types, the sodium polyphosphates and potassium polyphosphates. For the latter, in particular, a multitude of names are in use: fused or calcined phosphates, Graham's salt, Kurrol's salt and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with $6H_2O$ and has the general formula NaO—[P(O)(ONa)—O]$_n$—Na where n=3. About 17 g of the salt which is free of water of crystallization dissolve in 100 g of water at room temperature, at 600 approximately 20 g, at 100° around 32 g; after the solution has been heated at 100° for two hours, hydrolysis forms about 8% orthophosphate and 15% diphosphate. In the preparation of pentasodium triphosphate, phosphoric acid is reacted with sodium carbonate solution or sodium hydroxide solution in the stoichiometric ratio and the solution is dewatered by spraying. In a similar way to Graham's salt and sodium diphosphate, pentasodium triphosphate dissolves many insoluble metal compounds (including lime soaps etc.). Pentapotassium triphosphate, $K_5P_3O_{10}$ (potassium tripoly-phosphate), is available commercially, for example, in the form of a 50% by weight solution (>23% $P_2O_5$, 25% $K_2O$). The potassium polyphosphates find wide use in the washing and cleaning composition industry. There also exist sodium potassium tripolyphosphates which can likewise be used in the context of the present invention. They are formed, for example, when sodium trimetaphosphate is hydrolyzed with KOH:

$$(NaPO_3)_3+2KOH \rightarrow Na_3K_2P_3O_{10}+H_2O.$$

They can be used in accordance with the invention in precisely the same way as sodium tripolyphosphate, potassium tripolyphosphate or mixtures of the two; mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate can also be used in accordance with the invention.

Machine dishwasher detergents preferred in the context of the present inventions do not comprise any sodium hydroxide and/or potassium hydroxide. It has been found to be advantageous to dispense with sodium hydroxide and/or potassium hydroxide as the alkali source especially when the zinc salts used are zinc gluconate, zinc formate and zinc acetate.

Cobuilders

In the context of the present invention, the organic cobuilders used may, in particular, be polycarboxylates/polycarboxylic acids, polymeric polycarboxylates, aspartic acid, polyacetals, dextrins, further organic cobuilders (see below) and phosphonates. The polymers may also be part of the active substance-containing matrix, but they may also be present in the inventive compositions entirely independently thereof. The substance classes mentioned are described below.

Organic builder substances which can be used are, for example, the polycarboxylic acids usable in the form of their sodium salts, polycarboxylic acids referring to those carboxylic acids which bear more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), as long as such a use is not objectionable on ecological grounds, and mixtures thereof. Preferred salts are the salts of the polycarboxylic acids such as citric acid, adipic acid, succinic acid, glutaric acid, tartaric acid, methylglycinediacetic acid, sugar acids and mixtures thereof.

The acids themselves may also be used. In addition to their builder action, the acids typically also have the property of an acidifying component and thus also serve to set a lower and milder pH of washing or cleaning compositions. In this connection, particular mention should be made of citric acid, succinic acid, glutaric acid, adipic acid, gluconic acid and any mixtures thereof.

Also suitable as builders are polymeric polycarboxylates; these are, for example, the alkali metal salts of polyacrylic acid or of polymethacrylic acid, for example, those having a relative molecular mass of from 500 to 70,000 g/mol.

In the context of this document, the molar masses specified for polymeric polycarboxylates are weight-average molar masses $M_W$ of the particular acid form, which has always been determined by means of gel-permeation chromatography (GPC) using a UV detector. The measurement was against an external polyacrylic acid standard which, owing to its structural similarity to the polymers under investigation, provides realistic molecular weight values. These figures deviate considerably from the molecular weight data when polystyrenesulfonic acids are used as the standard. The molar masses measured against polystyrenesulfonic acids are generally distinctly higher than the molar masses specified in this document.

Suitable polymers are, in particular, polyacrylates which preferably have a molecular mass of from 1,000 to 20,000 g/mol. Owing to their superior solubility, preference within this group may be given in turn to the short-chain polyacrylates which have molar masses of from 1,000 to 10,000 g/mol and more preferably from 1,200 to 4,000 g/mol.

In the inventive compositions, particular preference is given both to polyacrylates and to copolymers composed of unsaturated carboxylic acids, monomers containing sulfonic acid groups, and also optionally further ionic or nonionogenic monomers. The copolymers containing sulfonic acid groups are described in detail below.

It will be appreciated that the polymers which contain sulfonic acid groups and have been described above may additionally be present in the inventive compositions without necessarily having to be part of the active substance-containing matrix.

As already mentioned above, particular preference is given to using, in the inventive compositions, both polyacrylates and the above-described copolymers composed of unsaturated carboxylic acids, monomers containing sulfonic acid groups and optionally further ionic or nonionogenic monomers. The polyacrylates have been described in detail above. Particular preference is given to combinations of the above-described copolymers containing sulfonic acid groups with polyacrylates of low molar mass, for example, in the range between 1,000 and 4,000 daltons. Such polyacrylates are commercially available under the trade names Sokalan® PA15 and Sokalan® P25 (BASF).

Also suitable are copolymeric polycarboxylates, especially those of acrylic acid with methacrylic acid and of acrylic acid or methacrylic acid with maleic acid. Copolymers which have been found to be particularly suitable are those of acrylic acid with maleic acid which contain from 50 to 90% by weight of acrylic acid and from 50 to 10% by weight of maleic acid. Their relative molecular mass, based on free acids, is generally from 2,000 to 100,000 g/mol, preferably from 20 000 to 90 000 g/mol and, in particular, from 30,000 to 80,000 g/mol.

The (co)polymeric polycarboxylates can either be used in the form of powders or in the form of aqueous solutions. The (co)polymeric polycarboxylate content of the compositions is preferably from 0.5 to 20% by weight, in particular, from 3 to 10% by weight.

To improve the water solubility, the polymers may also contain allylsulfonic acids, for example, allyloxybenzenesulfonic acid and methallylsulfonic acid, as monomers.

Also especially preferred are biodegradable polymers composed of more than two different monomer units, for example, those which contain, as monomers, salts of acrylic acid and of maleic acid, and vinyl alcohol or vinyl alcohol derivatives, or those which contain, as monomers, salts of acrylic acid and of 2-alkylallylsulfonic acid, and sugar derivatives.

Further preferred copolymers are those which preferably have, as monomers, acrolein and acrylic acid/acrylic acid salts or acrolein and vinyl acetate.

Further preferred builder substances which should likewise be mentioned are polymeric aminodicarboxylic acids, salts thereof or precursor substances thereof. Particular preference is given to polyaspartic acids or salts and derivatives thereof.

Further suitable builder substances are polyacetals which can be obtained by reacting dialdehydes with polyolcarboxylic acids which have from 5 to 7 carbon atoms and at least 3 hydroxyl groups. Preferred polyacetals are obtained from dialdehydes such as glyoxal, glutaraldehyde, terephthalaldehyde, and mixtures thereof, and from polyolcarboxylic acids such as gluconic acid and/or glucoheptonic acid.

Further suitable organic builder substances are dextrins, for example, oligomers or polymers of carbohydrates, which can be obtained by partial hydrolysis of starches. The hydrolysis can be carried out by customary, for example, acid-catalyzed or enzyme-catalyzed, processes. The hydrolysis products preferably have average molar masses in the range from 400 to 500,000 g/mol. Preference is given to a polysaccharide having a dextrose equivalent (DE) in the range from 0.5 to 40, in particular, from 2 to 30, where DE is a common measure of the reducing action of a polysaccharide compared to dextrose, which has a DE of 100. It is also possible to use maltodextrins with a DE between 3 and 20 and dry glucose syrups with a DE between 20 and 37, and also so-called yellow dextrins and white dextrins having relatively high molar masses in the range from 2,000 to 30,000 g/mol.

The oxidized derivatives of such dextrins are their reaction products with oxidizing agents which are capable of oxidizing at least one alcohol function of the saccharide ring to the carboxylic acid function. A composition oxidized on $C_6$ of the saccharide ring may be especially advantageous.

Oxydisuccinates and other derivatives of disuccinates, preferably ethylenediaminedisuccinate, are also further suitable cobuilders. In this case, ethylenediamine-N,N'-disuccinate (EDDS) is preferably used in the form of its sodium or magnesium salts. Furthermore, in this connection, preference is also given to glyceryl disuccinates and glyceryl trisuccinates. Suitable use amounts in zeolite-containing and/or silicate-containing formulations are from 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and a maximum of two acid groups.

A further class of substances having cobuilder properties is that of the phosphonates. These are, in particular, hydroxyalkane- and aminoalkanephosphonates. Among the hydroxyalkanephosphonates, 1-hydroxyethane-1,1-diphosphonate (HEDP) is of particular significance as a cobuilder. It is preferably used in the form of the sodium salt, the disodium salt giving a neutral reaction and the tetrasodium salt an alkaline reaction (pH 9). Useful aminoalkanephosphonates are preferably ethylenediamine-tetramethylenephosphonate (EDTMP), diethylenetriaminepentamethylene-phosphonate (DTPMP) and higher homologs thereof. They are preferably used in the form of the neutrally reacting sodium salts, for example, as the hexasodium salt of EDTMP or as the hepta- and octasodium salt of DTPMP. From the class of the phosphonates, preference is given to using HEDP as a builder. In addition, the aminoalkanephosphonates have a marked heavy metal-binding capacity. Accordingly, especially when the compositions also comprise bleaches, it may be preferable to use aminoalkanephosphonates, especially DTPMP, or mixtures of the phosphonates mentioned.

In addition, it is possible to use all compounds which are capable of forming complexes with alkaline earth metal ions as cobuilders.

In the context of the present application, inventive compositions are characterized in that they comprise builders, preferably from the group of the silicates, carbonates, organic cobuilders and/or phosphates, in amounts of from 0.1 to 99.5% by weight, preferably of from 1 to 95% by weight, more preferably of from 5 to 90% by weight and, in particular, of from 10 to 80% by weight, based in each case on the composition.

Bleaches

Bleaches and bleach activators are important constituents of washing and cleaning compositions, and a washing and cleaning composition may, in the context of the present invention, comprise one or more substances from the groups mentioned. Among the compounds which supply $H_2O_2$ in water and serve as bleaches, sodium percarbonate has particular significance. Further usable bleaches are, for example, sodium perborate tetrahydrate and sodium perborate monohydrate, peroxypyrophosphates, citrate perhydrates and $H_2O_2$-supplying peracidic salts or peracids such as perbenzoates, peroxophthalates, diperazelaic acid, phthalimino peracid or diperdodecanedioic acid.

"Sodium percarbonate" is a term, used in a nonspecific manner, for sodium carbonate peroxohydrates which, strictly speaking, are not "percarbonates" (i.e. salts of percarbonic acid), but rather hydrogen peroxide adducts to sodium carbonate. The commercial material has the average composition $2Na_2CO_3.3H_2O_2$ and is thus not a peroxycarbonate. Sodium percarbonate forms a white, water-soluble powder of density 2.14 $gcm^{-3}$ which decomposes readily to sodium carbonate and oxygen having a bleaching or oxidizing action.

Sodium carbonate peroxohydrate was obtained for the first time in 1899 by precipitation with ethanol from a solution of sodium carbonate in hydrogen peroxide, but regarded erroneously as a peroxycarbonate. Not until 1909 was the compound recognized as a hydrogen peroxide addition compound, but the historical term "sodium percarbonate" has become established in practice.

The industrial preparation of sodium percarbonate is prepared predominantly by precipitation from aqueous solution (so-called wet process). In this process, aqueous solutions of sodium carbonate and hydrogen peroxide are combined and the sodium percarbonate is precipitated by means of salting agents (predominantly sodium chloride), crystallizing assistants (for example, polyphosphates, polyacrylates) and stabilizers (for example, $Mg^{2+}$ ions). The precipitated salt which still contains from 5 to 12% by weight of mother liquor is subsequently centrifuged off and dried at 90° C. in fluidized bed dryers. The bulk density of the finished product may vary between 800 and 1200 g/l depending on the preparation process. In general, the percarbonate is stabilized by an additional coating. Coating processes and substances which are used for the coating have been widely described in the patent literature. In principle, it is possible in accordance with the invention to use all commercial percarbonate types, as supplied, for example, by Solvay Interox, Degussa, Kemira or Akzo.

Detergents for machine dishwashing may also comprise bleaches from the group of the organic bleaches. Typical organic bleaches which may be used as ingredients in the context of the present invention are the diacyl peroxides, for example, dibenzoyl peroxide. Further typical organic bleaches are the peroxy acids, of which particular mention is made of the alkylperoxy acids and the arylperoxy acids as examples. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproicacid [phthaliminoperoxyhexanoic acid (PAP)], o-carboxybenzamidoperoxycaproic acid, N-nonenylaminoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyidi(6-aminopercaproic acid).

The bleaches used for machine dishwashing according to the present invention may also be chlorine- or bromine-releasing substances. Among the suitable chlorine- or bromine-releasing materials, useful materials are, for example, heterocyclic N-bromo- and N-chloroamides, for example, trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

In the context of the present invention, advantageous compositions comprise one or more bleaches, preferably from the group of the oxygen or halogen bleaches, especially of the chlorine bleaches, with particular preference for sodium percarbonate and/or sodium perborate monohydrate, in amounts of from 0.5 to 40% by weight, preferably of from 1 to 30% by weight, more preferably of from 2.5 to 25% by weight and, in particular, of from 5 to 20% by weight, based in each case on the overall composition.

Bleach Activators

In order to achieve enhanced bleaching action when cleaning at temperatures of 60° C. and below, it is possible in the context of the present invention for detergents to comprise bleach activators. The bleach activators used may be compounds which, under perhydrolysis conditions, give rise to aliphatic peroxocarboxylic acids having preferably from 1 to 10 carbon atoms, in particular, from 2 to 4 carbon atoms, and/or optionally substituted perbenzoic acid. Suitable substances are those which bear O- and N-acyl groups of the carbon atom number mentioned and/or optionally substituted benzoyl groups. Preference is given to polyacylated alkylenediamines, in particular, tetraacetylethylenediamine (TAED), acylated triazine derivatives, in particular, 1,5-diacetyl-2,4-dioxohexahydro-1,3,5-triazine (DADHT), acylated glycolurils, in particular, tetraacetylglycoluril (TAGU), N-acylimides, in particular, N-nonanoylsuccinimide (NOSI), acylated phenolsulfonates, in particular, n-nonanoyl- or isononanoyloxybenzenesulfonate (n- or iso-NOBS), carboxylic anhydrides, in particular, phthalic anhydride, acylated polyhydric alcohols, in particular, triacetin, ethylene glycol diacetate and 2,5-diacetoxy-2,5-dihydrofuran.

In addition to the conventional bleach activators, or instead of them, so-called bleach catalysts can also be incorporated according to the present invention into the detergents. These substances are bleach-boosting transition metal salts or transition metal complexes, such as, for example, Mn-, Fe-, Co-, Ru- or Mo-salen complexes or -carbonyl complexes. Mn, Fe, Co, Ru, Mo, Ti, V and Cu complexes with N-containing tripod ligands, and also Co-, Fe-, Cu- and Ru-ammine complexes can also be used as bleach catalysts.

According to the invention, preference is given to compositions which comprise one or more substances from the group of bleach activators, in particular, from the groups of polyacylated alkylenediamines, in particular, tetraacetylethylenediamine (TAED), N-acylimides, in particular, N-nonanoylsuccinimide (NOSI), acylated phenolsulfonates, in particular, n-nonanoyl- or isononanoyloxybenzenesulfonate (n- or iso-NOBS) and n-methylmorpholiniumacetonitrile methylsulfate (MMA), in amounts of from 0.1 to 20% by weight, preferably from 0.5 to 15% by weight and, in particular, from 1 to 10% by weight, based in each case on the total composition.

Bleach activators which are preferred in the context of the present invention further include the "nitrile quats," cationic nitrites of formula (XV)

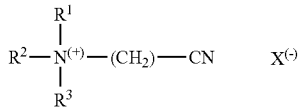

(XV)

in which $R^1$ is —H, —$CH_3$, a $C_{2-24}$-alkyl or -alkenyl radical, a substituted $C_{2-24}$-alkyl or -alkenyl radical with at least one substituent from the group of —Cl, —Br, —OH, —$NH_2$, —CN, an alkyl- or alkenylaryl radical with a $C_{1-24}$-alkyl group, or is a substituted alkyl- or alkenylaryl radical with a $C_{1-24}$-alkyl group and at least one further substituent on the aromatic ring, $R^2$ and $R^3$ are each independently selected from —$CH_2$—CN, —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —$(CH_2CH_2$—$O)_n$H where n=1, 2, 3, 4, 5 or 6 and X is an anion.

The general formula (XV) covers a multitude of cationic nitrites which can be used in the context of the present invention. With particular advantage, the inventive washing and cleaning composition tablets comprise cationic nitrites in which $R^1$ is methyl, ethyl, propyl, isopropyl or an n-butyl, n-hexyl, n-octyl, n-decyl, n-dodecyl, n-tetradecyl, n-hexadecyl or n-octadecyl radical. $R^2$ and $R^3$ are preferably selected from methyl, ethyl, propyl, isopropyl and hydroxyethyl, and it is possible for one or both of the radicals advantageously also to be a cyanomethylene radical.

For reasons of easier synthesis, preference is given to compounds in which the $R^1$ to $R^3$ radicals are identical, for example, $(CH_3)_3N^{(+)}CH_2$—$CNX^-$, $(CH_3CH_2)_3N^{(+)}CH_2$—$CNX^-$, $(CH_3CH_2CH_2)_3N^{(+)}CH_2$—$CNX^-$, $(CH_3CH(CH_3))_3N^{(+)}CH_2$—$CNX^-$ or $(HO$—$CH_2$—$CH_2)_3N^{(+)}CH_2$—$CNX^-$, where $X^-$ is preferably an anion which is selected from the group consisting of chloride, bromide, iodide, hydrogensulfate, methosulfate, p-toluenesulfonate (tosylate) or xylenesulfonate.

Washing and cleaning compositions preferred in the context of the present invention are characterized in that they comprise the cationic nitrile of formula (XV) in amounts of from 0.1 to 20% by weight, preferably from 0.25 to 15% by weight and, in particular, from 0.5 to 10% by weight, based in each case on the tablet weight.

Enzymes

Useful enzymes are especially those from the classes of hydrolases, such as the proteases, esterases, lipases and lipolytic enzymes, amylases, cellulases or other glycosyl hydrolases, and mixtures of the enzymes mentioned. In the wash, all of these hydrolases contribute to the removal of stains, such as protein-, grease- or starch-containing stains, and greying. Cellulases and other glycosylhydrolases may additionally contribute to the retention of color and to an increase in the softness of the textile by removing pilling and microfibrils. For the bleaching and for the inhibition of dye transfer, it is also possible to use oxidoreductases. Especially suitable enzymatic active ingredients are those obtained from bacterial strains or fungi such as *Bacillus subtilis, Bacillus licheniformis, Streptomyceus griseus, Coprinus cinereus* and *Humicola insolens*, and also from genetically modified variants thereof. Preference is given to using proteases of the subtilisin type and, in particular, proteases which are obtained from *Bacillus lentus*. Of particular interest in this context are enzyme mixtures, examples being those of protease and amylase or protease and lipase or lipolytic enzymes, or protease and cellulase or of cellulase and lipase or lipolytic enzymes or protease, amylase and lipase or lipolytic enzymes, or protease, lipase or lipolytic enzymes and cellulase, but, in particular, protease and/or lipase-containing mixtures or mixtures containing lipolytic enzymes. Examples of such lipolytic enzymes are the known cutinases.

Peroxidases or oxidases have also been found to be suitable in some cases. Suitable amylases include especially alpha-amylases, isoamylases, pullulanases, and pectinases. The cellulases used are preferably cellobiohydrolases, endoglucanases and endoglucosidases, which are also known as cellobiases, and mixtures thereof. Since different types of cellulase differ in their CMCase and Avicelase activities, specific mixtures of the cellulases may be used to establish the desired activities.

The enzymes may be adsorbed on carrier substances or embedded in coating substances in order to protect them from premature decomposition. Preferred inventive compositions comprise enzymes, preferably in the form of liquid and/or solid enzyme preparations, in amounts of from 0.1 to 10% by weight, preferably from 0.5 to 8% by weight and, in particular, from 1 to 5% by weight, based in each case on the overall composition.

Dyes

In order to improve the esthetic impression of the washing and cleaning compositions, they may be colored with suitable dyes. Dyes which are preferred in the context of the present invention, whose selection presents no difficulty whatsoever to the person skilled in the art, have a high storage stability and insensitivity toward the other ingredients of the compositions and toward light and no marked substantivity toward textile fibers, in order not to stain them.

For use in the inventive washing and cleaning compositions, preference is given to all colorants which can be destroyed oxidatively in the cleaning process, and to mixtures thereof with suitable blue dyes, known as bluing agents. It has been found to be advantageous to use colorants which are soluble in water or, at room temperature, in liquid organic substances. Examples of suitable colorants are anionic colorants, for example, anionic nitroso dyes. One example of a possible colorant is naphthol green (Color Index (CI) Part 1:

Acid Green 1; Part 2: 10020), which is available as a commercial product, for example, as Basacid® Green 970 from BASF, Ludwigshafen, Germany, and mixtures thereof with suitable blue dyes. Further suitable colorants are Pigmosol® Blue 6900 (CI 74160), Pigmosol® Green 8730 (CI 74260), Basonyl® Red 545 FL (CI 45170), Sandolan® Rhodamin EB400 (CI 45100), Basacid® Yellow 094 (CI 47005), Sicovit® Patent Blue 85 E 131 (CI 42051), Acid Blue 183 (CAS 12217-22-0, CI Acid Blue 183), Pigment Blue 15 (CI 74160), Supranol® Blue GLW (CAS 12219-32-8, CI Acid Blue 221)), Nylosan® Yellow N-7GL SGR (CAS 61814-57-1, CI Acid Yellow 218) and/or Sandolan® Blue (CI Acid Blue 182, CAS 12219-26-0).

In the selection of the colorant, it has to be ensured that the colorants do not have too strong an affinity towards the textile surfaces and here, in particular, towards synthetic fibres. At the same time, it should be taken into account when selecting suitable colorants that colorants have different stabilities towards oxidation. It is generally the case that water-insoluble colorants are more stable toward oxidation than water-soluble colorants. The concentration of the colorant in the washing or cleaning compositions varies depending on the solubility and hence also upon the oxidation sensitivity. In the case of highly water-soluble colorants, for example, the above-mentioned Basacid® Green or the likewise above-mentioned Sandolan® Blue, typical colorant concentrations in the region of a few $10^{-2}$ to $10^{-3}$% by weight are selected. In the case of the pigmentary dyes which are especially preferred owing to their brilliance but are less readily water-soluble, for example, the above-mentioned Pigmosol® dyes, the suitable concentration of the colorant in washing or cleaning compositions, in contrast, is typically a few $10^{-3}$ to $10^{-4}$% by weight.

Fragrances

Perfume oils and fragrances which can be used in the context of the present invention are individual odorant compounds, for example, the synthetic compositions of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethyl methylphenylglycinate, allylcyclohexyl propionate, styrallyl propionate, benzyl salicylate, cyclohexyl salicylate, floramate, melusate and jasmecylate. The ethers include, for example, benzyl ethyl ether and ambroxane; the aldehydes include, for example, the linear alkanals having 8-18 carbon atoms, citral, citronellal, citronellyloxyacetaldehyde, cyclamen aldehyde, lilial and bourgeonal; the ketones include, for example, the ionones, α-isomethylionone and methyl cedryl ketone; the alcohols include anethol, citronellol, eugenol, geraniol, linalool, phenylethyl alcohol and terpineol; the hydrocarbons include primarily the terpenes such as limonene and pinene. However, preference is given to mixtures of different odorants which together produce a pleasing fragrance note.

Such perfume oils may also comprise natural odorant mixtures, as are available from plant sources, examples being pine oil, citrus oil, jasmine oil, patchouli oil, rose oil or ylang ylang oil. Likewise suitable are clary sage oil, camomile oil, oil of cloves, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil.

The general description of the perfumes which can be used (see above) is a general representation of the different classes of odorant substances. In order to be perceptible, an odorant must be volatile, for which an important role is played not only by the nature of the functional groups and by the structure of the chemical compound but also by the molar mass. Thus, the majority of odorants have molar masses of up to about 200 daltons, while molar masses of 300 daltons or more tend to be an exception. On the basis of the different volatility of odorants there is a change in the odor of a perfume or fragrance composed of two or more odorants during its evaporation, and the perceived odors are divided into top note, middle note or body, and end note or dryout. Since the perception of odor is to a large extent also based on the odor intensity, the top note of a perfume or fragrance mixture does not consist only of volatile compounds, whereas the base note consists for the most part of less volatile odorants, i.e., odorants which adhere firmly. In the composition of perfumes it is possible for more volatile odorants, for example, to be bound to certain fixatives, which prevent them from evaporating too rapidly. The above-described embodiment of the present invention, in which the more volatile odorants or fragrances are applied to the water-insoluble carrier materials of low density, is such a method of fixing odorants. The subsequent classification of the odorants into "more volatile" and "firmly adhering" odorants, therefore, states nothing about the perceived odor and about whether the odorant in question is perceived as a top note or as a middle note.

Examples of firmly adhering odorants which can be used in the context of the present invention are the essential oils such as angelica root oil, anise oil, arnica blossom oil, basil oil, bay oil, bergamot oil, champaca blossom oil, noble fir oil, noble fir cone oil, elemi oil, eucalyptus oil, fennel oil, spruce needle oil, galbanum oil, geranium oil, ginger grass oil, guaiacwood oil, guriun balsam oil, helichrysum oil, ho oil, ginger oil, iris oil, cajeput oil, calamus oil, camomile oil, camphor oil, canaga oil, cardamom oil, cassia oil, pine needle oil, copaiva balsam oil, coriander oil, spearmint oil, caraway oil, cumin oil, lavender oil, lemon grass oil, lime oil, mandarin oil, balm oil, musk seed oil, myrrh oil, clove oil, neroli oil, niaouli oil, olibanum oil, orange oil, origanum oil, palmarosa oil, patchouli oil, peru balsam oil, petitgrain oil, pepper oil, peppermint oil, pimento oil, pine oil, rose oil, rosemary oil, sandalwood oil, celery oil, spike oil, star anise oil, turpentine oil, thuja oil, thyme oil, verbena oil, vetiver oil, juniperberry oil, wormwood oil, wintergreen oil, ylang-ylang oil, hyssop oil, cinnamon oil, cinnamon leaf oil, citronella, lemon oil and cypress oil.

However, the higher-boiling or solid odorants of natural or synthetic origin may also be used in the context of the present invention as firmly adhering odorants or odorant mixtures, i.e. fragrances. These compounds include the following compounds and mixtures thereof: ambrettolide, α-amylcinnamaldehyde, anethole, anisaldehyde, anisyl alcohol, anisole, methyl anthranilate, acetophenone, benzylacetone, benzaldehyde, ethyl benzoate, benzophenone, benzyl alcohol, benzyl acetate, benzyl benzoate, benzyl formate, benzyl valerate, borneol, bornyl acetate, α-bromostyrene, n-decyl aldehyde, n-dodecylaldehyde, eugenol, eugenol methyl ether, eucalyptol, famesol, fenchone, fenchyl acetate, geranyl acetate, geranyl formate, heliotropin, methyl heptynecarboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl n-amyl ketone, methyl methylanthranilate, p-methylacetophenone, methylchavicol, p-methylquinoline, methyl β-naphthyl ketone, methyl-n-nonylacetaldehyde, methyl n-nonyl ketone, muscone, β-naphthol ethyl ether, β-naphthol methyl ether, nerol, nitrobenzene, n-nonylaldehyde, nonyl alcohol, n-octylaldehyde, p-oxyacetophenone, pentadecanolide, β-phenylethyl alcohol, phenylacetaldehyde dimethyl acetal, phenylacetic acid, pulegone, safrol, isoamyl salicylate, methyl salicylate, hexyl salicylate, cyclohexyl salicylate, santalol, skatole, terpineol, thymene, thymol, γ-undecalactone, vanillin, veratrum aldehyde, cinnamaldehyde, cinnamyl alcohol, cinnamic acid, ethyl cinnamate, benzyl cinnamate.

The more volatile odorants include, in particular, the lower-boiling odorants of natural or synthetic origin, which may be used alone or in mixtures. Examples of more volatile odorants are alkyl isothiocyanates (alkyl mustard oils), butanedione, limonene, linalool, linalyl acetate and linalyl propionate, menthol, menthone, methyl-n-heptenone, phellandrene, phenylacetaldehyde, terpinyl acetate, citral, citronellal.

Corrosion Protectants

Detergents for machine dishwashing may comprise corrosion inhibitors to protect the ware or the machine, particularly silver protectants having particular significance in the field of machine dishwashing. The known substances of the prior art can be used. In general, it is possible to use, in particular, silver protectants selected from the group of the triazoles, the benzotriazoles, the bisbenzotriazoles, the aminotriazoles, the alkylaminotriazoles and the transition metal salts or complexes. Particular preference is given to the use of benzotriazole and/or alkylaminotriazole. Frequently found in detergent formulations are additionally agents containing active chlorine, which can significantly reduce corrosion of the silver surface. In chlorine-free detergents, particularly oxygen- and nitrogen-containing organic redox-active compounds are used, such as di- and trihydric phenols, e.g., hydroquinone, pyrocatechol, hydroxyhydroquinone, gallic acid, phloroglucinol, pyrogallol, and derivatives of these classes of compounds. Inorganic compounds in the form of salts and complexes, such as salts of the metals Mn, Ti, Zr, Hf, V, Co and Ce, are also often used. Preference is given here to the transition metal salts which are chosen from the group of manganese and/or cobalt salts and/or complexes, particularly preferably cobalt(ammine) complexes, cobalt(acetato) complexes, cobalt(carbonyl) complexes, the chlorides of cobalt or of manganese and manganese sulphate, and also to the manganese complexes $$[(\text{Me-TACN})\text{Mn}^{IV}(\text{m-O})_3\text{Mn}^{IV}(\text{Me-TACN})]^{2+}(\text{PF}_6^-)_2,$$

$$[(\text{Me-Me-TACN})\text{Mn}^{IV}(\text{m-O})_3\text{Mn}^{IV}(\text{Me-Me-TACN})]^{2+}(\text{PF}_6^-)_2,$$

$$[(\text{Me-TACN})\text{Mn}^{III}(\mu\text{-O})(\text{m-OAc})_2\text{Mn}^{III}(\text{Me-TACN})]^{2+}(\text{PF}_6^-)_2 \text{ and}$$

$$[(\text{Me-Me-TACN})\text{Mn}^{III}(\text{m-O})(\text{m-OAc})_2\text{Mn}^{III}(\text{Me-Me-TACN})]^{2+}(\text{PF}_6^-)_2,$$

where Me-TACN is 1,4,7-trimethyl-1,4,7-triazacyclononane and Me-Me-TACN is 1,2,4,7-tetramethyl-1,4,7-triazacyclononane. Zinc compounds may likewise be used to prevent corrosion on the ware.

A preferred agent for providing corrosion protection for glassware in cleaning and/or rinsing processes of a machine dishwasher is zinc in oxidized form, i.e. zinc compounds in which zinc is present in cationic form. Preference is also given analogously to magnesium salts. It is possible here to use either soluble, or sparingly soluble or insoluble zinc or magnesium compounds. Preferred inventive compositions comprise one or more magnesium and/or zinc salt(s) of at least one monomeric and/or polymeric organic acid.

The acids in question stem preferably from the group of the unbranched saturated or unsaturated monocarboxylic acids, the branched saturated or unsaturated monocarboxylic acids, the saturated and unsaturated dicarboxylic acids, the aromatic mono-, di- and tricarboxylic acids, the sugar acids, the hydroxy acids, the oxo acids, the amido acids and/or the polymeric carboxylic acids, the unbranched or branched, unsaturated or saturated, mono- or polyhydroxylated fatty acids having at least 8 carbon atoms and/or resin acids.

Even though all magnesium and/or zinc salt(s) of monomeric and/or polymeric organic acids may be present in accordance with the invention, preference is given, as described above, to the magnesium and/or zinc salts of monomeric and/or polymeric organic acids from the groups of the unbranched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxo acids, the amino acids and/or the polymeric carboxylic acids. In the context of the present invention, preference is in turn given within these groups to the acids specified below:

From the group of unbranched, saturated or unsaturated monocarboxylic acids: methanoic acid (formic acid), ethanoic acid (acetic acid), propanoic acid (propionic acid), pentanoic acid (valeric acid), hexanoic acid (caproic acid), heptanoic acid (enanthic acid), octanoic acid (caprylic acid), nonanoic acid (pelargonic acid), decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), octadecanoic acid (stearic acid), eicosanoic acid (arachic acid), docosanoic acid (behenic acid), tetracosanoic acid (lignoceric acid), hexacosanoic acid (cerotic acid), triacotanoic acid (melissic acid), 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid).

From the group of branched, saturated or unsaturated monocarboxylic acids: 2-methylpentanoic acid, 2-ethylhexanoic acid, 2-propylheptanoic acid, 2-butyloctanoic acid, 2-pentylnonanoic acid, 2-hexyldecanoic acid, 2-heptylundecanoic acid, 2-octyldodecanoic acid, 2-nonyltridecanoic acid, 2-decyltetradecanoic acid, 2-undecylpentadecanoic acid, 2-dodecylhexadecanoic acid, 2-tridecylheptadecanoic acid, 2-tetradecyloctadecanoic acid, 2-pentadecylnonadecanoic acid, 2-hexadecyleicosanoic acid, 2-heptadecylheneicosanoic acid.

From the group of unbranched, saturated or unsaturated di- or tricarboxylic acids: propanedioic acid (malonic acid), butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), 2c-butenedioic acid (maleic acid), 2t-butenedioic acid (fumaric acid), 2-butynedicarboxylic acid (acetylenedicarboxylic acid).

From the group of aromatic mono-, di- and tricarboxylic acids: benzoic acid, 2-carboxybenzoic acid (phthalic acid), 3-carboxybenzoic acid (isophthalic acid), 4-carboxy-benzoic acid (terephthalic acid), 3,4-dicarboxybenzoic acid (trimellitic acid), 3,5-dicarboxy-benzoic acid (trimesionic acid).

From the group of sugar acids: galactonic acid, mannonic acid, fructonic acid, arabinonic acid, xylonic acid, ribonic acid, 2-deoxyribonic acid, alginic acid.

From the group of hydroxy acids: hydroxyphenylacetic acid (mandelic acid), 2-hydroxypropionic acid (lactic acid), hydroxysuccinic acid (malic acid), 2,3-dihydroxybutanedioic acid (tartaric acid), 2-hydroxy-1,2,3-propanetricarboxylic acid (citric acid), ascorbic acid, 2-hydroxybenzoic acid (salicylic acid), 3,4,5-trihydroxybenzoic acid (gallic acid).

From the group of oxo acids: 2-oxopropionic acid (pyruvic acid), 4-oxopentanoic acid (levulinic acid).

From the group of amino acids: alanine, valine, leucine, isoleucine, proline, tryptophan, phenylalanine, methionine, glycine, serine, tyrosine, threonine, cysteine, aspargine, glutamine, aspartic acid, glutamic acid, lysine, arginine, histidine.

From the group of polymeric carboxylic acids: polyacrylic acid, polymethacrylic acid, alkylacrylamide/acrylic acid copolymers, alkylacrylamide/methacrylic acid copolymers, alkylacrylamide/methylmethacrylic acid copolymers, copolymers of unsaturated carboxylic acids, vinyl acetate/crotonic acid copolymers, vinylpyrrolidone/vinyl acrylate copolymers.

The spectrum of the zinc salts, preferred in accordance with the invention, of organic acids, preferably of organic carboxylic acids, ranges from salts which are sparingly soluble or insoluble in water, i.e. have a solubility below 100 mg/l, preferably below 10 mg/l, in particular, have zero solubility, to those salts which have a solubility in water above 100 mg/l, preferably above 500 mg/l, more preferably above 1 g/l and, in particular, above 5 g/l (all solubilities at water temperature 20° C.). The first group of zinc salts includes, for example, zinc citrate, zinc oleate and zinc stearate; the group of soluble zinc salts includes, for example, zinc formate, zinc acetate, zinc lactate and zinc gluconate.

In a further preferred embodiment of the present invention, the compositions according to the invention comprise at least one zinc salt, but no magnesium salt of an organic acid, preferably at least one zinc salt of an organic carboxylic acid, more preferably a zinc salt from the group of zinc stearate, zinc oleate, zinc gluconate, zinc acetate, zinc lactate and/or zinc citrate. Preference is also given to using zinc ricinoleate, zinc abietate and zinc oxalate.

---

LENGTHY TABLES

The patent contains a lengthy table section. A copy of the table is available in electronic form from the USPTO web site (http://seqdata.uspto.gov/?pageRequest=docDetail&DocID=US07514395B2). An electronic copy of the table will also be available from the USPTO upon request and payment of the fee set forth in 37 CFR 1.19(b)(3).

---

The invention claimed is:

1. A machine dishwasher detergent comprising (a) at least one polymer comprised of a terminal phosphorus-containing groups, wherein the pH of a 1% by weight solution of the polymer in distilled water is below 6 at 20°C.; and (b) a polymer comprising an unsaturated carboxylic acid and an unsaturated sulfonic acid.

2. The machine dishwasher detergent of claim 1, wherein the polymer (a) is a copolymer comprised of (i) unsaturated carboxylic acids; and (ii) phosphate-containing monomers; and (iii) optionally additional ionic or nonionogenic monomers.

3. The machine dishwasher detergent of claim 1, wherein the polymer (a) is a copolymer comprised of (i) unsaturated carboxylic acids; (ii) phosphonate containing monomers and; (iii) optionally further ionic or nonionogenic monomers.

4. The machine dishwasher detergent of claim 1, wherein the polymer (a) is a copolymer comprised of (i) unsaturated carboxylic acids; (ii) phosphite containing monomers and; (iii) optionally further ionic or nonionogenic monomers.

5. The machine dishwasher detergent of claim 1, wherein the polymer (a) is a copolymer comprised of (i) unsaturated carboxylic acids; (ii) phosphine oxide-containing monomers and; (iii) optionally further ionic or nonionogenic monomers.

6. The machine dishwasher detergent of claim 1, wherein the amount of the polymer (a) is from 0.1 to 20% by weight.

7. The machine dishwasher detergent of claim 1, wherein the mean molar mass of the polymer (a) is from 1,000 to 10,000,000 gmol.sup−1.

8. The machine dishwasher detergent of claim 1, wherein the degree of polymerization of the polymer (a) is from 10 to 10,000.

9. The machine dishwasher detergent of claim 2, wherein the molar ratio of monomers (i) to (ii) is from 1:1 to 200.

10. The machine dishwasher detergent of claim 2, wherein the phosphorus content of the copolymer is from 0.5 to 5.0% by weight.

11. The machine dishwasher detergent of claim 2, wherein the content the monomer (iii) in the copolymer is equal to or less than 20 mol %.

12. The machine dishwasher detergent of claim 1, further comprising one or more additional polymer selected from the group consisting of cationic polymer, one or more amphoteric polymer, and combinations thereof.

13. The machine dishwasher detergent of claim 12, wherein the amount of the additional polymer is from 0.1 to 20% by weight.

14. The machine dishwasher detergent of claim 1, wherein polymer (b) further contains ionic or nonionogenic monomers.

15. The machine dishwasher detergent of claim 1, further comprising one or more surfactants.

16. The machine dishwasher detergent of claim 15, wherein the surfactant is a nonionic surfactant in amount of from 0.1 to 20% by weight.

* * * * *